US007670743B2

(12) United States Patent
Ohta et al.

(10) Patent No.: US 7,670,743 B2
(45) Date of Patent: Mar. 2, 2010

(54) IMAGE FORMING METHOD

(75) Inventors: Katsuichi Ohta, Mishima (JP); Tatsuya Niimi, Numazu (JP); Nozomu Tamoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/013,891

(22) Filed: Jan. 14, 2008

(65) Prior Publication Data

US 2008/0145778 A1 Jun. 19, 2008

Related U.S. Application Data

(63) Continuation of application No. 11/367,786, filed on Mar. 6, 2006, now abandoned.

(30) Foreign Application Priority Data

Mar. 4, 2005 (JP) ..... 2005-060335
Nov. 14, 2005 (JP) ..... 2005-328554

(51) Int. Cl.
*G03G 15/06* (2006.01)
*G03G 5/14* (2006.01)

(52) U.S. Cl. ..... 430/123.42; 430/123.43; 430/123.4; 430/64; 430/65; 430/60; 399/159

(58) Field of Classification Search ..... 430/123.42, 430/123.43, 123.4
See application file for complete search history.

(56) References Cited

U.S. PATENT DOCUMENTS 3,640,708 A 2/1972 Humphriss et al.
4,400,455 A 8/1983 Hashimoto et al.

(Continued)

FOREIGN PATENT DOCUMENTS

JP 52-010138 1/1977

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner*—Christopher RoDee
(74) *Attorney, Agent, or Firm*—Oblon, Spivak, McClelland, Maier & Neustadt, L.L.P.

(57) ABSTRACT

An image is formed by projecting an image by way of an image irradiating device onto an image bearing member configured to operate at a linear velocity of at least 300 mm/sec, and which is constructed of(i) an electroconductive substrate having an image bearing surface that has an established surface charge having an electric field intensity of at least 32.1 V/μm which is defined as the ratio of the absolute value (V) of the surface voltage of a non-irradiated portion of the image bearing member at a developing position to the layer thickness of the photosensitive layer (μm), (ii) a charge blocking layer overlying the electroconductive substrate, (iii) a moiré prevention layer overlying the charge blocking layer and (iv) a photosensitive layer overlying the moiré prevention layer consisting essentially of a titanyl phthalocyanine; charging the image bearing member by means of a charging device; irradiating said surface of the image bearing member with plural irradiation beams; developing the latent electrostatic image with a developing device; transferring the developed image by a transfer device configured; and cleaning the image bearing member.

38 Claims, 15 Drawing Sheets

U.S. PATENT DOCUMENTS

| | | | |
|---|---|---|---|
| 4,818,650 | A | 4/1989 | Limburg et al. |
| 4,863,822 | A | 9/1989 | Fukagai et al. |
| 4,943,508 | A | 7/1990 | Yu |
| 5,013,624 | A | 5/1991 | Yu |
| 5,489,496 | A | 2/1996 | Katayama et al. |
| 5,492,784 | A | 2/1996 | Yoshikawa et al. |
| 5,576,131 | A | 11/1996 | Takai et al. |
| 5,578,405 | A | 11/1996 | Ikegami et al. |
| 5,677,096 | A | 10/1997 | Suzuki |
| 5,871,876 | A | 2/1999 | Ikuno et al. |
| 6,026,262 | A | 2/2000 | Kinoshita et al. |
| 6,030,733 | A | 2/2000 | Kami et al. |
| 6,066,428 | A | 5/2000 | Katayama et al. |
| 6,136,483 | A | 10/2000 | Suzuki et al. |
| 6,151,468 | A | 11/2000 | Kami et al. |
| 6,194,535 | B1 | 2/2001 | Katayama et al. |
| 6,210,848 | B1 | 4/2001 | Nagai et al. |
| 6,369,842 | B1 | 4/2002 | Abramsohn |
| 6,558,863 | B2 | 5/2003 | Rokutanzono et al. |
| 6,861,188 | B2 | 3/2005 | Ikegami et al. |
| 6,899,983 | B2 | 5/2005 | Tamoto et al. |
| 6,936,388 | B2 | 8/2005 | Suzuki et al. |
| 2004/0033428 | A1 | 2/2004 | Niimi |
| 2004/0053149 | A1 | 3/2004 | Toda et al. |
| 2004/0053152 | A1 | 3/2004 | Nagai et al. |
| 2004/0126687 | A1 | 7/2004 | Ikegami et al. |
| 2004/0234875 | A1 | 11/2004 | Toda et al. |
| 2004/0248024 | A1 | 12/2004 | Suzuki et al. |
| 2004/0253527 | A1 | 12/2004 | Suzuki et al. |
| 2005/0008957 | A1 | 1/2005 | Ikegami et al. |
| 2005/0069797 | A1 | 3/2005 | Niimi et al. |
| 2005/0112484 | A1 | 5/2005 | Nozoe et al. |
| 2005/0141919 | A1 | 6/2005 | Kitajima et al. |
| 2005/0158641 | A1 | 7/2005 | Yanagawa et al. |
| 2005/0158644 | A1 | 7/2005 | Kondo et al. |
| 2005/0175911 | A1 | 8/2005 | Tamoto et al. |
| 2005/0181291 | A1 | 8/2005 | Kami et al. |
| 2005/0196193 | A1 | 9/2005 | Tamoto et al. |
| 2005/0221210 | A1 | 10/2005 | Suzuki et al. |
| 2005/0266325 | A1 | 12/2005 | Yanagawa et al. |
| 2005/0266328 | A1 | 12/2005 | Yanagawa et al. |
| 2005/0287465 | A1 | 12/2005 | Ohshima et al. |
| 2006/0014096 | A1 | 1/2006 | Ohshima et al. |
| 2006/0057479 | A1 | 3/2006 | Niimi et al. |
| 2006/0292464 | A1 | 12/2006 | Yamada et al. |

FOREIGN PATENT DOCUMENTS

| | | |
|---|---|---|
| JP | 52-082238 | 7/1977 |
| JP | 54-36859 | 11/1979 |
| JP | 55-113045 | 9/1980 |
| JP | 56-048637 | 5/1981 |
| JP | 58-058556 | 4/1983 |
| JP | 58-093062 | 6/1983 |
| JP | 58-095351 | 6/1983 |
| JP | 58-105155 | 6/1983 |
| JP | 59-017557 | 1/1984 |
| JP | 59-093453 | 5/1984 |
| JP | 60-032054 | 2/1985 |
| JP | 60-066258 | 4/1985 |
| JP | 60-111255 | 6/1985 |
| JP | 61-239248 | 10/1986 |
| JP | 62-156172 | 7/1987 |
| JP | 62-290768 | 12/1987 |
| JP | 64-017066 | 1/1989 |
| JP | 64-068762 | 3/1989 |
| JP | 64-068763 | 3/1989 |
| JP | 64-073352 | 3/1989 |
| JP | 64-073353 | 3/1989 |
| JP | 01-118818 | 5/1989 |
| JP | 01-118849 | 5/1989 |
| JP | 01-299874 | 12/1989 |
| JP | 02-008256 | 1/1990 |
| JP | 03-109460 | 5/1991 |
| JP | 03-141363 | 6/1991 |
| JP | 03-255456 | 11/1991 |
| JP | 03-269064 | 11/1991 |
| JP | 04-170552 | 6/1992 |
| JP | 04-281464 | 10/1992 |
| JP | 05-080572 | 4/1993 |
| JP | 05-100461 | 4/1993 |
| JP | 05-113688 | 5/1993 |
| JP | 05-202135 | 8/1993 |
| JP | 05-210260 | 8/1993 |
| JP | 05-216249 | 8/1993 |
| JP | 05-294005 | 11/1993 |
| JP | 06-019174 | 1/1994 |
| JP | 06-208238 | 7/1994 |
| JP | 06-222600 | 8/1994 |
| JP | 06-293769 | 10/1994 |
| JP | 07-271072 | 10/1995 |
| JP | 08-110649 | 4/1996 |
| JP | 08-184979 | 7/1996 |
| JP | 08-262779 | 10/1996 |
| JP | 09-190005 | 7/1997 |
| JP | 09-288367 | 11/1997 |
| JP | 11-005919 | 1/1999 |
| JP | 2000-066425 | 3/2000 |
| JP | 2000-206723 | 7/2000 |
| JP | 2001-019871 | 1/2001 |
| JP | 2001-034001 | 2/2001 |
| JP | 2001-154379 | 6/2001 |
| JP | 2001-281578 | 10/2001 |
| JP | 2002-107988 | 4/2002 |
| JP | 2002-113903 | 4/2002 |
| JP | 2002-303997 | 10/2002 |
| JP | 2003-205642 | 7/2003 |
| JP | 2004-286831 | 10/2004 |
| JP | 2005-010662 | 1/2005 |
| JP | 2005-017381 | 1/2005 |
| JP | 2005-025180 | 1/2005 |

OTHER PUBLICATIONS

Nobuaki Ueki et al., *Vertical-Cavity Surface-emitting Laser Diode (VCSEL)*, Journal of the Imaging Society of Japan, p. 149 of No. 3 of vol. 44, Apr. 20, 2005.

Japan Hardcopy '89, The Annual Conference of Japan Hardcopy for the Society of Electrophotography of Japan, The Society of Electrophotography of Japan (1989).

Frank H. Moser et al., Phthalocyanine Compounds, American Chemical Society, Reinhold Publishing Corporation (1963).

* cited by examiner

INTENSITY OF ELECTRIC FIELD : 45V/μm

INTENSITY OF ELECTRIC FIELD : 35V/μm

INTENSITY OF ELECTRIC FIELD : 25V/μm

IMAGE FORMING METHOD

CROSS-REFERENCE TO RELATED APPLICATIONS

This application is a continuation of application Ser. No. 11/367,786 filed Mar. 6, 2006 now abandoned which claims priority to Japanese applications Serial Nos. 2005-060335 and 2005-328554 filed Mar. 4, 2005 and Nov. 14, 2005, respectively.

BACKGROUND OF THE INVENTION

1. Field of the Invention

The present application relates to an image forming apparatus taking electrophotography system.

2. Discussion of the Background

Recently, information processing systems using electrophotography have been significantly developed. Among these, optical printers, which convert information into digital signals to optically record the information, have been extremely improved in terms of the quality of printing and reliability. This digital recording technology is applied to not only printers but also typical photocopiers, which leads to development of digital photocopiers. In addition, it is anticipated that a typical analogue photocopier using this digital recording technology is more and more demanded because such a photocopier has various kinds of information processing functions. Further, with the diffusion and improvement of performance of home computers, the development of a digital color printer to output color images and documents increasingly speeds up.

Higher performance and better image quality are demanded for such printers and photocopiers. Published unexamined Japanese patent application No. (hereinafter referred to as JOP). 2001-281578 describes an image forming apparatus having a multi-beam recording head to irradiate the surface of an image bearing member with multiple laser beams to deal with the demand for increase in definition and speed of image formation.

The image formation apparatus such as digital electrophotographic photocopiers and laser printers operates its image bearing member at a high linear velocity to achieve a high definition and high printing speed. Accordingly, the rotation speed of the polygon mirror in the laser beam scanning irradiation system in the image formation apparatus also rotates at a high speed and the image scanning frequency in the secondary scanning direction increases. However, the number of rotation of a polygon mirror is currently around 30,000 rpm. Further, to increase the rotation speed, there are difficult technical issues such as improvement of the bearing of the polygon mirror. Therefore, to increase the speed of image formation without increasing the rotation speed of such a polygon mirror, a method of multi-beam scanning irradiation using plural beam recording heads is adopted in which plural polygon mirrors are arranged in the secondary scanning direction to scan multiple beams per scan in the primary scanning direction.

In the multi-beam recording head system having n (n is an integer of 2 or higher) beam power sources, the number of rotation of a polygon mirror is reduced to 1/n in comparison with a system having a single beam recording head. Therefore, it is possible to increase the image formation speed n times. Also, since this provides a margin to the primary scanning speed, the scanning density can be increased. Consequently, there is a merit such that high definition images can be output at a high speed.

However, when images are formed using such a multi-beam irradiation method, a drawback occurs such that the density, breadth and size of line images and dot images may vary depending on whether adjacent beams are emitted simultaneously or separately.

FIG. 22 is a diagram illustrating the relationship between the laser lighting state and the line images formed based on the reversal development system when multiple line images are continuously written with multi-beam head scanning irradiation structured of four laser beam sources of LD1, LD2, LD3 and LD4.

When one line is formed by two beams, as illustrated in (a) of FIG. 22, the first cycle scanning is performed with LD1, LD2 and LD4 on and LD3 off. Thereafter, the second cycle scanning is performed with LD1, LD3 and LD4 on and LD2 off. LD1 and LD2 in the first scanning cycle and LD3 and LD4 in the second cycle are irradiation for forming a Line 1 and a Line 3, respectively, as illustrated in (c) of FIG. 22. In this case, the image bearing member is simultaneously irradiated with the adjacent laser beams (simultaneous irradiation).

On the other hand, the image bearing member is irradiated with LD 4 in the first cycle and LD1 in the second cycle to form a Line 2 as illustrated in (C) of FIG. 22 with a time lag therebetween, i.e., sequential irradiation, as illustrated in (b) of FIG. 22. Due to the difference between the irradiation states, the line formed in the output image by the sequential irradiation is broader than that by the simultaneous irradiation (refer to (c) of FIG. 22).

The applicants of the present application infer on the phenomenon that normally each beam has an oval form and two adjacent laser beams are partially overlapped on each other in the case of the simultaneous irradiation so that the overlapped portion on the image bearing member receives extremely strong power at one time. On the other hand, although there is no difference in the irradiations in terms of the total irradiation power, the light power on the overlapped portion on the image bearing member in the case of the sequential irradiation is relatively weak in comparison with that in the case of the simultaneous irradiation.

Image bearing members may show reciprocity failure depending on how the energy is provided thereto even when the same irradiation energy is provided. Generally, irradiation energy amount is equal to light power (value per unit time and unit area) times irradiation time. The sensitivity of an image bearing member becomes low when a light beam having a strong power is used in a short time even when the amount of the energy provided to the image bearing member is the same. Therefore, attenuation of the surface potential of the irradiated portion on the image bearing member is small.

This phenomenon is deduced as follows:

(1) A pair of charges having a positive or a negative polarity are generated in the photosensitive layer due to irradiation;

(2) Some of the charges generated during the irradiation move in the photosensitive layer to which an electric field is applied and combine with and neutralize the charge on the surface of the image bearing member to exercise the photosensitivity but part of the remaining charges extinguish when reuniting with a nearby charge having a reverse polarity;

(3) The amount of charges generated per its life time and unit space is large when the light intensity is strong even when the irradiation energy is the same. Thereby, the probability of reunion of charges becomes high. Therefore, the amount of the charges movable becomes relatively small, resulting in reduction of the sensitivity; and (4) Also, when the intensity of the electric field applied to a photosensitive layer is low, the amount of the charges accumulated per unit space increases, which leads to rise in the probability of reunion of charges. Therefore, the amount of the charges movable becomes relatively small, resulting in reduction of the sensitivity.

As described above, the sequentially irradiated portion on the image bearing member receives relatively small irradiation power in comparison with the simultaneously irradiated portion. As a result, decrease in the sensitivity of the photosensitive layer due to the reciprocity failure is small. Therefore, the degree of attenuation of the surface potential of the image bearing member is high so that the surface potential of the irradiated portion becomes low.

The reversal development method is a developing method in which charged toner particles having the same polarity as that of an image bearing member are attached to the irradiated portion on the surface of the image bearing member. Therefore, as the potential of the irradiated portion on the surface of the image bearing member decreases, the amount of the toner for development increases. Therefore, the amount of toner attached to a sequentially irradiated portion is relatively large in comparison with that to a simultaneously irradiated portion.

An obtained toner image is transferred to a recording medium in the transfer process and thereafter fixed in the fixing process to form an image on the recording medium. In the reversal development, when toner is transferred to a recording medium, the toner scatters in the air. Thereby, the width of an obtained image is easily on the broad side. This phenomenon is referred to as toner transfer scattering. As the amount of the toner used for development increases, the area of the toner transfer scattering becomes broad, resulting in a broad line image. The transferred image is typically fixed upon application of pressure and heat in the fixing process by a fixing device such as a heating roller. During the fixing, the toner is in a flowing state and rolled. Therefore, the line image is further broadened. As the amount of the toner increases, this broadening is significant during fixing.

This is how the applicants of the present application think the line images formed on a sequentially irradiated portion become wider than those on a simultaneously irradiated portion.

The following documents describe methods of solving this drawback.

JOP 2003-205642 describes a technology in which, in addition to multiple main laser power sources, subsidiary laser power sources are provided and simultaneously and suitably emit light every time adjacent main laser power sources emit light to form images, thereby keeping the number of the light power sources simultaneously emitting light the same.

JOP 2002-113903 describes a technology in which the power of the laser emitting light is changed depending on whether adjacent laser power sources simultaneously emit light, a single laser power source emits light or power sources not adjacent to each other simultaneously emit light.

However, these technologies accompany device improvement, which leads to cost increase.

JOP 2002-107988 describes an image bearing member provided in an image forming apparatus having multiple laser beams as multi-beam image irradiation light sources to solve the drawback mentioned above. In the image bearing member, an electroconductive layer in which electroconductive particles are dispersed in the resin is provided between the electroconductive substrate and the photosensitive layer therein. However, when the electroconductive layer is in a direct contact with the photosensitive layer, the charge potential of an image bearing member tends to attenuate. Especially, when an image is formed based on reversal development, a drawback arises such that background fouling such as black spots is observed in the background portion in an image. This drawback significantly emerges while image formation is repetitively performed.

To deal with this drawback, an intermediate layer is provided to block the charges between the electroconductive layer and the photosensitive layer. However, while image formation is repetitively performed, the charges are accumulated in the intermediate layer, which leads to increase in the potential of the irradiated portion of the image bearing member. This causes a drawback such that electrostatic contrast (the difference between the voltage at the non-irradiated portion and the voltage at the irradiated portion), which is necessary to form images, becomes small.

Further, since the emitting points of the vertical cavity surface emitting laser recently developed can be arranged in a two dimensional way, the vertical cavity surface emitting laser can be used as a multi-beam light source to increase speed and density and reduce the size of a machine in comparison with a multi-beam light source using a typical end face emission laser (refer to, for example, JOP H05-294005 and P149 of No. 3 of Volume 44 of the journal of the Imaging Society of Japan, published in 2005). However, the plane emission laser has relatively a small power in comparison with a typical end face emission laser. Therefore, when the sensitivity of an image bearing member lowers while image formation is retentively performed, abnormal images and non-uniform images as mentioned above significantly occur. Therefore, various kinds of studies have been made on solving the problems involved in the multi-beam irradiation mentioned above to install a vertical cavity surface emitting laser on an image forming apparatus as a multi-beam irradiation device.

In an attempt to solve the problem of an image forming apparatus having a multi-beam image irradiation device, JOP S2005-10662 describes a technology in which an image bearing member having a photosensitive layer is provided to an image forming apparatus which forms a latent electrostatic image by scanning at least 8 laser beams emitted from a plane light emission laser array provided as an irradiation light source on the surface of the image bearing member. The specific resistance of the intermediate layer is controlled to be $10^8$ to $10^{13}$ Ωcm when measured in the electric field of $10^6$ V/m at 28° C. and 85% RH. However, it is found to be difficult to sufficiently deal with the drawback as mentioned above just simply by regulating the specific resistance of the intermediate layer when image formation is performed in a large amount with a linear velocity of at least 300 m/s of the image bearing member.

JOP 2005-25180 describes a technology to reduce the non-uniformity of the density by using an image bearing member in which a charge generating layer and a charge transport layer are accumulated. The sensitivity of the charge generating layer is sufficiently uniform by making the difference between maximum and the minimum of the glass transition temperature not greater than 5° C. JOP 2004-286831 describes an image bearing member of which the quantum efficiency is not less than 0.3 when the charging potential is light-decayed from 500 to 250 V as a technology to solve the drawback involved in using a plane light emission laser. JOP 2005-017381 describes an image bearing member having titanyl phthalocyanine having a light absorption of not less than 0.5 as a charge generating material.

However, in both cases, it is found to be difficult to sufficiently deal with the drawback as mentioned above when image formation is performed in a large amount with a high linear velocity of, for example, at least 300 m/s, of the image bearing member.

Further, JOP 2002-303997 describes an image bearing member having a photosensitive layer containing oxytitanium phthalocyanine for an electrophotographic image formation apparatus using a multi-beam irradiation method in which the electrophotographic process is not greater than 200 mm/s. The moving speed of the charges in the image bearing member is from $7.0\times10^{-7}$ to $2.0\times10^{-5}$ $cm^2/Vs$. However, a typical image bearing member containing a known titanyl phthalocyanine has a difficulty in that such an image bearing member has a short life because residual charges easily remain in the image bearing member while the image formation process, especially the charging process and the irradiation process, is repeated. In addition, the accumulated remaining charges substantially weaken the intensity of the electric field applied to the photosensitive layer contributing to the sensitivity of the image bearing member, which promotes reciprocity failure. This causes non-uniformity between the simultaneously irradiated portion and sequentially irradiated portion mentioned above when an image is formed by a multi-beam recording in which multiple laser beams are emitted. Especially, when a plane light emission laser, which has a relatively small light power, is used as a multi-beam irradiation light source, non-uniformity in an image becomes significant due to deterioration of the sensitivity and reciprocity failure ascribable to the increase of residual charges in an image bearing member.

An image forming apparatus capable of printing at a high speed using a multi-beam is used for by far a large quantity of prints in comparison with a low or moderate speed image forming apparatus. Therefore, when the durability of an image bearing member, which is a main device in the image formation process, is low, it is inevitable that such an image bearing member is frequently replaced. This causes problems such that the substantial time to be taken to print images is long and image formation cost increases. Therefore, good durability is preferred for an image bearing member.

In addition, in an image forming apparatus taking a multi-beam irradiation system in which an image bearing member containing known titanyl phthalocyanine is provided, when the image formation is performed at a linear velocity of the image bearing member of at least 300 m/s, it is found that, when one dot or one line is plurally formed in the secondary scanning direction with adjacent multi-beams, the quality of an image pattern obtained depends on the locality therein as described above. This is considered to be because, as the irradiation time to be taken per dot decreases, the light power of a laser is strengthened, resulting in significant reciprocity failure phenomenon of the image bearing member.

Further, since the reciprocity failure phenomenon of an image bearing member is significant in irradiation under an electric field having a weak intensity, it is preferred to perform multi-beam irradiation under an electric field having a strong intensity, e.g., at least 30 V/μm to solve the drawback mentioned above involved in multi-beam irradiation. However, as described later, known titanyl phthalocyanine has various kinds of deficiencies for use under an electric field having a strong intensity. Especially, such titanyl phthalocyanine is not suitable for multi-beam irradiation under an electric field of 30 V/μm or higher. Therefore, for a high speed image forming apparatus using a multi-beam irradiation system, an image bearing member is demanded in which residual voltage does not significantly increase and the degree of reciprocity failure is light and which is free from drawbacks such as background fouling and decrease in image density even when an electric field having an intensity of 30 V/μm or higher is applied thereto.

Additionally, the functions of a high speed image forming apparatus taking digital system have been improved year by year. Therefore, let alone high durability and high stability thereof, the quality of an image is simultaneously demanded. Further, to increase the speed of color printing, a color image forming apparatus taking a tandem system having multiple image forming elements is the main stream these days. Each of the multiple image forming elements includes an image bearing member around which devices such as a charging device, an irradiation device, a developing device, a cleaning device and a discharging device for image formation are provided. In this system, respective image formation elements for yellow, magenta, cyan and black are typically installed. Each color toner image is formed at each color image formation element in parallel and overlapped on a transfer body, e.g., paper, or an intermediate transfer body to form a color image at a high speed. Therefore, such an image forming apparatus is extremely large unless the image bearing member and each device therearound are compact in size. It is inevitable that the image bearing member disposed in the center of the image formation elements has a small diameter. When an image bearing member having a small diameter has an extremely short life in comparison with an image bearing member having a large diameter, the merit in size reduction of an image forming apparatus having such an image bearing member is lost. Therefore, elongating the life of such an image bearing member in comparison with that of a typical image bearing member is recognized as a technical issue.

There are two factors which limit the elongation of the life of an image bearing member. One is electrostatic fatigue and the other is the wear of the surface layer thereof. Either of these two limiting factors is a significant issue for a currently popular organic image bearing member. The first factor is relating to the changes in the surface potential (the charging voltage and the voltage at irradiated portion) of an image bearing member while image formation process such as charging and irradiating is repetitively performed. When an image bearing member formed of an organic material is used, it is typical that the decrease in the charging voltage or the rise in the voltage at irradiated portions is a problem. The phenomenon in the second factor is that the layer disposed at the upper most surface of an image bearing member is mechanically abraded due to abrasion with a cleaning device, etc. Therefore, the thickness of this surface layer decreases, which leads to vulnerability to damage to the image bearing member, rise in the intensity of the electric field and acceleration of electrostatic fatigue. This makes the life of an image bearing member extremely short. Therefore, to elongate the life of an image bearing member, the two factors mentioned above are simultaneously eliminated.

In addition, with the realization of speed-up of the operation of an electrophotographic image forming apparatus, such an electrophotographic image forming apparatus is penetrating into the printing business field. As a result, the quality of an image and the stability level of image formation achieved by a printing machine are required for an electrophotographic image forming apparatus. As for the image quality, the definition has been greatly improved to a degree that the minimal definition of image formation is 600 dpi. With regard to the stability level of image formation, the demanded level is extremely high. This relates to the merit of electrophotography. That is, during processing such as writing and developing the same document in a massive amount, the information contained in the document can be variously changed one by one. Therefore, the stability of the system is extremely essential. It is thus natural that the image formation elements therein stably should perform image formation for repetitive use. Is it also greatly important to prevent the occurrence of an abnormal image.

The life length and the stability of an image forming apparatus are indispensable to image formation. Especially, the image bearing member included therein is the key considering its linking with other members during image formation. In every intensive attempt to develop an image bearing member, several technologies are almost successfully complete with regard to the electrostatic characteristics and abrasion of the surface thereof. For example, as for the electrostatic characteristics, charge generating materials generating optical carriers with excellent efficiency and charge transport materials having excellent mobility have been developed. When these materials are used in combination, large gain and response can be obtained in light decay. This produces effects in the entire system such as decrease of a charging potential, an amount for writing light, a developing bias and a transfer bias and elimination of a discharging process, which provides a latitude for system designing. These reduce the probability of the occurrence of hazard applied to an image bearing member so that the image bearing member itself can have an allowance.

In addition, as described above, with the advent of a high speed full color image forming apparatus, the usage of an image bearing member in an analogue or monochrome image forming apparatus has been drastically changed so that various kinds of optical writing is performed. In such usage, the occurrence of abnormal images is mostly related to an image bearing member. There are variety of causes of abnormal images, which can be largely typified into two. One is a scar on the surface of an image bearing member. The other is electrostatic fatigue of an image bearing member. The problem of abnormal images caused by a scar on the surface of an image bearing member can be mostly dealt with by improving the surface layer of an image bearing member (for example, providing a protective layer) and the device contacting the image bearing member. The problem of abnormal images stemming from electrostatic fatigue is caused by deterioration of an image bearing member. The currently most concerning issue of this type of the abnormal images is the background fouling, i.e., black spots observed in the background of an image, ascribable to reversal development, also referred to as negative positive development.

The mechanism of the occurrence of such abnormal images based on the reversal development is inferred as follows.

The reversal development is a development method of forming an image in which charged toner particles having the same polarity as that of an image bearing member are electrostatically attracted to an image portion thereof having a relatively low surface potential by irradiation on the image bearing member in comparison with the surface potential of non-image portion therearound. The charged toner is not attracted to the non-image portion (background portion), which is charged to a high potential having the same polarity as the charged toner. However, some image bearing members locally have a portion easily leaking its surface charges. That is, such an image bearing member has portions having a low voltage relative to its surround when charged. The toner is thus attached to the local portion having a low voltage, resulting in the background fouling.

There are causes to this background fouling. For example, there can be mentioned fouling and deficiency of an electroconductive substrate, dielectric breakdown of a photosensitive layer, carrier (charge) infusion from a substrate, increase in light decay of an image bearing member and generation of heat carrier in a photosensitive layer. Among these, it is possible to deal with the fouling and deficiency of an image bearing member by eliminating such substrates before forming a photosensitive layer thereon. Since this is caused by an error in a sense, this does not make an essential cause. Therefore, it is thought that this background problem can be fundamentally solved by improving the property of anti-dielectric breakdown of an image bearing member and preventing the charge infusion from a substrate and electrostatic fatigue of an image bearing member.

Technologies such that an undercoating layer or an intermediate layer is provided between an electroconductive substrate and a photosensitive layer have been proposed relating to the charge infusion from an electrostatic substrate mentioned above as one of the causes of the occurrence of the background fouling.

For example, JOP S47-6341 describes an intermediate layer containing a cellulose nitrate resin based compound, JOP S60-66258 describes an intermediate layer containing a nylon based resin, JOP S52-10138 describes an intermediate layer containing a maleic acid based resin, and JOP S58-105155 describes an intermediate layer containing a polyvinyl alcohol resin. However, such a single intermediate layer formed of a simple resin has a high electric resistance, which causes the residual potential to rise. As a result, the image density deteriorates in a negative positive development.

In addition, such an intermediate layer shows ion conductivity caused by impurities. Therefore, the electric resistance of the intermediate layer is extremely high in a low temperature and low humid circumstance. This extremely raises the residual voltage. Further, the electric resistance of the intermediate layer is lowered in a high temperature and high humid circumstance. Therefore, the background fouling tends to occur. Actually, the background fouling is not sufficiently restrained. To lower the residual voltage, it is necessary to make the thickness of an intermediate layer thin.

To deal with these problems, a technology to control the electric resistance of an intermediate layer is proposed in which electroconductive additives are added to an intermediate layer bulk. For example, JOP S51-65942 describes an intermediate layer in which carbon or chalcogen based material is dispersed in a curing resin, JOP S52-82238 describes a thermopolymeric intermediate layer in which a quaternary ammonium salt is added and an isocyanate based curing agent is used, JOP S55-113045 describes a resin intermediate layer in which a resistance controlling agent is added, and JOP S58-93062 describes an intermediate resin layer in which an organic metal compound is added. The residual voltage is reduced by simple these resin layers, but the background fouling tends to worsen. In addition, there is a problem that, when these resin layers are used in an image forming apparatus of late years using coherent light such as a laser beam, moiré is observed in images obtained.

Further, to prevent moiré and control the electric resistance of an intermediate layer at the same time, an image bearing member having a filler in its intermediate layer is proposed. For example, JOP S58-58556 describes an intermediate resin layer in which an oxide of aluminum or tin is dispersed. JOP S60-111255 describes an intermediate layer in which electroconductive particles are dispersed. JOP S59-17557 describes an intermediate layer in which a magnetite is dispersed. JOP S60-32054 describes an intermediate resin layer in which titanium oxide and tin oxide are dispersed. JOPs S64-68762, S64-68763, S64-73352, S64-73353, H01-118848 and H01-118849 describe an intermediate resin layer in which powder of borides, nitrides, fluorides and oxides of calcium, magnesium, aluminum, etc., are dispersed. In the case of such an intermediate layer in which a filler is dispersed, it is desired to increase the amount of the filler in terms of reduction of residual voltage, but it is desired to decrease the amount thereof in terms of background fouling. Consequently, it is difficult to have a good combination of reducing residual voltage and decreasing background fouling. In addition, when the content of a resin is small, the adhesive property between the intermediate layer and an electroconductive substrate deteriorates, which easily causes detachment thereof. Especially, this has a fatal effect on an image bearing member formed of an electroconductive substrate having a flexible belt form.

To deal with these problems, a technology is proposed in which an intermediate layer is formed of accumulated layers. Largely, there are two types of accumulation. One is that a resin layer 202 in which a filler is dispersed, a resin layer 203 in which a filler is not dispersed, and a photosensitive layer 204 are disposed on an electroconductive substrate 201 in this order (refer to FIG. 1). The other is that a resin layer 203 in which a filler is not dispersed, a resin layer 202 in which a filler is dispersed, and a photosensitive layer 204 are accumulated on an electroconductive substrate 201 in this order (refer to FIG. 2).

The former structure is detailed as follows. To seal off the deficiency mentioned above involved in a substrate, an electroconductive filler dispersed layer in which a filler having a low electroconductivity is dispersed is provided on an electroconductive substrate. Further, the resin layer mentioned above is provided on the electroconductive filler dispersed layer. For example, JOPs S58-95351, S59-93453, H04-170552, H06-208238, H06-222600, H08-184979, H09-43886, H09-190005, and H09-288367 describe such a structure. This structure can prevent the occurrence of moiré by the filler dispersed layer containing an electroconductive filler. In addition, it is possible to have an effect on restraining background fouling due to the resin layer provided on the filler dispersed layer. However, only the resin layer restrains the carrier infusion from the electroconductive substrate. Therefore, as in the case in which a resin layer is singly used, when the resin layer is thickened, the residual potential extremely increases. When the resin layer is thinned, the background fouling increases. Therefore, it is not satisfying in terms of achieving a good combination thereof. In addition to the insulative resin layer provided on the filler dispersion layer, the filler dispersed layer is desired to be thickened, for example, at least 10 μm, to seal off the deficiency of an electroconductive substrate. Therefore, it is difficult to restrain the occurrence of background fouling by raising the resistance of a filler contained in the filler dispersed layer because the influence of the residual potential extremely increases.

In addition, JOPs H05-100461, H05-210260 and H07-271072 describe an image bearing member in which an electroconductive layer, an intermediate layer and a photosensitive layer containing titanyl phthalocyanine crystal are accumulated. However, it is difficult to sufficiently restrain the occurrence of background fouling simply by accumulating an electroconductive layer and an intermediate layer. This is because, in addition to the cause mentioned above, the titanyl phthalocyanine contained in the photosensitive layer works as another factor to cause background fouling, which will be described later.

On the other hand, in the latter structure, a resin layer to restrain carrier infusion is provided on an electroconductive substrate and a filler dispersed layer containing a filler is provided on the resin layer. For example, JOPS H05-80572 and H06-19174 describe such a structure. In this structure, carrier infusion can be restrained by the resin layer. The filler diffusion layer accumulated thereon hardly has an effect on the residual potential even when the filler diffusion layer does not contain an electroconductive filler. Therefore, carrier infusion can be further prevented so that the latter structure is more effective than the former structure in terms of having a good combination of preventing the rise of the residual potential and reducing the background fouling.

The structure mentioned above having accumulated undercoating layers each of which has a separate function is highly effective to prevent the occurrence of moiré and background fouling and reduce the residual potential at the same time. However, since the resin layer is desired to be thickened, background fouling and residual potential tend to be greatly dependent on a combination of humidity and/or the layer thickness and a resin used in the resin layer. As a result, the structure is devoid of high stability.

Further, in addition to charge (positive hole) infusion from an electroconductive substrate to a photosensitive layer, the influence of the generation of heated carrier in the photosensitive layer is not ignorable as the cause of the occurrence of background fouling. Therefore, background fouling caused during repetitive use cannot be fully controlled without suitably selecting a charge generating material used in a charge generating layer and controlling the state of the particles thereof.

In addition, an image bearing member having a high sensitivity and a high speed responsiveness is used to deal with the issue of speed-up. It is known that an LD having a wavelength of 780 nm or an LED having a wavelength of around 760 nm is generally used as the light source and its corresponding image bearing member (charge generating material) is formed of a titanyl phthalocyanine crystal having a CuKα X ray (having a wavelength of 1.542 Å) diffraction spectrum such that at least the maximum diffraction peak is observed at a Bragg (2θ) angle of 27.3±0.2° (for example, JOP 2001-19871). This specific crystal type has an extremely high carrier generating function and therefore can be effectively used as a charge generating material contained in an image bearing member for use in a high speed image forming apparatus. However, this crystal type is unstable as a crystal and has a drawback in that the crystal form has a low stability and is vulnerable to mechanical stress and thermal stress during dispersion, etc., and easily transferred to another crystal form. The crystal form obtained after the crystal transfer has en extremely low sensitivity relative to that of the crystal form before the crystal transfer. When part of the crystal is crystalline transferred, the optical carrier generating function thereof is not fully exercised. In addition, especially abnormal images having background fouling stemming from the negative positive development easily occur while an image bearing member is repeatedly used.

Typical titanyl phthalocyanines described in JOPs 2001-19871, H08-110649, H01-299874, H03-269064, H02-8256, S64-17066, H11-5919 and H03-255456 have a strong agglomeration property. When such phthalocyanines are used in a charge generating layer, although charge infusion from an undercoating layer is restrained, reduction in charge easily occurs and dark decay tends to increase at a local portion where agglomerated or coarse particles are present. That is, background fouling becomes obvious. In addition, the purity of the titanyl phthalocyanine has a significant effect. Contaminants contained in titanly phthalocyanine cause extreme reduction in the amount of charges and increase of dark decay due to fatigue, resulting in deterioration of anti-background fouling property. Therefore, it is desired to eliminate such causes of the background fouling by controlling the dispersability and the crystal type of a titanyl phthalocyanine for use in a charge generating layer.

In addition, since images are frequently output, the quality of the output images is an important factor. To obtain an image having excellent quality, there are three issues to be dealt with, which are: (i) to form a high density latent electrostatic image formed on an image bearing member by a charging device and an irradiating device; (ii) to form a toner image true to the latent electrostatic image in the next process (development process) by a developing device; and finally (iii) to exactly transfer the toner image on the image bearing member to a transfer medium. To solve these issues, with regard to (i), there is a method of forming a latent electrostatic image by a high density writing by an irradiation device using a laser beam having a small diameter. However, when the intensity of an electric filed applied on an image bearing member is small, the optical carrier generated in a photosensitive layer spreads due to Coulomb repulsion. Therefore, the size of a dot formed does not correspond to the beam diameter. With regard to (ii), there is a method of using a toner having a small particle diameter to form a toner image true to a latent electrostatic image on an image bearing member by a developing device. When the surface potential of an image bearing member is low, the efficiency of development deteriorates. Thereby, dots formed scatters to the corresponding dots of the latent electrostatic image. With regard to (iii), there is a method of truly transferring a toner image on an image bearing member to a transfer medium by a transfer device by raising the intensity of a gap electric field to improve transfer efficiency. However, an increased intensity of the transfer electric field causes discharging to the contrary, which may cause transfer toner scattering and accelerate the fatigue of electrostatic characteristics of an image bearing member.

Among these, especially the increase in the surface potential (intensity of the electric field) of an image bearing member mentioned in (i) and (ii) causes abnormal images having background fouling when an image bearing member formed of the titanyl phthalocyanine mentioned above having a CuKα X ray (having a wavelength of 1.542 Å) diffraction spectrum such that at least the maximum diffraction peak is observed at a Bragg (2θ) angle of 27.3±0.2° is repetitively used.

FIG. 3 is a diagram illustrating how dots are formed (writing at 1,200 dpi) to the intensity of an electric field (surface potential of an image bearing member/layer thickness of a photosensitive layer) applied on an image bearing member. As illustrated in FIG. 3, to truly reproduce small dots, it is desired to have a high intensity of an electric field. In FIG. 4, the relationship between background fouling and the intensity of an electric field is illustrated. The background ranking in FIG. 4 represents the degree thereof. The larger the value of the background is, the better the degree of the background fouling is, meaning the frequency of the occurrence of background fouling is low. As seen in FIGS. 3 and 4, there is a trade off relationship between the intensity of en electric field and the background fouling ranking. To avoid background fouling, a system has been used in which the intensity of an image bearing member is typically not greater than 30 V/μm and thereby the reproduction of small dots are sacrificed in some degree. For example, JOP 2001-154379 describes that the intensity of an electric field of an image bearing member is limited in the range of from 12 to 40 V/μm to have a good combination of background fouling and reproduction of fine lines.

However, when the definition of a writing laser beam increases, it is not possible to develop written dots with good reproducibility without setting the lower limit thereof to be relatively high. In addition, with regard to background fouling, the upper limit of the intensity of an electric field varies depending on the materials (mainly charge generation material) forming an image bearing member. The titanyl phthalocyanine having a CuKα X ray (having a wavelength of 1.542 Å) diffraction spectrum such that at least the maximum diffraction peak is observed at a Bragg (2θ) angle of 27.3±0.2° has an extremely high sensitivity but has a drawback in that the titanyl phthalocyanine is not suitable on background fouling. Actually, the range of the intensity of an electric field of such a titanyl phthalocyanine is limited to around not greater than 30 V/μm.

Further, the optical carrier generating efficiency (capability) of the titanyl phthalocyanine crystal mentioned above depends on the intensity of an electric field. As the intensity of an electric field decreases, the optical carrier generating efficiency extremely worsens. Therefore, in an actual system, the advantage of the titanyl phthalocyanine crystal having the specifically high sensitivity is not fully brought out. This drawback is not greatly significant for a writing laser beam having a low definition, for example, not greater than 400 dpi, but for a high definition of late, for example, at least 600 dpi and higher, specifically, at least 1,200 dpi.

In the typical technologies, it is difficult to have a good combination of restraining background fouling and the rise in the residual voltage. To be specific, when the background fouling is restrained, it invites the rise in the residual voltage and the extreme dependency on environment. When the rise in the residual voltage is restrained, the effect on restraint of the background fouling is insufficient. As described above, background fouling is caused not only by charge infusion from an electron substrate, but also by other factors such as coarse particles contained in titanyl phthalocyanine and contaminants contained in a photosensitive layer or a charge generating layer. Furthermore, there is another factor having a great effect on the background fouling, which is the increase in the intensity of an electric field induced by the decrease in the layer thickness of an image bearing member.

Therefore, a charge transport layer or a protective layer formed as the uppermost surface layer of an image bearing member has been devised to improve anti-abrasion property. There are technologies to improve anti-abrasion property of a photosensitive layer such that (i) a curing binder resin is used in a cross linkage type charge transport layer (for example, refer to JOP S56-48637), (ii) a polymeric charge transport material is used (for example, refer to JOP S64-1728) and (iii) an inorganic filler is dispersed in a cross linkage type charge transport layer (for example, refer to JOP H04-281461). The temporary variation of the intensity of an electric field can be thus lessened by improving the anti-abrasion property of an image bearing member. Thereby, such an image bearing member has a high effect on restraint of background fouling.

However, among these, the technology mentioned in (i): the curing binder resin, is not sufficiently compatible with a charge transport material. Therefore, the residual voltage tends to rise. In addition, the residual also tends to rise due to the existence of contaminants such as non-reacted remaining group and a polymerization initiator. This leads to decrease in the image density. Further, when the polymeric charge transport material mentioned in (ii) is used, the anti-abrasion property of an image bearing member can be improved in some degree but does not reach a desired level. Further, polymerizing and refining a polymeric charge transport material is so difficult that the purity is not sufficient. Therefore, the electric characteristics between materials are not easily stable. Furthermore, there are problems relating to manufacturing such that the liquid for application has a high viscosity. In addition, in the case of the technology mentioned in (iii) where an inorganic filler is dispersed, the anti-abrasion property thereof is relatively high in comparison with that of a typical image bearing member in which a charge transport material having a low molecular weight is dispersed in an inactive polymer. However, the residual voltage rises due to charge trap, which is caused by the charge existing on the surface of the inorganic filler. This may lead to decrease in image density. Further, when the concavity and convexity of the inorganic filler and the binder resin on the surface of an image bearing member is large, the cleaning performance deteriorates, which may lead to toner filming and image flowing. These technologies (i) to (iii) have an effect on restraining background fouling but have a problem about the residual potential and cleaning performance, resulting in image deficiency. Therefore, these technologies are not fully sufficient to improve the durability of an image bearing member.

Further, an image bearing member is known which contains multifunctional acrylate monomer curing material to improve anti-abrasion property and anti-damage property (for example, refer to Japanese Patent No. (hereinafter referred to as JP) 3262488. However, in this image bearing member, there is a description in which this multi-functional acrylate curing material can be contained in a protective layer provided on a photosensitive layer of the image bearing member. This is a simple but not specific description about a charge transport material contained in the protective layer. In addition, when a charge transport material having a low molecular weight is simply contained in a cross linkage type charge transport layer, there arises a compatibility problem between the charge transport material and the curing material mentioned above. Thereby, the charge transport material having a low molecular weight precipitates and causes clouding phenomenon. Therefore, the rise in the irradiated portion voltage causes decrease in the image density and the mechanical strength weakens. Further, to manufacture this image bearing member, the monomer reacts in a state in which the polymeric binder resin is contained. Therefore, since a three-dimensional mesh structure is not fully developed and naturally the cross-linkage density is thin, this type of an image bearing member does not have a drastically improved anti-abrasion property.

As to the anti-abrasion technology relating to these, it is known that there is a charge transport layer formed of a liquid of application formed of a monomer having one or more carbon-carbon double linkages, a charge transport material having one or more carbon-carbon double linkages and a binder resin (for example, refer to JP 3194392). This binder resin is considered to have a function of improving the adhesiveness between a charge generating layer and a curing type charge transport layer and further relax the internal stress in a thick layer during curing the thick layer. The binder resin is typified into two. One has one or more carbon-carbon double linkages and is reactive to the charge transport material. The other does not have a carbon-carbon double linkage and is not reactive thereto. This type of an image bearing member is notable in that the image bearing member has a good combination of anti-abrasion property and electric characteristics. When a binder resin non-reactive to a charge transport material is used, the compatibility between the binder resin and a curing material formed in the reaction between the monomer and the charge transport material is poor so that the layer detachment tends to occur in the cross-linkage type charge transport layer, which may lead to damage or adhesion of external additives and paper dust. Further, as described above, since the three dimensional mesh structure is not fully developed, and naturally the cross-linkage density is thin, this type of an image bearing member does not have a drastically improved anti-abrasion property. Furthermore, a specific monomer for this type of an image bearing member in the description has two functional groups so that the anti-abrasion property is not sufficiently improved. In addition, when a binder resin reactive to a charge transport material is used, although the molecular weight of the curing resin increases, the number of linkages among molecules is small. Therefore, it is difficult to have a good combination of the amount and the density of the linkage of the charge transport material and the electric characteristics and anti-abrasion property are not sufficiently improved.

Additionally, it is known that there is a photosensitive layer containing a compound cured from a positive hole transfer compound having at least two chain polymeric functional groups in a molecular (for example, refer to JOP 2000-66425). This photosensitive layer can improve the density of cross linkage and thus has a high hardness. However, since the cumbersome positive hole transfer compound has at least two chain polymeric functional groups, the obtained cured compound tends to have distortion therein and a high internal stress. Thereby, the cross-linkage surface layer is vulnerable to cracking and peeling for an extended period of use. As described above, an image baring member having a cross-linkage photosensitive layer in which a charge transport structure is chemically bonded based on these typical technologies does not have sufficient comprehensive characteristics.

Since the background fouling is influenced not only by an undercoating layer but also by each layer such as a charge generating layer, a charge transport layer and a protective layer, the background fouling is not sufficiently restrained and therefore the durability of an image bearing member is not achieved without improving each layer at the same time. However, in the related typical art, there are few cases in which background fouling is restrained by each of the layers forming an image bearing member. In addition, in attempts to improve every layer at the same time, image deterioration drawbacks other than the background fouling frequently arise such that the residual potential rises, the dependency of chargeability and the residual potential on humidity increases, and filming, image blur and image deficiency tend to occur. That is, the durability of an image bearing member has not been highly improved.

SUMMARY OF THE INVENTION

Because of these reasons, the present applicants recognize that a need exists for a small-sized image forming apparatus stably outputting high definition images for an extended period of time without producing abnormal images even when the image forming apparatus is repetitively used at a high speed.

Accordingly, an object of the present application is to provide an image forming apparatus outputting quality images at a high speed with a high durability.

Briefly this object and other objects of the present application as hereinafter described will become more readily apparent and can be attained, either individually or in combination thereof, by an image forming apparatus including an image bearing member, a charging device configured to charge the image bearing member, an irradiating device configured to irradiate the surface of the image bearing member with plural irradiation beams emitted from the power source to form a latent electrostatic image on the image bearing member, a developing device configured to develop the latent electrostatic image on the image bearing member, a transfer device configured to transfer the developed image, and a cleaning device configured to clean the image bearing member. The image bearing member operates at a linear velocity of at least 300 mm/sec. The image bearing member includes an electroconductive substrate, a charge blocking layer located overlying the electroconductive substrate, a moiré prevention layer located overlying the charge blocking layer, and a photosensitive layer located overlying the moiré prevention layer. The photosensitive layer contains titanyl phthalocyanine having a primary particle diameter of not greater than 0.25 μm and having a crystal form having a CuKα X ray diffraction spectrum having a wavelength of 1.542 Å such that a maximum diffraction peak is observed at a Bragg (2θ) angle of 27.2±0.2°, main peaks are observed at a Bragg (2θ) angle of 9.4±0.2°, 9.6±0.2°, and 24.0±0.2°, and a peak is observed at a Bragg (2θ) angle of 7.3±0.2° as a lowest angle diffraction peak, while there is no peak between 9.4±0.2° and 7.3±0.2° and there is no peak at 26.3±0.2°).

It is preferred that, in the image forming apparatus mentioned above, the photosensitive layer includes a charge generation layer and a charge transport layer located overlying the charge generation layer.

It is still further preferred that, in the image forming apparatus mentioned above, a protective layer is located overlying the photosensitive layer.

It is still further preferred that, in the image forming apparatus mentioned above, the electric field intensity determined by the following relationship of the charge of the surface of the image bearing member is at least 30 V/μm;

Electric field intensity(V/μm)=an absolute value(V)of a surface voltage of a non-irradiated portion of the image bearing member at developing position/a layer thickness of the photosensitive layer (μm).

It is still further preferred that, in the image forming apparatus mentioned above, the charge blocking layer contains an insulating material having a layer thickness of from 0.1 to 2.0 μm.

It is still further preferred that, in the image forming apparatus mentioned above, the insulating material is a polyamide.

It is still further preferred that, in the image forming apparatus mentioned above, the polyamide is N-methoxymethyl nylon.

It is still further preferred that, in the image forming apparatus mentioned above, the moiré prevention layer contains an inorganic pigment and a binder resin and a volume ratio of the inorganic pigment to the binder resin is from 1/1 to 3/1.

It is still further preferred that, in the image forming apparatus mentioned above, the binder resin is a thermosetting resin.

It is still further preferred that, in the image forming apparatus mentioned above, the thermosetting resin is a mixture of an alkyd resin and a melamine resin.

It is still further preferred that, in the image forming apparatus mentioned above, the mixing ratio by weight of the alkyd resin to the melamine resin is from 5/5 to 8/2.

It is still further preferred that, in the image forming apparatus mentioned above, the inorganic pigment is a titanium oxide.

It is still further preferred that, in the image forming apparatus mentioned above, the titanium oxide contains a titanium oxide (T1) having an average particle diameter of D1 and another titanium oxide (T2) having an average particle diameter of D2 and the ratio of D2/D1 satisfies the following relationship:

$$0.2<D2/D1\leqq 0.5.$$

It is still further preferred that, in the image forming apparatus mentioned above, the mixing ratio {T2/(T1+T2)} by weight of the two titanium oxides (T1 and T2) is from 0.2 to 0.8.

It is still further preferred that, in the image forming apparatus mentioned above, the photosensitive layer is formed by applying a dispersion liquid of the titanyl phtahlocyanine having the crystal form prepared by dispersing the titanyl phthalocyanine until the titanyl phtahlocyanine has an average particle diameter of not greater than 0.3 μm with a deviation of not greater than 0.2 μm and filtrating the resultant titanyl phtahlocyanine with a filter having an effective mesh diameter of not greater than 3 μm to obtain the titanyl phtahlocyanine having an average primary particle diameter of not greater than 0.25 μm.

It is still further preferred that, in the image forming apparatus mentioned above, the titanyl phtahlocyanine having the crystal form is prepared by performing crystal-conversion of an amorphous form or low crystalline titanyl phtahlocyanine with an organic solvent under the presence of water and filtrating the titanyl phthalocyanine after the crystal-conversion from the organic solvent before the primary average particle diameter of the titanyl phthalocyanine after the crystal-conversion is greater than 0.25 μm. The amorphous form or low crystalline titanyl phtahlocyanine has an average primary particle diameter of not greater than 0.1 μm and having a CuKα X ray diffraction spectrum having a wavelength of 1.542 Å such that a maximum diffraction peak is observed at a Bragg (2θ) angle of 7.0 to 7.5±0.2° with a half value width of at least 1°.

It is still further preferred that, in the image forming apparatus mentioned above, the titanyl phthalocyanine having the crystal form is synthesized of a material excluding a halogenated compound.

It is still further preferred that, in the image forming apparatus mentioned above, the titanyl phthalocyanine is prepared by an acid paste method and washed with a deionized water until the deionized water after washing has at least one of a pH of from 6 to 8 and a specific conductivity of not greater than 8 μS/cm.

It is still further preferred that, in the image forming apparatus mentioned above, the ratio by weight of the organic solvent to the amorphous form or low crystalline titanyl phthalocyanine is not less than 30/1.

It is still further preferred that, in the image forming apparatus mentioned above, the photosensitive layer contains a polycarbonate having a triaryl amine structure in at least one of the main chain or a side chain thereof.

It is still further preferred that, in the image forming apparatus mentioned above, the protective layer contains an inorganic pigment or a metal oxide having a specific electric resistance of not less than $10^{10}$ Ωcm.

It is still further preferred that, in the image forming apparatus mentioned above, the protective layer contains a charge transport polymer material.

It is still further preferred that, in the image forming apparatus mentioned above, the protective layer contains a binder resin having a cross-linking structure.

It is still further preferred that, in the image forming apparatus mentioned above, the cross linking structure in the binder resin has a charge transport portion.

It is still further preferred that, in the image forming apparatus mentioned above, the protective layer is formed by curing a radical polymeric monomer having at least three functional groups without a charge transport structure and a radical polymeric compound with a charge transport structure having a functional group.

It is still further preferred that, in the image forming apparatus mentioned above, the functional groups of the radical polymeric monomer are at least one of acryloyloxy group and methacryloyloxy group.

It is still further preferred that, in the image forming apparatus mentioned above, the ratio (molecular weight/number of functional groups) of the molecular weight of the radical polymeric monomer to the number of functional groups thereof is not greater than 250.

It is still further preferred that, in the image forming apparatus mentioned above, the functional group of the radical polymeric compound is one of acryloyloxy group and methacryloyloxy group.

It is still further preferred that, in the image forming apparatus mentioned above, the charge transport structure in the radical polymeric compound is triaryl amine structure.

It is still further preferred that, in the image forming apparatus mentioned above, the radical polymeric compound is at least one of compounds represented by the following chemical formulae (1) and (2):

Chemical formula (1)

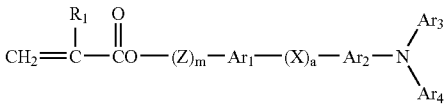

Chemical formula (2)

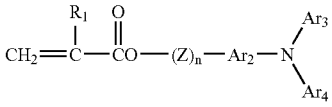

In the Chemical formulae (1) and (2), $R_1$ represents hydrogen atom, a halogen atom, an alkyl group, an aralky group, an aryl group, a cyano group, a nitro group, an alkoxy group, —$COOR_7$, wherein $R_7$ represents hydrogen atom, a halogen atom, an alkyl group, an aralkyl group or an aryl group, a halogenated carbonyl group or $CONR_8R_9$, wherein $R_8$ and $R_9$ independently represent hydrogen atom, a halogen atom, an alkyl group, an aralkyl group or an aryl group, $Ar_1$ and $Ar_2$ independently represent an arylene group, $Ar_3$ and $Ar_4$ independently represent an aryl group, X represents an alkylene group, a cycloalkylene group, an alkylene ether group, oxygen atom, sulfur atom or a vinylene group, Z represents an alkylene group, an alkylene ether divalent group or an alkyleneoxy carbonyl divalent group, and a represents 0 or 1, m and n represent an integer of from 0 to 3.

It is still further preferred that, in the image forming apparatus mentioned above, the radical polymeric compound contains at least one of the compounds represent by the following chemical formula (3).

Chemical formula (3)

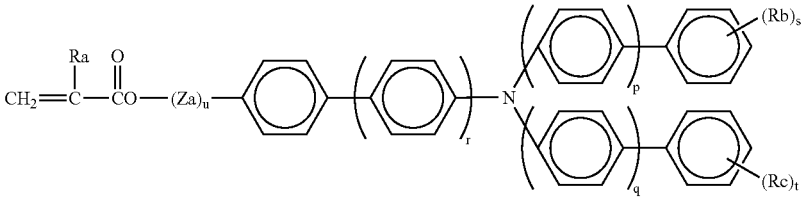

In Chemical formula (3), u, r, p, q represent 0 or 1, s and t represent an integer of from 0 to 3, Ra represents hydrogen atom or methyl group, Rb and Rc independently represent an alkyl group having 1 to 6 carbon atoms, and Za represents methylene group, ethylene group, —$CH_2CH_2O$—, —$CHCH_3CH_2O$—, or —$C_6H_5CH_2CH_2$—.

It is still further preferred that, in the image forming apparatus mentioned above, the content ratio of the radical polymeric monomer is from 30 to 70 weight % based on the total weight of the protective layer.

It is still further preferred that, in the image forming apparatus mentioned above, the content ratio of the radical polymeric compound is from 30 to 70 weight % based on the total weight of the protective layer.

It is still further preferred that, in the image forming apparatus mentioned above, the radical polymeric monomer and the radical polymeric compound are cured by irradiation of heat or optical energy.

It is still further preferred that, in the image forming apparatus mentioned above, the transfer device directly transfers the developed image on the image bearing member to a transfer body.

It is still further preferred that, in the image forming apparatus mentioned above, the potential of the surface of the image bearing member at non-developing portion is not greater than 100 V in absolute value.

It is still further preferred that, in the image forming apparatus mentioned above, the power source include at least 3 vertical cavity surface emitting lasers.

It is still further preferred that, in the image forming apparatus mentioned above, the vertical cavity surface emitting lasers are arranged in a two dimension.

It is still further preferred that, the image forming apparatus mentioned above includes a cartridge detachably attached to the main body of the image forming apparatus. the cartridge includes the image bearing member and at least one of the charging device, the irradiating device, the developing device and the cleaning device.

As another aspect of the present application, a process cartridge is provided which is detachably attached to the image forming apparatus mentioned above. The process cartridge includes an image bearing member and at least one of a charging device, an irradiation device, a developing device and a cleaning device.

These and other objects, features and advantages of the present application will become apparent upon consideration of the following description of the preferred embodiments of the present application taken in conjunction with the accompanying drawings.

BRIEF DESCRIPTION OF THE DRAWINGS

Various other objects, features and attendant advantages of the present application will be more fully appreciated as the same becomes better understood from the detailed description when considered in connection with the accompanying drawings in which like reference characters designate like corresponding parts throughout and wherein.

DETAILED DESCRIPTION OF THE INVENTION

The image forming apparatus of the present application will be described below in detail with reference to several embodiments and accompanying drawings.

Figure 5:
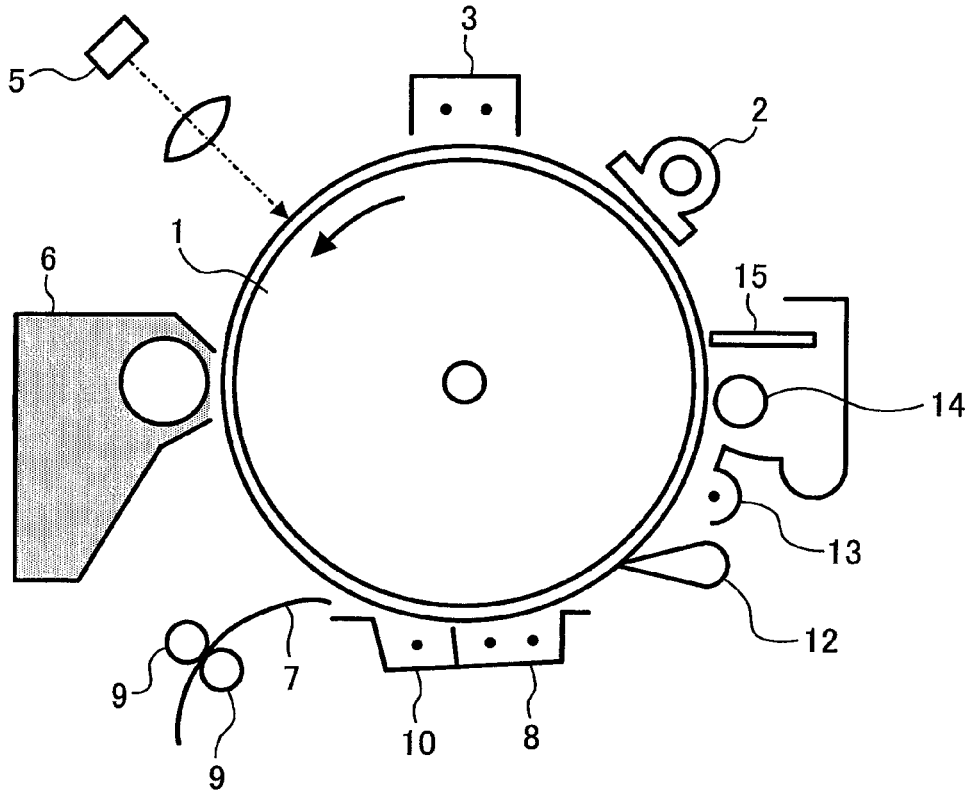
FIG. 5 is a schematic diagram illustrating the electrophotography process and the image forming apparatus of the present application.

FIG. 5 is a schematic diagram illustrating the image forming apparatus of the present application and other variations described later also belong to the scope of the present application.

In FIG. 5, an image bearing member 1 has an electrostatic substrate on which at least a charge blocking layer, a moiré prevention layer and a photosensitive layer are provided. The photosensitive layer contains titanyl phthalocyanine crystal having an average primary particle diameter of not greater than 0.25 μm. The titanyl phthalocyanine crystal having a crystal form having a CuKα X ray diffraction spectrum having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.4°±0.2° and 7.3°±0.2° and no peak at 26.3±0.2°. The image bearing member 1 has a drum form but can also have a sheet form or an endless belt form.

Any known charging device can be suitably used as a charging device 3. For example, there can be used a charging device adopting a corotron system, a scorotron system, a contact charging system in which a charging device is brought in contact with the surface of an image bearing member to charge the image bearing member by discharging, and a charging system in which a charging device is disposed with a gap of several tens to hundreds μm between the charging device and the image bearing member.

An image bearing member is charged by such a charging device so that the intensity of an electric field is applied thereto. The intensity of an electric field applied to an image bearing member is not less than 20 V/μm. As the intensity increases, reproducibility of images becomes good in such a manner that non-uniformity of line images and dot images caused by the difference between the simultaneous irradiation and the sequence irradiation mentioned above of multiple laser beams can be reduced and image density and sharpness of dots are improved. It is preferred for the intensity to be not less than 30 V/μm. However, there is a probability that an image bearing member having such an intensity may cause dielectric breakdown thereof and a problem of carrier attachment during development. Therefore, the upper limit of the intensity is preferably about 60 V/μm and more preferably about 50 V/μm.

In addition, with regard to the charging system, a charging device, which is illustrated in FIG. 5 as the charging device 3, adopting the scorotron system, is preferred as a charging device at least for use in main charging of an image bearing member.

In an image irradiating device 5, a light source is used having a multiple laser beam writing head in which multiple semiconductor laser diode (LD) elements are arranged in the secondary scanning direction of an image bearing member.

Figure 23:
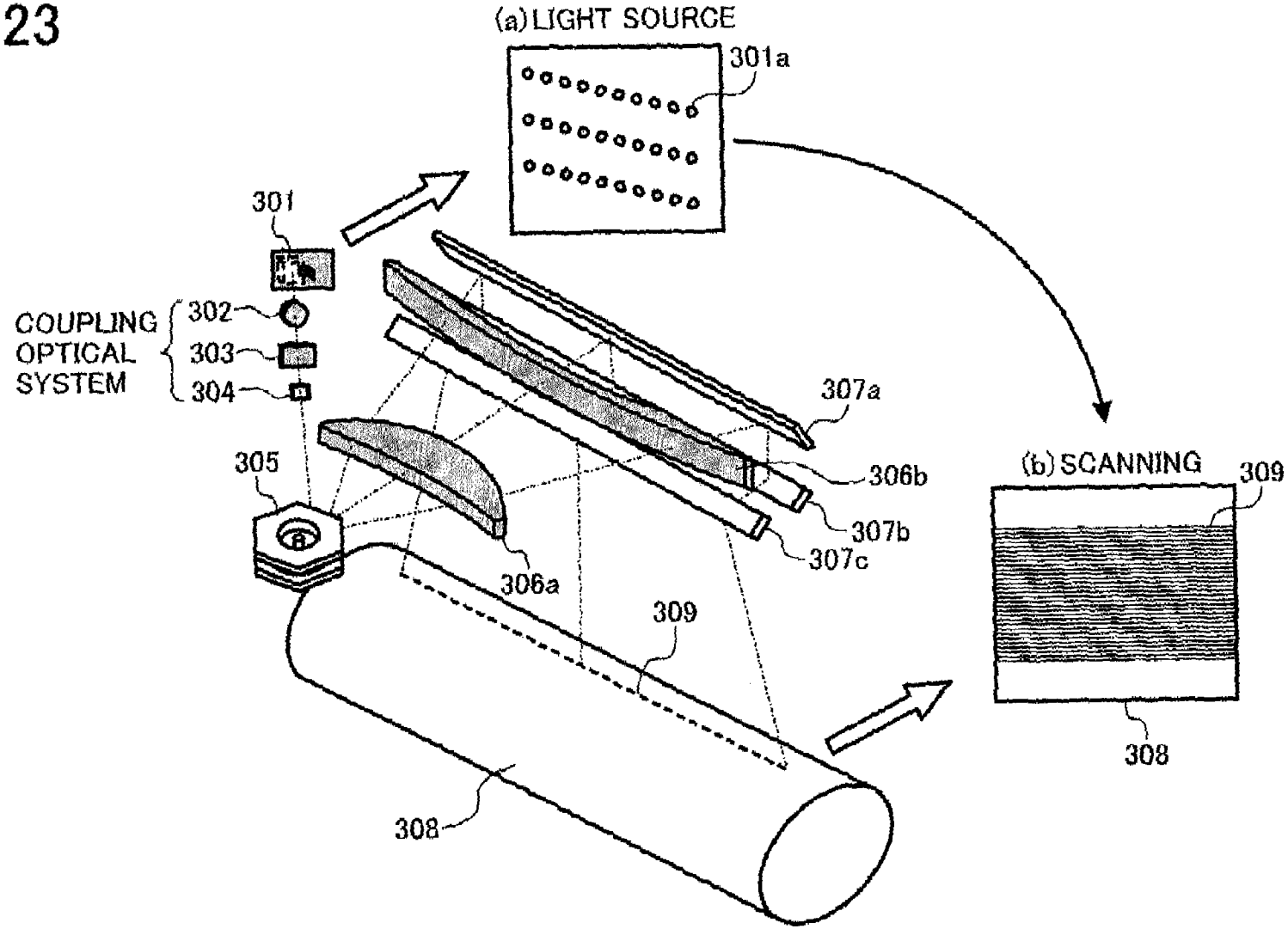
FIG. 23 is a diagram illustrating a multi-beam irradiation device example of the present application.

FIG. 23 is a diagram illustrating an example of the multi-beam irradiation device for use in the present application.

Multiple laser beams emitted from a light source 301 in which multiple luminous points 301*a* are arranged in one or two dimensions are collimated or significantly collimated. Then, the (significantly) collimated laser beams are deflected to the primary scanning direction by a polygon mirror 305 via a cylindrical lens 303 and an aperture 304.

The laser beams deflected by the polygon mirror 305 are converged by scanning lenses 306*a* and 306*b* and focused on the surface of an image bearing member 308 via reflective mirrors 307*a*, 307*b* and 307*c* to scan the image bearing member 308 in the primary scanning direction. Thus, scanned lines 309 are formed thereon.

An end face light emission laser or a surface light emission laser can be used as a light source for a multi-beam irradiation device. Especially, a surface light emission laser can form a laser array in which luminous points 301*a* are arranged in two dimensions so that such a laser array is effective to increase the speed, reduce the size and improve the definition of an image.

Generally, when the definition of writing is increased, it takes a long time accordingly, which limits the speed of image formation. When a multi-beam writing head is used, relatively high speed image formation with a relatively fine definition is possible in comparison with the case of when a single-beam writing head is used. In addition, when a multi-beam writing head is used in combination with an image bearing member containing the titanyl phthalocyanine dye having a specific crystal form for use in the present application, a high speed image formation not lower than 300 mm/sec of an image bearing member linear velocity is possible without producing the abnormal images peculiar to multi-beam writing.

In addition, in the examples of the present application described later, a multi-beam writing head in which four end face light emission laser diode elements are arranged in the secondary scanning direction and a laser array in which surface light emission lasers are arranged in two dimensions in 4×4 are used but the present application is not limited thereto.

A developing unit 6 in FIG. 5 can deal with regular development and reversal development depending on the polarity of a charged toner. When a toner having a polarity reverse to that of the image bearing member 1 is used, a regular development is used. When a toner having the same polarity as that of the image bearing member 1 is used, latent electrostatic images are developed by reversal development. Although it depends on the light source in the irradiating device 5, reversal development in which toner development is performed on a writing portion has an advantage in the case of a digital light source recently used considering the ratio of imaged area, which is generally low, and the life of a light source. Additionally, there are two development methods. One is a development method in which a single component containing only a toner is used. The other is a development method in which a two-component developer containing a toner and a carrier is used. Both development methods are suitable.

In addition, a toner image formed on an image bearing member becomes an image on a transfer medium when the toner image is transferred thereto. There are two methods of transferring images to a transfer medium. One is a method as illustrated in FIG. 5 in which a toner image developed on the surface of an image bearing member is directly transferred to a transfer medium. The other is a method in which a toner image is transferred from an image bearing member to an intermediate transfer body and then transferred to a transfer medium. Both transferring methods can be used in the present application. Especially, a direct transfer method in which a toner image formed on the surface of an image bearing member is directly transferred to a transfer body (such as paper on which the image is output) is suitably used.

In addition, a transfer charging device 10 is illustrated in FIG. 5 as a transfer device. A transfer conveying belt and a transfer roller can be also used as a transfer device. With regard to voltage/current applying method during transfer, either of a constant voltage method or a constant current method can be used. A constant current method is preferred because the amount of transfer charge can be constantly maintained so that the stability thereof is excellent. Any known transfer device can be used as long as such a device satisfies the structure of the present application.

The surface voltage of an image bearing member after transfer has a large effect on electrostatic fatigue of the image bearing member during repetitive use. That is, the electrostatic fatigue of an image bearing member greatly depends on the amount of the charges passing therethrough. The amount of the charges passing through an image bearing member corresponds to the amount of charge flowing in the layer thickness direction of the image bearing member. During image formation, an image bearing member is charged to a desired voltage by a main charging device (negatively charged in most cases) and optical writing is performed thereon according to an input signal according to a document. Optical carrier is generated in the written portion and neutralizes the surface charge (i.e., voltage decay). The amount of charge depending on the amount of optical carrier generated flows in the layer thickness direction of the image bearing member.

On the other hand, the portion not subject to the optical writing advances to an optical discharging process via a development process, a transfer process and an optional cleaning process. Typically, optical discharging system is used as a discharging device. When the surface potential (excluding the amount reduced by dark decay) of an image bearing member is approximately the same as the voltage charged by a main charging, approximately the same amount of charge as that in the portion subject to the optical writing flows in the layer thickness direction of the image bearing member by discharging. Considering that documents generally have a small image area, the current flowing in the discharging process is almost all the amount of the charge passing through an image bearing member during its repetitive use. For example, when the image area of a document is 10%, the current flowing in the discharging process is 90% of the total.

The amount of the charge passing through an image bearing member has a large effect on the electrostatic characteristics of the image bearing member such that the material forming the image bearing member deteriorates. As a result, especially, the residual voltage of the image bearing member increases depending on the amount of the charge passing therethrough. When the residual voltage thereof rises, the intensity of an electric field applied to the photosensitive layer of the image bearing member weakens. Consequently, as described above, the reciprocity failure of the image bearing member is notable. Therefore, abnormal images peculiar to multi-beam image irradiation for use in the present application tend to occur. Further, in the negative positive development for use in the present application, the density of an image decreases, which is a large problem. To obtain an image bearing member having a long life (good durability) in an image forming apparatus, there exists a problem of how the amount of the charge passing through an image bearing member is restrained.

To deal with the problem, there is an idea that the optical discharging is not performed. However, the charging is not stable when the charging device performing the main charging does not have a large capacity. When the charging is not stable, a problem such as a residual image tends to arise.

The charge passing through an image bearing member is generated when optical carriers generated in an image bearing member are transferred. These optical carriers are generated when the voltage applied to the surface of the image bearing member forms an electric field and light irradiation is performed thereon. Therefore, when the surface voltage of an image bearing member is decayed by a device other than light, the amount of the charge passing through an image bearing member per rotation of the image bearing member (i.e., a cycle of image formation) can be reduced. It is effective to control the amount of the charge passing through an image bearing member by controlling a transfer bias in a transfer process. That is, the portion charged by the main charging and not subject to writing advances to the transfer process with a voltage close to the charged voltage excluding the amount of dark decay.

When the voltage is reduced to a value not greater than 100 V in absolute value of the same polarity as that applied by the main charging device, optical carrier is hardly generated in the following discharging process. As a result, the charge passing through an image bearing member is not generated. The closer the value is to 0 V, the more preferred the value is.

In addition, it is preferred to control a transfer bias applied to have a polarity reverse to that applied by a main charging. Thereby, the optical carrier is not generated at all. However, when such a transfer bias is applied, transfer toner scattering may increase and the main charging to an image bearing member may not be performed in time for the next image formation process (cycle). This easily leads to a drawback such as a residual image. Therefore, the value in the case of the reverse polarity is preferred to be not greater than 100 V in absolute value.

Typical luminous materials and devices such as a fluorescent lamp, a tungsten lamp, a halogen lamp, a mercury lamp, a sodium lamp, a light emitting diode (LED), a semiconductor laser (LD), and electroluminescence (EL) can be used as a light source of a discharging lamp 2, etc. In addition, various kinds of filters such as a sharp cur filer, a band pass filter, a near infra red cut filter, a dichroic filter, a coherent filter, and a color conversion filter can be used to irradiate an image bearing member with light only having a desired wavelength.

Such a light source irradiates an image bearing member with light in a transfer process, a discharging process, or a cleaning process combinationally used with light irradiation or a pre-irradiation process other than the process illustrated in FIG. 5.

In the charging systems mentioned above, it is possible to omit this discharging mechanism when AC component is overlapped or when the residual voltage of an image bearing member is small. In addition, other than an optical discharging, it is also possible to use electrostatic discharging mechanism (for example, having a discharging brush to which a reverse bias is applied or which is grounded). As described above, optical discharging system has a large effect in the case of a document having a small image area. Therefore, it is preferred to dispense with optical discharging as long as changing or eliminating an optical discharging process does not cause a problem such as a residual image.

In FIG. 5, 9 represents a registration roller, 12 represents a separation device, and 13 represents a pre-cleaning charging device.

In addition, the toner developed on the image bearing member 1 by the developing unit 6 is transferred to a transfer medium 7. The toner remaining on the image bearing member 1 is removed by a cleaning brush 14 and a cleaning blade 15. cleaning may be performed only by the cleaning brush 14. Any cleaning device such as a fur brush and a magnetic fur brush can be used as the cleaning device 14.

Figure 6:
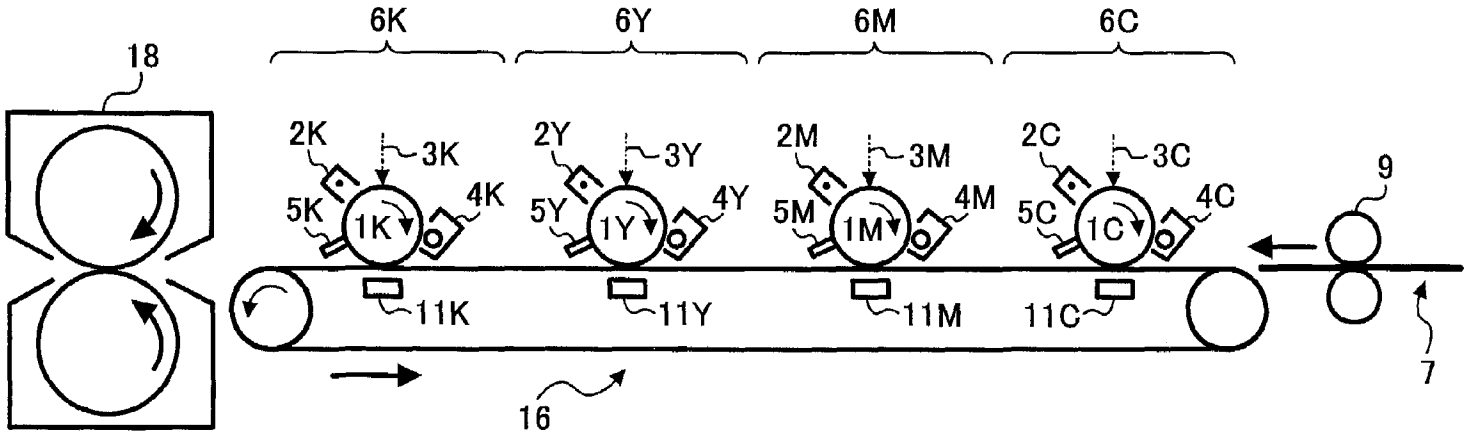
FIG. 6 is a schematic diagram illustrating an example of the type full color image forming apparatus taking a tandem system of the present application.

FIG. 6 is a schematic diagram illustrating an example of a full color image forming apparatus taking a tandem system of the present application. The variations described later are also within the scope of the present application.

In FIG. 6, reference numerals 1C, 1M, 1Y and 1K represent an image bearing member having a drum form formed of an electrostatic substrate on which at least a charge blocking layer, a moiré prevention layer and a photosensitive layer are provided. The photosensitive layer contains titanyl phthalocyanine crystal having an average primary particle diameter of not greater than 0.25 μm. The titanyl phthalocyanine crystal having a crystal form having a CuKα X ray diffraction spectrum ray having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.4°±0.2° and 7.3°±0.2° and having no peak at 26.3±0.2°.

These image bearing members 1C, 1M, 1Y and 1K rotate at a speed of at least 300 mm/sec in the direction indicated by the arrow in FIG. 6. There are disposed charging devices 2C, 2M, 2Y and 2K taking a scorotron system, developing devices 4C, 4M, 4Y and 4K, cleaning devices 5C, 5M, 5Y and 5K around the image bearing members 1C, 1M, 1Y and 1K in the rotation direction thereof. A light source (not shown) having a multi-beam writing head having 4 semiconductor laser diode elements (not shown) arranged in the secondary scanning direction of the image bearing members 1C, 1M, 1Y and 1K emits oscillated multiple laser beams 3C, 3M, 3Y and 3K. With the beams, the light source irradiates the image bearing members 1C, 1M, 1Y and 1K from the surface thereof between the charging devices 2C, 2M, 2Y and 2K and the developing devices 4C, 4M, 4Y and 4K to form latent electrostatic images on the image bearing members 1C, 1M, 1Y and 1K. Four image forming elements 6C, 6M, 6Y and 6K including the image bearing members 1C, 1M, 1Y and 1K as their central device are arranged along a transfer belt 16 functioning as a device to convey a transfer medium. The transfer belt 16 is in contact with the image bearing members 1C, 1M, 1Y and 1K between the developing devices 4C, 4M, 4Y and 4K and the cleaning devices 5C, 5M, 5Y and 5K of the respective image forming elements 6C, 6M, 6Y and 6K. On the back side of the side of the image bearing member 1C, 1M, 1Y and 1K of the transfer belt 16, transfer brushes 11C, 11M, 11Y and 11K to apply a transfer bias are disposed. The image forming elements 6C, 6M, 6Y and 6K are the same in structure and the difference thereamong is the color of the toner contained therein.

The full color image forming apparatus having a structure illustrated in FIG. 6 performs the image forming operation as follows: the image bearing members 1C, 1M, 1Y and 1K in the image forming elements 6C, 6M, 6Y and 6K rotate at a speed of at least 300 mm/sec in the direction indicated by the arrow; the charging devices 2C, 2M, 2Y and 2K taking a scorotron system charge the image bearing members 1C, 1M, 1Y and 1K in order that the intensity of an electric field of the image bearing members 1C, 1M, 1Y and 1K is from 30 to 60 V/μm and preferably to 50 V/μm; laser beams 3C, 3M, 3Y and 3K each of which has multiple oscillated laser beams emitted from the light source having a multi-beam writing head having 4 semiconductor laser diode elements (not shown) arranged in the secondary scanning direction of the image bearing members 1C, 1M, 1Y and 1K perform writing on the image bearing members 1C, 1M, 1Y and 1K with a definition of at least 600 dpi to form latent electrostatic images according to each color image information; the developing devices 4C, 4M, 4Y and 4K, which perform development with a color toner of cyan (C), magenta (M), yellow (Y) and black (K), develop the latent electrostatic images to form color toner images on the image bearing members 1C, 1M, 1Y and 1K; a transfer medium 7 is sent out from a tray by feeding rollers, temporarily stopped at the registration roller 9, and transferred to the transfer belt 16, where the transfer medium 7 is temporarily stopped, and further transferred to the contacting place (image transfer portion) with the image bearing members 1C, 1M, 1Y and 1K in synchronization with the timing of image formation on the image bearing members 1C, 1M, 1Y and 1K; each color toner image formed thereon is transferred to and overlapped on the transfer medium 7 by the potential difference between the transfer biases applied to the transfer brushes 11C, 1M, 11Y and 11K and the voltage applied to the image bearing members 1C, 1M, 1Y and 1K; the transfer medium 7 on which the four color toner images are overlapped while passing through the four transfer portions is transferred to a fixing device 18, where the overlapped image is fixed; and the transfer medium 7 is discharged to a discharging portion (not shown). In addition, the toner remaining on each image bearing member 1C, 1M, 1Y and 1K without being transferred at the transfer portions is retrieved at the cleaning devices 5C, 5M, 5Y and 5K. In the example illustrated in FIG. 6, the image formation elements are arranged in the sequence of cyan (C), magenta (M), yellow (Y) and black (K) from the upstream side to the downstream side relative to the direction of the transfer direction of the transfer medium 7 but the arrangement sequence is not limited thereto. That is, the color sequence can be arranged in an arbitrary manner. Further, it is especially effective for the present application to provide a mechanism in which the image formation elements 6C, 6M and 6Y other than 6K are set to be not in operation while forming a black color image of a document.

As described above, the rise in the residual voltage during repetitive use of an image bearing member can be effectively reduced by limiting the voltage of the surface of the image bearing member within 100 V on the same polarity as the main charging, preferably on the reverse polarity thereto and more preferably 100 V on the reverse polarity.

The image forming apparatus mentioned above can be built in a photocopier, a facsimile machine and a printer. Also, each electrophotographic element can be set in these machines as a form of a process cartridge. The process cartridge is a device including an image bearing member and other devices such as a charging device, an irradiating device, a transfer device, a cleaning device and a discharging device.

Such a process cartridge can take a variety of forms. A typical example thereof is the form illustrated in FIG. 7. An image bearing member 101 therein has an electrostatic substrate on which at least a charge blocking layer, a moiré prevention layer and a photosensitive layer are provided. The photosensitive layer contains titanyl phthalocyanine crystal having an average primary particle diameter of not greater than 0.25 μm. The titanyl phthalocyanine crystal having a crystal form having CuKα X ray diffraction spectrum having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.4°±0.2° and 7.3°±0.2° and no peak at 26.3±0.2°.

Figure 7:
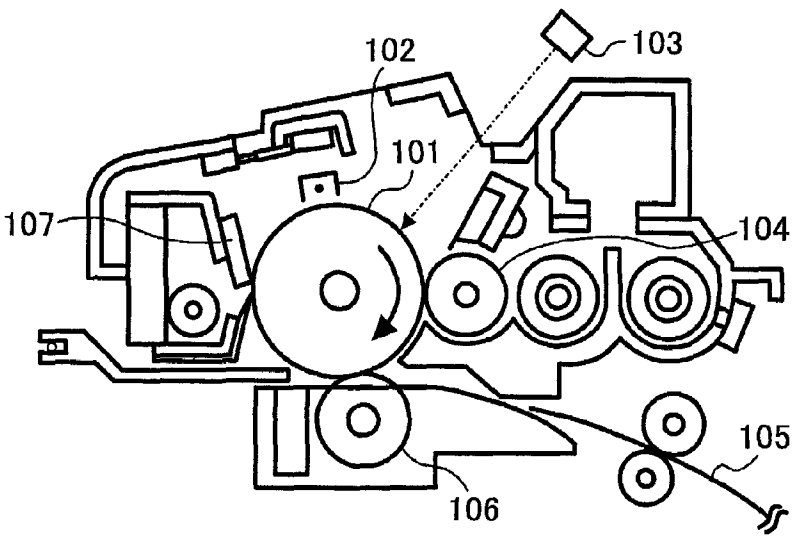
FIG. 7 is a diagram illustrating an example of the process cartridge for use in the image forming apparatus of the present application.

An image irradiating device 103 includes a light source having a multiple laser beam writing head in which multiple semiconductor laser diode (LD) elements are arranged in the secondary scanning direction of an image bearing member. A charging device 102 has a charging member taking a scorotron system as described above and applies to the image bearing member 101 an intensity of an electric field of from 20 to 60 V/μm and preferably from 30 to 50 V/μm. In FIG. 7, 104 represents a developing device, 105 represents a transfer body, 106 represents a transfer device and 107 represents a cleaning device.

The image bearing member for use in the image forming apparatus of the present application is now described in detail.

The image bearing member contains titanyl phthalocyanine crystal having an average primary particle diameter of not greater than 0.25 μm. The titanyl phthalocyanine crystal having a crystal form having CuKα X ray diffraction spectrum having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.4°±0.2° and 7.3°±0.2° and no peak at 26.3±0.2°.

This crystal type is described in JOP 2001-19871. By using this titanyl phthalocyanine crystal, such a stable electrophotographic image bearing member can be obtained that the chargeability and the sensitivity thereof do not deteriorate for repetitive use. JOP 2001-19871 describes a charge generating material having the same crystal type as that of the present application and an image bearing member and an image forming apparatus using the charge generating material. However, when an image bearing member is used for an extremely extended period of time under the condition of a high definition such as at least 600 or 1,200 dpi, the image bearing member causes background fouling. That is, the charge generating material determines the life of an image bearing member. This background fouling is significantly observed when an image bearing member containing the charge generating material is used in an image forming apparatus having a relatively high processing speed in comparison with the image forming apparatus described in JOP 2001-19871. As a result of an intensive study of this phenomenon, it is found that this phenomenon can be controlled by controlling the particle size of the titanyl phthalocyanine. The image bearing member described in JOP 2001-19871 has not fully tapped the potential of the charge generating material.

In addition, there is no description or controlling technologies on the particle size of the titanyl phthalocyanine in JOP 2001-19871. Therefore, the titanyl phthalocyanine used is not optimized in terms of the particle size. In the present application, an image bearing member contains titanyl phthalocyanine having a specific crystal form with its particle size controlled. Further, the image bearing member has a suitable intermediate layer having an accumulation structure formed of a charge blocking layer and a moiré prevention layer. Furthermore, the processing conditions in an image forming apparatus having such an image bearing member are optimized to obtain a suitable image forming apparatus.

Structuring such an intermediate layer having an accumulation structure formed of a charge blocking layer and a moiré prevention layer in this order between an electric substrate and a photosensitive layer is a technology described in JOP H05-100461, etc. However, in a combinational use of such an intermediate layer with a photosensitive layer having a high sensitivity, heat carrier generated in the photosensitive layer has a large effect on background fouling. This tendency is a significant peculiar problem to a charge generating material having absorption in a long wavelength, for example, the titanyl phthalocyanine crystal for use in the present application.

Both technologies are still unfinished. Therefore, an image bearing member having a photosensitive layer formed of titanyl phthalocyanine crystal having the specific crystal form as mentioned above and an intermediate layer having an accumulation structure formed of a charge blocking layer and a moiré prevention layer in this order can have a high sensitivity and electrostatic stability. However, such an image bearing member is not satisfying in terms of improvement on anti-background fouling and prevention of insulation breakdown, which are the objects of the present application.

As described above, there are proposed methods of restraining background fouling using a charge generating layer and an undercoating layer. However, the background fouling is caused by multiple factors. Therefore, it is impossible to obtain an image bearing member achieving the objects without restraining these factors simultaneously under the conditions of repetitive uses for an extended period of time. These problem causing factors may be extremely trivial and ignorable in the initial stage. But as an image bearing member is fatigued during repetitive use and the deterioration of the materials forming the image bearing member is heavy, these factors greatly grow. Therefore, it is preferred to eliminate the causes of background fouling as much as possible and to improve the durability of an image bearing member against fatigue caused during repetitive use. However, a method of solving these factors at the same time and drastically improving the durability has not been described.

The technology of controlling the particle size of the titanyl phthalocyanine crystal having the specific crystal form mentioned above is further combined in the present application. Thereby, it is found that the background fouling caused by multiple factors can be restrained and the chargeability can be maintained over time. Further, side effects to residual voltage and environmental dependency can be minimized so that the stability is maintained for repetitive use. The method of limiting the particle size of the titanyl phthalocyanine within 0.25 μm is described later.

In addition, JOP H06-293769 describes a method of synthesizing a titanyl phthalocyanine crystal in which a halogenated titanium is not used as a material for synthesis. This method is desired. The merit thereof is that the synthesized titanyl phthalocyanine crystal is free from halogenation. When titanyl phthalocyanine crystal contains a halogenated titanyl phthalocyanine crystal as an impurity, such a titanyl phthalocyanine may have an adverse effect on electrostatic characteristics such as photosensitivity and chargeability of an image bearing member (for example, refer to "Japan Hardcopy, 1989 collections of articles, P103, published in 1989). Halogenation free titanyl phthalocyanine crystal is a suitable titanyl phthalocyanine of the present application. For example, JOP 2001-19871 describes an example thereof.

To synthesize a titanyl phthalocyanine crystal free from halogenation, a halogenated material is not used as a raw material of titanyl phthalocyanine synthesization. Specific methods of synthesizing such a titanyl phthalocyanine crystal free from halogenation are described later.

The method of synthesizing the titanyl phthalocyanine having the specific crystal form for use in the present application is described.

First, the method of coarsely synthesizing a titanyl phthalocyanine crystal is described. The methods of synthesizing a titanyl phthalocyanine crystal are well known for a long time as described in, for example, JOP H06-293769 and "Phthalocyanine compounds" and "The phthalocyanines" authored by Moser, etc, and published in 1963 and 1983, respectively.

There is a first method in which a mixture of phthalic anhydride, a metal or a halogenated metal and urea is heated under the optional presence of a solvent having a high boiling point. A catalyst such as ammonium molybdenum acid is used in combination if desired. There is a second method in which the mixture of a phtahlonitrile and a halogenated metal is heated under the optional presence of a solvent having a high boiling point. This method is used to prepare phthalocyanines which are not prepared by the first method. Specific examples thereof include aluminum phthalocyanines, indium phthalocyanines, oxovanadium phthalocyanine, oxotitanium phthalocyanines and zirconium phthalocyanines. There is a third method in which phthalic anhydride or a phthalonitrile and ammonium are reacted first to produce an intermediary body such as 1,3-diiminoisoindoline which is then reacted with a halogenated metal in a solvent having a high boiling point. A fourth method is that a phthalonitrile and a metal alcoxide are reacted under the presence of urea. Among these, the fourth method is extremely useful as a method of synthesizing an electrophotographic material because chlorization (halogenation) of a benzene ring does not occur. Therefore, this method is also extremely suitable for the present application.

Next, a method of synthesizing titanyl phthalocyanine having an amorphous form (titanyl phthalocyanine having low crystalline property) is described. In this method, a phthalocyanine is dissolved in sulfuric acid and then diluted with water for re-precipitation. Specific examples of the methods include methods referred to as an acid paste method or an acid slurry method.

Specifically, the coarsely synthesized compound obtained in the manner mentioned above is dissolved in sulfuric acid. The ratio of the compound to the sulfuric acid is 10 to 50. Undissolved material is removed by, for example, filtration, if desired. The solution is slowly put into sufficiently cooled water or iced water having an amount of 10 to 50 times as much as that of the sulfuric acid to re-precipitate titanyl phthalocyanine. Subsequent to filtration of the precipitated phthalocyanine, the titanyl phthalocyanine is washed with deionized water and filtrated. Washing and filtration are fully repeated until the filtrated liquid shows neutrality. The last time washing and filtration are performed with clean deionized water to obtain a water paste having a solid portion density of from about 5 to about 15 weight %.

It is important to sufficiently wash titanyl phthalocyanine with deionized water to remove the strong sulfuric acid as much as possible. To be specific, it is preferred that the deionized water after washing shows the following physicality. That is, to quantitatively representing the remaining amount of the sulfuric acid, pH or the specific electric conductivity of the deionized water can be used. When the physicality is represented by pH, it is preferred to have a PH of from 6 to 8. In this range, it can be determined that the remaining amount of the sulfuric acid does not have an affect on the characteristics of an image bearing member formed of the titanyl phhtalocyanine. The value of Ph can be easily measured by a marketed pH meter. When the physicality is represented by specific electric conductivity, the specific electric conductivity is preferably not greater than 8 μS/cm, more preferably not greater than 5 μS/cm, and furthermore preferably 3 μS/cm. In this range, it can be determined that the remaining amount of the sulfuric acid does not have an effect on the characteristics of an image bearing member formed of the titanyl phhtalocyanine. The value of the specific electric conductivity can be easily measured by a marketed specific electric conductivity meter. The lowest limit of the specific electric conductivity is the specific electric conductivity of the deionized water for use in washing. In either measurement, when the result is in a range outside the range mentioned above, the amount of the remaining sulfuric acid is too large, resulting in decrease of the chargeability of an image bearing member and deterioration of the photosensitivity thereof, which is not preferred.

The thus obtained compound is the titanyl phthalocyanine having an amorphous form (titanyl phthalocyanine having low crystalline property) for use in the present application. The titanyl phthalocyanine having an amorphous form (titanyl phthalocyanine having low crystalline property) preferably has a CuKα X ray diffraction spectrum having a wavelength of 1.542 Å such that the maximum diffraction peak (±0.2°) is observed at a Bragg (2θ) angle of from 7.0 to 7.5°. Especially, the half value width of the diffraction peak is preferably not less than 1°. Further, the titanyl phthalocyanine preferably has a primary particle size of not greater than 0.1 μm.

Next, the method of crystal conversion is described.

The crystal conversion is a process in which the titanyl phthalocyanine having an amorphous form (titanyl phthalocyanine having low crystalline property) is converted into a titanyl phthalocyanine crystal having a crystal form having a CuKα X ray diffraction spectrum having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.40±0.2° and 7.30±0.2° and no peak at 26.3±0.2°.

A specific method thereof is that the titanyl phthalocyanine having an amorphous form (titanyl phthalocyanine having low crystalline property) is mixed and stirred with an organic solvent under the presence of water without drying to obtain the crystal form mentioned above.

Any organic solvent can be used as long as a desired crystal forms is obtained. Among these, one of tetrahydrofuran, toluene, methylene chloride, carbon disulfide, orthodichlorobenzene, and 1,1,2-trichloroethane is preferably selected to obtain a good result. These organic solvents can be preferably used singly but can be used in combination or mixed with another solvent. The content by weight of the organic solvent for use in crystal conversion is at least 10 times that of the titanyl phthalocyanine having an amorphous form (titanyl phthalocyanine having low crystalline property) and preferably at least 30 times. This is desired to rapidly and sufficiently perform crystal conversion and sufficiently remove impurities contained in the titanyl phthalocyanine having an amorphous form (titanyl phthalocyanine having low crystalline property). The titanyl phthalocyanine having an amorphous form (titanyl phthalocyanine having low crystalline property) used here is prepared by an acid paste method. As described above, it is preferred to use the titanyl phthalocyanine which has been sufficiently washed to remove sulfuric acid. When crystal conversion is performed under the condition in which sulfuric acid undesirably remains, sulfuric acid ion remains in the crystalline particles and cannot be completely removed from the obtained crystal by a treatment such as water-washing. Sulfuric acid remaining in the obtained crystal particle causes reduction of the sensitivity and the chargeability of an image bearing member, which is not preferred. For example, JOP H08-110649 describes a method of crystal conversion in its comparative example in which titanyl phthalocyanine dissolved in sulfuric acid is put in an organic solvent together with deionized water. The titanyl phthalocyanine obtained by this method is close to the titanyl phthalocyanine obtained in the present application in terms of X ray diffraction spectrum. However, the density of the sulfuric acid ion in the titanyl phthalocyanine obtained by the method is high, resulting in an image bearing member having a poor dark decay property (photosensitivity). Therefore, the titanyl phthalocyanine obtained by this method is not suitable as the titanyl phthalocyanine for use in the present application due to the reason described above. The crystal conversion method described above is according to JOP 2001-19871.

The particle size of the titanyl phthtalocyanine crystal contained in the image bearing member of the present application as the charge generating material is reduced. Therefore, the background fouling prevention effect increases, which is effective to improve the image stability and the elongation of the life of the image bearing member. Below is the description of the method of manufacturing titanyl phthalocyanine having a small particle size.

There are two main methods of controlling the particle size of titanyl phthalocaynine crystal contained in a photosensitive layer. One is a method in which crystal particulates having a particle diameter of not greater than 0.25 μm are synthesized when titanyl phthalocyanine crystal particles are synthesized. The other is that coarse particles having a particle diameter greater than 0.25 μm are removed after titanyl phthalocyanine crystal is dispersed. It is effective to use both methods in combination.

A method of synthesizing titanyl phthalocyanine crystal particulates is described.

Figure 8:
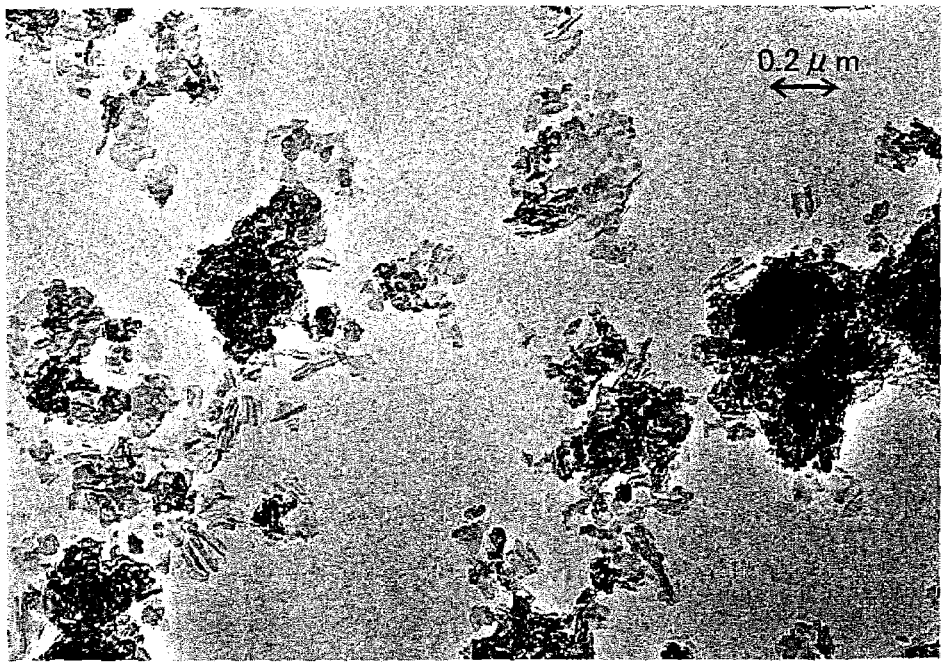
FIG. 8 is a photograph of the transmission electron microscope (TEM) image with a scale bar of 2 μm of titanyl phtalocyanine having an amorphous form.

According to the observation by the inventors of the present application, it is found that titanyl phthalocyanine having an amorphous form (titanyl phthalocyanine having low crystalline property) mostly has a primary particle diameter not greater than 0.1 μm (most of which is from about 0.01 to about 0.05 μm (refer to FIG. 8) but the crystal is converted while the crystal grows. In this type of crystal conversion, typically, the time to be taken to perform crystal conversion is sufficiently secured to prevent a raw material from remaining. After the crystal conversion is fully performed, the resultant is filtrated to obtain a titanyl phthalocyanine crystal having a desired crystal type. Therefore, although a raw material having a sufficiently small particle diameter is used, the crystal obtained after crystal conversion has a large particle diameter (about from 0.3 to 0.5 μm) (refer to FIG. 9). The scales in FIGS. 8 and 9 are both 0.2 μm.

Figure 9:
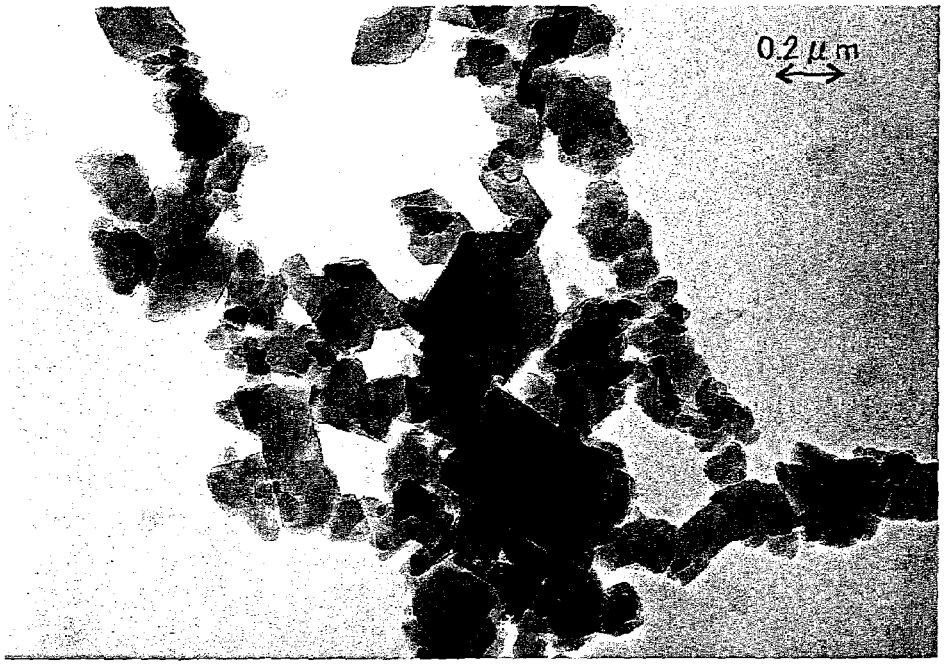
FIG. 9 is a photograph of the transmission electron microscope (TEM) image with a scale bar of 2 μm of titanyl phtalocyanine after crystal conversion.

When the titanyl phthalocyanine crystal illustrated in FIG. 9 is dispersed, a strong shearing force is imparted to obtain a crystal having a small particle diameter (not greater than 0.25 μm) after dispersion. Further, a strong energy is imparted to pulverize a primary particle for dispersion if desired. As a result, as described above, there is a possibility that the crystal is transferred to a crystal having an undesired particle diameter.

This problem can be solved by a method in which the primary particle size of titanyl phthalocyanine crystal is controlled at the synthesized stage to obtain a crystal having a small particle diameter. This is effective in the present application. In a specific method, titanyl pththalocyanine crystal having a small primary particle size is obtained by nailing down when the crystal conversion is complete, i.e., when the particle size is in the range where crystal growth has hardly occurred. The range is that the size of titanyl phthalocyanine having an amorphous form observed in FIG. 8 is kept after crystal conversion, i.e., about 0.25 μm. The size of the particle after crystal conversion increases in proportion according to the time taken for crystal conversion. Therefore, as described above, it is desired to improve the efficiency of crystal conversion and complete the crystal conversion in a short time. To achieve this, there are points to be mentioned.

One is to select a suitable organic solvent as described above to improve the efficiency of crystal conversion. The other is to violently stir the solvent and titanyl phthalocyanine water paste manufactured from titanyl phthapcyanine having an amorphous form as described above to sufficiently contact each other and to complete crystal conversion in a short time. Specifically, a device having a propeller having a violent stirring (dispersion) force, or a stirring (dispersion) device such as a homogenizer (HOMOMIXER), etc. is used to complete crystal conversion in a short time. Under these conditions, crystal can be sufficiently converted to titanyl phthapcyanine crystal in a state in which crystal growth does not occur. The optimization of the amount of an organic solvent for use in crystal conversion is effective again. The desired amount of an organic solvent is at least 10 times and preferably at least 30 times based on the solid portion of titanyl phthapcyanine having an amorphous form. Thereby, crystal conversion can be securely completed in a short time and the contaminants contained in the titanyl phthapcyanine having an amorphous form can be also securely removed.

In addition, since the crystal particle size is in proportion to the crystal conversion time as described above, it is effective to stop the reaction immediately when the target reaction (crystal conversion) is complete. To stop the reaction, for example, a solvent in which crystal conversion can hardly occur is added in a large amount immediately after the crystal conversion. Specific examples of such solvents include an alcohol based solvent and an ester based solvent. It is possible to stop crystal conversion by adding such a solvent in an amount about 10 times as much as the solvent for use in crystal conversion.

The smaller the size of the thus obtained primary particle is, the better the result is to the issues involved in an image bearing member. However, considering the next process, which is the process of preparing a dye (filtration process), and dispersion stability of a dispersion liquid, too small a primary particle size causes a side effect. Namely, an extremely long time is necessary to filtrate too small a primary particle size in the filtration process. In addition, when a primary particle size is too small, a dye particle in a dispersion liquid has a large superficial area. Such dye particles easily re-agglomerate. Therefore, the suitable particle size of a dye particle is from about 0.05 to about 0.2 μm.

Figure 10:
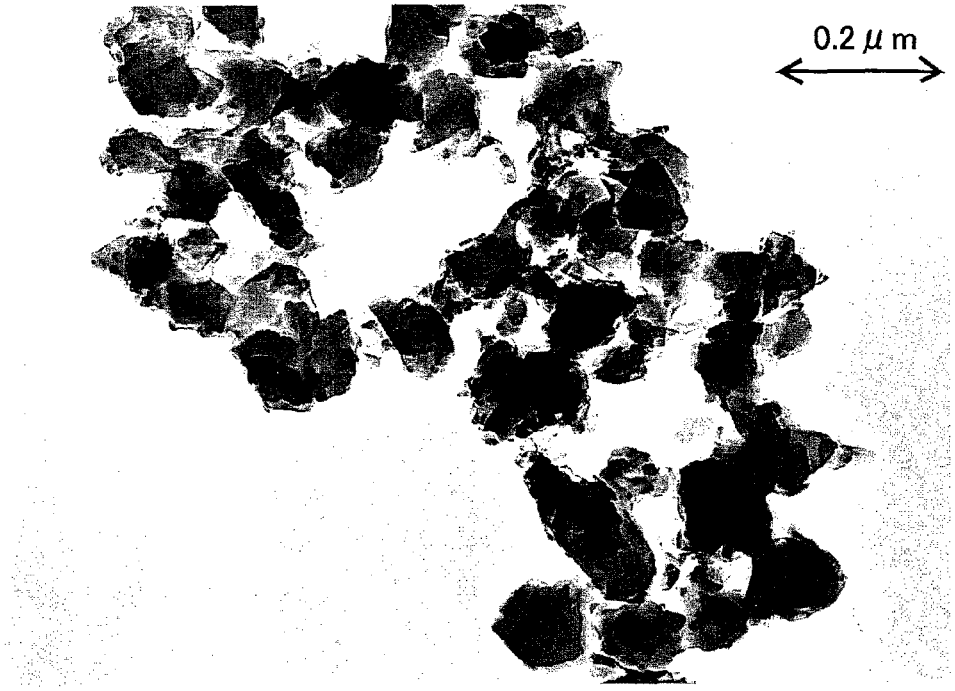
FIG. 10 is a photograph of the transmission electron microscope (TEM) image with a scale bar of 2 μm of titanyl phtalocyanine crystal-converted in a short time.

FIG. 10 is a transmission electron microscope (TEM) image illustrating a titanyl phthtlaocyanine crystal when crystal conversion is performed in a short time. The scale in FIG. 10 is 0.2 μm. Different from the image illustrated in FIG. 9, there is no coarse particle observed in FIG. 10 and the particle sizes therein are small and almost uniform.

When the titanyl phthalocyanine crystals having a small primary particle size as illustrated in FIG. 10 are dispersed, it is desired that a shearing force is imparted to break a secondary particle formed by agglomeration of the primary particles to obtain a particle having a small size, i.e., not greater than 0.25 μm and preferably not greater than 0.2 μm. As a result, since unnecessary energy is not provided, different from the result described above, the particle obtained hardly has an undesired crystal type. Therefore, it is possible to easily prepare a dispersion liquid having a sharp particle distribution.

The particle size mentioned above is the volume average particle size which is obtained using an ultracentrifugal automatic particle size measuring device (CAPA-700, manufactured by Horiba Ltd.). The volume average particle size calculated is the median radius (corresponding to 50% of cumulative distribution). However, since this method has a possibility that a minute quantity of coarse particles is not detected, it is desired to directly observe crystal powder or dispersion liquid of titanyl phthalocyanine with an electron microscope to obtain the exact size thereof.

As a result of a study on the minute defect based on further observation of the dispersion liquid, the phenomenon is recognized as follows. In a typical method of measuring an average particle size, when particles having an extremely large size are present in an amount of not less than a few %, these particles can be detected. But the measuring device cannot detect large particles present in a small amount, for example, about less than 1% based on the total amount. Consequently, such large particles cannot be detected by simply measuring an average particle size, which makes understanding the minute defect mentioned above difficult.

Figure 11:
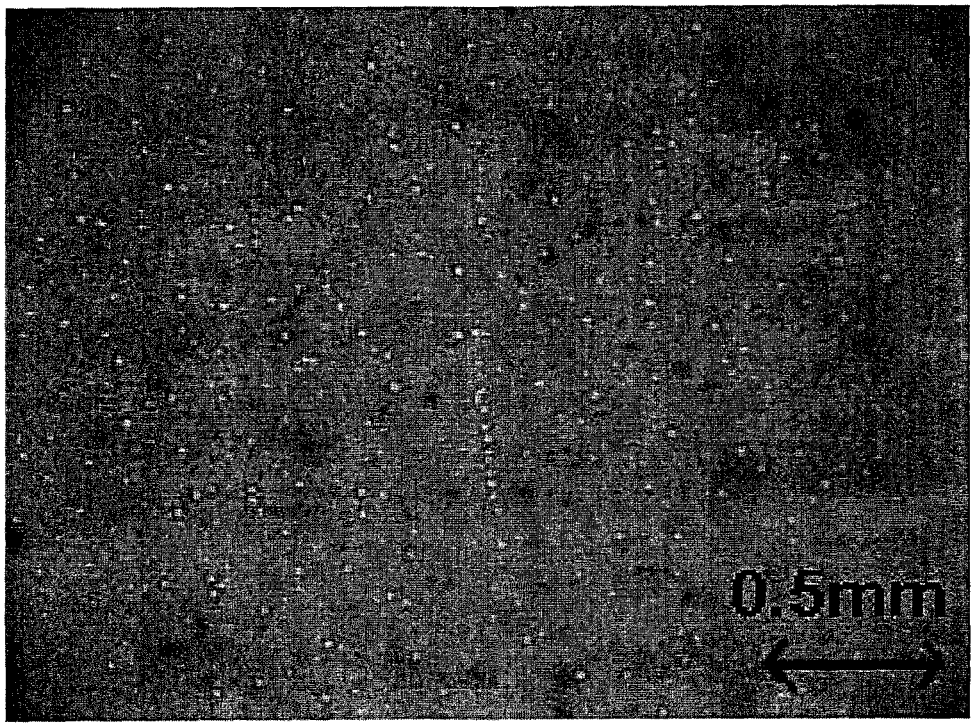
FIG. 11 is a diagram illustrating the state of a dispersion liquid dispersed in a short time.
Figure 12:
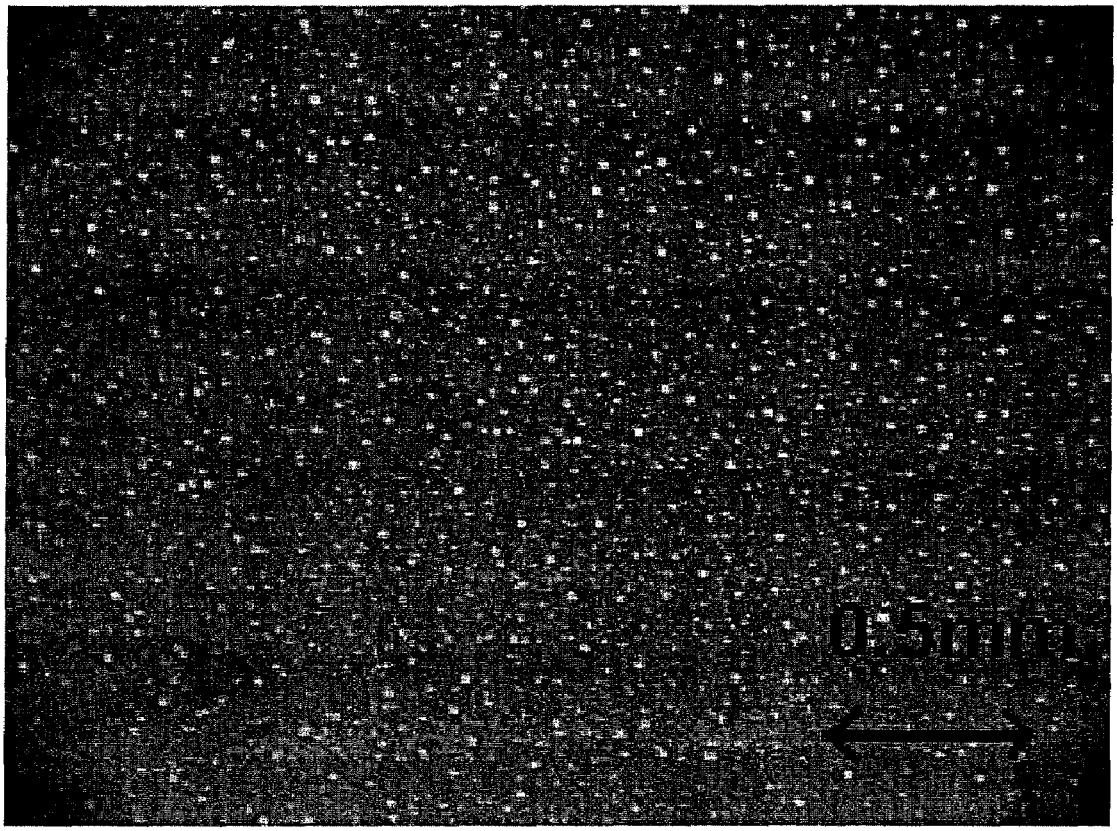
FIG. 12 is a diagram illustrating the state of a dispersion liquid dispersed in a long time.

FIGS. 11 and 12 are photographs illustrating the states of two kinds of dispersion liquid formed under the same dispersion conditions except for the dispersion time. FIG. 11 is a photograph of dispersion liquid formed in a short dispersion time. Black particles, which are remaining coarse particles, are observed in the photograph of FIG. 11 as compared with the photograph of dispersion liquid of FIG. 12 which is formed in a relatively long dispersion time.

Figure 13:
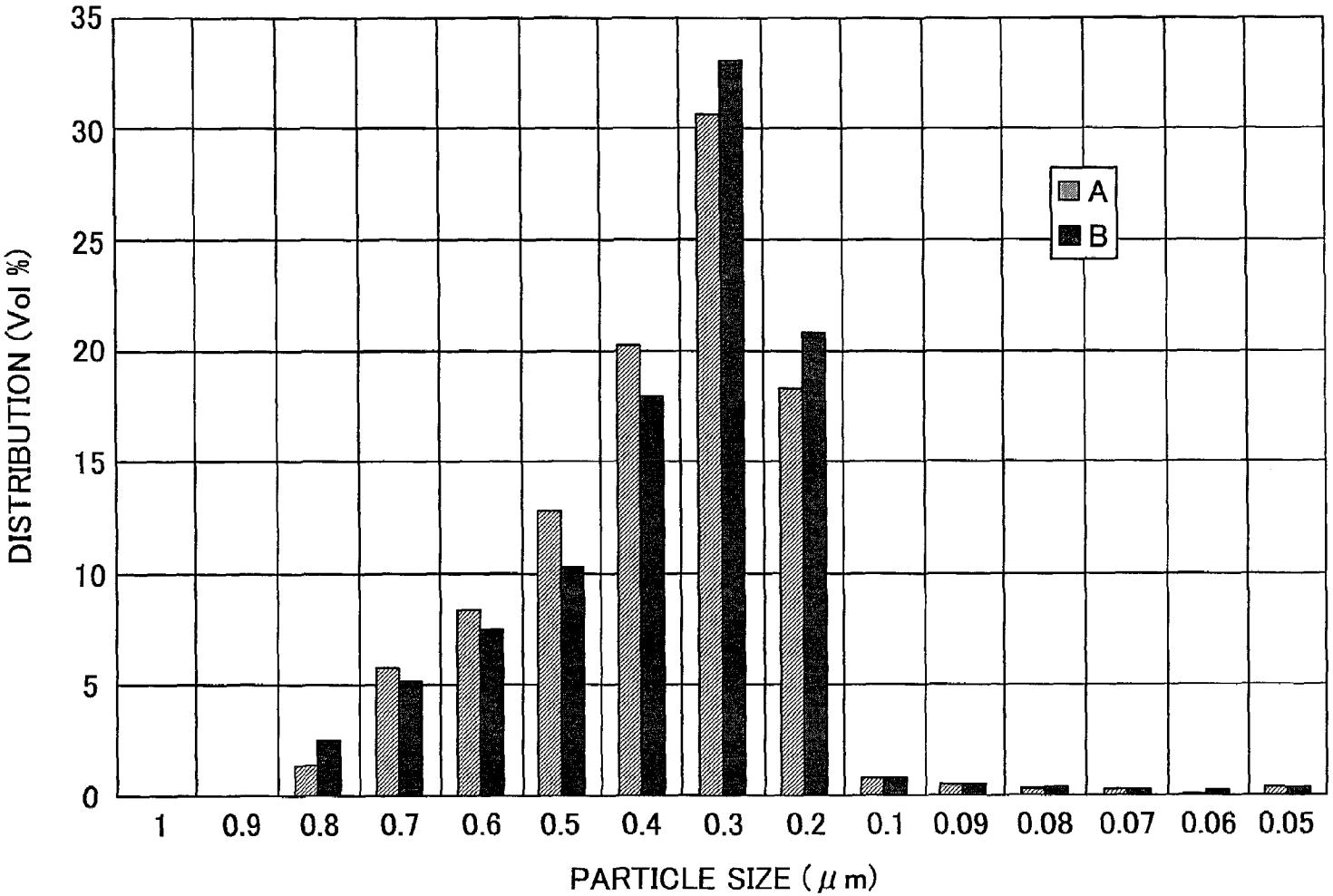
FIG. 13 is a diagram illustrating the average particle diameter and the particle size distribution with regard to the dispersion liquids of FIGS. 12 and 13.

The average particle diameter and the particle size distribution of these two kinds of distribution liquid are measured by a known method using a marketed ultracentrifugal automatic particle size measuring device (CAPA-700, manufactured by Horiba Ltd.). The results are shown in FIG. 13. A in FIG. 13 corresponds to these particle diameter and the particle size of the dispersion liquid of FIG. 11 and B in FIG. 13 corresponding to these particle diameter and the particle size of the dispersion liquid of FIG. 12. When both are compared, there is actually no difference with regard to the particle size distribution. The average particle diameters of A and B are 0.29 μm and 0.28 μm, respectively. Considering the measuring error, it is difficult to determine that there is a difference between A and B.

Therefore, it is impossible to detect a minute quantity of large particles remaining in dispersion liquid by a known method of measuring an average particle size. Therefore, it is difficult to clear the relationship between the particle size and background fouling. Such large particles existing in a minute quantity are clearly recognized only when the liquid of application is observed with a microscope.

As seen in the results, it is found that violent stirring by which a solvent and the titanyl phthalocyanine water paste prepared as described above fully contact each other is effective to complete crystal conversion in a short time while improving the efficiency of crystal conversion by a suitable crystal conversion solvent selected as described above to make the primary particle prepared during the crystal conversion as small as possible.

By adopting such a crystal conversion method, titanyl phthalocyanine crystal having a small primary particle diameter, i.e., not greater than 0.25 μm and preferably not greater than 0.2 μm, can be obtained. In addition to the technology described in JOP 2001-19871, it is effective to use the technologies mentioned above (crystal conversion method of obtaining minute titanyl phthalocyanine crystal) in combination therewith to improve the effect of the present application.

Sequentially, titanyl phthalocyanine crystal complete with crystal conversion is separated from the crystal conversion solvent by filtration performed immediately after the crystal conversion. A suitably sized filter is used for the filtration. It is desired to perform the filtration with a reduced pressure.

Thereafter, the separated titanyl phthalocyanine crystal is heated and dried if desired. Any known drying device for heating and drying can be used. An air blasting type dryer is preferably used in atmosphere. Further, it is extremely effective to dry the crystal under a reduced pressure to fully exercise the effect of the present application. Especially, this is extremely effective to a material decomposed or changing its crystal form at a high temperature. Further, it is especially effective to perform drying at a high vacuum degree greater than 10 mmHg.

The thus obtained titanyl phthalocyanine crystal having a specific crystal form is extremely suitable as a charge generating material forming an electrophotographic image bearing member. However, this specific crystal form has a drawback in that the crystal form is not stable as described above, i.e., the specific crystal form is easily transferred during forming dispersion liquid. However, when a primary particle has a small size as in the present application, it is possible to prepare dispersion liquid in which the average particle size of the particles dispersed is small without an excessive shearing force provided during preparing the dispersion liquid. In addition, the crystal form can be stably manufactured without changing the synthesized crystal form.

Next, the method of preparing dispersion liquid is described.

Dispersion liquid can be prepared by a known method. The titanyl phthalocyanine crystal and an optional binder resin are dispersed in a suitable solvent with a ball mill, an attritor, a sand mill, a bead mill or supersonic. Such a binder resin can be selected based on the electrostatic characteristics of an image bearing member and such a solvent can be selected based on wettability to a dye and dispersability thereof.

Next, a method of removing a particle having a particle size not less than 0.25 μm after dispersing titanyl phthalocyanine having a specific crystal form is described.

As described above, it is well known that the titanyl phthalocyanine crystal having a crystal form having a CuKα X ray diffraction spectrum having a wavelength of 1.542 Å such that at least the maximum diffraction peak is observed at a Bragg (2θ) angle of 27.2±0.2° is easily transferred to another crystal form under a stress such as thermal energy and mechanical shearing. This is true to the titanyl phthalocyanine crystal for use in the present application. That is, it is desired to devise a dispersion method to prepare dispersion liquid containing minute particles. But the stability of a crystal form and the size reduction of the particles tend to have a trade-off relationship. It is possible to avoid the trade-off relationship by optimizing the dispersion condition. But such optimization extremely limits the preparation conditions. Therefore, an easy method is desired. To solve this problem, the following method is effective.

The method is that, after preparing a dispersion liquid in which particles have a possible small size within the range in which crystal conversion does not occur, the dispersion liquid is filtrated with a suitable filter. In this method, it is possible to remove large particles present in a minute amount which cannot be observed or detected by particle size measurement. In addition, the method is also extremely effective in light of obtaining a sharp particle size distribution. Specifically, the dispersion liquid prepared as described above is subject to filtration with a filter having an effective mesh size of not greater than 3 μm and preferably not greater than 1 μm. Dispersion liquid containing only titanyl phthalocyanine crystal having a small particles size, i.e., not greater than 0.25 μm and preferably not greater than 0.2 μm, can be prepared by this method. When an image bearing member formed of this titanyl phthalocyanine is installed in an image forming apparatus, safety margin to background fouling is heightened, which is effective to improve the durability of the image bearing member.

Selection of the filters filtrating dispersion liquid depends on the size of coarse particles to be removed. According to the study by the applicants of the present application, it is found that a particle having a size of about 3 μm existing in an image bearing member for use in an image forming apparatus performing image formation with a definition of about 600 dpi has an adverse effect on images. Therefore, a filter used preferably has an effective mesh size less than 3 μm and more preferably less than 1 μm. When such filtration is performed, coarse particles smaller than the effective mesh size can be removed. Further, dispersion liquid having a sharp particle distribution and not having such coarse particles can be prepared.

With regard to the effective mesh size, it is more effective to remove large particles with a smaller effective mesh size. But when the effective mesh size is too small, the desired dye particles may be filtrated as well. Therefore, there is a suitable effective mesh size. In addition, when the effective mesh size is too small, there are problems such that it takes a long time to complete filtration, the mesh is clogged, and the burden of a pump, etc., becomes heavy when the pump, etc., sends liquid. The material insoluble to a solvent for use in dispersion liquid to be filtrated is used for such filters.

With regard to filtration, when large particles are present in too great an amount in the dispersion liquid, the amount of dye removed increases. This leads to, for example, fluctuation in the density of the solid portion in the dispersion liquid after filtration, which is not preferred. Therefore, there is a suitable particle size distribution (particle size and standard deviation) for filtration. As in the present application, to efficiently perform filtration such that dye is not lost and the filter is not clogged, it is desired that the volume average particle size in dispersion liquid before filtration is not greater than 0.3 μm and its standard deviation is not greater than 0.2 μm.

Coarse particles can be removed when such filtration operation for dispersion liquid is added. Further, background fouling occurring to an image bearing member prepared by using a dispersion liquid can be reduced. As described above, when a filter having a small mesh size is used, the effect is secured. However, proper dye particles may be filtrated as well. In this case, the combinational use of the filtration and the technology in which titanyl phthalocyanine primary particles are miniatuarized during synthesis is extremely effective. Namely, when synthesized minute titanyl phthalocyanines are used, the dispersion time and stress can be reduced, which reduces the possibility of crystal form conversion during dispersion. In addition, the remaining coarse particles prepared with miniaturization are relatively small in size in comparison with those prepared without miniaturization. Therefore, a filter having a small mesh size can be used and thereby the effect of removing large particles is secured. In addition, the amount of titanyl phthalocyanine particles removed is reduced so that the dispersion component does not vary between before and after filtration. Therefore, a dye can be stably prepared. As a result, an image bearing member manufactured as such has a stable durability against background fouling.

Next, the image bearing member for use in the present application is described in detail with reference to drawings.

Figure 14:
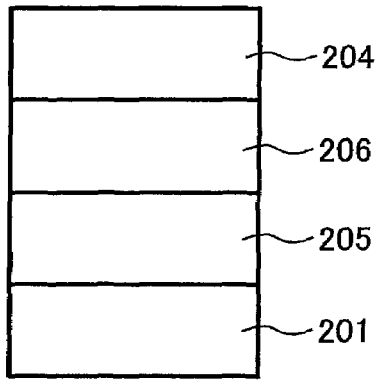
FIG. 14 is a diagram illustrating a layer structure example of the image bearing member for use in the present application.

FIG. 14 is a diagram illustrating the cross section of an example of the structure of the image bearing member for use in the present application. The image bearing member has a layer accumulation structure in which a charge blocking layer 205, a moiré prevention layer 206, and a photosensitive layer 204 containing titanyl phthalocyanine having a specific crystal form and a particle size not greater than a desired size are accumulated on an electroconductive substrate 201 in this order.

Figure 15:
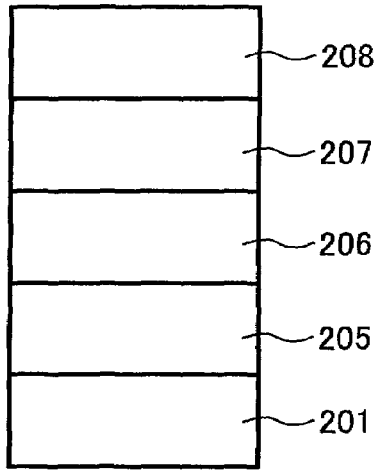
FIG. 15 is a diagram illustrating another layer structure example of the image bearing member for use in the present application.

FIG. 15 is a diagram illustrating the cross section of another example of the structure of the image bearing member for use in the present application. The image bearing member has a layer accumulation structure in which a charge blocking layer 205, a moiré prevention layer 206, a charge generating layer 207 containing titanyl phthalocyanine having a specific crystal form and a particle size not greater than a desired size and a charge transport layer 208 mainly formed of a charge transport material are accumulated on an electroconductive substrate 201 in this order.

Figure 16:
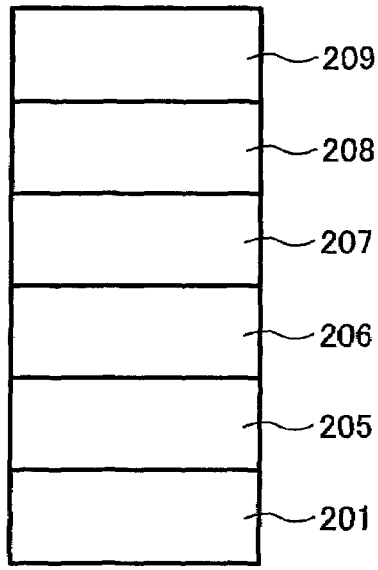
FIG. 16 is a diagram illustrating another further layer structure example of the image bearing member for use in the present application.

FIG. 16 is a diagram illustrating the cross section of further another example of the structure of the image bearing member for use in the present application. The image bearing member has a layer accumulation structure in which a charge blocking layer 205, a moiré prevention layer 206, a charge generating layer 207 containing titanyl phthalocyanine having a specific crystal form and a particle size not greater than a desired size, a charge transport layer 208 mainly formed of a charge transport material and a protective layer 209 are accumulated on an electroconductive substrate 201 in this order.

Materials having a volume resistance of not greater than $10^{10}$ Ωcm can be used as a material for the electroconductive substrate 201. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used.

Further, a tube which is manufactured from the board mentioned above by a crafting technique such as extruding and extracting and surface-treatment such as cutting, super finishing and glinding is also usable. In addition, endless nickel belt and endless stainless belt can be used as the electroconductive substrate 201.

The electroconductive substrate 71 of the present application can be formed by applying to the substrate mentioned above a liquid of application in which electroconductive powder is dispersed in a suitable binder resin.

Specific examples of such electrconductive powder include carbon black, acetylene black, metal powder such as aluminum, nickel, iron, nichrome, copper, zinc and silver, and metal oxide powder such as electroconductive tin oxide, and ITO.

Specific examples of the binder resins which are used together with the electroconductive powder include thermoplastic resins, thermosetting resins, and optical curing resins such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acryl resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent such as tetrahydrofuran (THF), dichloromethane (MDC), methyl ethyl ketone (MEK), and toluene and applying the resultant to a substrate.

Also, an electroconductive substrate formed by forming a heat contraction rubber tube on a suitable cylindrical substrate can be used as the electroconductive substrate of the present application. The heat contraction tube is formed of a material such as polyvinyl chloride, polypropylene, polyester, polystyrene, polyvinylidene chloride, polyethylene, chloride rubber, and TEFLON® in which the electroconductive powder mentioned above is contained.

Next, the charge blocking layer 205 and the moiré prevention layer 206 are described. Such undercoating layers have functions of restraining the infusion of a charge having a reverse polarity induced on the electroconductive substrate 201 during charging an image bearing member, preventing the occurrence of moiré, sealing off the deficiency of a raw tube, maintaining the adhesiveness of a photosensitive layer, etc. Typically, an undercoating layer is formed of a single layer. When the infusion of the charge from an electroconductive substrate is restrained using a typical undercoating layer, the residual voltage tends to rise. To the contrary, when the residual voltage is reduced, background fouling increases. To deal with this trade-off relationship, an undercoating layer including multiple layers is formed. Each layer of the multiple layers has its own function. Thereby, the effect of restraining the background fouling is improved without affecting the residual voltage. This applies to the present application. Especially, since at least the charge blocking layer 205, i.e., an undercoating layer not containing an inorganic pigment, and the moiré prevention layer 206, i.e., another undercoating layer containing an inorganic pigment are accumulated in this order in the present application, the background fouling can be significantly restrained with hardly affecting the residual voltage. Further, no side-effect occurred with regard to moiré and adhesiveness. Therefore, such a structure has a large effect on improvement on the durability of an image bearing member.

First, the charge blocking layer 205 having the main function of restraining the charge infusion from the electroconductive substrate 201 is described.

The charge blocking layer 205 is a layer having a function of restraining the infusion of a charge having a reverse polarity induced on the electric pole, i.e., the electroconductive substrate 201 during charging an image bearing member. Thereby, the charge blocking layer 205 is to restrain the occurrence of background fouling. When the image bearing member is negatively charged, the infusion of positive holes is prevented. When the image bearing member is positively charged, the infusion of electrons is prevented. In addition, the charge blocking layer 205 has a function of improving the effect of sealing the deficiency of a raw tube, which leads to improvement on the restraint effect on background fouling. To restrain the charge transfer, the charge blocking layer 205 is desirably formed of only a resin having a high insulating property without containing an inorganic pigment.

As the charge blocking layer 205, there can be mentioned a positive electric pole oxidized film represented by an aluminum oxide film, an insulation layer formed of an organic compound such as SiO, a layer formed of glassy network of a metal oxide described in JOP H03-191361, a layer formed of polyphosphazene described in JOP H03-141636, a layer formed of a product obtained by aminosilane reaction described in JOP H03-101737, a layer formed of an insulating binder resin, and a layer formed of a curing binder resin. Among these, a layer formed of an insulating binder resin or a curing binder resin, which can be formed by a wet application method, is suitably used. Since the moiré prevention layer 206 and a photosensitive layer are accumulated on the charge blocking layer 205, when a wet application method is used, it is essential to use a material or a composition not dissolved in a liquid of application for use in the method.

Usable binder resins are thermal plastic resins such as polyamides, polyesters, copolymers of vinyl chloride and vinyl acetate and thermal curing resins formed by thermally polymerizing a compound having plural active hydrogen atoms (hydrogen contained in OH group, NH2 group, NH group, etc., and at least one of a compound having plural isocyanate groups and a compound having plural epoxy groups. Specific examples of the compounds having plural active hydrogen atoms include polyvinyl butyral, a phenoxy resin, a phenol resin, a polyester, a polyethylene glycol, a polypropylene glycol, polybutylene glycol, and an acrylic resin having a hydroxyl ethyl methacrylate group, etc. Specific examples of the compounds having plural isocyanate groups include tolylene diisocyanate, hexamethylene diisocyanate, diphenyl methane diisocyanate and their prepolymers. Specific examples of the compounds having plural epoxy groups include a bisphenol A epoxy resin. In addition, a thermal curing resin formed by thermally polymerizing an oil-free alkyd resin and an amino resin such as butylized melamine resin can be also used as a binder resin. Further, optical curing resins formed by a combination of a polyurethane having an unsaturated linkage, a resin having an unsaturated linkage such as an unsaturated polyester, a thioxanthone based compound, and an optical polymerization initiator such as methyl benzyl formate can be used as a binder resin. These alcohol soluble resins and thermal curing resins have a high insulating property and are not dissolved since a ketone based solvent is used as the liquid of application for use in the layer provided thereabove. Therefore, the thickness of such a layer is uniform so that the layer uniformly and stably has an excellent effect on restraining background fouling.

In the present application, polyamide resins are preferred among these resins. N-methoxy methylized nylon is most preferred. Polyamide resins have an excellent effect on restraining the infusion of charges and little effect on the residual voltage. In addition, these polyamide resins are soluble in alcohol but not soluble in other solvents. Further, a uniform thin layer can be formed by a dip coating method, meaning that these polyamide resins are excellent in application property. Especially, this undercoating layer is desired to be uniformly thin to minimize the affect of the rise in the residual voltage. Therefore, the application property has a special meaning in stabilizing the image quality.

In general, alcohol soluble resins significantly depend on humidity. Therefore, there is an environment problem such that the electric resistance of alcohol soluble resins rises under a low humid environment, which leads to increase in the residual voltage and the electric resistance of alcohol soluble resins decreases under a high humid environment, which leads to reduction of chargeability. However, among the polyamide resins, N-methoxy methylized nylon has a high insulation property and is extremely excellent in blocking the charge infused from an electroconductive substrate. Further, N-methoxy methylized nylon has a slight effect on the residual voltage and the dependency on environment thereof is significantly reduced. Therefore, the image quality is stable even when the environmental conditions are changed and it is suitable to accumulate a moiréprevention layer on this charge blocking layer. In addition, when N-methoxy methylized nylon is used, the residual voltage has only a slight dependency on the layer thickness. Thereby, the affect on the residual voltage is reduced and a high restraint effect on background fouling can be obtained.

There is no specific limit to the substitution ratio of methoxymethyl group in N-methoxy methylized nylon. The ratio is preferably not less than 15 mol %. The effects of N-methoxy methylized nylon is affected by the degree of methoxymethylization. When the substitution ratio of methoxy methyl group is too small, the temporal stability of the liquid of application slightly deteriorates. This is because there is a tendency that the humidity dependency rises and when N-methoxy methylized nylon is dissolved in an alcohol, the obtained alcohol solution is clouded.

In the present application, it is possible to use methoxy methylized nylon alone and a cross-linking agent or an acid catalyst can be added if desired. Known marketed products such as melamine resins and isocyanate resins can be used as a cross-linking agent and known catalysts such as tartaric acid can be used as an acid catalyst. However, an addition of an acid catalyst may have a reverse effect on the insulation property of an undercoating layer, which leads to deterioration of the restraint effect on background fouling. Therefore, the addition amount thereof is desired to be small. It is preferred to add such an acid catalyst in an amount of 5 weight % based on the amount of a resin. In addition, another binder resin can be mixed. Such a mixable binder resin is, for example, a polyamide resin soluble in alcohol. Thereby, the temporal stability of a liquid of application can be improved.

In addition, it is also possible to add an electroconductive polymer, a resin or a compound having a low molecular weight having an acceptor (donor) property according to the polarity, and other kinds of additives. These additives can be effective to reduce the residual voltage. However, when a layer is accumulated on the undercoating layer by a dip coating method, these additives may melt into the accumulated layer. Therefore, it is desired to limit the addition amount thereof to the minimal level.

Further, the layer thickness of a charge blocking layer is from 0.1 to less than 2.0 μm and preferably from about 0.3 to about 1.0 μm. When the layer thickness of a charge blocking layer is too thick, the residual voltage significantly rises during repetitive charging and irradiation especially in a low temperature and low humid environment. When the layer thickness of a charge blocking layer is too thin, the charge blocking property thereof may be reduced. A charge blocking layer is formed on an electroconductive substrate by a known method such as a blade coating method, a dip coating method, a spray coating method, a beat coating method and a nozzle coating method. It is possible to add an agent, a solvent, an additive, and a promoter to help curing (cross-linking). After coating, the layer is dried or cured by a curing treatment such as drying, heating, or application of light.

Next, the moiré prevention layer is described. A moiré prevention layer is provided to mainly prevent the occurrence of moiré and improve the adhesiveness of a photosensitive layer and also effective to prevent the decrease in charging caused by fatigue and reduce the residual voltage. In addition, a moiré prevention layer has a function of restraining the background fouling. To prevent the occurrence of moiré and improve the adhesiveness of a photosensitive layer, it is preferred to increase the surface roughness of a moiré prevention layer. This is achieved by dispersing an inorganic pigment therein. Such an inorganic pigment contained in a moiré prevention layer can restrain the occurrence of moiré, and reduce the fluctuation of the residual voltage and dark decay caused by fatigue. Further, such a moiré prevention layer can improve the adhesive property of a photosensitive layer.

The moiré mentioned above is a kind of image deficiencies. This is caused by interference stripes referred to as moiré formed in an image caused by optical interference inside a photosensitive layer when a coherent light such as a laser beam is used for writing. Moiré is basically prevented by an undercoating layer in which incident laser beams are light scattered. Therefore, it is desired to contain a material having a large refraction index therein. To prevent moiré, a structure in which an inorganic pigment is dispersed in a binder resin is effective. Especially, a white inorganic pigment is effective among inorganic pigments. For example, a titanium oxide, a calcium fluoride, a calcium oxide, a silicon oxide, a magnesium oxide and an aluminum oxide are suitably used. Among these, a titanium oxide is especially effective in terms of sealing-off property.

Further, it is preferred that a moiré prevention layer has a function of transferring a charge having the same polarity as that of the charge on an image bearing member from the photosensitive layer to the electroconductive substrate side in light of reduction of the residual voltage. The inorganic pigment mentioned above also has such a function. For example, when a negatively charged type image bearing member is used, the undercoating layer can significantly reduce the residual voltage by having an electroconductive property. As such an inorganic pigment, the metal oxides mentioned above are effectively used. However, when a metal oxide having a low electric resistance is used or the addition ratio of such a metal oxide to a binder resin is excessive, the effect of reducing the residual voltage becomes high but the effect of restraining the background fouling may be reduced. Therefore, it is desired to change the structure and the layer thickness of an undercoating layer in an image bearing member or control the addition amount of such an additive to have a good combination of the restraint effect on the background fouling and the reduction effect on the residual voltage. In addition, the present application is further effective by using an electroconductive material such as an acceptor in a moiré prevention layer.

As described above, the metal oxides mentioned above is suitably used as the inorganic pigment for use in the present application. When an electroconductive metal oxide is used, it is effective to reduce the residual voltage but may have an adverse effect on the background fouling. To the contrary, when a metal oxide having a high electric resistance is used, it is effective to reduce the background fouling but may have an adverse effect on the residual voltage. In the present application, an undercoating layer is formed by multiple layers formed of a charge blocking layer and a moiré prevention layer, both of which have a separate function. Therefore, the range of the selection of such inorganic pigments is wide. But even when an undercoating layer not having an inorganic pigment and another undercoating layer having an inorganic pigment are provided, the electric resistance of the inorganic pigment contained in the undercoating layer having an inorganic layer at least has some effect on the background fouling and the residual voltage. Therefore, it is preferred to use a metal oxide having a high electric resistance rather than an electroconductive metal oxide. Among these, it is particularly preferred to use a titanium oxide in terms of the stability of the image quality. The titanium oxide for use therein preferably has a high purity to reduce the rise of the residual voltage. The purity thereof is preferably not less than 99.0% and more preferably not less than 99.5%.

The average primary particle diameter of the inorganic pigment for use in the present application is preferably from 0.01 to 0.8 μm and more preferably from 0.05 to 0.5 μm. However, when only an inorganic pigment having an average primary particle diameter not greater than 0.1 μm is used, the inorganic pigment is effective to reduce the background fouling but the effect of preventing moiré tends to be reduced. To the contrary, when only an inorganic pigment having an average primary particle diameter not less than 0.4 μm is used, the inorganic pigment has an excellent effect on moiré prevention but has a tendency of a slightly reduced effect on the background fouling. In these cases, by using a mixture of inorganic pigments having a different average primary particle diameter, a good combination of moiré prevention effect and reduction effect of the residual voltage may be obtained. Such a mixture may have an effect on reducing the residual voltage.

As a binder resin for use in a moiré prevention layer, the same binder reins as those for use in a charge blocking layer can be used. Considering that a photosensitive layer is accumulated on a moiré prevention layer, a binder resin insoluble in a liquid of application for a photosensitive layer is suitable. Specific examples of such binder resins include water soluble resins such as polyvinyl alcohol, casein and sodium polyacrylate, alcohol soluble resins such as polyamide, copolymeric nylon and methoxy methilized nylon, and curing type resins having a three dimension mesh structure such as polyurethane, a phenol resin, an alkyd-melamine resin, and an epoxy resin. Among these resins, the curing-type resins are particularly preferred since curing-type resins are hardly affected and dissolved out by an organic solvent applied while forming a photosensitive layer. Among the curing-type resins mentioned above, a mixture of an alkyd resin and a melamine resin is particularly suitable. The mixing ratio of an alkyd resin and a melamine resin is an important factor to determine the structure and the characteristics of a moiré prevention layer. The weight ratio of an alkyd resin to a melamine resin is preferably from 5/5 to 8/2. An excessive content ratio of a melamine resin is not preferred because the residual voltage of an image bearing member tends to increase and layer deficiency tends to occur due to significant volume contraction during thermal curing. In addition, an excessive content ratio of an alkyd resin is not preferred because, although it is effective to reduce the residual voltage of an image bearing member, the bulk resistance thereof tend to be too low, which leads to deterioration of background fouling.

In a moiré prevention layer, the volume content ratio of an inorganic pigment and a binder resin determines the important characteristics thereof. The volume content ratio of an inorganic pigment to a binder resin is preferably from 1/1 to 3/1. When the volume ratio is too low, not only does the moiré prevention effect become low, but also the residual voltage may significantly rise during repetitive use. When the volume content ratio is too large, the binding ability of a binder resin may deteriorate and the surface properties of a coated moiré prevention layer may deteriorate, which leads to an adverse effect on the filming property of a photosensitive layer there above. This adverse effect can cause a significant problem when a photosensitive layer includes accumulated layers and a thin layer such as a charge generating layer is formed. In addition, when the volume content ratio is too large, the binder resin may not be able to cover the surface of an inorganic pigment. In such a case, the probability of generating heat carrier increases because the uncovered inorganic pigment may directly contact a charge generating material, resulting in an adverse effect on the background fouling.

Further, when two different kinds of titanium oxides having a different average particle diameter are used in a moire prevention layer, an electroconductive substrate is preferably covered, which leads to further restraint of the occurrence of moiré. Thereby, a pinhole causing an abnormal image is not produced. To achieve this, it is desired that the ratio of the average particle diameters of two kinds of titanium oxides used is from greater than 0.2 to not greater than 0.5. When the ratio (D2/D1) of the average particle diameter (D1) of a titanium oxide (T1) having a smaller average particle diameter than that of the other to the average particle diameter (D2) of the other titanium oxide (T2) is too small, the activity on the surface of titanium oxide increases and thereby the electrostatic stability of an image bearing member formed thereof significantly deteriorates. In addition, when the ratio (D2/D1) is too large, an electroconductive substrate tends not to be sufficiently covered, which leads to deterioration of restraint effect on the occurrence of moiré and abnormal images. The average particle diameter mentioned above is obtained by measuring the particle size distribution obtained when a strong dispersion is performed in an aqueous system.

In addition, the average particle diameter (D2) of a titanium oxide (T2) having a smaller particle diameter is an important factor and preferably from greater than 0.05 to 0.20 μm. When the D2 is too small, the covering is not sufficient and thereby moiré may occur. To the contrary, when the D2 is too large, the filling ratio of titanium oxide in a moiré prevention layer decreases, resulting in deterioration of the background restraint effect.

In addition, the mixing ratio {T2/(T1+T2)} by weight of the two titanium oxides is also an important factor. The ratio {T2/(T1+T2)} is preferably from 0.2 to 0.8. When the ratio {T2/(T1+T2)} is too small, the filling ratio of titanium oxide in a moiré prevention layer is not so high, resulting in deterioration of the background restraint effect. When the ratio {T2/(T1+T2)} is too large, an electroconductive substrate is not sufficiently covered and thereby moiré may occur.

Further, the layer thickness of a moiré prevention layer is from 1 to 10 μm and preferably from 2 to 5 μm. When the layer thickness is too thin, the effects of reducing background fouling and residual voltage are not sufficient. When the layer thickness is too thick, the residual voltage tends to accumulate, which is not preferred.

The inorganic pigment can be dispersed with a binder resin in a solvent by a known method with a ball mill, a sand mill, or an attritor. A moiré prevention layer can be formed by a known method such as a blade coating method, a dip coating method, a spray coating method, a beat coating method and a nozzle coating method. It is possible to add an agent, a solvent, an additive, and a promoter to help curing (cross-linking). After coating, the layer is dried or cured by a curing treatment such as drying, heating, or application of light.

Next, the photosensitive layer is described. A photosensitive layer can be formed of a single layer containing a charge generating layer and a charge transport material. As described above, a photosensitive layer having a layer accumulation structure formed of a charge generating layer and a charge transport layer is preferably used in terms of sensitivity and durability.

The charge generating layer contains titanyl phthalocyanine crystal having an average primary particle diameter of not greater than 0.25 μm, which is achieved during synthesizing titanyl phthalocyanine crystal or by a dispersion filtration treatment. The titanyl phthalocyanine crystal having a crystal form having a CuKα X ray diffraction spectrum having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.4°±0.2° and 7.30±0.2° and no peak at 26.3±0.2°.

As described above, the effect of restraining the background fouling is significantly improved by accumulating a charge blocking layer and a moiré prevention layer. This is achieved by restraining the infusion of charges from an electroconductive substrate. Therefore, another countermeasure is taken to prevent the background fouling caused by agglomeration of a charge generating layer and decrease of the purity thereof. In the present application, the durability of an image bearing member is highly improved by restraining the background fouling factors both in an undercoating layer formed of a charge blocking layer and a moiré prevention layer and a charge generating layer. Further, although the deterioration of the chargeability of an image bearing member during repetitive use accelerates the occurrence of background fouling, the deterioration of the chargeability can be alleviated in the present application by specifying the crystal type and the average particle size of the titanyl phthalocyanine for use in a charge generating layer. Therefore, the effect of restraining the background fouling can be further improved. In addition, the humidity dependency is also decreased. Therefore, the dependency of the image quality on environmental conditions is decreased, meaning that the stability of the image quality is improved. Thereby, the durability and the stability are drastically improved.

The method of manufacturing the titanyl phhtalocyanine having an average primary particle diameter not greater than 0.25 μm is as described above.

The charge generating layer can be formed by dispersing the dye mentioned above in a suitable solvent together with an optional binder resin with a ball mill, an attritor, a sand mill or supersonic wave, and applying the resultant to an electroconductive substrate followed by drying.

Specific examples of the optional binder resins for use in a charge generating layer include polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, polyacrylamides, polyvinyl benzals, polyesters, phenoxy resins, copolymers of vinylchloride-vinyl acetates, polyvinyl acetates, polyphenylene oxidos, polyvinyl pyridines, cellulose-based resins, caseine, polyvinyl alcohols, and polyvinyl pyrrolidones. The content of the optional binder resin is from 0 to 500 parts by weight and preferably from 10 to 300 parts by weight based on 100 parts by weight of a charge generating material.

Specific examples of the solvents include isopropanol, acetone, methlethylketone, cyclohexane, tetrahydrofuran, dioxane, ethylcellosolve, ethyl acetate, methyl acetate, dichloromethane, dichloroethane, monochlorobenzene, cyclohexane, toluene, xylene, and ligroin. Usable methods of coating a liquid of application are, for example, a dip coating method, a spray coating method, a beat coating method, a nozzle coating method, a spinner coating method and a ring coating method. The layer thickness of a charge generating layer is from about 0.01 to about 5 μm and preferably from 0.1 to 2 μm.

The charge transport layer can be formed by dispersing or dissolving a charge transport material and a binder resin in a suitable resin, and applying the resultant to a charge generating layer followed by drying. In addition, a plasticizer, a leveling agent and an anti-oxidization agent can be added if desired. There are two types of the charge transport materials, which are a positive hole transport material and an electron transport material. Specific examples of such positive hole transport materials include poly-N-vinylcarbazols and their derivatives, poly-γ-carbazolyl ethyl glutamates and their derivatives, pyrene-formaldehyde condensation compounds and their derivatives, polyvinyl pyrenes, polyvinyl phenanthrenes, polysilanes, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These charge transport materials can be used alone or in combination.

Specific examples of such electron transport material include electronacceptance materials such as chloranil, bromanil, tetracyano ethylene, tetracyanoquino dimethane, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, 1,3,7-trinitrodibenzo thhiophene-5,5-dioxide, and benzoquinone derivatives.

Specific examples of the binder resins include thermal curing resins and thermal plastic resins such as polystyrenes, styrene-acrylonitrile copolymers, styrene-butadiene copolymers, styrene-maleic acid anhydride copolymers, polyesters, polyvinyl chlorides, vinyl chloride-vinyl acetate copolymers, polyvinyl acetates, polyvinyl vinylidenes, polyarates, phenoxy resins, polycarbonates, cellulose acetate resins, ethyl cellulose resins, polyvinyl butyrals, polyvinyl formals, polyvinyl toluene, poly-N-vinylcarbazols, acrylic resins, silicone resins, epoxy resins, melamine resins, urethane resins, phenol resins, and alkyd resins.

The content of the charge transport material is from 20 to 300 parts by weight and preferably from 40 to 150 parts by weight based on 100 parts by weight of a binder resin. In addition, the layer thickness of the charge transport layer is preferably from about 5 to about 100 μm.

Specific examples of the solvents include tetrahydrofuran, dioxane, toluene, dichloromethane, monochlorobenzne, dichloroethane, cyclohexanone, methyl ethyl ketone, and acetone. Among these, to reduce the burden on the environment, the use of a non-halogenated solvent is preferred. Preferred specific examples thereof include cyclic ethers such as tetrahydrofuran, dioxolane and dioxane, aromatic hydrocarbons such as toluene and xylene and their derivatives.

In addition, a charge transport polymer which can function as a charge transport material and a binder resin can be preferably used in a charge transport layer. A charge transport layer formed of such a charge transport polymer has an excellent anti-abrasion property. Any known materials can be used as the charge transport polymer and especially polycarbonate having a triaryl amine structure in its main and/or side chain is suitably used. In particular, charge transport polymers represented by the following formulae of from (1) to (10) are preferably used:

(1)

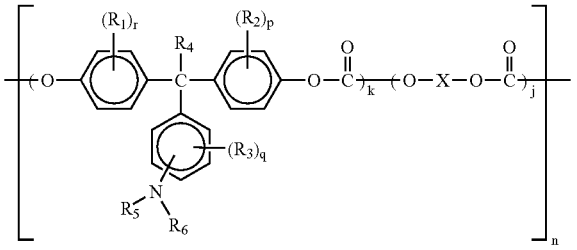

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

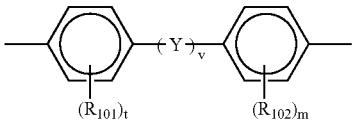

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—, —CO—O-Z-O—CO— (Z represents a divalent aliphatic group), or a group having the following formula:

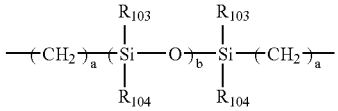

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$, may be the same or different from the others.

(2)

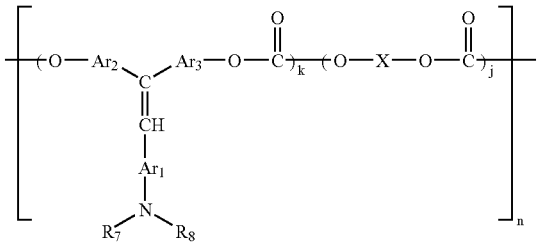

wherein $R_7$ and $R_8$ independently represent a substituted or unsubstituted aryl group; $Ar_1$, $Ar_2$ and $Ar_3$ independently represent an arylene group; and X, k, j and n are defined above in formula (1).

(3)

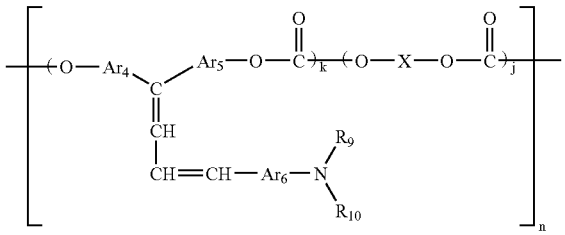

a substituted or unsubstituted aryl group; $Ar_4$, $Ar_5$ and $Ar_6$ independently represent an arylene group; and X, k, j and n are defined above in formula (1).

(4)

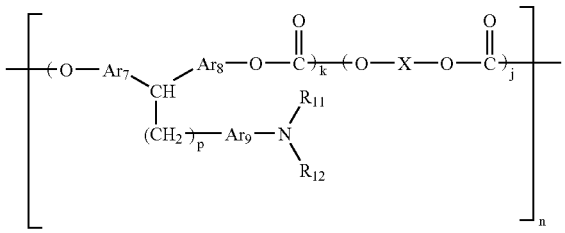

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (1).

(5)

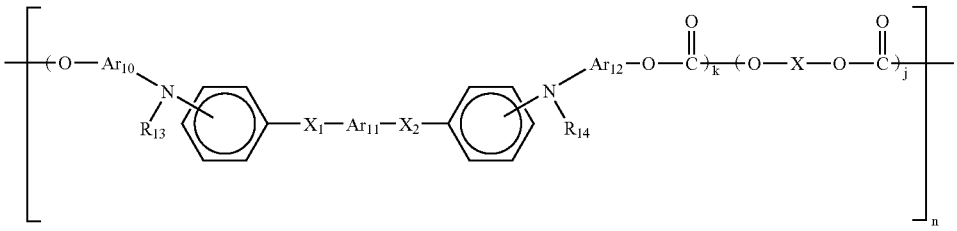

wherein $R_{13}$ and $R_{14}$ independently represent a substituted or unsubstituted aryl group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in formula (1).

(6)

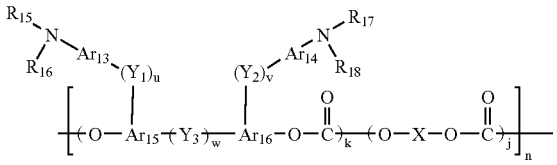

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w independently represent 0 or 1; and X, k, j and n are defined above in formula (1).

(7)

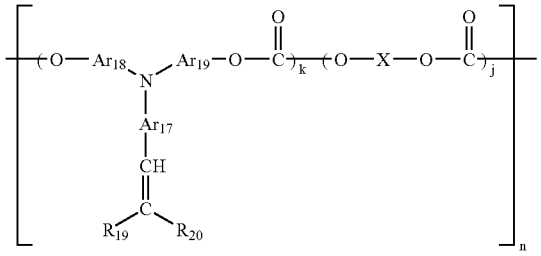

wherein $R_{19}$ and $R_{20}$ independently represent a hydrogen atom, or substituted or unsubstituted aryl group, and $R_{19}$ and $R_{20}$ optionally share bond connectivity to form a ring; $Ar_{17}$, $Ar_{18}$ and $Ar_{19}$ independently represent an arylene group; and X, k, j and n are defined above in formula (1).

(8)

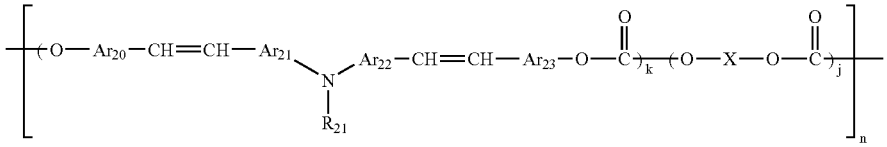

wherein $R_{21}$ represents a substituted or unsubstituted aryl group; $Ar_{20}$, $Ar_{21}$, $Ar_{22}$ and $Ar_{23}$ independently represent an arylene group; and X, k, j and n are defined above in formula (1).

(9)

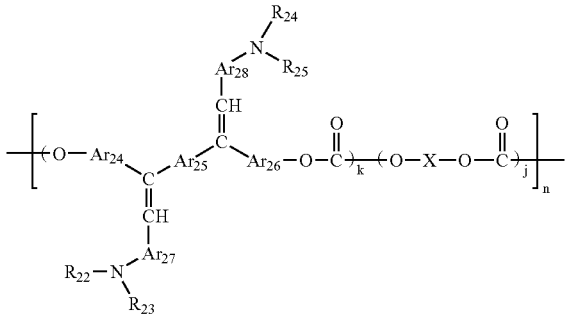

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in formula (1).

(10)

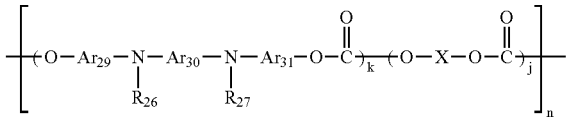

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in formula (1).

Formulae (1) to (10) are illustrated in the form of block copolymers, but the polymers are not limited thereto, and may be random copolymers.

In addition, the charge transport layer can also be formed by coating one or more monomers or oligomers, which have an electron donating group, and thereafter subjecting the monomers or oligomers to a cross-linking (curing) reaction such that the layer has a two- or three-dimensional cross-linking structure.

The charge transport layer formed of a polymer or a cross-linked polymer, which has an electron donating group, has good abrasion resistance. In an electrophotographic image forming apparatus, the potential of charges formed on an image bearing member (i.e., the potential of a non-irradiated area) is generally set to be constant. Therefore, the heavier the abrasion loss of the photosensitive layer of the image bearing member, the larger the intensity of electric field formed on the image bearing member.

When the intensity of electric field increases, background fouling occurs in the resultant images. Namely, an image bearing member having a good abrasion resistance hardly causes the background fouling problem. The above-mentioned charge transport layer formed of a polymer having an electron donating group has a good film formability because the layer itself is a polymer. In addition, the charge transport layer has a good charge transportability since charge transport moieties can be formed therein at a relatively high concentration in comparison with a charge transport layer containing a polymer and a low molecular weight charge transport material. Namely, the image bearing member including a charge transport layer formed of a charge transport polymer has a high response property.

Known copolymers, block polymers, graft polymers, and star polymers can also be used as a polymer having an electron donating group. In addition, a cross-linking polymer including an electron donating group described in JOP 03-109406, 2000-206723, and 2001-34001, can also be used to form the charge transport layer.

The charge transport layer for use in the present application can include additives such as a plasticizer and a leveling agent. Specific examples of the plasticizers include known plasticizers such as dibutyl phthalate and dioctyl phthalate. The content of the plasticizer in the charge transport layer is from 0 to 30% by weight based on the binder resin included in the charge transport layer. Specific examples of the leveling agents include silicone oils such as dimethyl silicone oils and methyl phenyl silicone oils, and polymers and oligomers, which include a perfluoroalkyl group in their side chain. The content of the leveling agent in the charge transport layer is from 0 to 1% by weight based on the binder resin included in the charge transport layer.

Hereinbefore, the layer accumulated photosensitive layer is described. However, the photosensitive layer of the image bearing member of the present application is not limited to the layer accumulated photosensitive layer, and a single-layered photosensitive layer can also be used. In this case, the photosensitive layer includes at least a charge generating material (i.e., titanyl phthalocyanine having a specific crystal form and particle size) and a binder resin. Suitable materials for use as the binder resin include the materials mentioned above for use as the binder resin in the charge generating layer and the charge transport layer. In addition, a charge transport material is preferably added to the single-layered photosensitive layer so that the resultant image bearing member has high photosensitivity, high carrier transportability and low residual potential. The proper charge transport material is chosen from either of a hole transport material or an electron transport material depending on the charge formed on the surface of the image bearing member. In addition, the charge transport polymer mentioned above can also be preferably used for the single-layered photosensitive layer.

In the image bearing member of the present application, a protective layer is optionally provided on a photosensitive layer for protection. Recently, computers have been used in daily life, and therefore, a high-speed printing and size reduction are demanded for a printer. Such a protective layer on a photosensitive layer can improve the durability of an image bearing member. Therefore, the image bearing member of the present application having a high sensitivity can be fully utilized without producing abnormal images.

Protective layers for use in the present application can be typified into two. One has a structure in which a filler is added in a binder resin. The other is a structure in which a cross-linking type binder is used.

The structure in which a filler is added in a binder resin is described first.

Specific examples of the materials for use in the protective layer include ABS resins, ACS resins, olefin-vinyl monomer copolymers, chlorinated polyether, allyl resins, phenolic resins, polyacetal, polyamide, polyamideimide, polyallysulfone, polybutylene, polybutyleneterephthalate, polycarbonate, polyarylate, polyethersulfone, polyethylene, polyethyleneterephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. Among these resins, polycarbonate and polyarylate are preferably used.

In addition, to improve the anti-abrasion property of such a protective layer, fluorine-containing resins such as polytetrafluoroethylene, and silicone resins can be used therefor. Further, combinations of such resins and an inorganic filler such as titaniumoxide, aluminumoxide, tinoxide, zincoxide, zirconiumoxide, magnesium oxide, potassium titanate and silica or an organic filler can also be used therefor. These inorganic fillers may be subjected to a surface-treatment.

In addition, organic and inorganic fillers can be used in the protective layer. Suitable organic fillers include powders of fluorine-containing resins such as polytetrafluoroethylene, silicone resin powders, amorphous carbon powders, etc. Specific examples of the inorganic fillers include powders of metals such as copper, tin, aluminum and indium; metal oxides such as alumina, silica, tin oxide, zinc oxide, titanium oxide, alumina, zirconia, indium oxide, antimony oxide, bismuth oxide, calcium oxide, tin oxide doped with antimony, indium oxide doped with tin; potassium titanate, etc. In terms of the hardness of a filler, the inorganic fillers are preferred. In particular, silica, titanium oxide and alumina are preferred.

The content of the filler in the protective layer is preferably determined depending on the species of the filler used and the application conditions of the resultant image bearing member, but the content of a filler on the uppermost surface side of a protective layer is preferably not less than 5% by weight, more preferably from 10 to 50% by weight, and even more preferably from 10 to 30% by weight, based on the total weight of the solid portion of the side.

The filler included in the protective layer preferably has a volume average particle diameter of from 0.1 to 2 μm, and more preferably from 0.3 to 1 μm. When the average particle diameter is too small, the anti-abrasion property of the resultant image bearing member is not satisfactory. In contrast, when the average particle diameter is too large, the surface of the resultant protective layer significantly becomes irregular or a protective layer is not formed.

The average particle diameter of a filler described in the present application means a volume average particle diameter unless otherwise specified, and is measured using an ultracentrifugal automatic particle size measuring device (CAPA-700, manufactured by Horiba Ltd.). Therein, the cumulative 50% particle diameter (i.e., the median particle diameter) is defined as the average particle diameter. In addition, it is preferred that the standard deviation of the particle diameter distribution curve of the filler used for the protective layer is not greater than 1 μm. When the standard deviation is too large (i.e., when the filler has too broad particle diameter distribution), the effect of the present application is not obtained.

In addition, pH of a filler for use in the present application has a large effect on the resolution of images produced and the dispersability thereof in liquid of application. One of the thinkable reasons is as follows. Hydrochloric acid used in the preparation of the filler (in particular, metal oxides) may remain therein. When the content of the remaining hydrochloric acid is large, the resultant image bearing member tends to produce blurred images. In addition, hydrochloric acid can have an adverse effect on the dispersibility of the filler when the remaining amount thereof is too large.

Another reason therefor is that the chargeability of a filler (in particular, a metal oxide) is greatly affected by the pH of the fillers. In general, particles dispersed in a liquid are positively or negatively charged. In this case, ions gather around the particles reversely charged thereto for electric neutralization. As a result, an electric double layer is formed and thereby the particles are stably dispersed in the liquid. As the distance from the particle increases, the potential (i.e., zeta potential) dwindles and finally becomes zero in an electrically neutral area. As the absolute value of zeta potential increases, the repulsion between particles is strong, meaning that the stability of the dispersion is high. As the absolute value of zeta potential approaches to zero, the particles easily aggregate. The zeta potential of a system greatly depends on the pH thereof. The zeta potential becomes zero at a particular pH, meaning that the system has an isoelectric point. Therefore, to stabilize a dispersion system, it is preferred to increase the absolute value of zeta potential, meaning away from the isoelectric point of the system.

It is preferred that the protective layer contains a filler having a pH of 5 or higher at the isoelectric point to prevent formation of a blurred image. In other words, a filler having a highly basic property is preferably used in the image bearing member of the present application to increase the prevention effect. A filler having a high basic property at an isoelectirc point has a high zeta potential (i.e., the filler is stably dispersed) in an acidic system.

In this application, the pH of a filler means the pH value of the filler at the isoelectric point, which is determined by the zeta potential of the filler. Zeta potential can be measured by a laser beam potential meter manufactured by Otsuka Electronics Co., Ltd.

In addition, to prevent production of blurred images, a filler having a high electric resistance (i.e., not less than $1\times10^{10}$ Ω·cm in resistivity) is preferably used. Further, a filler having a pH not less than 5 and a filler having a dielectric constant not less than 5 can be particularly preferably used. A filler having a dielectric constant not less than 5 and/or a pH not less than 5 can be used alone or in combination. In addition, a filler having a pH not less than 5 and a filler having a pH less than 5, or a filler having a dielectric constant not less than 5 and a filler having a dielectric constant less than 5 can also be used in combination. Among these fillers, α-alumina, which has a high insulating property, a high heat stability and an anti-abrasion property due to its hexagonal close-packed structure, is particularly preferred in terms of prevention of formation of blurred images and improvement of anti-abrasion property of the resultant image bearing member.

Figure 1:
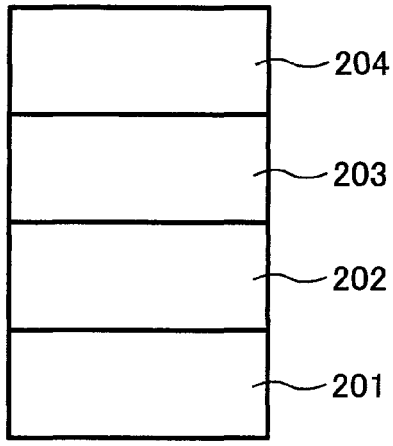
FIG. 1 is a diagram illustrating a cross section of an example structure of accumulated intermediate layers of a typical image bearing member.
Figure 2:
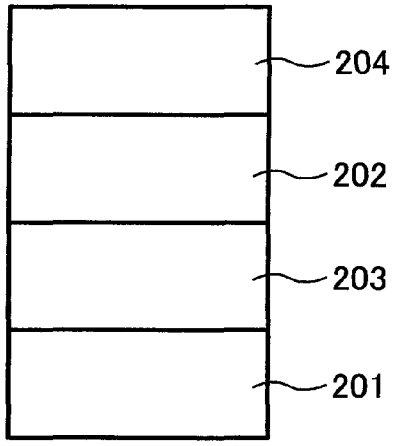
FIG. 2 is a diagram illustrating a cross section of another example structure of accumulated intermediate layers of a typical image bearing member.
Figure 3:
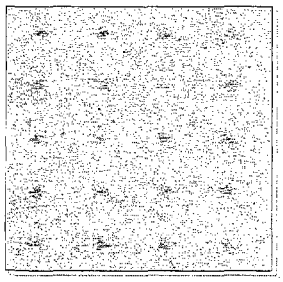
FIG. 3 is a diagram illustrating the dependency of dot formation on the intensity of an electric field.
Figure 3:
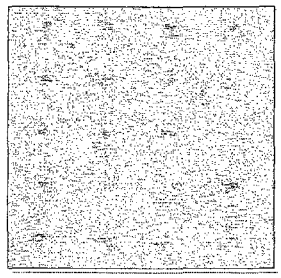
Figure 3:
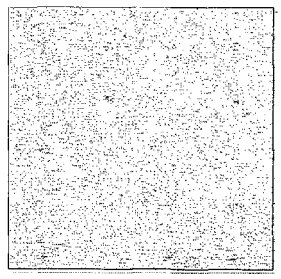
Figure 4:
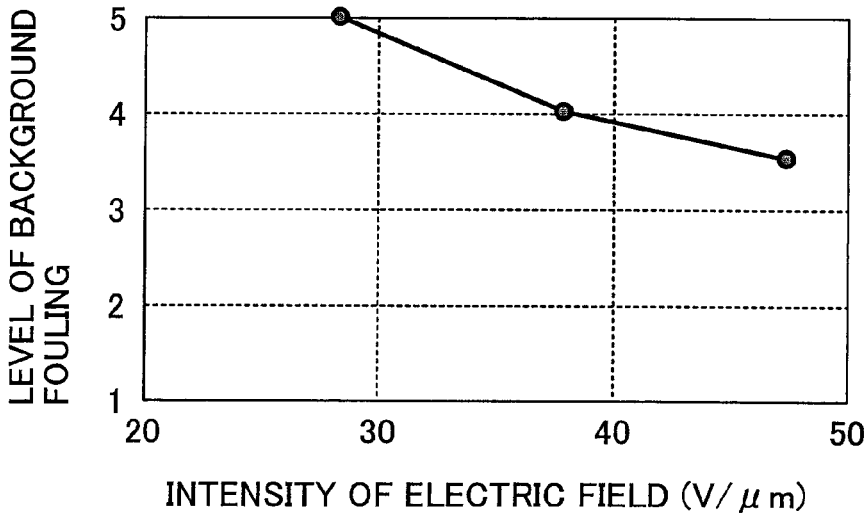
FIG. 4 is a diagram illustrating the dependency of background fouling on the intensity of an electric field.

In the present application, the resistivity of a filler is defined as follows. The resistivity of a powder such as a filler fluctuates depending on the filling factor thereof. Therefore, it is desired to measure the resistivity under a constant condition. In the present application, the resistivity is measured by a device having a similar structure to that of device illustrated in FIG. 1 of JOP H05-113688. The surface area of the electrodes of the device is 4.0 $cm^2$. Before the resistivity of a sample powder is measured, a load of 4 kg is applied to one of the electrodes for 1 minute and the amount of the sample powder is adjusted such that the distance between the two electrodes is 4 mm.

The resistivity of the sample powder is measured while the sample powder is under pressure of the weight (i.e., 1 kg) of the upper electrode without any other load. The voltage applied to the sample powder is 100 V. HIGH RESISTANCEMETER (from Yokogawa Hewlett-Packard Co.) is used to measure the resistivity not less than $10^6$ Ω·cm. A digital multimeter (from Fluke Corp.) is used to measure the resistivity less than $10^6$ Ω·cm. The thus obtained resistivity is defined as the resitivity of the present application.

The dielectric constant of a filler is measured as follows. A cell similar to that used in measuring the resistivity is also used to measure a dielectric constant. After a load is applied to a sample powder, the electric capacity of the sample powder is measured using a dielectric loss measuring instrument (from Ando Electric Co., Ltd.) to determine the dielectric constant of the powder.

These fillers can be subject to surface treatment using at least one surface treatment agent to improve the dispersion property of the fillers in a protective layer. When a filler is poorly dispersed in a protective layer, the following problems occur.

(1) the residual potential of the resultant image bearing member increases;

(2) the transparency of the resultant protective layer decreases;

(3) coating defects occur in the resultant protective layer;

(4) the anti-abrasion property of the protective layer deteriorates;

(5) the durability of the resultant image bearing member deteriorates; and (6) the image qualities of the images produced by the resultant image bearing member deteriorate.

Suitable surface treatment agents include known surface treatment agents. Among these, surface treatment agents which can maintain the highly insulative property of a filler used are preferred.

As the surface treatment agents, titanate coupling agents, aluminum coupling agents, zircoaluminate coupling agents, higher fatty acids, combinations of these agents with a silane coupling agent, $Al_2O_3$, $TiO_2$, $ZrO_2$, silicones, aluminum stearate, and the like, can be preferably used to improve the dispersibility of fillers and to prevent formation of blurred images. These materials can be used alone or in combination.

When a filler treated with a silane coupling agent is used, the resultant image bearing member tends to produce blurred images. However, when a silane coupling agent is used in combination with one of the surface treatment agents mentioned above, the affect of the silane coupling is possibly restrained.

The coating weight of a surface treatment agents is preferably from 3 to 30% by weight, and more preferably from 5 to 20% by weight, based on the weight of the treated filler although the weight is determined depending on the average primary particle diameter of the filler.

When the content of the surface treatment agent is too low, the dispersibility of the filler is not improved. In contrast, when the content is too high, the residual potential of the resultant image bearing member significantly increases.

These fillers can be dispersed using a proper dispersion machine. In this case, the fillers are preferably dispersed to an extent such that the aggregated particles are dissociated and primary particles of the fillers are dispersed to improve the transparency of the resultant protective layer.

In addition, a charge transport material can be contained in the protective layer to enhance the photo-responsive property and to reduce the residual potential of the resultant image bearing member. The charge transport materials mentioned above for use in the charge transport layer can also be used for the protective layer.

When a low molecular weight charge transport material is used in a protective layer, the concentration of the charge transport material may be gradated in the thickness direction of the protective layer with the surface side being thinner. Specifically, it is preferred to reduce the concentration of the charge transport material at the surface portion of the protective layer to improve the anti-abrasion property of the resultant image bearing member. The concentration of the charge transport material means the ratio of the weight of the charge transport material to the total weight of the protective layer.

It is preferred to use a charge transport polymer in the protective layer in order to improve the durability of the image bearing member.

In addition, the charge transport polymer described in the charge transport layer can be used as the binder resin in a protective layer. The effect of using such a polymer is the same as described for the charge transport layer, i.e., improvement on anti-abrasion property and high speed charge transport.

The protective layer can be formed by any known coating method. The thickness thereof is preferably from about 0.1 to about 10 μm.

Next, a protective layer having a cross-linking structure as a binder structure of the protective layer is described (hereinafter referred to as the cross-linking type protective layer).

In the formation of such a cross-linking structure, one or more reactive monomers having multiple cross-linking functional groups in one molecular are used to perform a cross-linking reaction with optical or thermal energy, resulting in formation of three-dimensional mesh structure. This mesh structure has a binding function and a high anti-abrasion property.

In addition, it is extremely effective to use only or partially a monomer having a charge transport function as the reactive monomer mentioned above. By using such a monomer, the charge transport portion is formed in the mesh structure so that the function of a protective layer is fully exercised. A reactive monomer having a triaryl amine structure is effectively used as a reactive monomer having a charge transport function.

A protective layer having such a mesh structure has an excellent anti-abrasion property but significantly contracts in volume during cross-linking reaction, which leads to cracking when too thick a protective layer is formed. It is possible to avoid such a defect by having a layer accumulated protective layer formed of a layer formed of a polymer in which a low molecular weight compound is dispersed disposed on the bottom and a layer having a cross-linking structure disposed on the top.

Among the cross-linking type protective layers, the protective layer having the following specific structure is effectively used.

The protective layer having the specific structure is a protective layer which is formed by curing a radical polymeric monomer having at least 3 functional groups without having a charge transport structure and a radical polymeric compound having a functional group with a charge transport structure. In the protective layer, a three-dimensional mesh structure is developed because the protective layer has a cross-liking structure formed by curing a radical polymeric monomer having at least 3 functional groups. Therefore, the resultant surface layer has an extremely high cross linking density with a high hardness and a high elasticity. Further, the surface is uniform and smooth and obtains a high anti-abrasion property and a high anti-damage property. As described above, it is important to increase the cross-linking density of the surface, i.e., the number of the cross-linkings per unit area. However, an internal stress is generated due to volume contraction since a number of linkages are formed instantly in the curing reaction. This internal stress increases as the layer thickness of a cross-linking type protective layer thickens. Therefore, curing the entire of a cross-linking type protective layer tends to invite cracking and peeling-off thereof. This phenomenon may not occur initially. But while electrophotography processes such as charging, developing, transferring and cleaning are repetitively performed, such cracking and peeling-off tend to occur due to cleaning hazard, thermal fluctuation, etc.

There are the following methods of solving this problem: (1) introducing a polymeric component in the cross-linking layer and the cross-linking structure, (2) using a radical polymeric monomer having one or two functional groups in a large amount, and (3) using a monomer having multi-functional groups having a plasticity group. The cured resin layer can be flexible by these methods. However, the cross-linking density is thin in either of these methods and the anti-abrasion property is not significantly improved. To the contrary, the image bearing member of the present application has a cross linkage type protective layer provided on a charge transport layer. The linkage type protective layer has a high cross-linking density with a preferred layer thickness of from 1 to 10 μm in which a three-dimensional structure is developed. Thereby, such cracking and peeling-off does not occur to the image bearing member of the present application and further, an extremely high anti-abrasion property is obtained. When the layer thickness of such a cross-linking protective layer is from 2 to 8 μm, the margin of the problem mentioned above is wide. In addition, a material having a high cross-linking density can be selected to further improve the anti-abrasion property.

The reason the image bearing member of the present application can restrain the occurrence of cracking and peeling-off is, for example, that the internal stress can be limited because the cross-linking type protective layer can be made to be thin. Another reason is that the internal stress in the cross-linking type protective layer forming the surface can be relaxed because the photosensitive layer and the charge transport layer are provided under the cross-linking type protective layer. Thereby, the cross-linking type protective layer does not necessarily contain a polymeric material in a large amount, which leads to reduction of incompatibility of a cured compound obtained during the reaction between the polymeric material and a radical polymeric composition (radical polymeric monomer or a radical polymeric composition having a charge transport structure). Therefore, scars and toner filming hardly occur. Further, when a protective layer is entirely cured upon application of optical energy, light transmission inside the protective layer is limited due to the absorption thereof in the charge transport structure. Thereby, it is possible that the curing reaction does not fully and uniformly proceed inside the layer. In the cross-linking type protective layer of the present application, the curing reaction uniformly proceeds inside the layer because the layer is thin, i.e., preferably not greater than 10 μm. Therefore, the layer can have a good anti-abrasion property therein as on the surface thereof. Further, the cross-linking protective layer of the present application is formed of a radical polymeric compound having a functional group and a charge transport structure in addition to the radical polymeric monomer having three functional groups mentioned above. The radical polymeric compound having a functional group and a charge transport structure is trapped in the cross-linking when the radical polymeric monomer having three functional groups is cured. In contrast, when a low molecular weight charge transport material having no functional group is contained in the cross-linking surface layer, the low molecular weight charge transport material precipitates or causes clouding phenomenon due to its low compatibility. Further, the surface of the cross-linking layer has a low mechanical strength. On the other hand, when a charge transport material having at least two functional groups is mainly used, the charge transport material is trapped in multiple linkages, which leads to improvement on the cross-linking density. However, the charge transport structure becomes extremely bulky, which greatly distorts the structure of the resultant curing resin. This can be a cause of increasing the internal stress in a cross-linking type protective layer.

Further, the image bearing member of the present application has good electric characteristics and therefore has a good stability for repetitive use, which leads to high durability and stability. This is because a radical polymeric compound having a functional group and a charge transport structure is used as a composition material forming the cross-linking type protective layer and is fixed between the cross-linkings in a pendant manner. As described above, a low molecular weight charge transport material having no functional group precipitates or causes white turbidity, which leads to significant deterioration of the electric characteristics, such as deterioration of sensitivity and rise of the residual voltage, during repetitive use. When a charge transport compound having at least two functional groups is mainly used, the charge transport layer is fixed in the cross linking structure with multiple linkings. Therefore, the structure of the intermediary body (cation radical) during charge transport is not stable, which may lead to deterioration of sensitivity and rise of the residual voltage by charge entrapment. The deterioration of the electric characteristics results in the decrease in the image density and an image with thinned lines. Further, the design of a typical image bearing member, which is designed to have a high transportability with less charge entrapment, can be applied to an undercoating layer of the image bearing member of the present application. Therefore, electric side effects of the cross-linking type protective layer can be limited to the minimal level.

Further, the cross-linking type protective layer of the present application is insoluble in an organic solvent during the formation of the cross-linking type protective layer. Therefore, the cross-linking type protective layer of the present application is highly anti-abrasive. The cross-linking type protective layer of the present application is formed by curing a radical polymeric monomer having three functional groups without having a charge transport structure and a radical polymeric compound having a functional group and a charge transport structure. A three-dimensional mesh structure is developed in the cross-linking type protective layer and therefore the density of the cross-linking structure therein is high. However, depending on the other components (additives such as a monomer having one or two functional groups, a polymeric binder, an anti-oxidization agent, a leveling agent and a plasticizer and a dissolved commingling component from the layer disposed under the protective layer) other than the polymeric monomer and the compound mentioned above and the curing conditions, the cross-linking density may locally be thin or a collective body of fine cured cross-linked materials having a high density is formed. In this type of cross-linking type protective layer, the linkage force among cured materials is weak and soluble in an organic agent. Further, during repetitive use in the electrophotography process, the cross-linking type protective layer tends to be locally abraded and the fine cured material is easily detached in a minute piece. As in the present application, when a cross-linking type protective layer is insoluble in an organic solvent, the proper three-dimensional mesh structure is developed with a high density. In addition, since the chain reaction proceeds in a wide area and the cured material grows and has a high molecular weight, the anti-abrasion property is highly improved.

Below is a description about the composition materials of the liquid of application for use in forming the cross-linking type protective layer of the present application.

The radical polymeric monomer having three functional groups without having a charge transport structure represents a monomer having at least three radical polymeric functional groups and not having a positive hole structure such as triaryl amine, hydrazone, pyrazoline, and carbazole, nor an electron transport structure such as condensed polycyclic quinone, diphenoquinone and electron absorbing aromatic ring having a cyano group, a nitro group, etc. Any radical polymeric functional group having one or more carbon-carbon double linkages and performing radical polymerization can be used. For example, 1-substituted ethylene functional groups and 1,1-substituted ethylene functional groups can be used as suitable radical polymeric functional groups.

A specific example of 1-substituted ethylene functional groups is the functional group represented by the following chemical formula (11):

$$CH_2{=}CH{-}X_1{-} \qquad \text{Chemical formula (11),}$$

wherein $X_1$ represents a substituted or non-substituted phenylene group, an arylene group such as a naphthylene group, a substituted or non-substituted alkenylene group, —CO—, —COO—, —CON($R_{10}$) (wherein, $R_{10}$ represents hydrogen, an alkyl group such as methyl group and ethylene group, an aralkyl group such as benzyl group, naphthyl methyl group, and phenethyl group, and an aryl group such as phenyl group and naphthyl group), or —S—.

Specific examples of such functional groups include vinyl group, styryl group, 2-methyl-1,3-butadienyl group, vinyl carbonyl group, acryloyloxy group, acryloyl amide group, and vinylthio ether group.

A specific example of 1,1-substituted ethylene functional groups is the functional group represented by the following chemical formula (12):

$$CH_2{=}C(Y){-}(X_2)_d{-} \qquad \text{Chemical formula (12),}$$

Wherein Y represents a substituted or non-substituted aralkyl group, a substituted or no-substituted phenyl group, an aryl group such as a naphthylene group, a halogen atom, a cyano group, a nitro group, an alkoxy group such as a methoxy group or an ethoxy group, $-COOR_{11}$ ($R_{11}$ represents a hydrogen atom, an alkyl group such as a substituted or no-substituted methyl group or an ethyl group, an aralkyl group such as a substituted or non-substituted benzyl group and or a phenethyl, an aryl group such as a substituted or non-substituted phenyl group or a naphthyl group or-$CONR_{12}R_{13}$ ($R_{12}$ and $R_{13}$ independently represent a hydrogen atom, an alkyl group such as a substituted or non-substituted methyl group or an ethyl group, an aralkyl group such as a substituted or non-substituted benzyl group, naphthylmethyl group, or a phenethyl group, or an aryl group such as a substituted or non-substituted phenyl group or a naphthyl group. $X_2$ represents the same substitution group as $X_1$, or an alkylene group and d represents 0 or 1. At least one of Y and $X_2$ is an oxycarbonyl group, a cyano group, an alkenylene group and an aromatic ring.

Specific examples of these functional groups include α-cyanoacryloyloxy group, a methacryloyloxy group, an α-cyanoethylene group, an α-cyanophenylene group and a methacryloylamino group.

Specific examples of substitution groups further substituted to the substitution groups of $X_1$, $X_2$ and Y include a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group.

Among these radical polymeric functional groups, acryloyloxy group, and methacyloyloxy group are particularly suitable. A compound having at least three acryloyloxy groups can be obtained by performing ester reaction or ester conversion reaction using, for example, a compound having at least three hydroxyl groups therein and an acrylic acid (salt), a halide acrylate and an ester of acrylate. Similarly, a compound having at least three methacryloyloxy groups can be obtained. In addition, the radical polymeric functional groups in a monomer having at least three radical polymeric functional groups can be the same or different from each other.

The radical polymeric monomer having three functional groups without having a charge transport structure are specifically the following compounds but not limited thereto.

Specific examples of the radical polymeric monomer mentioned above for use in the present application include trimethylol propane triacrylate (TMPTA), trimethylol propane trimethacrylate, trimethylol propane alkylene modified triacrylate, trimethylol propane ethyleneoxy modified (hereinafter referred to as EO modified) triacrylate, trimethylol propane propyleneoxy modified (hereinafter referred to as PO modified) triacrylate, trimethylol propane caprolactone modified triacrylate, trimethylol propane alkylene modified triacrylate, pentaerythritol triacrylate, pentaerythritol tetra acrylate (PETTA), glycerol triacrylate, glycerol epichlorohydrin modified (hereinafter referred to as ECH modified) triacrylate, glycerol EO modified triacrylate, glycerol PO modified triacrylate, tris (acryloxyrthyl) isocyanulate, dipenta erythritol hexacrylate (DPHA), dipenta erythritol caprolactone modified hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, phosphoric acid EO modified triacrylate, and 2,2,5,5-tetrahydroxy methyl cyclopentanone tetracrylate. These can be used alone or in combination.

In addition, the radical polymeric monomer having three functional groups without having a charge transport structure for use in the present application preferably has a ratio (molecular weight/the number of functional groups) of the molecular weight to the number of functional groups in the monomer is not greater than 250 to form a dense cross-linking in a cross-linking type protective layer. Further, since a cross-linking type protective layer formed of such a monomer is slightly soft, when the ratio (molecular weight/the number of functional groups) is too large, the anti-abrasion property thereof tends to deteriorate. Therefore, among the monomers mentioned above, it is not preferred to singly use a monomer having an extremely long modified (EO, PO, caprolactone modified) group. In addition, the content ratio of the radical polymeric monomer having three functional groups without having a charge transport structure is from 20 to 80% by weight and preferably from 30 to 70% by weight based on the total weight of a cross-linking type protective layer. When the monomer content ratio is too small, the density of three-dimensional cross-linking in a cross-linking type protective layer tends to be small. Therefore, the anti-abrasion property thereof is not drastically improved in comparison with a case in which a typical thermal plastic binder resin is used. When the monomer content ratio is too large, the content of a charge transport compound decreases, which may cause deterioration of the electric characteristics. Desired electric characteristics and anti-abrasion property vary depending on the process and the layer thickness of the cross-linking type protective layer for use in the present application varies. Therefore, it is difficult to jump to any conclusion but considering the balance, the range of from 30 to 70% by weight is preferred.

The radical polymeric monomer having a functional group and a charge transport structure for use in the cross-linking type protective layer of the present application represents a monomer having a radical polymeric functional group which has a positive hole structure such as triaryl amine, hydrazone, pyrazoline, and carbazole, or an electron transport structure such as condensed polycyclic quinone, diphenoquinone and electron absorbing aromatic ring having a cyano group, a nitro group, etc. As the radical polymeric functional group, the radical polymeric functional group mentioned in the radical polymeric monomer mentioned above can be suitably used. Especially, acryloyloxy group and methcryloyloxy group are suitable. In addition, a triaryl amine structure is high effective as charge transport structure. Among these, when a compound having the structure represented by the following chemical formulae (13) and (14) is used, the electric characteristics such as sensitivity and residual voltage are preferably maintained during repetitive use.

Chemical formula 17

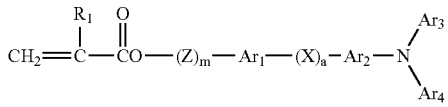

Chemical formula 18

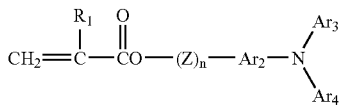

wherein, $R_1$ represents hydrogen atom, a halogen atom, an alkyl group, an aralky group, an aryl group, a cyano group, a nitro group, an alkoxy group, —$COOR_7$, wherein $R_7$ represents hydrogen atom, a halogen atom, an alkyl group, an aralkyl group or an aryl group, a halogenated carbonyl group or $CONR_8R_9$, wherein $R_8$ and $R_9$ independently represent hydrogen atom, a halogenatom, an alkyl group, an aralkyl group or an aryl group, $Ar_1$ and $Ar_2$ independently represent an arylene group, $Ar_3$ and $Ar_4$ independently represent an aryl group, X represents an alkylene group, a cycloalkylene group, an alkylene ether group, oxygen atom, sulfur atom or a vinylene group, Z represents an alkylene group, an alkylene ether divalent group or an alkyleneoxy carbonyl divalent group, and a represents 0 or 1, m and n represent an integer of from 0 to 3.

Specific examples of the structure represented by the chemical formulae (13) and (14) are as follows.

In the chemical formulae (13) and (14), the alkyl group of $R_1$ is, for example, methyl group, ethyl group, propyl group, and butyl group. The aryl group thereof is, for example, phenyl group and naphtyl group. The aralkyl group thereof is, for example, benzyl group, phenthyl group, naphtyl methyl group. The alkoxy group thereof is, for example, methoxy group, ethoxy group and propoxy group. These can be substituted by a halogen atom, nitrogroup, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group.

Among these substitution groups for $R_1$, hydrogen atom and methyl group are especially preferred.

$Ar_3$ and $Ar_4$ represent a substituted or non-substituted aryl group. In the present application, condensed polycyclic hydrocarbon groups, non-condensed ring hydrocarbon groups and heterocyclic groups. Specific examples thereof are as follows.

Specific examples of the condensed polycyclic hydrocarbon groups include a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include a single-valent group such as carbazol, dibenzofuran, dibenzothiophene, oxadiazole, and thiadiazole.

The aryl groups represented by $Ar_3$ and $Ar_4$ can have a substitution group. Specific examples thereof are as follows:

(1) a halogen atom, cyano group, and nitro group;

(2) an alkyl group, preferably a straight chained or side chained alkyl group having 1 to 12, more preferably 1 to 8 and furthermore preferably from 1 to 4 carbons. These alkyl groups can have a fluorine atom, a hydroxyl group, an alkoky group having 1 to 4 carbons, a phenyl group or a phenyl group substituted by a halogen atom, an alkyl group having 1 to 4 carbon atoms or an alkoxy group having 1 to 4 carbon atoms. Specific examples thereof include methyl group, ethyl group, n-butyl group, I-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) an alkoxy group (—$OR_2$), wherein $R_2$ is the alkyl group represented in (2). Specific examples thereof include methoxy group, ethoxy group, n-propoxy group, i-propoxy group, t-butoxy group, n-butoxy group, s-butoxy group, i-butoxy group, 2-hydroxy ethoxy group, benzyl oxy group and trifluoromethoxy group;

(4) an aryloxy group. As an aryl group, phenyl group, and naphtyl group are included. These can contain an alkoxy group having 1 to 4 carbon atoms, an alkyl group having a 1 to 4 carbon atoms or a halogen atom as a substitution group. Specific examples include phenoxy group, 1-naphtyloxy group, 2-naphtyloxy group, 4-methoxyphenoxy group, and 4-methylphenoxy group;

(5) an alkyl mercapto group or an aryl mercapto group. Specific examples thereof include methylthio group, ethylthio group, phenylthio group, and p-methylphenylthio group;

(6)

Chemical formula 15

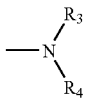

In Chemical formula 15, $R_3$ and $R_4$ independently represent a hydrogen atom, the alkyl group defined in (2), or an aryl group. Specific examples of the aryl groups include phenyl group, biphenyl group, or naphtyl group. These can contain an alkoxy group having 1 to 4 carbon atoms, an alkyl group having 1 to 4 carbon atoms or a halogen atom as a substitution group. $R_3$ and $R_4$ can form a ring together.

Specific examples thereof include amino group, diethyl amino group, N-methyl-N-phenyl amino group, N,N-diphenyl amino groupo, N,N-di(tril) amino group, dibenzyl amino group, piperidino group, morpholino group, and pyrrolidino group;

(7) an alkylene dioxy group or an alkylene dithio such as methylene dioxy group and methylene dithio group; and (8) a substituted or non-substituted styryl group, a substituted or non-substituted β-phenyl styryl group, diphenyl aminophenyl group, ditril aminophenyl group, etc.

The arylene groups represented by $Ar_1$ and $Ar_2$ are divalent groups derived from the aryl group represented by $Ar_3$ and $Ar_4$ mentioned above.

The X in Chemical formula (13) represents a substituted or non-substituted alkylene group, a substituted or non-substituted cycloalkylene group, a substituted or non-substituted alkylene ether group, an oxygen atom, a sulfer atom, or a vinylene group.

Specific examples of the substituted or non-substituted alkylene groups include a straight chained or side chained alkylene group having 1 to 12, more preferably 1 to 8 and furthermore preferably from 1 to 4 carbons. These alkylene groups can furtherhave a fluorine atom, a hydroxyl group, an alkoky group having 1 to 4 carbons, a phenyl group or a phenyl group substituted by a halogen atom, an alkyl group having 1 to 4 carbon atoms or an alkoxy group having 1 to 4 carbon atoms. Specific examples thereof include methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylpheny ethylene group, and 4-biphenyl ethylene group.

Specific examples of the substituted or non-substituted cycloalkylene groups include cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms. Specific examples thereof include cyclohexylidene group, cyclohexylene group, and 3,3-dimethyl cyclohexylidene group.

Specific examples of the substituted or non-substituted alkylene ether groups include ethyleneoxy, propyleneoxy, ethyleneglycol, propylene glycol, diethylene glycol, tetraethylene glycol, and tripropylene glycol. These alkylene ether groups can have a substitution group such as hydroxyl group, methyl group and ethyl group.

The vinylene group is represented by the following chemical formulae (16) and (17):

Chemical formula 16

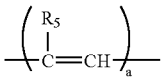

Chemical formula 17

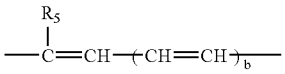

wherein, $R_5$ represents hydrogen or an alkyl group (the same as the alkylene groups defined in (2)) and a represents 1 or 2 and b is an integer of from 1 to 3.

The Z mentioned in Chemical formulae (13) and (14) represents a substituted or non-substituted alkylene group, a substituted or non-substituted alkylene ether divalent group or an alkyleneoxy carbonyl divalent group.

Specific examples of the substituted or non-substituted alkylene groups include the same as those mentioned for the X mentioned above.

Specific examples of the substituted or non-substituted alkylene ether divalent groups include the same as those mentioned for the X mentioned above.

Specific examples of the alkyleneoxy carbonyl divalent group include caprolactone modified divalent group.

The compound represented by the following chemical formula (18) as a further suitably preferred radical polymeric compound having a functional group with a charge transport structure:

u, r, p, q represent 0 or 1, s and t represent an integer of from 0 to 3, Ra represents hydrogen atom or methyl group, Rb and Rc independently represent an alkyl group having 1 to 6 carbon atoms, and Za represents methylene group, ethylene group, —$CH_2CH_2O$—, —$CHCH_3CH_2O$—, or —$C_6H_5CH_2CH_2$—.

The compound represented by the chemical formula (18) illustrated above is especially preferably methyl group or ethyl group as a substitution group of Rb and Rc.

The radical polymeric compound having a functional group with a charge transport structure for use in the present application represented by the chemical formulae (13), (14) and (18) is polymerized in a manner that both sides of the carbon-carbon double bond are open. Therefore, the radical polymer compound does not constitute an end of the structure and is set in a chained polymer. The radical polymeric compound having a functional group is present in the main chain of a polymer in which cross-linking is formed by polymerization with a radical polymeric monomer having 3 functional groups or a cross-linking chain between the main chains. There are two kinds of the cross-linking chains. One is the cross-linking chain between a polymer and another polymer and the other is the cross-linking chain formed by cross-linking a portion in the main chain present in a folded state in a polymer and a moiety deriving from a monomer polymerized away from the portion. Whether a radical polymeric compound having a functional group with a charge transport structure is present in a main chain or in a cross-linking chain, the triaryl amine structure suspends from the chain portion. The triaryl amine structure has at least three aryl groups disposed in the radial directions relative to the nitrogen atom therein. Such a triaryl amine structure is bulky but does not directly bind with the chain portion and suspends from the chain portion via the carbonyl group, etc. That is, the triaryl amine structure is stereoscopically fixed in a flexible state. Therefore, these triaryl amine structures can be adjacent to each other with a moderate space. Therefore, the structural distortion is slight in a molecule. In addition, when the structure is used in the surface layer of an image bearing member, it can be deduced that the internal molecular structure can have a structure in which there are relatively few disconnections in the charge transport route.

Below are the specific examples of the radical polymeric compounds having a functional group with a charge transport structure of the present application. But the radical polymeric compounds are not limited thereto.

Chemical formula 18

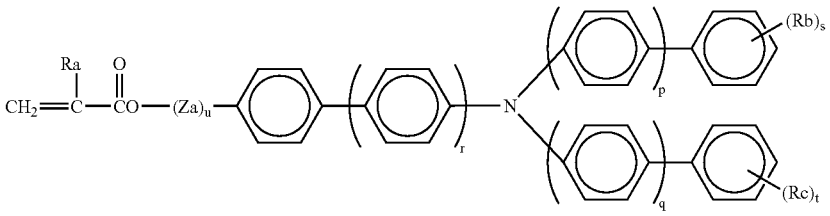

No. 1
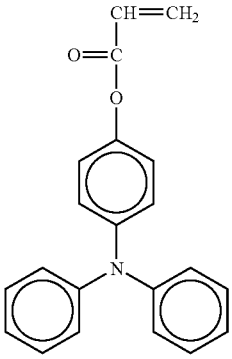
No. 2
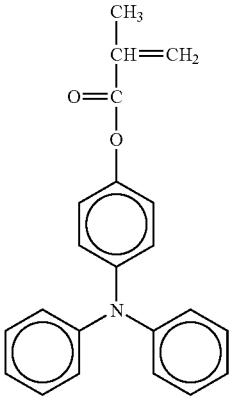
No. 3
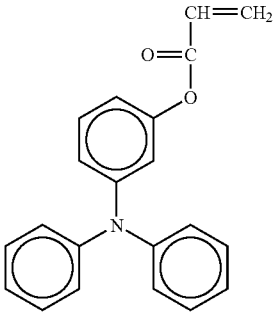
No. 4
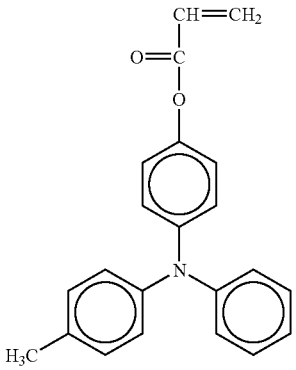
-continued
No. 5
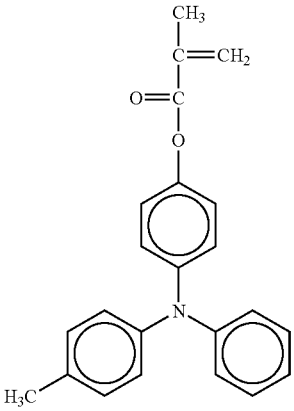
No. 6
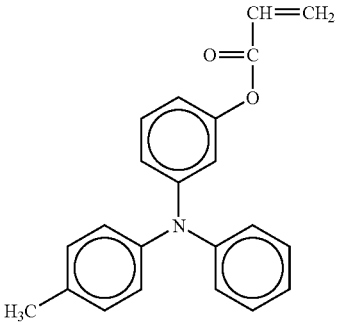
No. 7
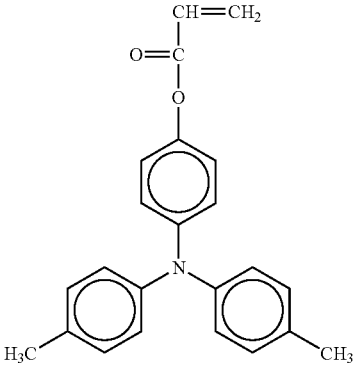
No. 8
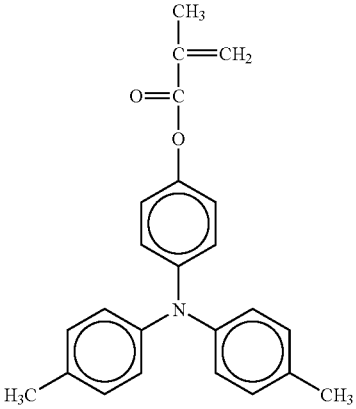

-continued
No. 9
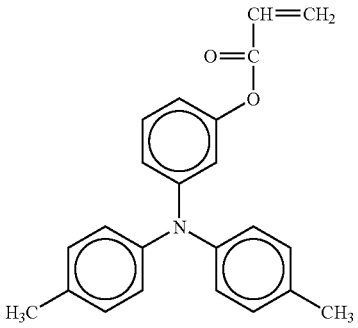
No. 10
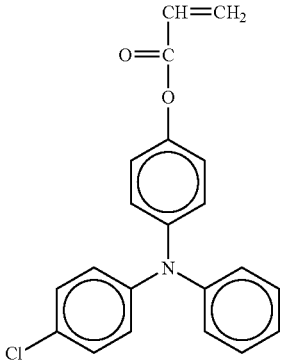
No. 11
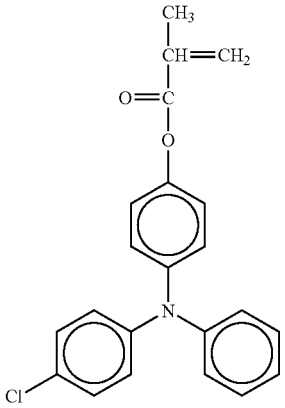
No. 12
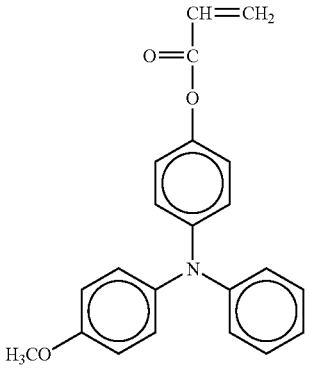
-continued
No. 13
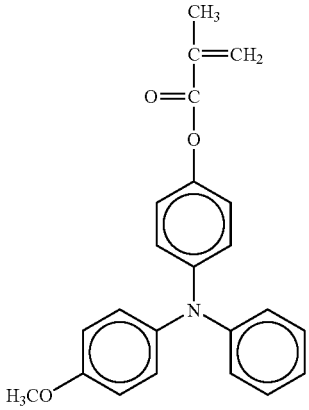
No. 14
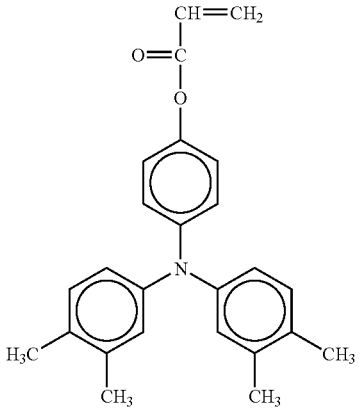
No. 15
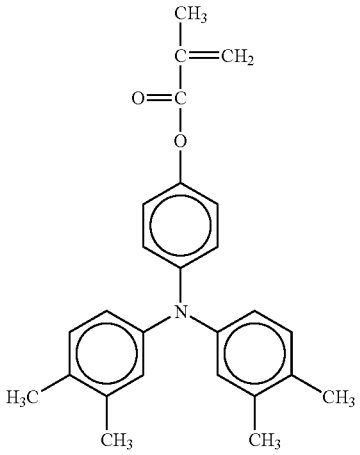

-continued
No. 16
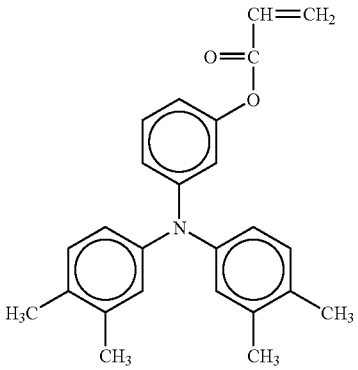
No. 17
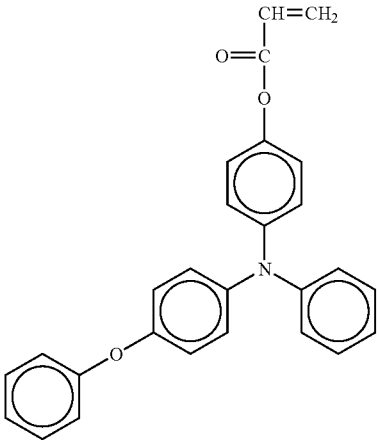
No. 18
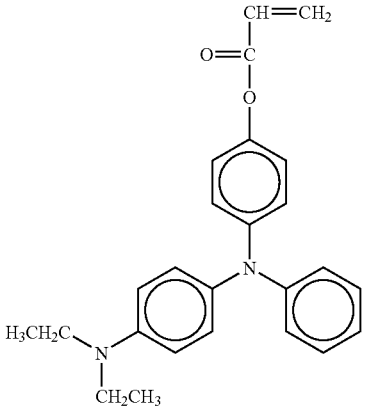
-continued
No. 19
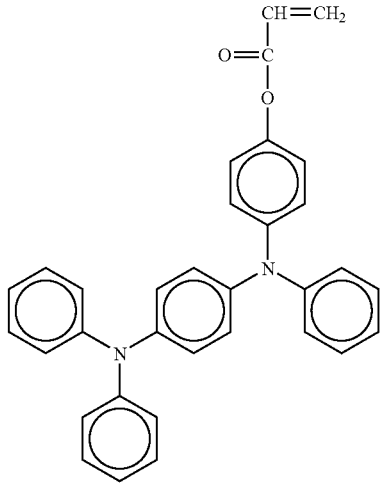
No. 20
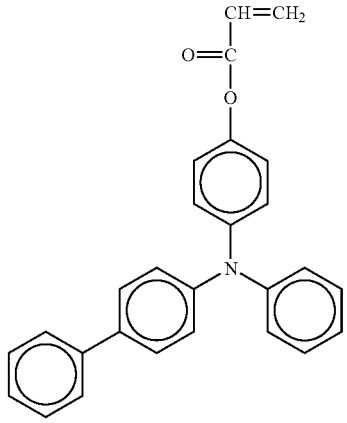
No. 21
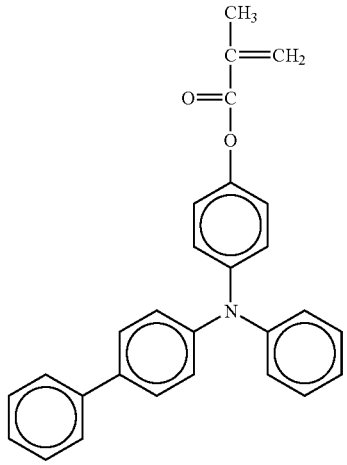

-continued
No. 22
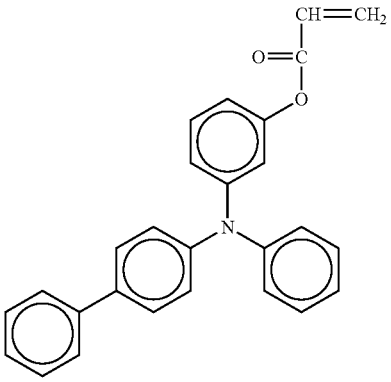
No. 23
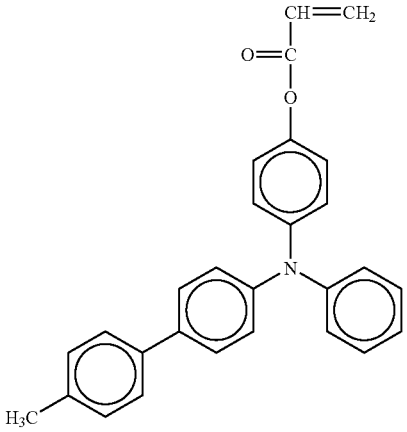
No. 24
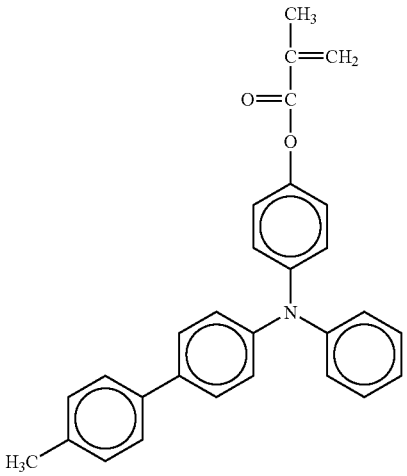
-continued
No. 25
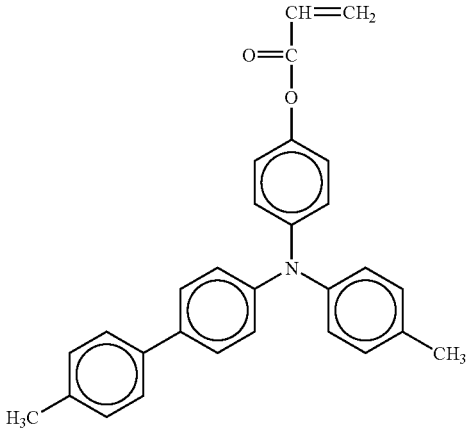
No. 26
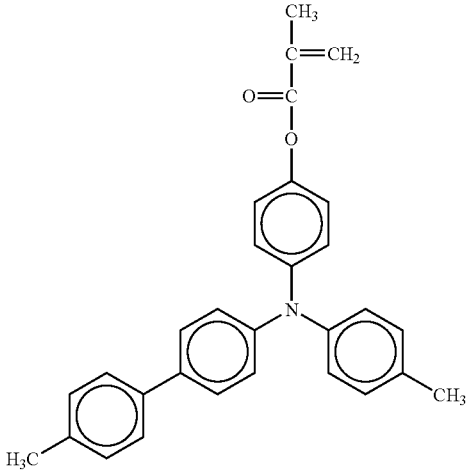
No. 27
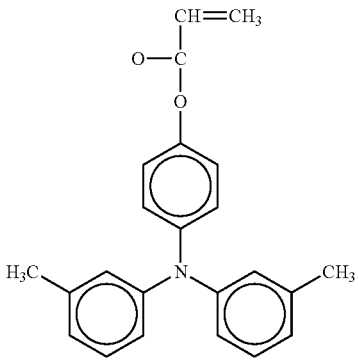

-continued
No. 28
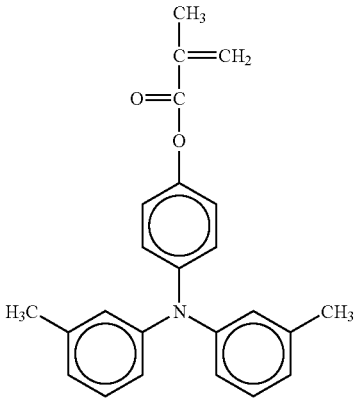
No. 29
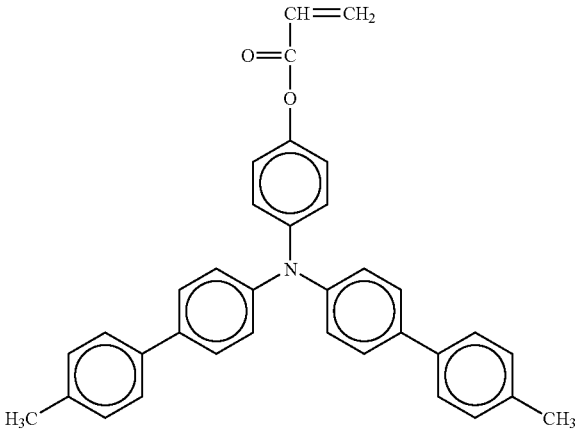
No. 30
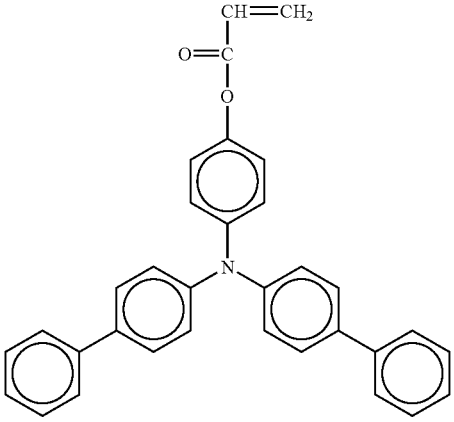
No. 31
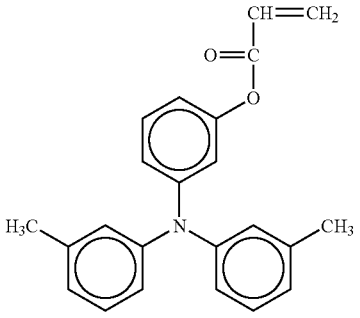
-continued
No. 32
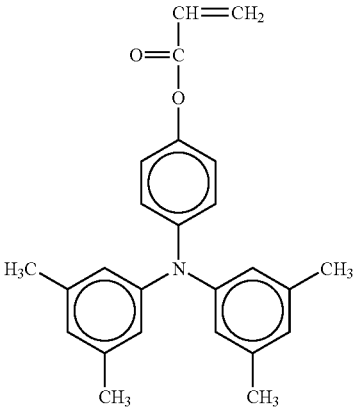
No. 33
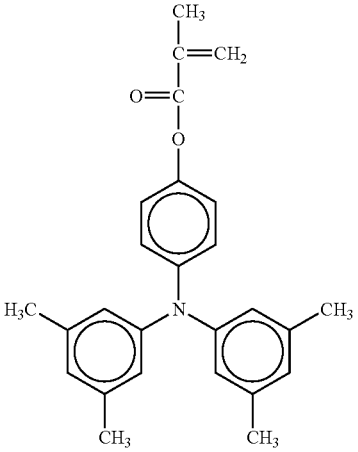
No. 34
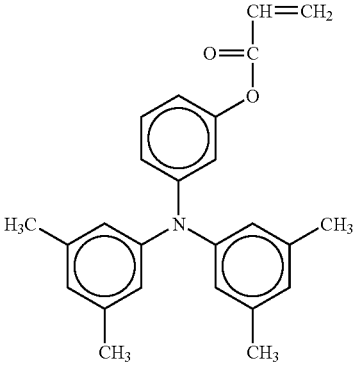
No. 35
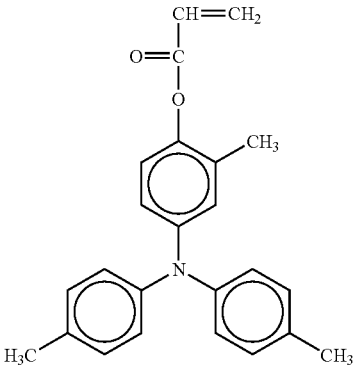

-continued
No. 36
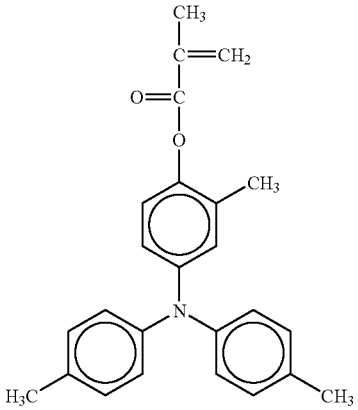
No. 37
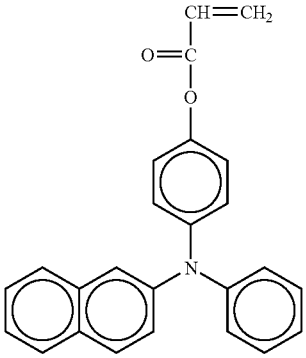
No. 38
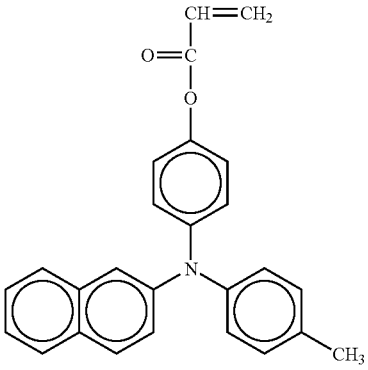
No. 39
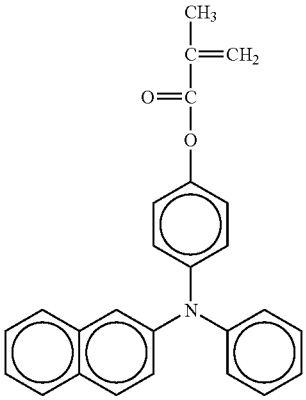
-continued
No. 40
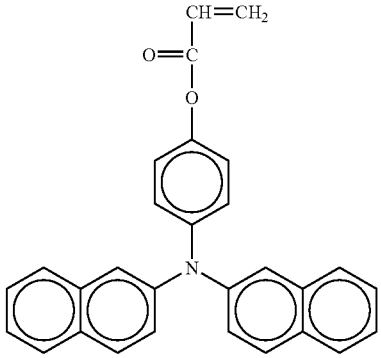
No. 41
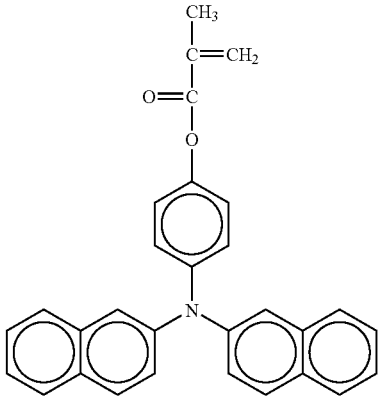
No. 42
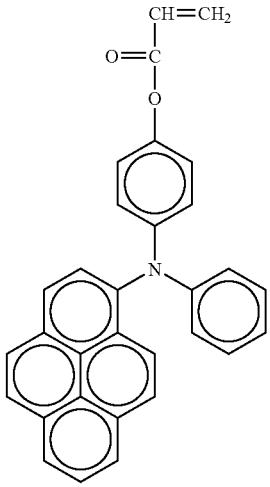

-continued
No. 43
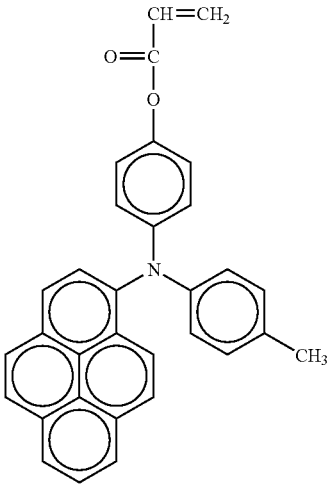
No. 44
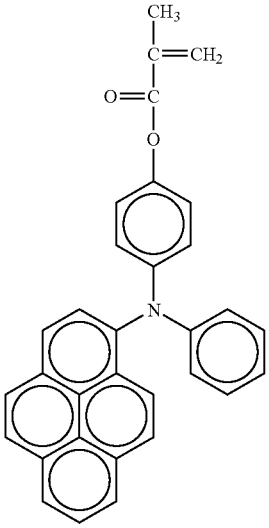
No. 45
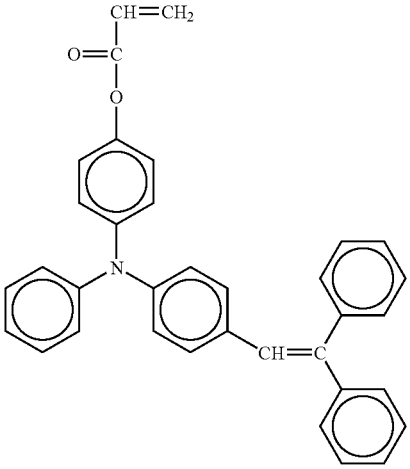
-continued
No. 46
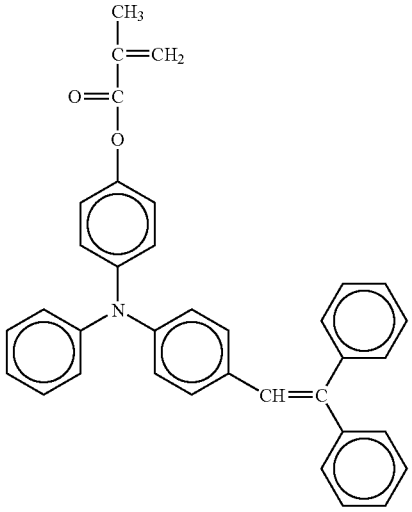
No. 47
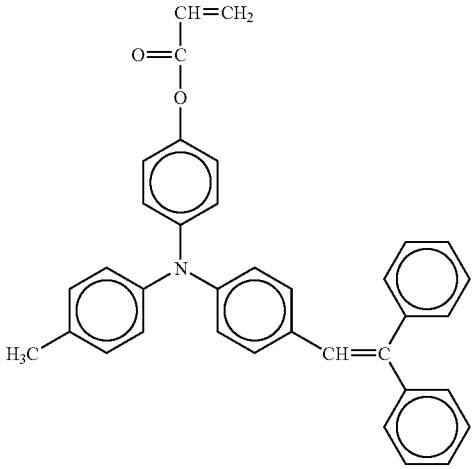
No. 48
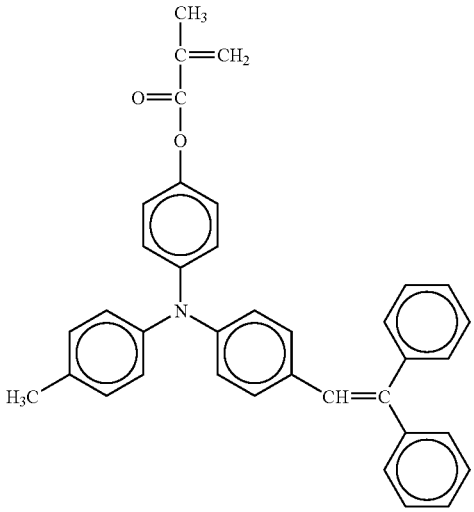

-continued
No. 49
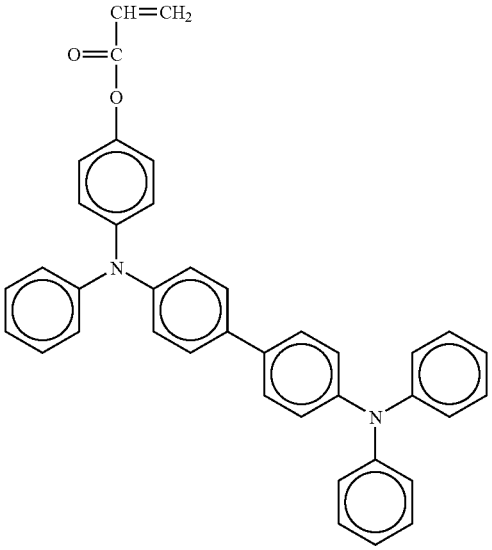
No. 50
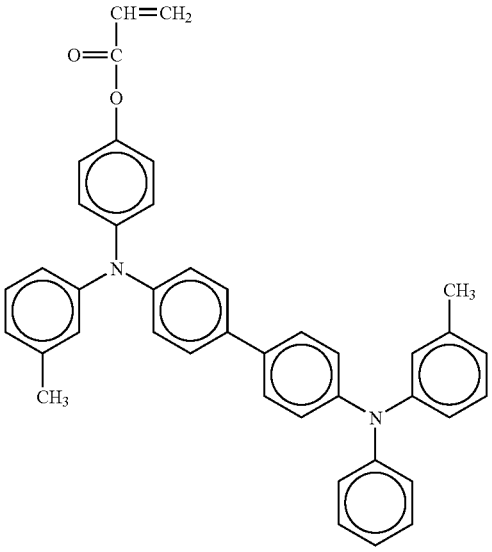
No. 51
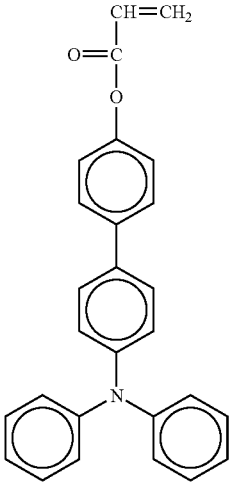
-continued
No. 52
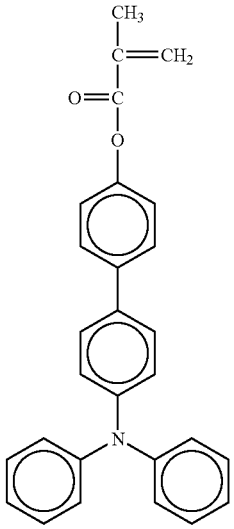
No. 53
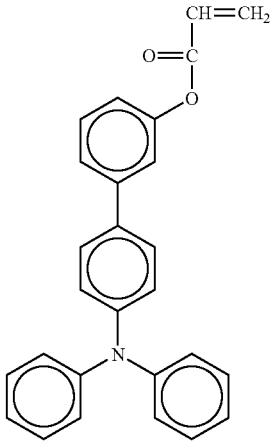
No. 54
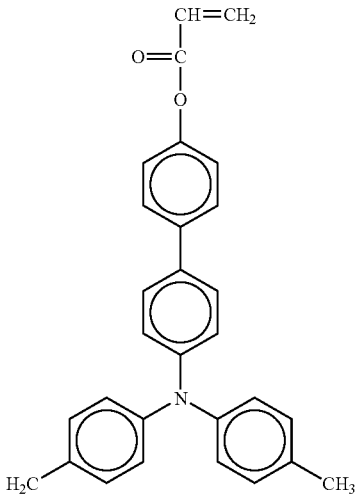

-continued
No. 55
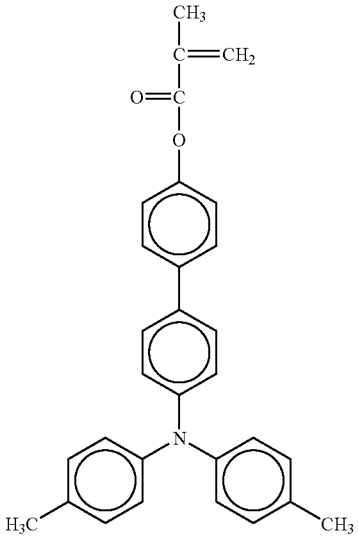
No. 56
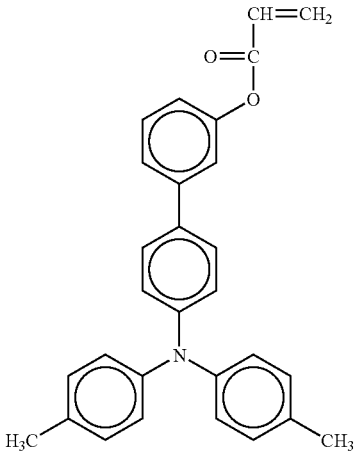
No. 57
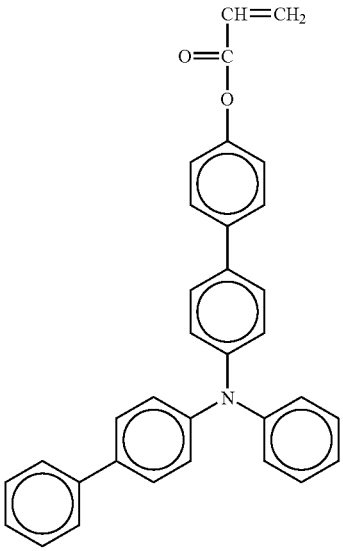
-continued
No. 58
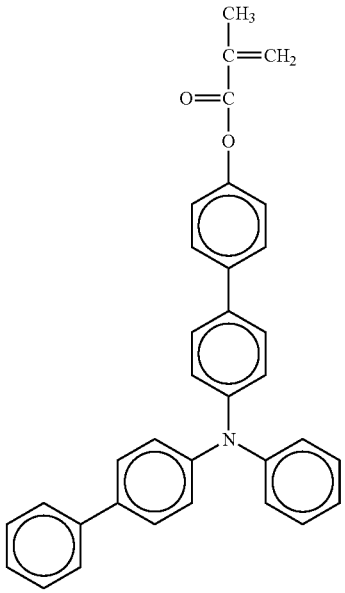
No. 59
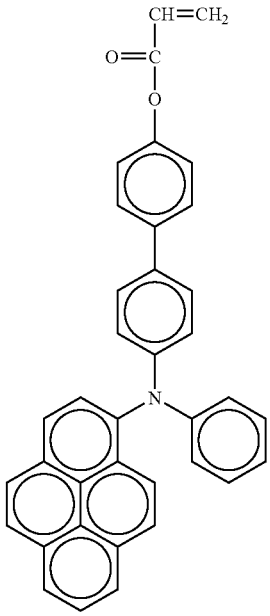

-continued
No. 60
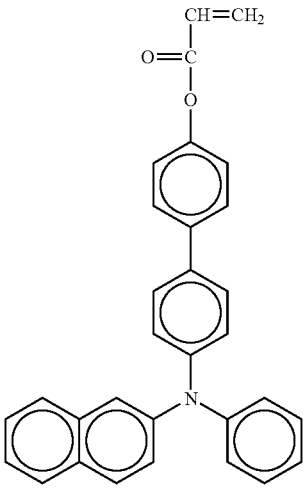
No. 61
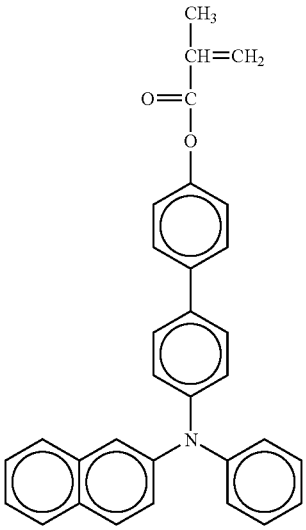
No. 62
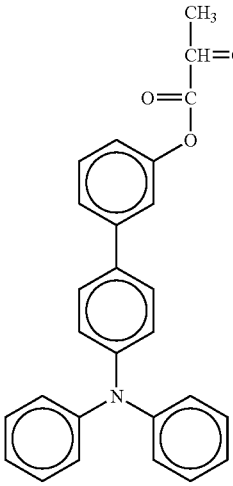
-continued
No. 63
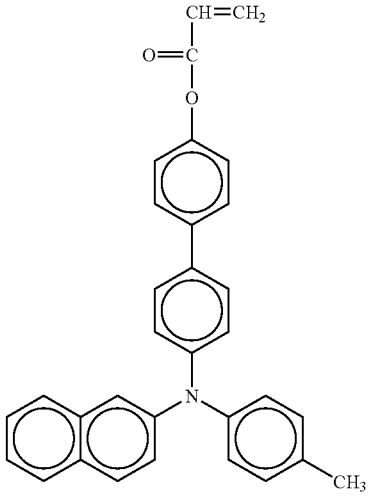
No. 64
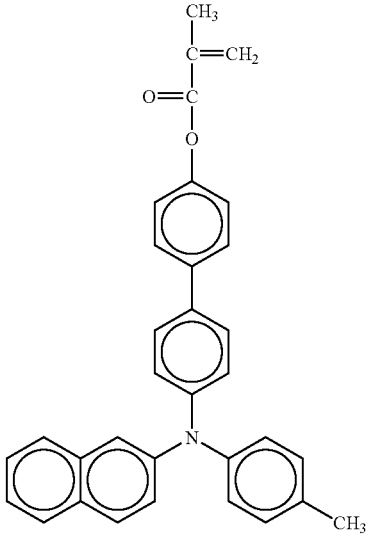
No. 65
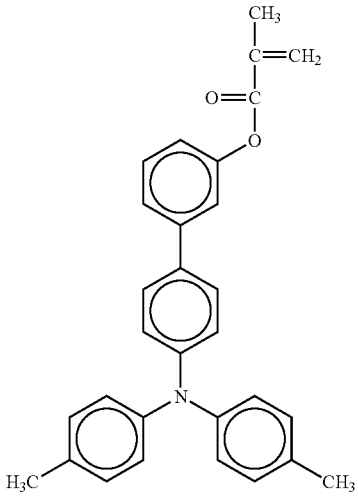

-continued
No. 66
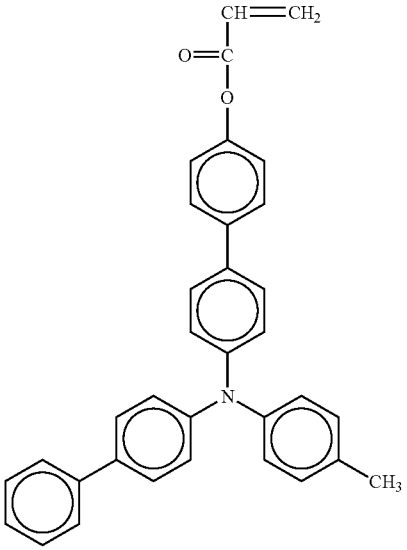
No. 67
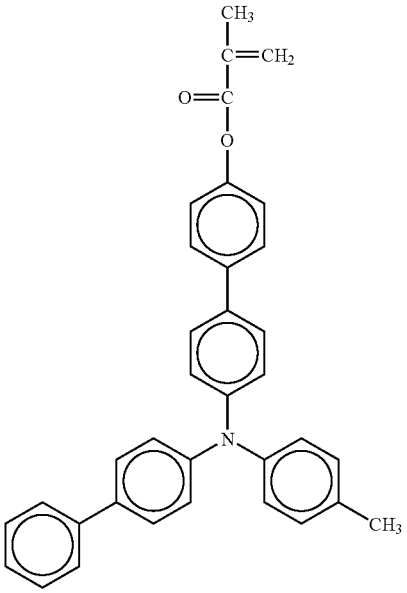
-continued
No. 68
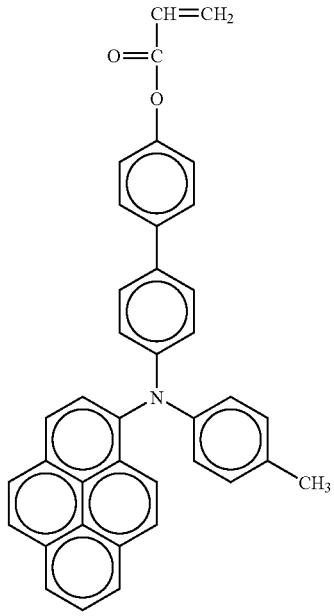
No. 69
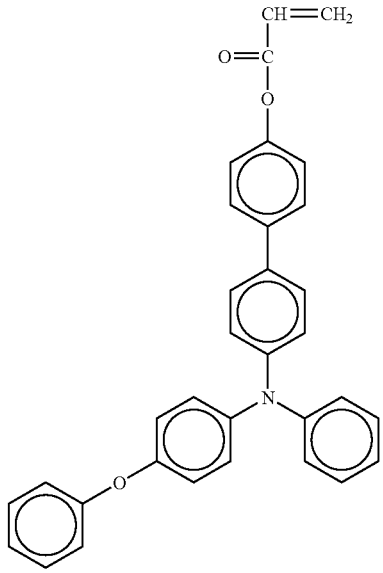

-continued
No. 70
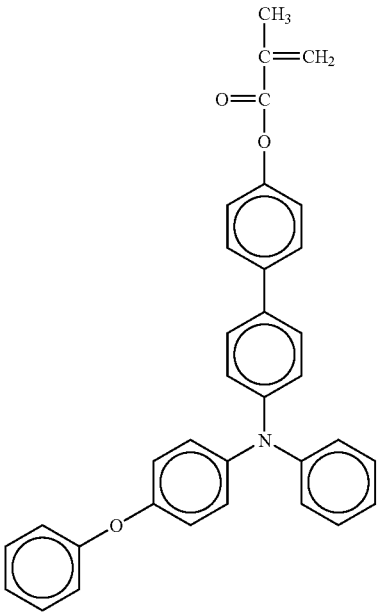
No. 71
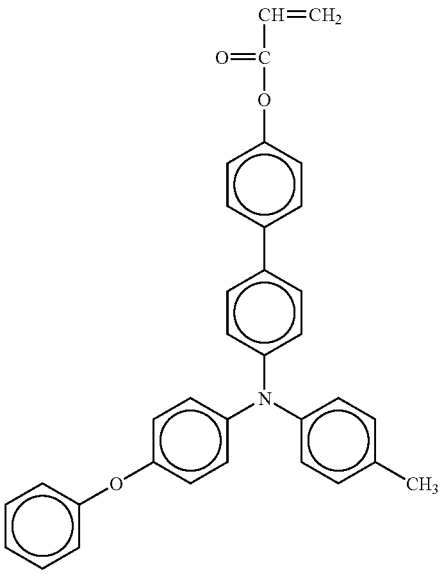
-continued
No. 72
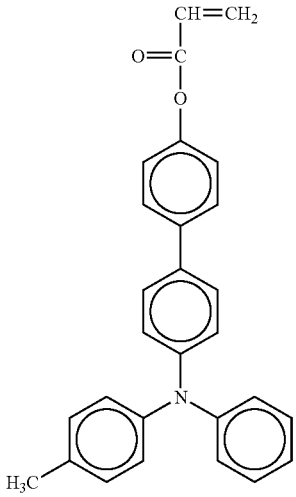
No. 73
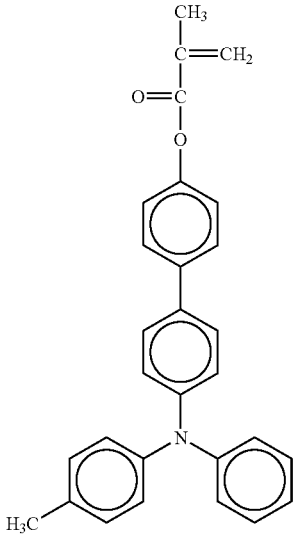
No. 74
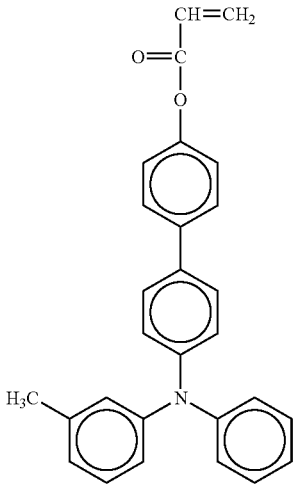

-continued
No. 75
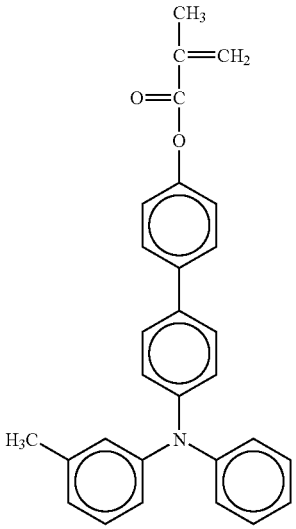
No. 76
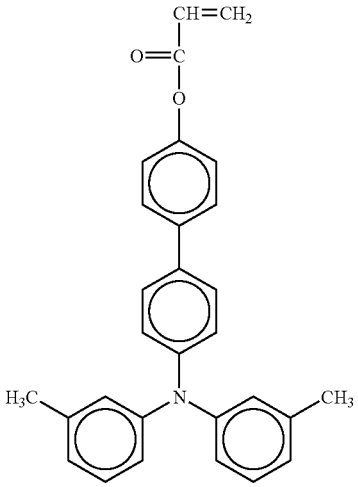
No. 77
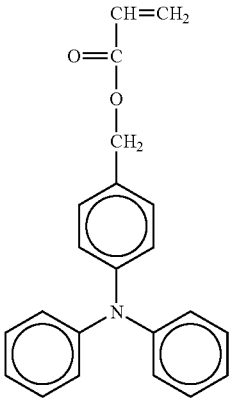
-continued
No. 78
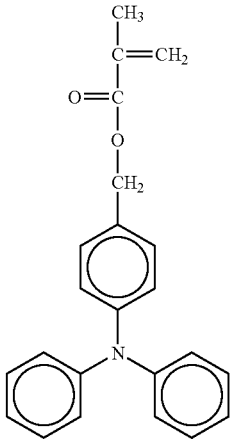
No. 79
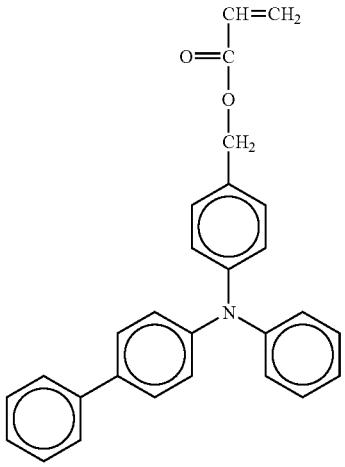
No. 80
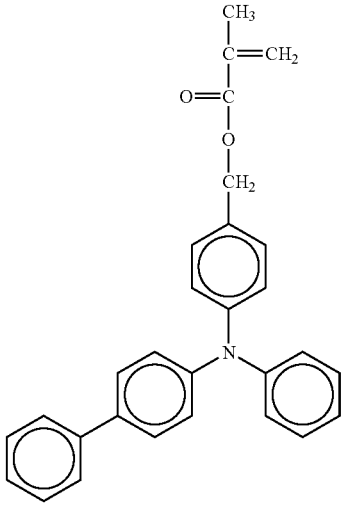

-continued
No. 81
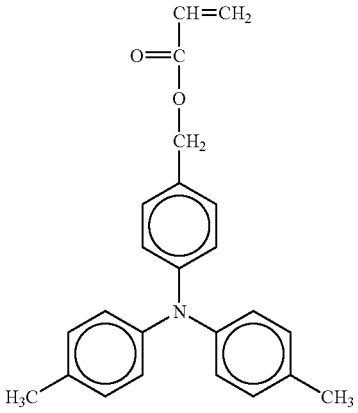
No. 82
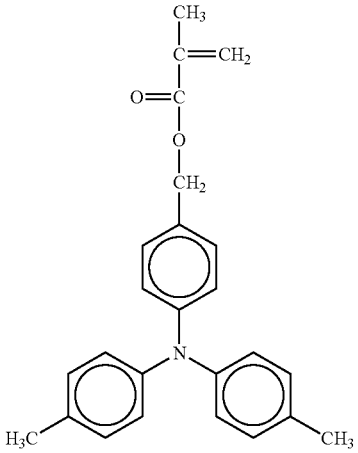
No. 83
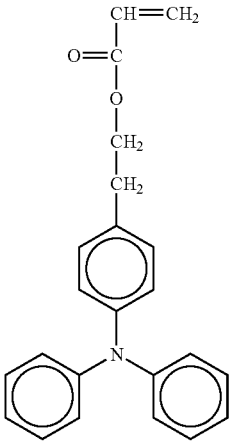
-continued
No. 84
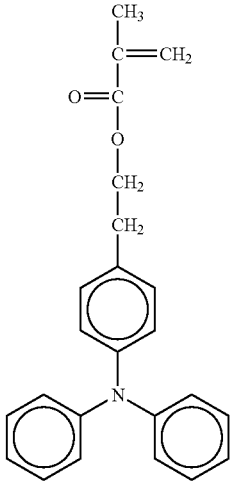
No. 85
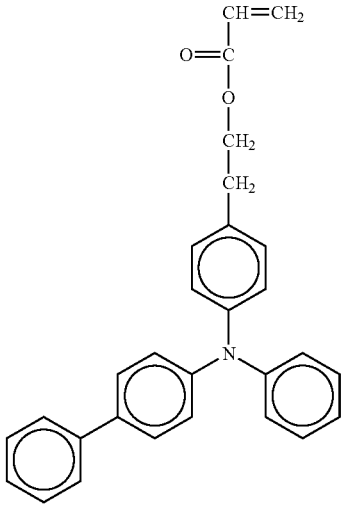
No. 86
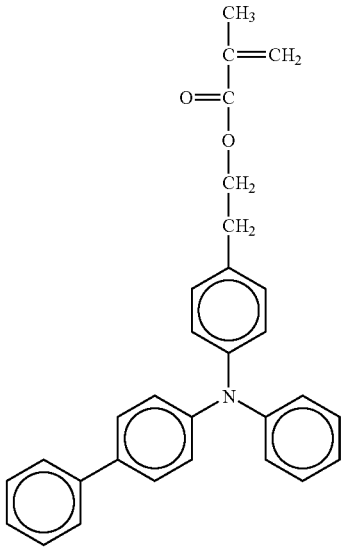

-continued
No. 87
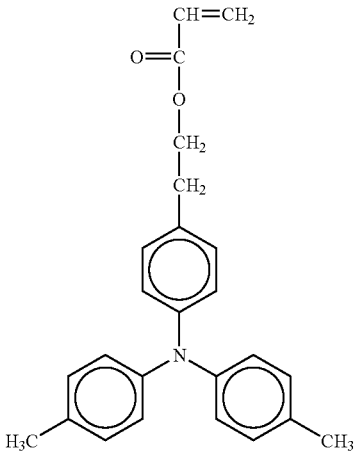
No. 88
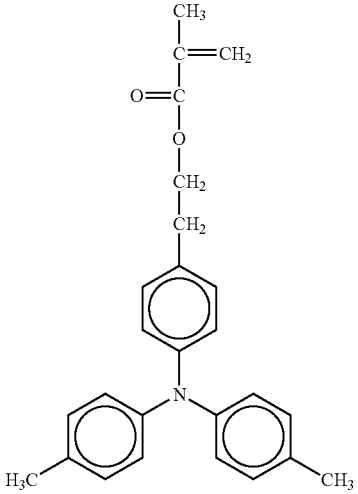
No. 89
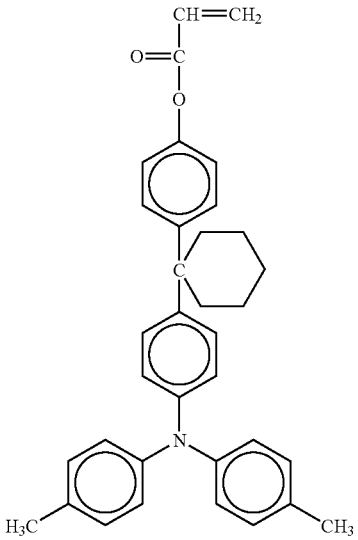
-continued
No. 90
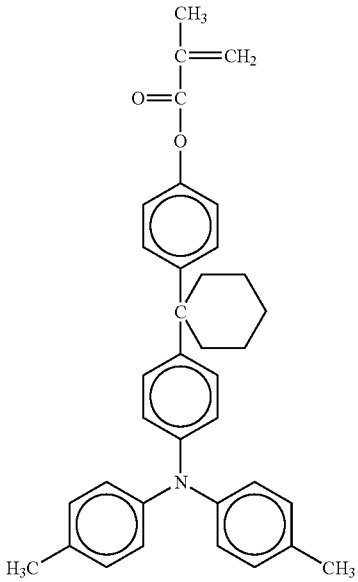
No. 91
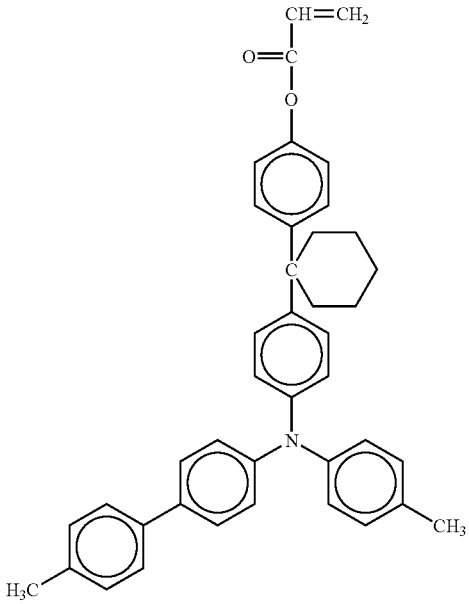

-continued
No. 92
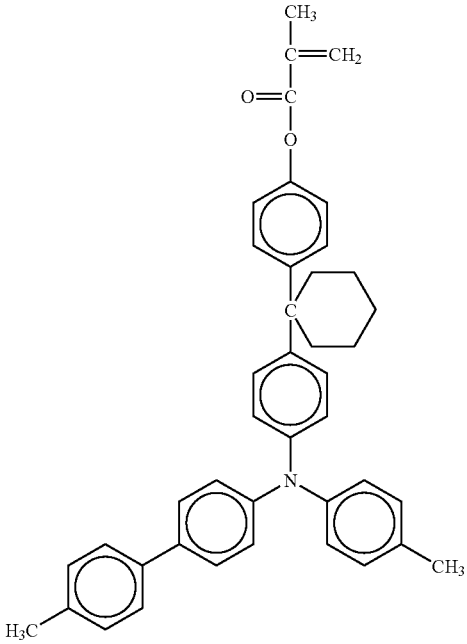
No. 93
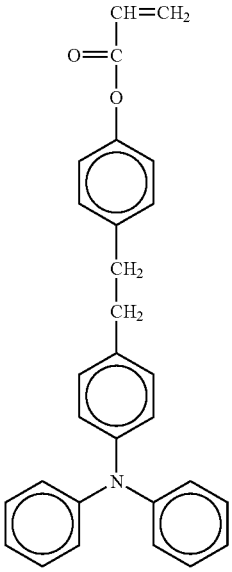
-continued
No. 94
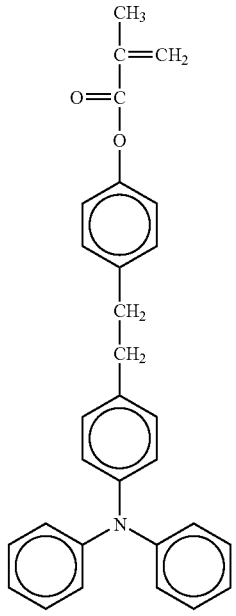
No. 95
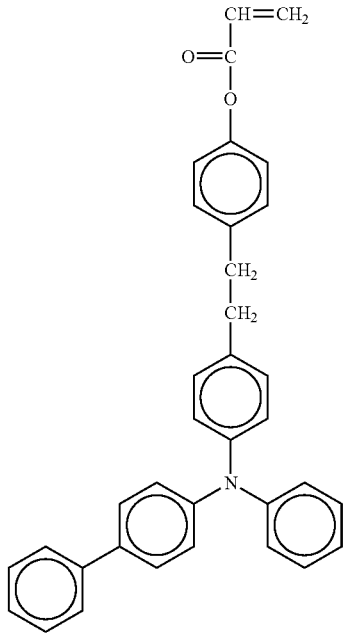

-continued
No. 96
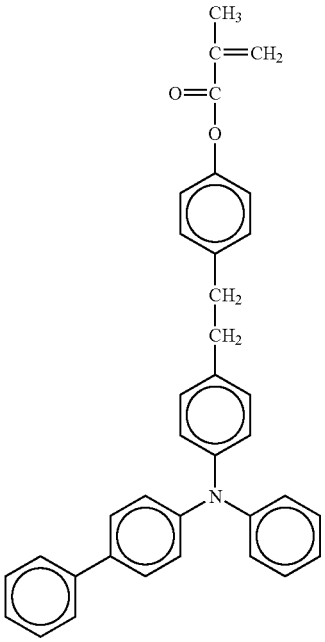
No. 97
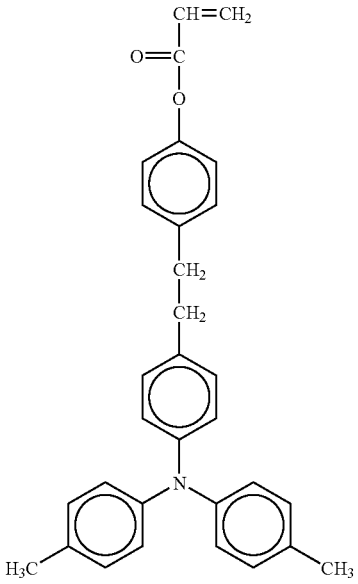
-continued
No. 98
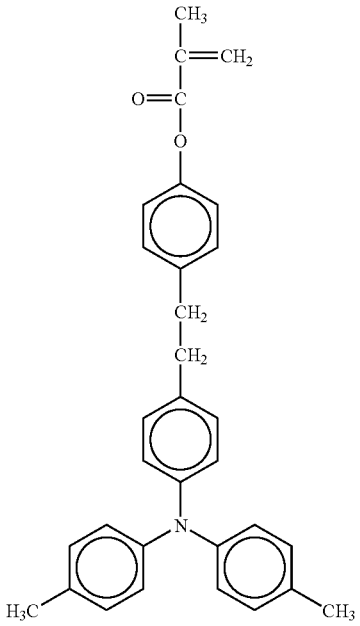
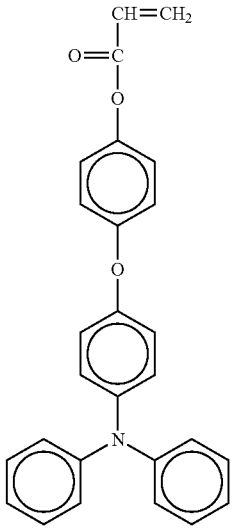

-continued
No. 100
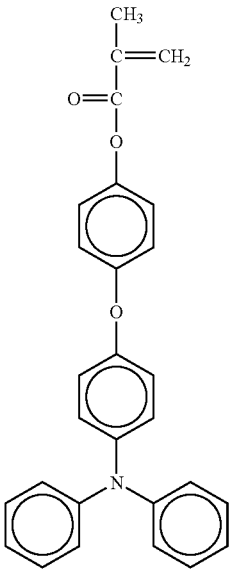
No. 101
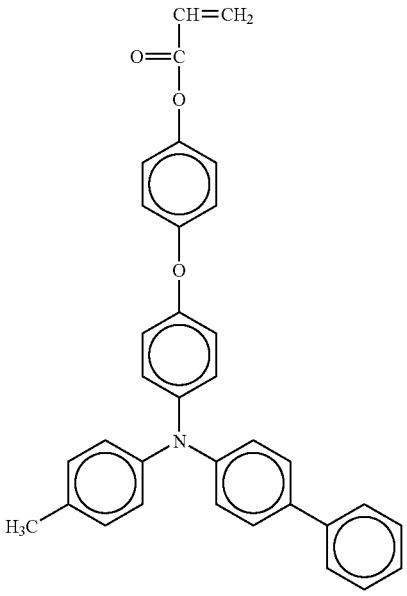
-continued
No. 102
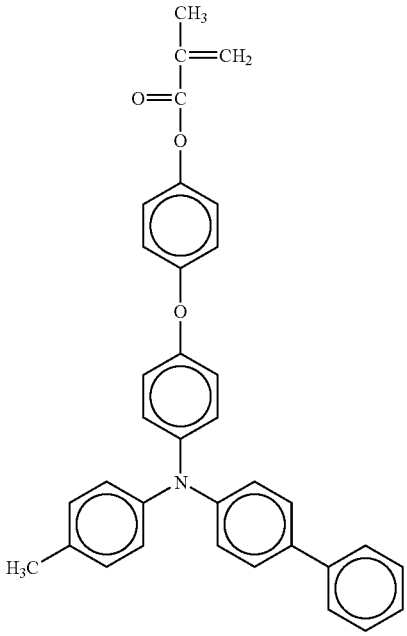
No. 103
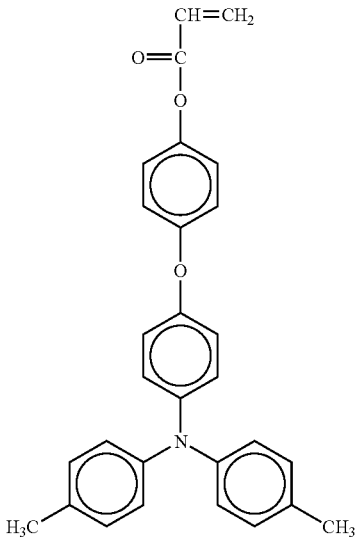

-continued
No. 104
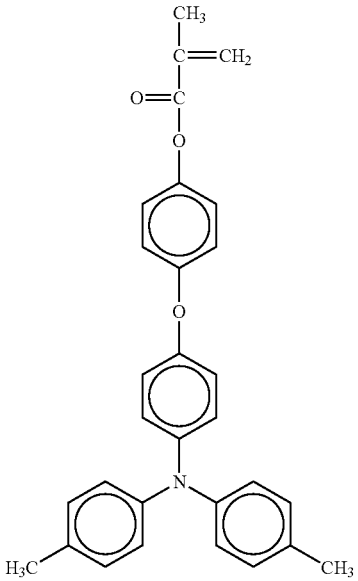
No. 105
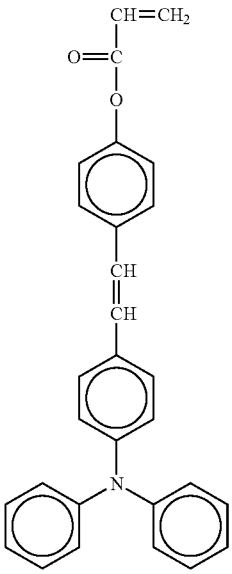
-continued
No. 106
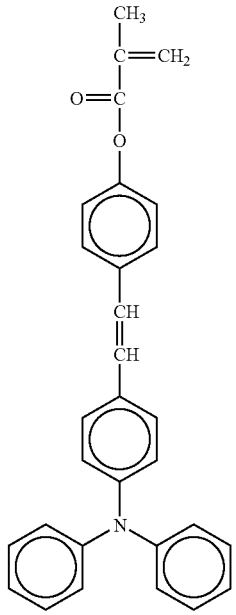
No. 107
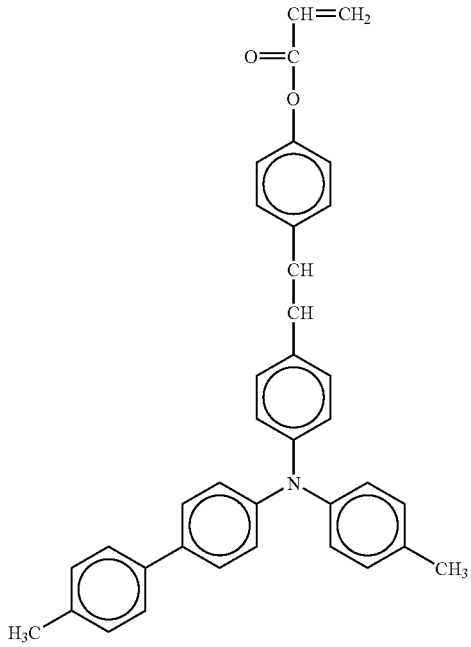

-continued
No. 108
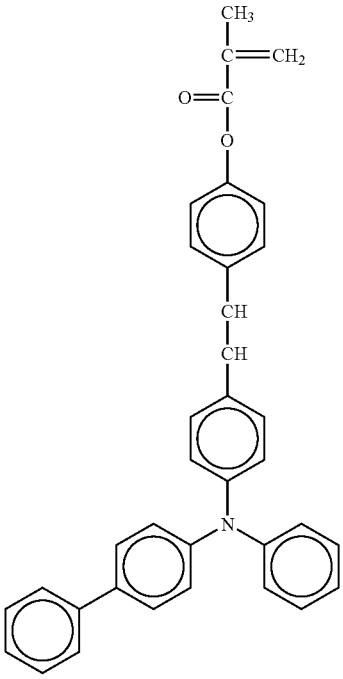
No. 109
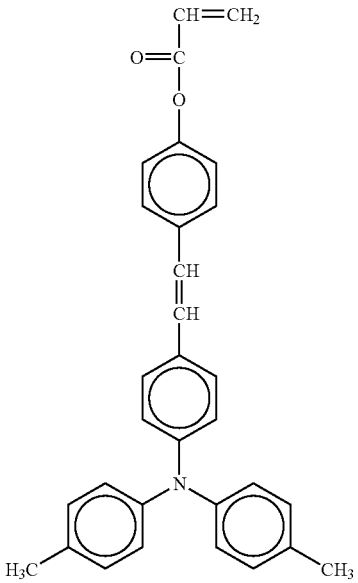
-continued
No. 110
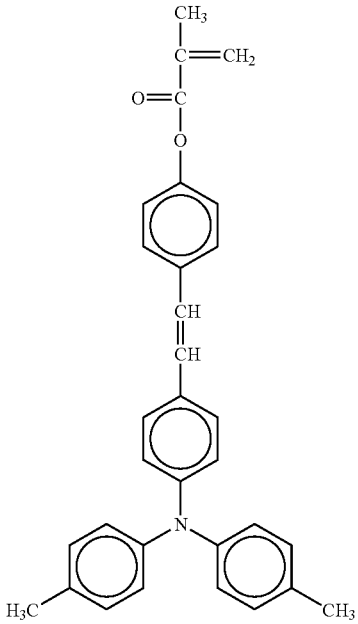
No. 111
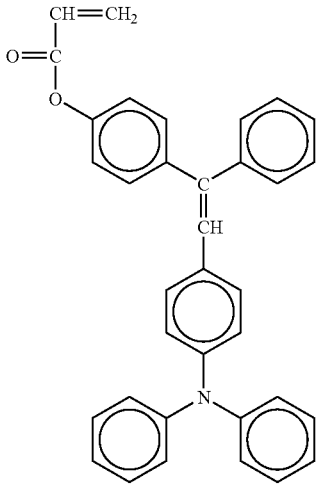
No. 112
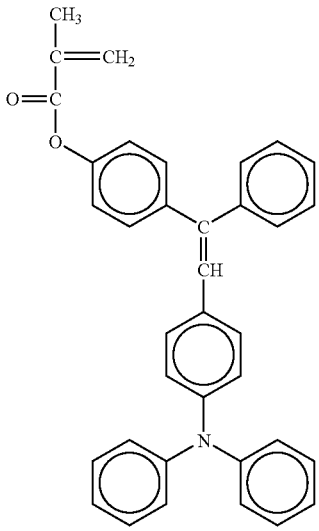

-continued
No. 113
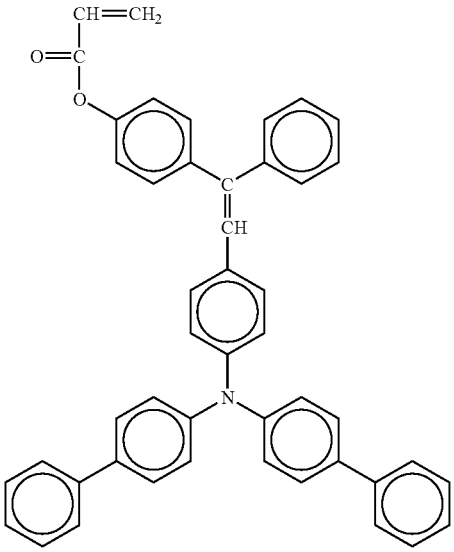
No. 114
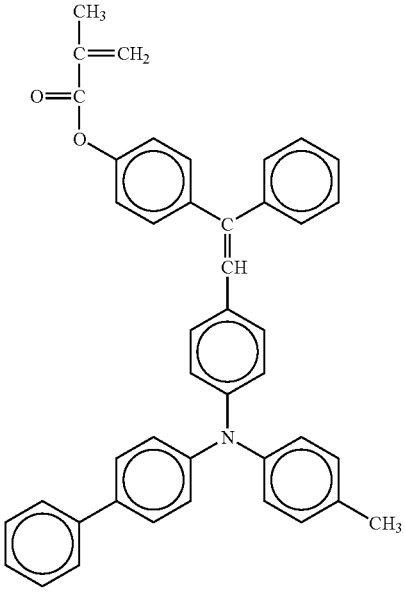
No. 115
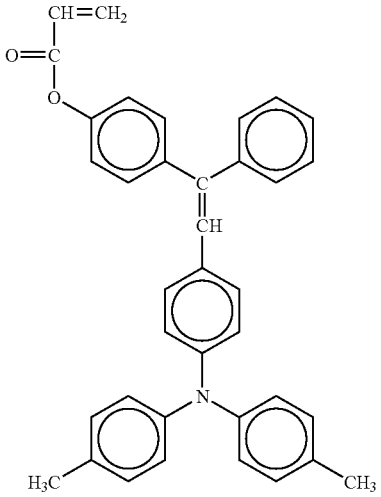
-continued
No. 116
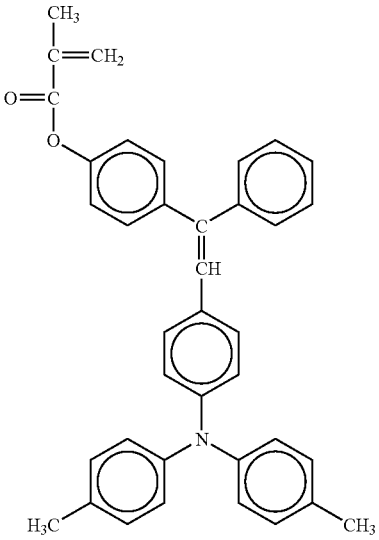
No. 117
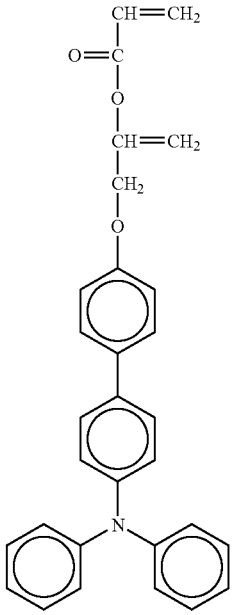

-continued
No. 118
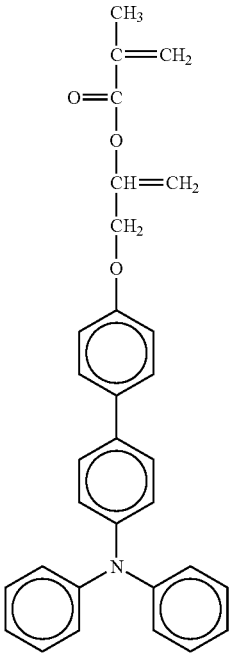
No. 119
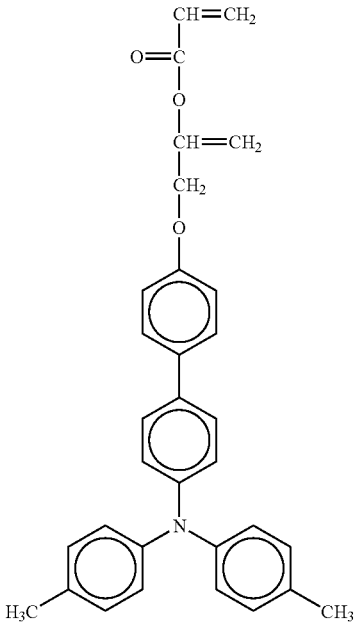
-continued
No. 120
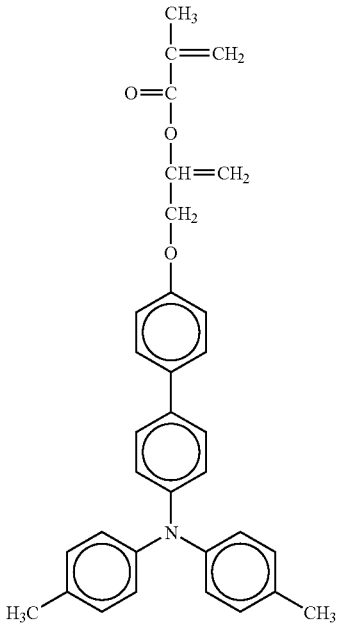
No. 121
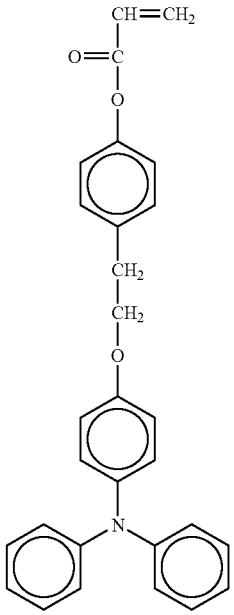

-continued
No. 122
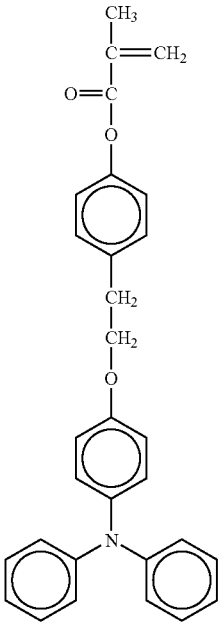
No. 123
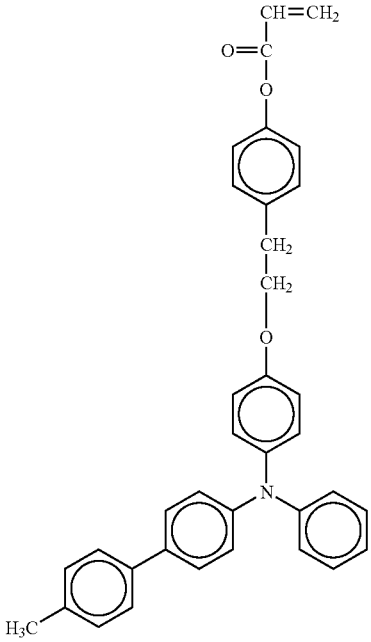
-continued
No. 124
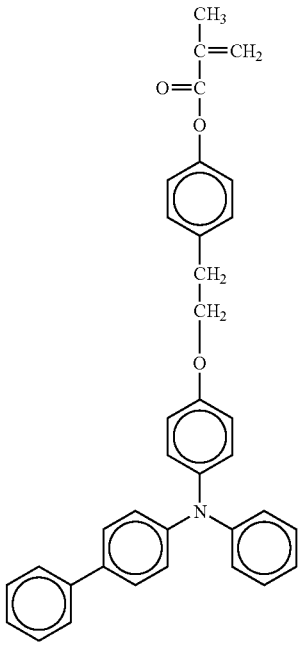
No. 125
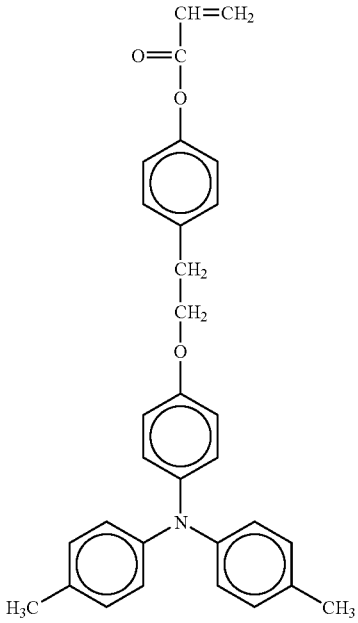

-continued
No. 126
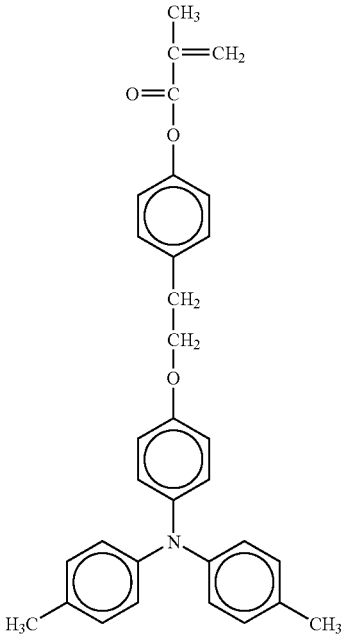
No. 127
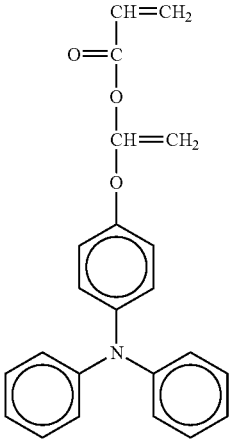
No. 128
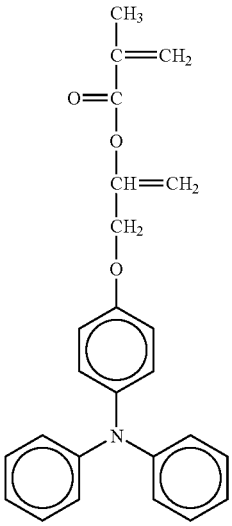
-continued
No. 129
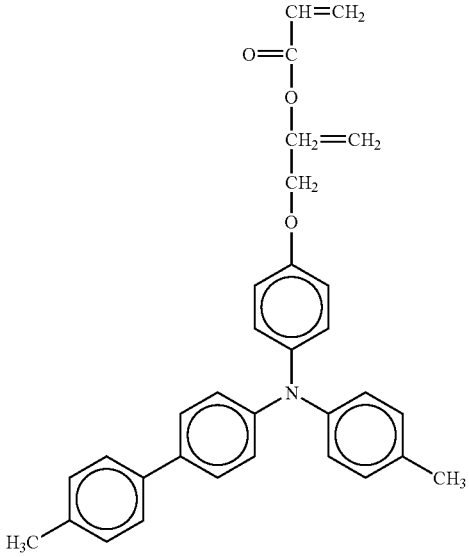
No. 130
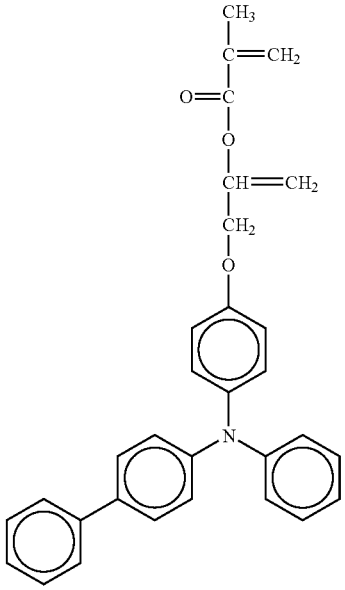

-continued
No. 131
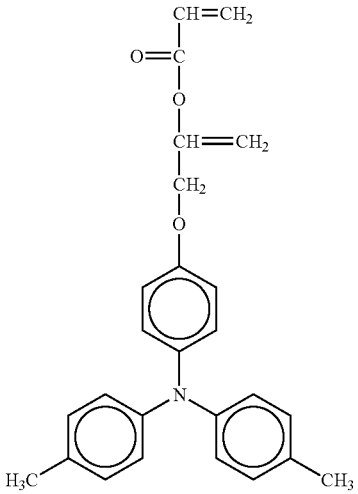
No. 132
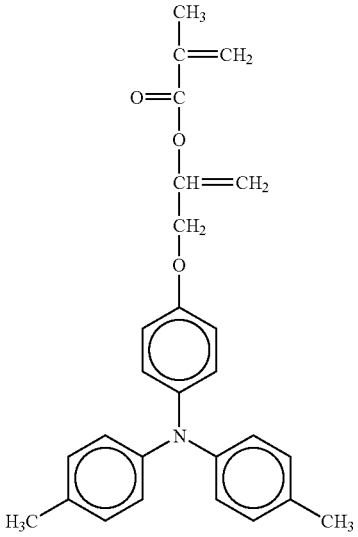
No. 133
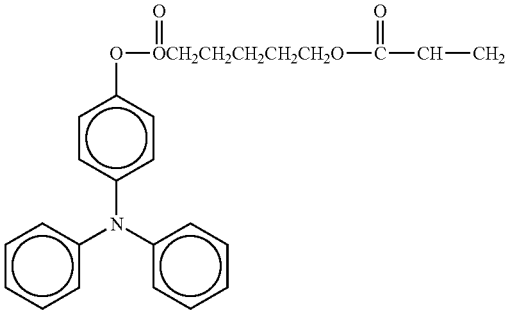
-continued
No. 134
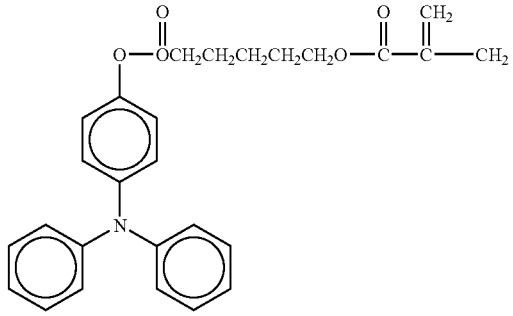
No. 135
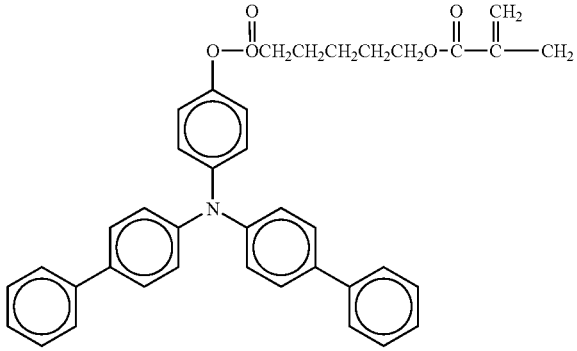
No. 136
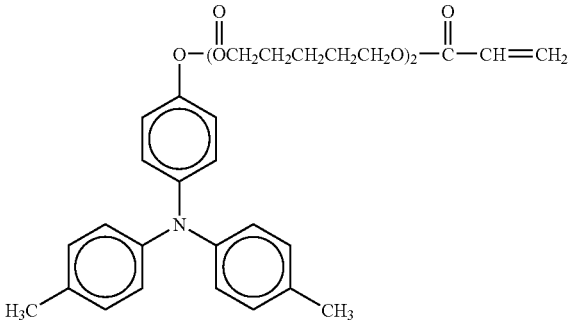
No. 137
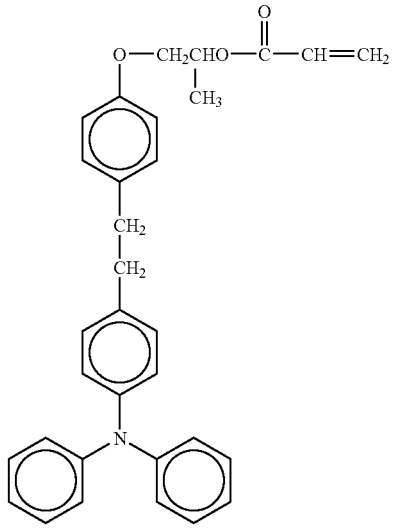

-continued
No. 138
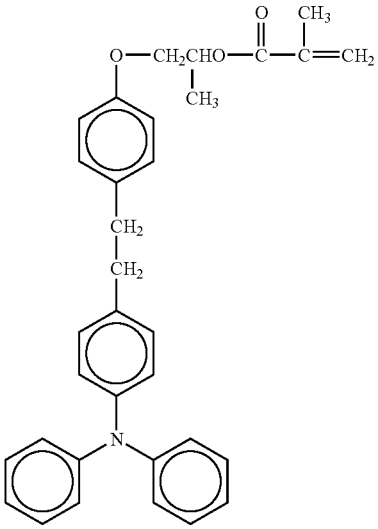
No. 139
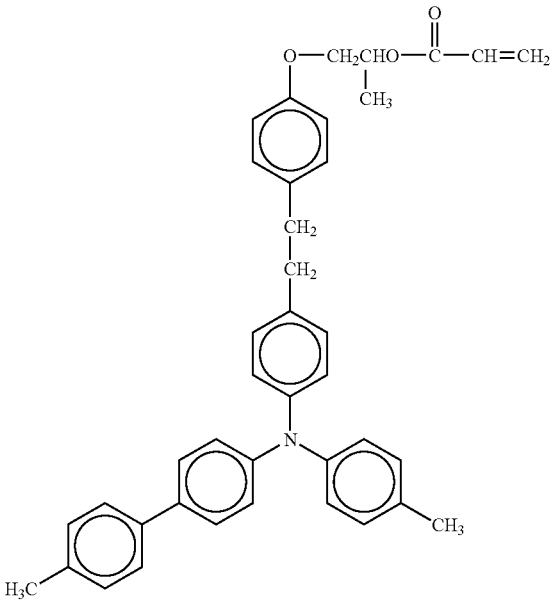
-continued
No. 140
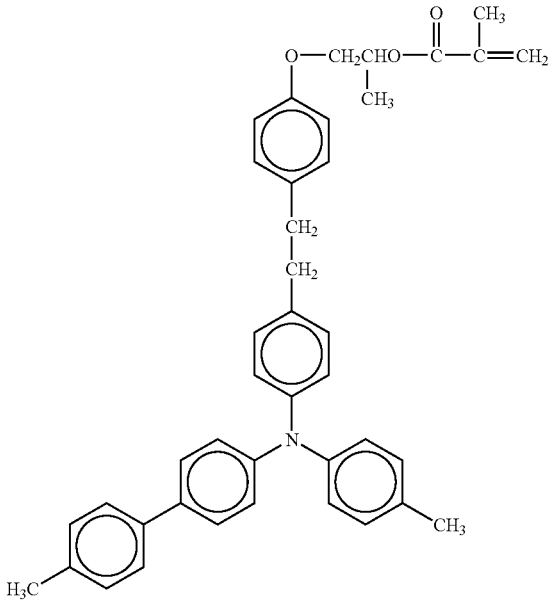
No. 141
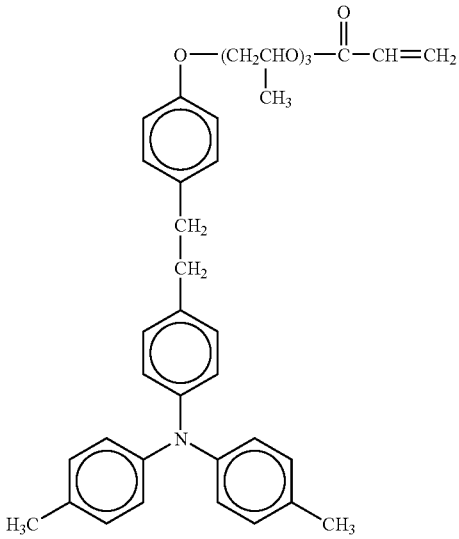

-continued
No. 142
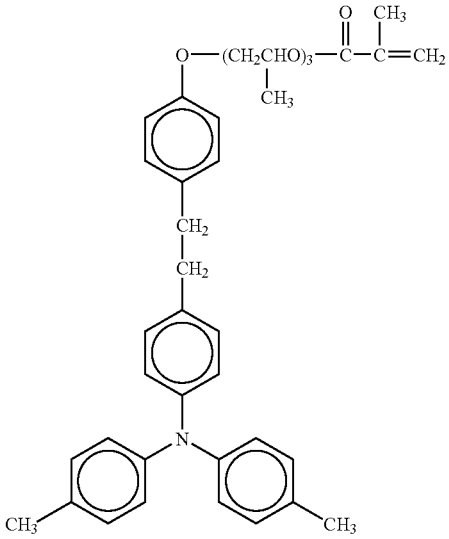
No. 143
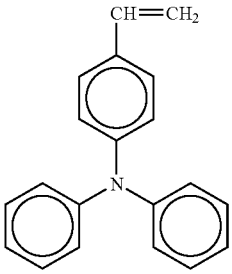
No. 144
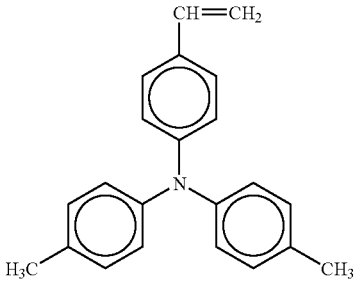
No. 145
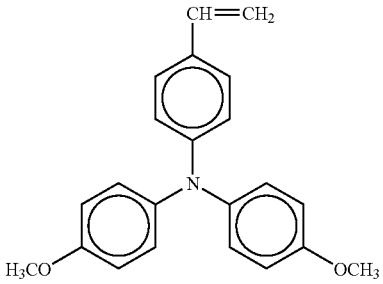
-continued
No. 146
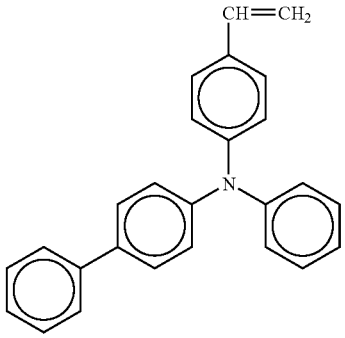
No. 147
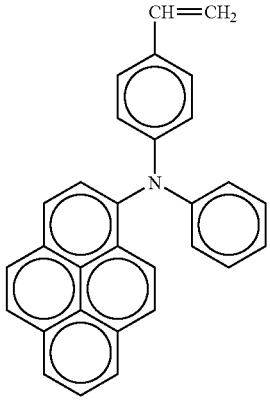
No. 148
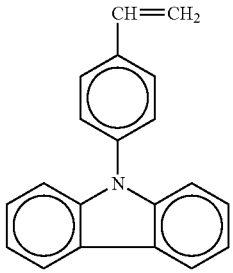
No. 149
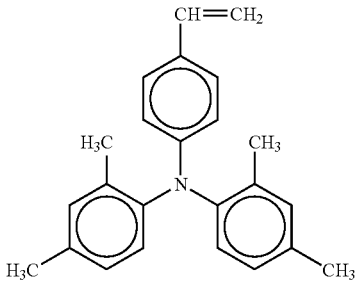
No. 150
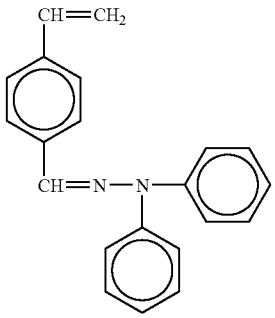

-continued
No. 151
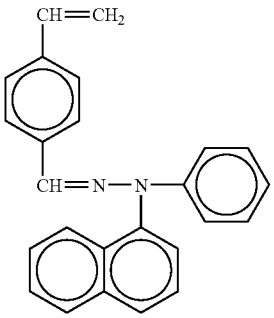
No. 152
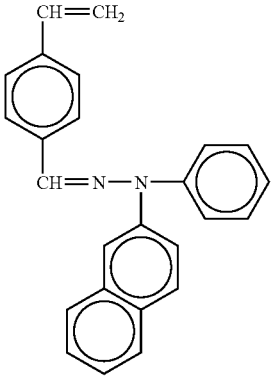
No. 153
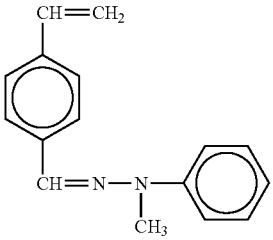
No. 154
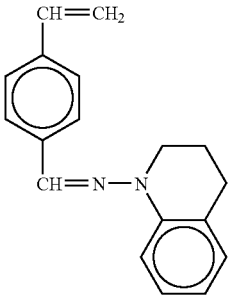
No. 155
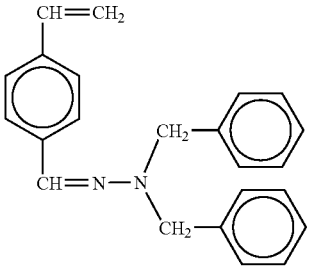
-continued
No. 156
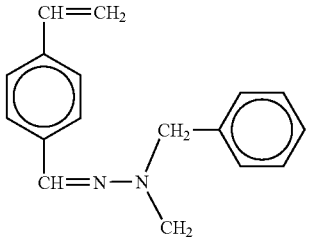
No. 157
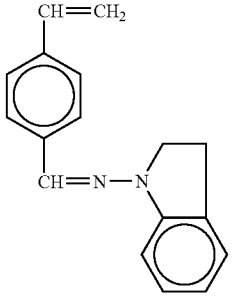
No. 158
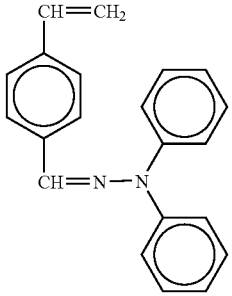
No. 159
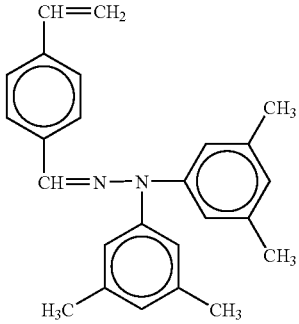
No. 160
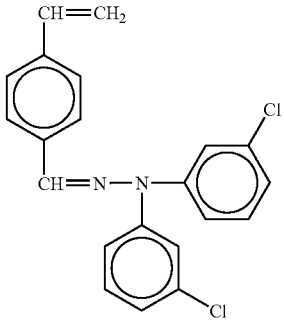
In addition, the radical polymeric compound having a functional group with a charge transport structure for use in the present application is important to impart the charge transport ability of a cross-linking type protective layer. The content ratio of the radical polymeric compound having a functional group with a charge transport structure is from 20 to 80% by weight and preferably from 30 to 70% by weight based on a cross-linking type protective layer. When the content ratio is too small, the charge transport ability of a cross-linking type protective layer is not sufficient, which may lead to deterioration of the electric characteristics such as sensitivity and rise in the residual voltage. When the content ratio is too large, the content of a radical polymeric monomer having at least 3 functional groups without having a charge transport structure decreases so that the density of cross-linking decreases and the anti-abrasion property may deteriorate. Desired electric characteristics and anti-abrasion property vary depending on the process and thus the layer thickness of the cross-linking type protective layer for use in the present application varies. Therefore, it is difficult to jump to any conclusion but considering the balance of the electric characteristics and the anti-abrasion property, the range of from 30 to 70% by weight is preferred.

As described above, the cross-linking type protective layer forming the image bearing member of the present application is formed by curing a radical polymeric monomer having three functional groups without having a charge transport structure and a radical polymeric compound having a functional group and a charge transport structure. In addition, a radical polymeric monomer having one or two functional groups, a functional monomer and a radical polymeric oligomer can be used in combination therewith to control the viscosity during coating, relax the internal stress within a cross-linking type protective layer, reduce the surface energy, decrease the friction index, etc. Known radical polymeric monomers and oligomers can be used.

Specific examples of such radical polymeric monomers having a functional group include 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the radical polymeric divalent functional groups include 1,3-butane diol acrylate, 1,4-butane diol acrylate, 1,4-butane diol dimethacrylate, 1,6-hexane diol diacrylate, 1,6-hexane diol dimethaacrylate, diethylene glycol diacrylate, neopentyl glycol diacrylate, bisphenol A-EO modified diacrylate, bisphenol F-EO modified diacrylate, and neopentyl glycol diacrylate.

Specific examples of such functional monomers include a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a siloxane repeating unit described in published unexamined Japanese patent applications No. H05-60503 and H06-45770; and a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl.

Specific examples of the radical oligomers include an epoxy acrylate based oligomer, a urethane acrylate based oligomer, and a polyester acrylate based oligomer.

However, too excessive an amount of a radical polymeric monomer having one or two functional groups and a radical polymeric oligomer substantially decreases the density of three-dimensional cross-linking in a cross-linking type polymeric protective layer, which leads to deterioration of the anti-abrasion property thereof. Therefore, the content of these monomer and oligomer is not greater than 50 parts and preferably not greater than 30 parts based on 100 parts of a radical polymeric monomer having at least three functional groups.

In addition, the liquid of application coated to form a cross-linking type protective layer can optionally contain a polymerization initiator to accelerate the curing reaction of a radical polymeric monomer having at least three functional groups without having a charge transport structure and a radical polymeric compound having a functional group and a charge transport structure.

Specific examples of thermal polymerization initiators include a peroxide based initiator such as 2,5-dimethyl hexane-2,5-dihydroperoxide, dicumyl peroxide, benzoyl peroxide, t-butylcumyl peroxide, 2,5-dimethyl-2,5-di(peroxybenzoyl) hexine-3, di-t-butyl beroxide, t-butylhydro beroxide, cumenehydro beroxide, lauroyl peroxide, and 2,2-bis(4,4-di-t-butylperoxy cyclohexane)propane, and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound. In addition, a compound having an acceleration effect on photopolymerization can be used alone or in combination with the photopolymerization initiator. Specific examples of such compounds include triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination. The content of such a polymerization initiator is 0.5 to 40 parts by weight and preferably from 1 to 20 parts by weight based on 100 parts by weight of the compound having a radical polymerization property.

Further, the liquid of application for use in forming the cross-linking type protective layer of the present application include can optionally contain additives such as various kinds of plasticizers (for relaxing stress and improving adhesiveness), a leveling agent, a charge transport material having a low molecular weight having no radical reaction property. Known additives can be used as these additives. As a plasticizer, an additive, such as dibutylphthalate and dioctyl phthalate, which is used in a typical resin can be used. The content thereof is not greater than 20% by weight and preferably not greater than 10% based on the total solid portion of a liquid of application. As a leveling agent, silicone oils such as dimethyl cilicone oil, methyl phenyl silicone oil and a polymer or an oligomer having a perfluoroalkyl group in its side chain can be used. The content thereof is suitably not greater than 3% by weight based on the total solid portion of a liquid of application.

The cross-linking type protective layer of the present application is formed by coating and curing on the photosensitive layer or the charge transport layer mentioned above at least a radical polymeric monomer having three functional groups without having a charge transport structure and a radical polymeric compound having a functional group and a charge transport structure. When a radical polymeric monomer contained in a liquid of application is liquid, it is possible to coat the liquid of application while dissolving other components therein. In addition, a liquid of application can be diluted in a suitable solvent before coating if desired. Specific examples of such solvents include an alcohol based solvent such as methanol, ethanol, propanol and butanol; a ketone based solvent such as acetone, methyl ethyl ketone, methyl isobutyl ketone, and cycle hexanone; an ester based solvent such as ethyl acetate and butyl acetate; an ether based solution such as tetrahydrofuranm dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosove and cellosolve acetate. These solvents can be used alone or in combination. The dilution ratio by such a solvent depends on solubility, a coating method, and a layer thickness of a composition suitable for desires purposes. A dip coating method, a spray coating method, a beat coating method, a ring coating method, etc., can be used for application.

In the present application, subsequent to application of a liquid of application, a cross-linking type protective layer is cured upon application of external energy such as heat, light and radiation ray. As a method of applying heat energy, a cross-linking type protective layer is heated from the application surface side or the substrate side using a gas such as air and nitrogen, vapor, or various kinds of heat media, infra-red radiation and electromagnetic wave. The heating temperature is not lower than 100° C. and preferably not lower than 170° C. When the heating temperature is too low, the reaction speed tends to be slow so that the curing reaction may not be complete. When the heating temperature is too high, the curing reaction does not uniformly proceed. Thereby, the protective layer is significantly distorted inside, non-reaction groups may remain therein and three-dimensional mesh structure is not developed completely. For uniform curing reaction, it is effective to heat a cross-linking type protective layer at a relatively low temperature, for example lower than 100° C., followed by heating at a relatively high temperature, for example, higher than 100° C. to complete the curing reaction. As light energy, a UV irradiation light source such as a high pressure mercury lamp or a metal halide lamp having an emission wavelength mainly in the ultraviolet area is used. A visible light source can be used according to the absorption wavelength of a radical polymeric compound and a photopolymerization initiator. The irradiation light amount is preferably from 50 mW/cm$^2$ to 1,000 mW/cm$^2$. When the irradiation light amount is too small, it takes a long time to complete the curing reaction. When the irradiation light amount is too large, the reaction does not uniformly proceed, which leads to the occurrence of wrinkle on the surface of a protective layer and significant amount of non-reacted groups and polymerization terminated ends. In addition, the internal stress in a protective layer increases due to such rapid cross-linking, which causes cracking and peeling thereof. As radiation ray energy, beam of electron can be used. Among these forms of energies, thermal or light energy is suitably used in terms of easiness of reaction speed control and simplicity of a device.

The layer thickness of the cross-linking protective layer of the present application is preferably from 1 to 10 μm, and more preferably from 2 to 8 μm. When the layer thickness is too thick, cracking and peeling easily occur as described above. When the layer thickness is in the preferred range, the safety margin is improved so that the density of cross-linking can be increased. Further, it is possible to select a material having a high anti-abrasion property and set a curing condition. On the other hand, the radical polymerization reaction is vulnerable to oxygen inhibition. That is, on the surface, which contacts air, cross-linking tends to not proceed at all or uniformly due to the radical trap caused by oxygen. This radical trap has a significant effect on the portion having a depth not greater than 1 μm from the surface. Therefore, in a cross-linking type protective layer having a thickness not greater than 1 μm, the anti-abrasion property may deteriorate and non-uniform abrasion may occur. In addition, when the layer thickness of a cross-linking type protective layer is too thin, contaminants may diffuse in the entire layer, which leads to inhibition of the curing reaction and decrease of the density of cross-linking. Considering these, a cross-linking type protective layer having a layer thickness not less than 1 μm has a good anti-abrasion property and anti-damage property. But when the cross-linking type protective layer is locally ground to the charge transport layer provided under the protective layer during repetitive use, the ground portion is significantly abraded, resulting in production of a half tone image with uneven density due to fluctuation of chargeability and sensitivity. Therefore, to obtain a durable image bearing member and improve the image quality, the layer thickness of a cross-linking type protective layer is preferably at least 2 μm.

In the structure of the image bearing member of the present application in which a charge blocking layer, a moiré prevention layer, a photosensitive layer (a charge generating layer and a charge transport layer) and a cross-linking type protective layer are accumulated on an electroconductive substrate in this order, when the cross-linking type protective layer provided uppermost is insoluble in an organic solvent, the anti-abrasion property and the anti-damaging property can be significantly improved. A method of testing the solubility in an organic solvent is as follows: drop on the surface of an image bearing member a droplet of an organic solvent such as tetrahydrofuran and dichloromethane having a high solubility in a polymer; and subsequent to natural dry, observe the change in the form of the surface of the image bearing member with a microscope. In the case of an image bearing member having a high solubility, the following phenomenon can be observed: the center portion on the image bearing member where the droplet has been dropped is dented and the portion therearound rises; the charge transport layer precipitates, causing white turbidity or clouding due to crystallization thereof; and wrinkled portion is observed as a result of swelling of the surface and contraction thereafter. To the contrary, an image bearing member insoluble in an organic solvent does not change at all and these phenomena are not observed.

In the structure of the present application, to make the cross-linking type protective layer insoluble in an organic solvent, the following measures can be taken: (1) controlling the compositions and their content ratio of the liquid of application for the cross-linking type protective layer; (2) controlling the diluting solvent and the density of the solid portion of the cross-linking type protective layer; (3) selecting the method of coating the cross-linking type protective layer; (4) controlling the curing conditions of the cross-linking type protective layer; and (5) making the charge transport layer hardly soluble in an organic solvent. Each factor is important and desired to be used in combination.

When a binder resin having no radical polymeric functional group and an additive such as an anti-oxidization agent and a plasticizer in a large amount are contained in a large amount in the composition of the cross-linking type protective layer in addition to the radical polymeric monomer having at least three functional groups without having a charge transport structure and the radical polymeric compound having a functional group and a charge transport structure mentioned above, the density of cross-linking decreases, and the phase separation occurs between the cured material and the additives. As a result, the composition may be soluble in an organic solvent. Specifically, it is desired to restrain the content of the additives within not greater than 20% by weight based on the total solid portion of the liquid of application. In addition, not to reduce the cross-linking density, it is also desired to restrain the total content of a radical polymeric monomer having one or two monomers, a reactive oligomer, and a reactive polymer within not greater than 20% by weight based on the radical polymeric monomer having three functional groups. Further, when a radical polymeric compound having a charge transport structure having at least two functional groups is contained in a large amount, bulky structure bodies are fixed by multiple bondings in a cross-linking structure, which may cause distortion. Therefore, such a structure tends to become an agglomeration of minute cured materials, which may make the structure soluble in an organic solvent. Although it depends on structures, it is preferred to restrain the content of a radical polymeric compound having a charge transport structure having at least two functional groups within not greater than 10% by weight based on the radical polymeric compound having a charge transport structure having a functional group.

With regard to the dilution solvent for a liquid of application for a cross linking type protective layer, when a solvent having a slow evaporation speed is used, the solvent remaining may inhibit curing reaction or the content of contaminants of the layer provided under the cross-linking type protective layer may increase, which causes non-uniform curing and decrease in the curing density. Therefore, such a protective layer tends to be soluble in an organic solvent. Suitable specific examples of the dilution solvents include tetrahydrofuran, a mixture solvent of tetrahydrofuran and methanol, ethyl acetate, methylethyl ketone and ethylcellosolve. These are selected in combination with a coating method. When the density of solid portion in a liquid of application is too low, a cross-linking type protective layer formed thereof tends to be solved in an organic solvent because of the same reason as described above. In contrast, due to the restraint on the layer thickness and the viscosity of a liquid of application, the density has an upper limit. Specifically, the density is preferred to be from 10 to 50% by weight. As a method of coating a liquid of application for a cross-linking type protective layer, as described above, a method is preferred in which the content of the solvent during coating is small and the contact time of the solvent is short. To be specific, spray coating method or ring coating method regulating the amount of a liquid of application is preferred. In addition, to restrain the infusion amount of the components of the layer provided under the protective layer, it is effective to use a charge transport polymer for a charge transport layer and provide an intermediate layer insoluble in a liquid of application for a cross-linking type protective layer between a photosensitive layer (or a charge transport layer) and the cross-linking type protective layer.

With regard to the curing conditions for a cross-linking type protective layer, when the heating energy or light irradiation energy is too low, curing reaction does not proceed completely. Thereby, the solubility in an organic solvent rises. To the contrary, extremely high energy causes non-uniform curing reaction, which leads to increase of non-cross-linked portions and radical terminated portions and formation of an agglomeration of cured materials. Such a cross-linking type protective layer tends to be dissolved in an organic solvent. To make a cross-linking type protective layer insoluble in an organic solvent, heat curing is preferably performed at a temperature from 100 to 170° C. and for 10 minutes to 3 hours. UV irradiation curing is preferably performed at a range of from 50 to 1,000 mW/cm$^2$ for 5 seconds to 5 minutes while restraining the temperature rise within 50° C. Thereby, non-uniform curing reaction can be prevented.

Below are examples of making a cross-linking type protective layer forming the image bearing member for use in the present application insoluble in an organic solvent. When an acrylate monomer having three acryloyloxy groups and a triaryl amine compound having an acryloyloxy group are used as a liquid of application, the content ratio of the acrylate monomer to the triaryl amine is 3/7 to 7/3 and an polymerization initiator is added in an amount of 3 to 20% by weight based on the total amount of the acrylate compound followed by an addition of a solvent to prepare a liquid of application. When a triaryl amine based doner and polycarbonate as a binder resin are used in a charge transport layer provided under the cross-linking type protective layer and the surface thereof is formed by a spray method, it is preferred to use teterahydrofuran, 2-butanone or ethyl acetate as the solvent mentioned above for a liquid for application, the content of which is 3 to 10 times as much as the total weight of the acrylate compound.

Next, for example, the liquid of application prepared as described above is applied with, for example, a spray, on an image bearing member in which a charge blocking layer, a moiré prevention layer, a charge generating layer and the charge transport layer are accumulated on a substrate such as an aluminum cylinder. Subsequent to natural drying or drying at a relatively low temperature (25 to 80° C.) for a short time (1 to 10 minutes), the liquid of application is cured by UV ray irradiation or heat. In the case of UV ray irradiation, a metal halide lamp, etc., is used for preferably about 5 seconds to about 5 minutes while the drum temperature is controlled not to be high than 50° C. In the case of heat curing, the heating temperature is preferably from 100 to 170° C. An air supply oven is used as a heating device and when the heating temperature is set at 150° C., the liquid of application is heated for 20 minutes to 3 hours. When the curing reaction ends, to reduce the amount of remaining solvent, the liquid of application is heated at 100 to 150° C. for 10 to 30 minutes and thus the image bearing member of the present application is obtained.

In addition to a filler for use in forming a protective layer or a cross-linking type protective layer, it is also possible to use known materials such as a-C and a-SiC formed by a method of forming vacuum thin layer to form a protective layer.

As described above, by using a charge transport polymer in a photosensitive layer (charge transport layer) or providing a protective layer on the surface of an image bearing member, the durability (anti-abrasion property) of the image bearing member is improved and a new effect is provided on a tandem type full color image forming apparatus.

In the present application, to improve the environmental durability, especially to prevent deterioration of the sensitivity and the rise in the residual voltage, anti-oxidization agent can be suitably added in each layer of a protective layer, a charge transport layer, a charge generating layer, a charge blocking layer, a moiréprevention layer, etc. Specific examples of such anti-oxidization agents include the following: phenol based compounds such as 2,6-t-butyl-p-cresol, butylized hydroxyl anisole, 2,6-di-t-butyl-4-ethylphenol, stearyl-β-(3,5-di-t-butyl-4-hydroxyphehyl)propionate, 2,2'-methylene-bis(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroroxy-5-t-butylphenyl)butane, 1,3,5-rimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester and tocopherol;

Paraphenylene diamines such as N-phenyl-N'isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine; Hydroquinones such as 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl)-5-methyl hydroquinone; Organic sulfur compounds such as dilauryl-3,3-thiodipropionate, distearyl-3,3'-thiodipropionate, and ditetradecyle-3,3'-thiodipropionate; and organic phosphorus compounds such as triphenyl phosphine, tri(nonylphenyl) phosphine, tri(dinonylphenyl)phosphine, tricresyl phosphine and tri(2,4-dibutylphenoxy)phosphine.

These compounds are known as anti-oxidization agents for rubber, plastic, and oil and marketed products thereof can easily be obtained. The addition amount of the anti-oxidization agent in the present application is from 0.01 to 10% by weight based on the total amount of the layer to which the anti-oxidization agent is added.

In the case of a full color image, various kinds of images including regular images are input. Proof marks in Japanese documents are one of such regular images. Images such as proof marks are typically disposed at an edge of an image area and the usable color therefor is limited. In a state in which a random image is constantly written, writing, developing and transferring an image are averagely performed on and around the image bearing member in the image formation elements. However, when images are repeatedly written on a specific area many times or when only a specific image element is repeatedly used, the durability among the areas and the image forming elements is thrown off balance. When an image bearing member having a surface the durability of which is physically, chemically and mechanically weak is used in such a state, the imbalance becomes significant among the elements, which leads to an image problem. To the contrary, when an image bearing member having a high durability is used, the local variation is small. Thereby, an abnormal image is hardly obtained. Consequently, such an image bearing member having a high durability is extremely effective to improve the stability of output images.

Having generally described preferred embodiments of this application, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, examples of synthesizing charge generating materials (titanyl phthalocyanine crystal) are described.

Comparative Synthesis Example 1

According to JOP 2001-19871, a dye was prepared. That is, 29.2 parts of 1,3-diiminoisoindoline and 200 parts of sulfolane were mixed and 20.4 parts of titanium tetrabutoxido was dropped thereto in nitrogen atmosphere. Thereafter, the temperature was raised to 180° C., and the resultant was stirred for reaction for 5 hours while the reaction temperature was maintained in a range of from 170 to 180° C. After the reaction, the resultant was naturally cooled down and the precipitation was filtrated. The filtrated resultant was washed with chloroform until the obtained powder indicates the color of blue. Next, the resultant powder was washed with methanol several times. Further, subsequent to washing with hot water of 80° C. several times and drying, a coarse titanyl phthalocyanine was obtained. The titanyl phthalocyanine was dissolved in strong sulfuric acid the amount of which was 20 times as much as that of the titanyl phthalocyanine. The resultant was dropped to iced water the amount of which was 100 times as much as the resultant. The precipitated crystal was filtrated and water-washing was repeated with deionized water having a pH of 7.0 and a specific electric conductivity of 1.0 μS/cm until the washing water was neural to obtain a wet cake (water paste) of titanyl phthalocyanine dye. The Ph value of the deionized water and the specific electric conductivity after washing was 2.6 μS/cm and 6.8, respectively. 40 parts of the thus obtained wet cake (water paste) was put in 200 parts of tetrahydrofuran and stirred for 4 hours. After filtration and drying, titanyl phthalocyanine powder (Dye No. 1) was obtained.

The solid portion density of the wet cake was 15 weight %. The weight ratio of the solvent for crystal conversion to the wet cake was 33. No halogenated material was used in the raw material of Comparative Synthesis Example 1.

Figure 17:
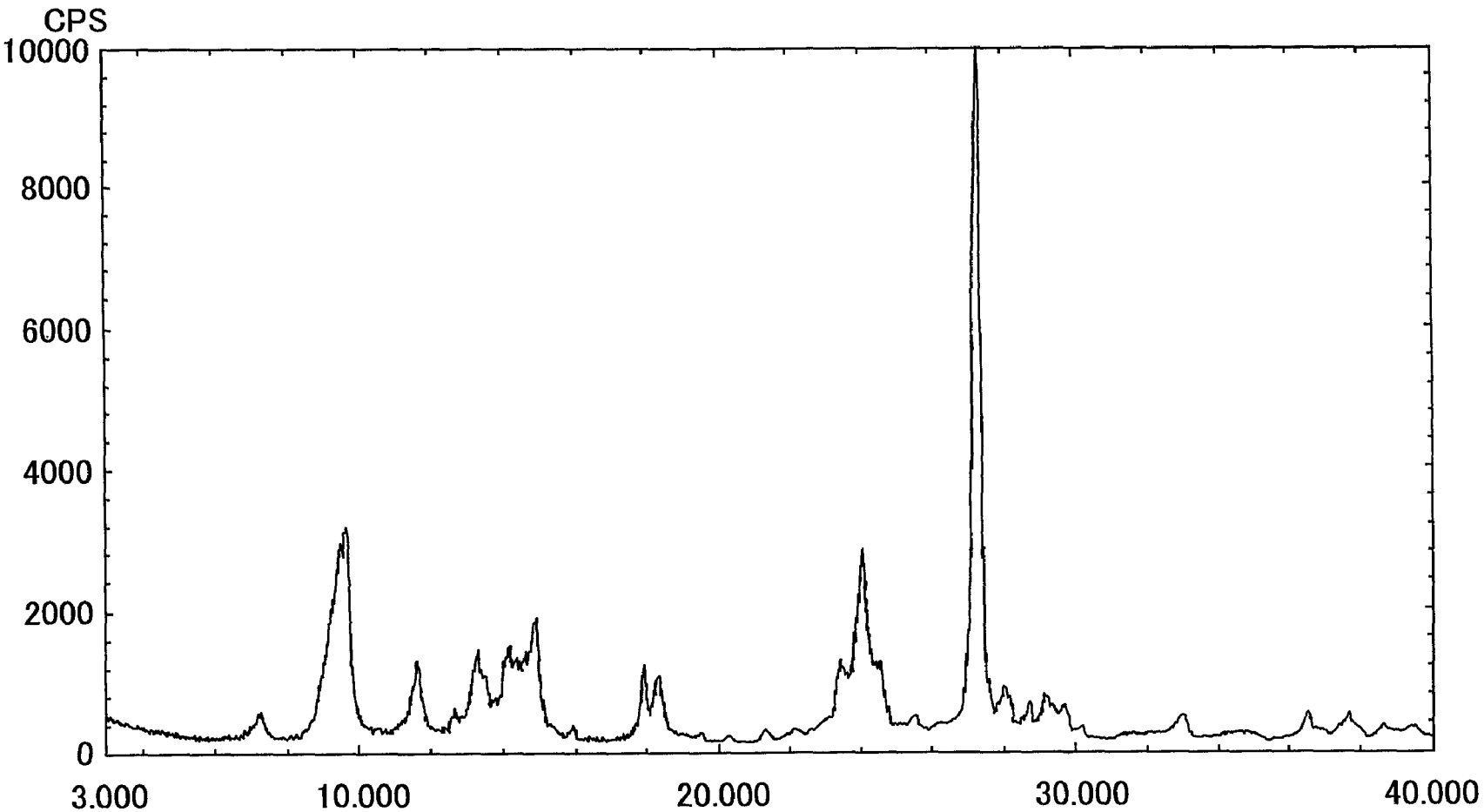
FIG. 17 is a diagram illustrating XD spectrum of the titanyl phthalocyanine synthesized in Comparative synthesis Example 1 described later.

The thus obtained titanyl phthalocyanine powder measured using X ray diffraction spectrum under the following conditions had a CuKα X ray diffraction spectrum having a wavelength of 1.542 Å such that the maximum diffraction peak was observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2 as the lowest angle diffraction peak and having no peak between 9.4°±0.2° and 7.3°±0.2° and no peak at 26.3±0.2°. The result is illustrated in FIG. 17.

(Measuring Conditions of X Ray Diffraction Spectrum)

X ray tube: Cu
Voltage: 50 kV
Current: 30 mA
Scanning speed: 2°/minute
Scanning area: 3 to 40°
Decay time constant: 2 sec.

Figure 18:
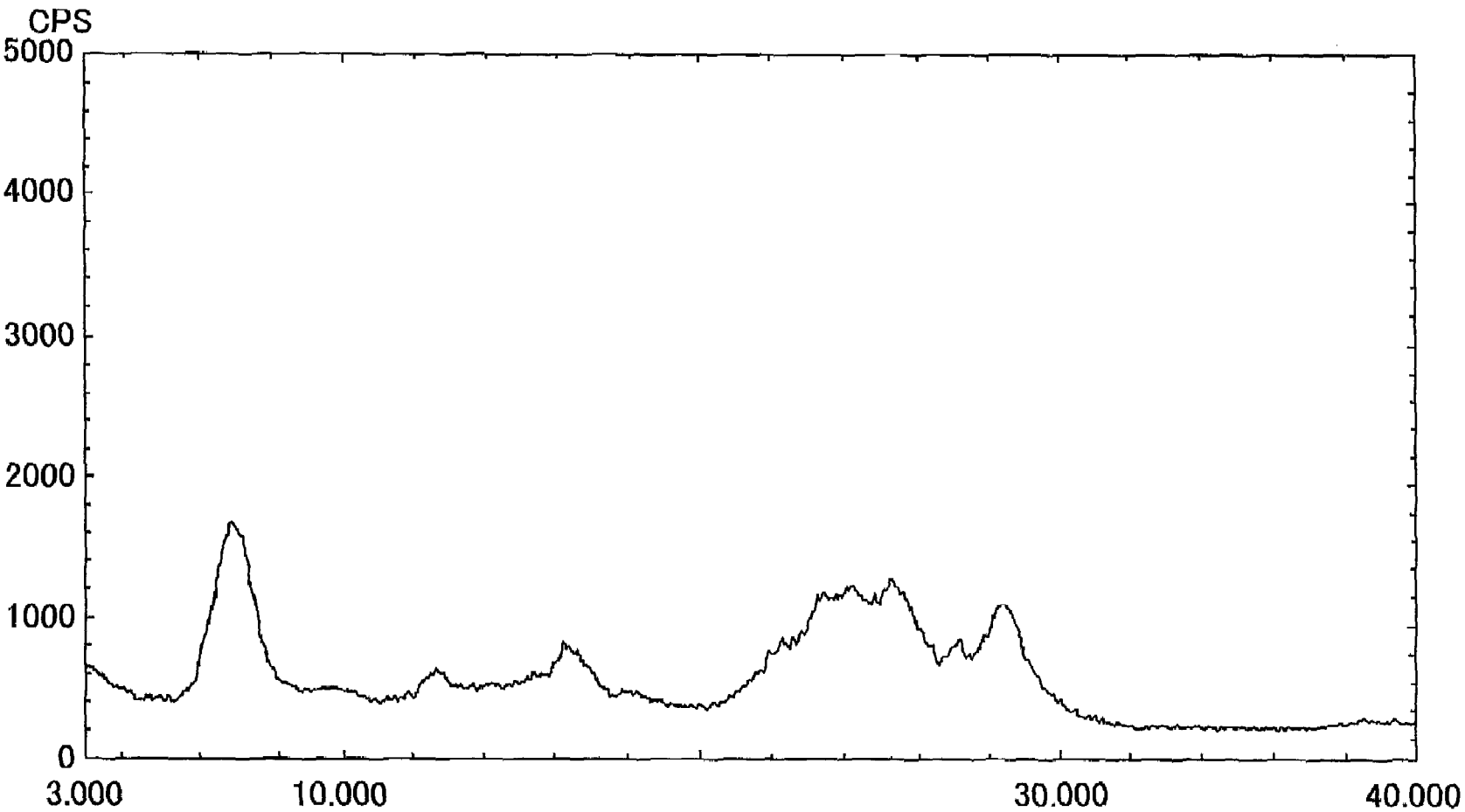
FIG. 18 is a diagram illustrating XD spectrum of dried powder of the water paste obtained in Comparative synthesis Example 1 described later.

In addition, part of the water paste obtained in Comparative Synthesis Example 1 was dried for 2 days with a reduced pressure of mm Hg at 80° C. to obtain titanyl phthalocyanine powder having a low crystalline property. The X ray diffraction spectrum of the dried powder of the water paste is illustrated in FIG. 18.

Comparative Synthesis Example 2

A dye was prepared based on the method described in JOP H01-299874 and Comparative Synthesis Example 1. That is, the wet cake prepared in Comparative Synthesis Example 1 was dried. 1 part of the dried product was added to 50 parts of polyethylene glycol and the mixture was pulverized with 100 parts of glass beads using a Sand mill. After crystal transfer, the resultant was washed with dilute sulfuric acid and an aqueous solution of ammonium hydroxide in this order. After drying, a dye (Dye No. 2) was obtained. No halogenated material was used in the raw material of Comparative Synthesis Example 2.

Comparative Synthesis Example 3

A dye was prepared based on the method described in JOP H03-269064 and Comparative Synthesis Example 1. That is, the wet cake prepared in Comparative Synthesis Example 1 was dried. 1 part of the dried product was stirred at 50° C. in a mixture solvent of 10 parts of deionized water and 1 part of monochlorobenzene for one hour. Thereafter, the resultant was washed with methanol and deionized water. After drying, a dye (Dye No. 3) was obtained. No halogenated material was used in the raw material of Comparative Synthesis Example 3.

Comparative Synthesis Example 4

A dye was prepared based on the method described in JOP H02-8256. That is, 9.8 parts of phthalodinitrile and 75 parts of 1-chloronaphthalene were mixed with stirring and 2.2 parts of titanium tetrachloride was dropped in nitrogen atmosphere. Thereafter, the temperature was gradually raised to 200° C. and the resultant was stirred for reaction for 3 hours while the reaction temperature was maintained in a range of from 200 to 220° C. After the reaction, the resultant was naturally cooled down to 130° C. and heat-filtrated. The filtrated resultant was washed with 1-chloronaphthalene until the obtained powder indicated the color of blue. Next, the resultant powder was washed with methanol several times. Further, subsequent to washing with hot water of 80° C. several times and drying, a dye (Dye No. 4) was obtained. The raw material of Comparative Synthesis Example 4 contains a halogenated material.

Comparative Synthesis Example 5

A dye was prepared based on the method described in JOP S64-17066 and Comparative synthesis Example 1. That is, 5 parts of α type TiOPc was subject to crystal conversion treatment at 100° C. for 10 hours in a sand grinder together with 10 parts of sodium chloride and 5 parts of acetophenone. The resultant was washed with deionized water and methanol and purified with dilute sulfuric acid. Thereafter, the purified resultant was washed with deionized water until the acid component was lost. Subsequent to drying, a dye (Dye No. 5) was obtained. The raw material of Comparative Synthesis Example 5 contains a halogenated material.

Comparative Synthesis Example 6

A dye was prepared based on the method described in JOP H11-5919 and Comparative Synthesis Example 1. That is, 20.4 parts of O-phthalodinitrile and 7.6 parts of titanium tetrachloride were heated and reacted in 50 parts of quinoline at 200° C. for 2 hours. After the solvent was removed by moisture vapor distillation, the resultant was purified with 2% hydrochloric acid and 2% sodium hydroxide aqueous solution and washed with methanol and N,N-dimethyl formaldehyde. Subsequent to drying, titanyl phthalocyanine was obtained. 2 parts of the titanyl phthalocyanine were dissolved in 40 parts of 98% sulfuric acid at 5° C. little by little. The mixture was stirred for about one hour while maintaining the temperature to not higher than 5° C. The resultant was slowly added in 400 parts of iced water in which sulfuric acid had been vigorously stirred and the precipitated crystal was filtrated. The crystal was washed with distilled water until the acid portion was removed to obtain a wet cake. The cake was stirred in 100 parts of tetrahydrofuran for about 5 hours. Subsequent to filtration, washing with tetrahydrofuran, and drying, a dye (Dye No. 6) was obtained. The raw material of Comparative Synthesis Example 6 contains a halogenated material.

Comparative Synthesis Example 7

A dye was prepared based on the method described in JOP H03-255456 and Comparative Synthesis Example 2. That is, 10 parts of the wet cake prepared in Comparative Synthesis Example 1 was mixed with 15 parts of sodium chloride and 7 parts of diethylene glycol. The mixture was subject to milling treatment by an automatic mortar for 60 hours at 80° C. Next, the resultant was sufficiently water-washed to completely remove the sodium chloride and diethylene glycol contained therein. Subsequent to drying with a reduced pressure, 200 parts of cyclohexanone and glass beads having a particle diameter of 1 mm were added to the resultant. The mixture was subject to treatment using a Sand mill for 30 minutes and a dye (Dye No. 7) was obtained. No halogenated material was used in the raw material of Comparative Synthesis Example 7.

Comparative Synthesis Example 8

A dye was prepared based on the method described in JOP H08-110649. That is, 58 parts of 1,3-diiminoiso indoline and 51 parts of tetrabutoxy titanium were reacted in 300 parts of α-chloronaphthalene for 5 hours at 210° C. The resultant was washed with α-chloronaphthalene and dimethyl formamide (DMF) in this order. Thereafter, the resultant was washed with heated DMF, hot water, and methanol. After drying, 50 parts of titanyl phthalocyanine was obtained. 4 parts of the titanyl phthalocyanine were added in 400 parts of sulfuric acid cooled down to 0° C. and stirred for one hour at 0° C. When the titanyl phthalocyanine was completely dissolved, the resultant was added in a mixture solution of 800 ml of water and 800 ml of toluene cooled down to 0° C. After the resultant was stirred for 2 hours at room temperature, the precipitated titanyl phthalocyanine mixed crystal was filtrated and dried to obtain 2.9 parts of titanyl phthalocyanine mixed crystal. No halogenated material was used in the raw material of Comparative Synthesis Example 8.

Synthesis Example 1

Water paste of titanyl phthalocyanine dye was synthesized according to the method of Comparative Synthesis Example 1. Crystal conversion was performed as follows and titanyl phthalocyanine crystal having a relatively small primary particle diameter in comparison with that in Comparative Synthesis Example 1.

400 parts of tetrahydrofuran was added to 60 parts of the water paste before crystal conversion obtained in Comparative Synthesis Example 1. The mixture was vigorously stirred (2,000 rpm) with HOMOMIXER (Mark II f model, manufactured by Kenis Ltd.) at room temperature. When the color of navy blue of the water paste was changed to the color of light blue (20 minutes after the stirring started), the stirring was stopped and filtration with a reduced pressure was performed immediately. The crystal obtained on the filtration device was washed with tetrahydrofuran and a wet cake of a dye was obtained. The resultant wet cake was dried with a reduced pressure (5 mmHg) at 70° C. for two days to obtain 8.5 parts of titanyl phthalocyanine crystal (Dye No. 9). No halogenated material was used in the raw material of Synthesis Example 1. The density of the solid portion of the wet cake described above is 15% by weight. The weight ratio of the solution for use in crystal conversion to the wet cake was 44.

Synthesis Example 2

Titanyl phthalocyanine crystal (Dye No. 10) was obtained in the same crystal conversion manner as in Synthesis Example 1 except that the stirring was performed for 30 minutes.

Synthesis Example 3

Titanyl phthalocyanine crystal (Dye No. 11) was obtained in the same crystal conversion manner as in Synthesis Example 1 except that the stirring was performed for 40 minutes.

Part of the titanyl phthalocyanine (water paste) before crystal conversion obtained in Comparative Synthesis Example 1 was diluted with deionized water to be 1% by weight. The paste was scooped by a copper net the surface of which was electrocondcutively treated. The particle size of the titanyl phthalocyanine was observed by a transmission electron microscope (TEM) (H-9000NAR, manufactured by Hitachi, Ltd.) with a magnifying power of 75,000. The average particle size thereof was obtained as follows.

The TEM image observed as described above was photographed as a TEM photograph. 30 photographed titanyl phthalocyanine particles (having a needle-like form) are arbitrarily selected and the major axis thereof was measured. The arithmetical mean of the major axes of the measured 30 particles were determined as the average particle size.

The average particle size in the water paste of the Synthesis Example 1 was 0.06 μm.

In addition, the crystalline converted titanyl phthalocyanine crystals before filtration of Comparative Synthesis Example 1 and Synthesis Examples 1 to 3 were diluted with tetrahydrofuran to be about 1% by weight and observed in the same manner as in the method described above. The average particle size diameters obtained as described above are shown in Table 1. The forms of the titanyl phthalocyanine crystals manufactured in Comparative Synthesis Example 1 and Synthesis Examples 1 to 3 were not identical, for example, a form close to a triangle or a form close to a square. Therefore, the maximum diagonal of the crystal was used for calculation as the major axis.

TABLE 1

| | Average particle size | Note |
|---|---|---|
| Comparative Synthesis Example 1 (Dye No. 1) | 0.31 | Containing a large particle having a particle diameter of from about 0.3 to 0.4 μm |
| Synthesis Examples 1 (Dye No. 9) | 0.12 | Almost the same crystal size |
| Synthesis Examples 2 (Dye No. 10) | 0.18 | Almost the same crystal size |
| Synthesis Examples 3 (Dye No. 11) | 0.24 | Almost the same crystal size |

The X-ray diffraction spectrum was measured for the dyes Nos. 2 to 8 manufactured in Comparative Synthesis Examples 2 to 8 and confirmed that the X-ray diffraction spectrum thereof was the same as those described in the corresponding JOPs. The X-ray diffraction spectra of the Dyes Nos. 9 to 11 manufactured in Synthesis Examples 1 to 3 matched the spectrum of the Dye No. 1 manufactured in Comparative Synthesis Example 1. The X-ray diffraction spectra of the Comparative Synthesis Examples and Synthesis Examples and the comparison with the peaks obtained in Comparative Synthesis Example 1 are shown in Table 2.

TABLE 2

| | | Maximum peak | Lowest Angle peak | Peak at 9.4° | Peak at 9.6° | Peak in the range of 7.3° to 9.4° | Peak at 24.0° | Peak at 26.3° |
|---|---|---|---|---|---|---|---|---|
| CSE 1 | D1 | 27.2° | 7.3° | Y | Y | N | Y | N |
| CSE 2 | D2 | 27.2° | 7.3° | N | N | N | Y | N |
| CSE 3 | D3 | 27.2° | 9.6° | Y | Y | N | Y | N |
| CSE 4 | D4 | 27.2° | 7.4° | N | Y | N | N | N |
| CSE 5 | D5 | 27.3° | 7.3° | Y | Y | Y (7.5°) | Y | N |
| CSE 6 | D6 | 27.2° | 7.5° | N | Y | Y (7.5°) | Y | N |
| CSE 7 | D7 | 27.2° | 7.4° | N | N | Y (9.2°) | Y | Y |
| CSE 8 | D8 | 27.2° | 7.3° | Y | Y | N | Y | N |
| SE 1 | D9 | 27.2° | 7.3° | Y | Y | N | Y | N |
| SE 2 | D10 | 27.2° | 7.3° | Y | Y | N | Y | N |
| SE 3 | D11 | 27.2° | 7.3° | Y | Y | N | Y | N |

CSE represents Comparative synthesis Example;
SE represents Synthesis Example;
D represents dye;
Y represents Yes; and
N represents No.

Next, Synthesis Examples of a compound having a charge transport structure having a functional group for use in the protective layer in Manufacturing Examples of the image bearing members described later are described.

Synthesis Example of a Compound Having a Charge Transport Structure Having a Functional Group The compound having a charge transport structure having a functional group of the presents application is synthesized according to the method described in, for example, Japanese Patent No. 3164426.

The following is an example.

(1) Synthesis of Hydroxy Group Substituted Triaryl Amine Compound (Represented by the Following Chemical Structure B)

240 parts of sulfolane are added to 113.85 parts (0.3 mol) of methoxy group substituted triaryl amine compound represented by the Chemical structure A and 138 parts (0.92 mol) of sodium iodide. The mixture is heated to 60° C. in nitrogen air stream. 99 parts (0.91 mol) of trimethyl chlorosilane is dropped to the liquid in one hour and the resultant is stirred at about 60° C. for 4 hours to complete the reaction.

About 1,500 parts of toluene is added to the reaction liquid. Subsequent to cooling down to room temperature, the liquid is repeatedly washed with water and sodium carbide aqueous solution.

Thereafter, the solvent is removed from the toluene solution. The toluene solution is purified with column chromatography treatment {absorption medium (silica gel), developing solvent (toluene: ethyl acetate=20:1)}.

Cyclohexane is added to the obtained light yellow oil to precipitate crystal.

88.1 parts (yield ratio=80.4%) of the white crystal represented by the following Chemical structure B was thus obtained. (Melting point: 64.0 to 66.0° C.)

TABLE 3

| | Element analysis (%) | | |
|---|---|---|---|
| | C | H | N |
| Measured value | 85.06 | 6.41 | 3.73 |
| Calculation value | 85.44 | 6.34 | 3.83 |

Chemical structure A

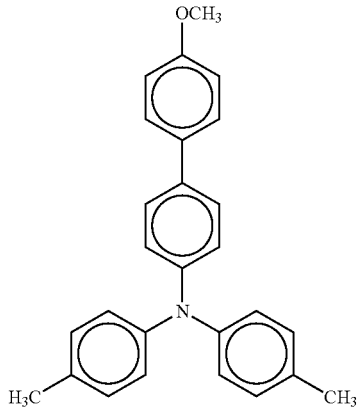

-continued

Chemical structure B

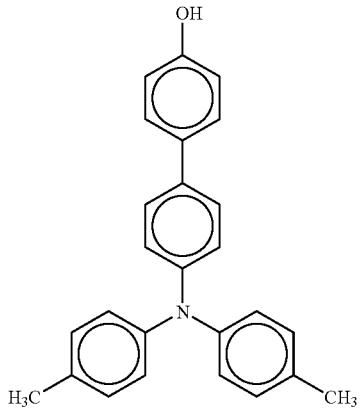

(2) Synthesis Example of Triaryl Amino Group Substituted Acrylate Compound (Example Chemical Compound No. 54)

82.9 parts (0.227 mol) of the hydroxyl group substituted triaryl amine compound (Chemical structure B) was dissolved in 400 parts of tetrahydrofuran and sodium hydroxide aqueous solution (NaOH:12.4 parts, water: 100 parts) was dropped thereto.

The solution was cooled down to 5° C. and 25.2 parts (0.272 mol) of chloride acrylate was dropped thereto over 40 minutes. Thereafter, the solution was stirred at 5° C. for 3 hours to complete reaction. The resultant reaction liquid was poured to water and extracted by toluene. The extracted liquid was repeatedly washed with sodium acid carbonate and water. Thereafter, the solvent was removed from the toluene aqueous solution and purified by column chromatography treatment (absorption medium: silica gel, development solvent:toluene). N-hexane was added to the obtained colorless oil to precipitate crystal.

80.73 parts (yield rate: 84.8%) of white crystal of the Example Chemical Compound No. 54 (melting point: 117.5 to 119.0° C.) was thus obtained.

TABLE 4

| | Element analysis (%) | | |
|---|---|---|---|
| | C | H | N |
| Measured value | 83.13 | 6.01 | 3.16 |
| Calculation value | 83.02 | 6.00 | 3.33 |

Dispersion Liquid Example 1

Dye No. 1 prepared in Comparative Synthesis Example 1 was dispersed by the following recipe under the following dispersion treatment to obtain a dispersion liquid as a charge generating liquid of application.

Recipe:

| | |
|---|---|
| Titanyl phthalocyanine dye (Dye No. 1) | 15 parts |
| Polyvinyl butyral (BX-1, manufactured by Sekisui Chemical Co., Ltd. | 10 parts |
| 2-butanone | 280 parts |

Treatment:

All of 2-butanone and the dye where polyvinyl butyral was dissolved was put in a marketed bead mill dispersion device using PSZ balls having a diameter of 0.5 mm. Dispersion was performed for 30 minutes at 1,200 rpm to prepare a dispersion liquid (Dispersion Liquid No. 1)

Dispersion Liquid Examples 2 to 11

Instead of Dye No. 1 used in Dispersion Liquid Example 1, dispersion Liquids Nos. 2 to 11 were each prepared using Dyes Nos. 2 to 11 prepared in Comparative Synthesis Examples 2 to 8 and Synthesis Examples 1 to 3 under the same condition of Dispersion Liquid Example 1 (Dispersion Liquids 2 to 11 correspond to Dyes Nos. 2 to 11).

Dispersion Liquid Example 12

Dispersion Liquid No. 1 prepared in Dispersion Liquid Example 1 was filtrated using cotton wind cartridge filter (TCW-1-CS with an effective hole diameter of 1 μm, manufactured by ToyoRoshi Kaisha, Ltd.). Filtrated liquid (Dispersion Liquid No. 12) was obtained by using a pump under pressure.

Dispersion Liquid Example 13

Dispersion Liquid Example 13 was prepared in the same manner as in Dispersion Liquid Example 12 except that the filter (TCW-1-CS with an effective hole diameter of 1 μm, manufactured by ToyoRoshi Kaisha, LTd.) used in Dispersion Liquid Example 12 was replaced with (TCW-3-CS with an effective hole diameter of 3 μm, manufactured by ToyoRoshi Kaisha, LTd.).

Dispersion Liquid Example 14

Dispersion Liquid Example 14 was prepared in the same manner as in Dispersion Liquid Example 12 except that the filter (TCW-1-CS with an effective hole diameter of 1 μm, manufactured by ToyoRoshi Kaisha, LTd.) used in Dispersion Liquid Example 12 was replaced with (TCW-5-CS with an effective hole diameter of 5 μm, manufactured by ToyoRoshi Kaisha, Ltd.).

Dispersion Liquid Example 15

Dispersion Liquid Example 15 was prepared in the same manner as in Dispersion Liquid Example 1 except that the dispersion treatment was changed to 1,000 rpm for 20 minutes.

Dispersion Liquid Example 16

The dispersion liquid prepared in Dispersion Liquid Example 15 was filtrated using a cotton wind cartridge filter TCW-1-CS with an effective hole diameter of 1 μm, manufactured by ToyoRoshi Kaisha, LTd. The dispersion liquid was filtrated using a pump under pressure. During filtration, the filter was clogged so that the dispersion liquid was not filtrated completely. Therefore, the dispersion liquid was not evaluated.

The particle size distribution of the Dye particles in the distribution liquids as prepared above was measured using CAPA-700, manufactured by Horiba, Ltd. The results are shown in Table 5.

TABLE 5

| | | Average particle diameter (μm) | Standard deviation (μm) |
|---|---|---|---|
| Dispersion Liquid 1 | Dye No. 1 | 0.29 | 0.18 |
| Dispersion Liquid 2 | Dye No. 2 | 0.28 | 0.9 |
| Dispersion Liquid 3 | Dye No. 3 | 0.31 | 0.20 |
| Dispersion Liquid 4 | Dye No. 4 | 0.30 | 0.20 |
| Dispersion Liquid 5 | Dye No. 5 | 0.27 | 0.19 |
| Dispersion liquid 6 | Dye No. 6 | 0.29 | 0.20 |
| Dispersion Liquid 7 | Dye No. 7 | 0.27 | 0.18 |
| Dispersion Liquid 8 | Dye No. 8 | 0.26 | 0.17 |
| Dispersion liquid 9 | Dye No. 9 | 0.19 | 0.13 |
| Dispersion Liquid 10 | Dye No. 10 | 0.21 | 0.14 |
| Dispersion Liquid 11 | Dye No. 11 | 0.23 | 0.15 |
| Dispersion Liquid 12 | Dye No. 12 | 0.22 | 0.13 |
| Dispersion Liquid 13 | Dye No. 13 | 0.2 | 0.17 |
| Dispersion Liquid 14 | Dye No. 14 | 0.28 | 0.18 |
| Dispersion Liquid 15 | Dye No. 15 | 0.33 | 0.23 |

Manufacturing Example 1 of Image Bearing Member

A charge blocking layer liquid of application, a moiré prevention layer liquid of application, a charge generating layer liquid of application, and a charge transport layer liquid of application, each of which had the following composition, were coated and dried on a aluminum cylinder (JIS1050) having a diameter of 100 mm in this order. A layer accumulated image bearing member (Manufacturing Example 2 of image bearing member) was thus manufactured in which a charge blocking having a thickness of 1.0 μm and a moiré prevention layer having a thickness of 3.5 μm, a charge generating layer and a charge transport layer having a thickness of 28 μm.

The layer thickness of the charge generating layer was adjusted to have a transmission factor of 25% at 780 nm. The transmission factor of the charge generating layer was evaluated as follows: the charge generating layer liquid of application was coated on an aluminum cylinder on which polyethylene terephthalate film was wound under the same coating condition as that for the image bearing member; and the transmission factor at 780 nm was evaluated using a marketed spectral photometer (UV-3100, manufactured by Shimadzu Corporation) comparing with that for polyethylene terephtahalate film on which a charge generating layer was not formed.

In addition, after manufacturing the image bearing member, when the layer thickness of the photosensitive layer was measured, the layer thickness of the charge generating layer was not greater than 0.1 μm, and the substantial layer thickness of the photosensitive layer was 28 μm, which was almost the same as that of the charge transport layer.

| Charge blocking layer liquid of application | |
|---|---|
| N-methoxy methylized nylon (fine resin FR-101, manufactured by Namariichi Co., Ltd.) | 4 parts |
| Methanol | 70 parts |
| n-butanol | 30 parts |
| Moire prevention layer | |
| Titanium oxide (CR-EL, manufactured by Ishihara Sangyo Kaisha, Ltd.: Average particle diameter: 0.25 μm) | 126 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 6/4.

| Charge generating layer liquid of application | |
|---|---|
| Dispersion Liquid 1 was used | |
| Charge transport layer liquid of application | |
| Polycarbonate (TS2050, manufactured by Teijin Chemicals Ltd.) | 10 parts |
| Charge transport material represented by the following chemical formula | 7 parts |
| Methylene chloride | 80 parts |

Manufacturing Examples 2 to 15 of Image Bearing Member

Examples 2 to 15 of image bearing member were manufactured in the same manner as in Manufacturing Example 1 of image bearing member except that the charge generating layer liquid of application (Dispersion Liquid No. 1) was replaced with Dispersion Liquids Nos. 2 to 15. The layer thickness thereof was adjusted to have a transmission factor of 25% at 780 nm as in Manufacturing Example 1 of image bearing member. Manufacturing Examples 2 to 15 of image bearing member corresponded to Distribution Liquids Nos. 2 to 15. Manufacturing Example 16 of image bearing member Example 16 of image bearing member was manufactured in the same manner as in Manufacturing Example 9 of image bearing member except that no charge blocking layer was provided.

Manufacturing Example 17 of Image Bearing Member

Example 17 of image bearing member was manufactured in the same manner as in Manufacturing Example 9 of image bearing member except that no moire prevention layer was provided.

Manufacturing Example 18 of Image Bearing Member

Manufacturing Example 18 of image bearing member was manufactured in the same manner as in Manufacturing Example 18 of image bearing member except that the coating sequence of the charge blocking layer and the moiré prevention layer was reversed.

Manufacturing Example 19 of Image Bearing Member

Example 19 of image bearing member was manufactured in the same manner as in Image bearing member Example 9 except that the layer thickness of the charge blocking layer was changed to 0.1 μm.

Manufacturing Example 20 of Image Bearing Member

Example 20 of image bearing member was manufactured in the same manner as in Manufacturing Example 20 of image bearing member except that the layer thickness of the charge blocking layer was changed to 0.3 μm.

Manufacturing Example 21 of Image Bearing Member

Example 21 of image bearing member was manufactured in the same manner as in Manufacturing Example 9 of image bearing member except that the layer thickness of the charge blocking layer was changed to 0.6 μm.

Manufacturing Example 22 of Image Bearing Member

Example 22 of image bearing member was manufactured in the same manner as in Manufacturing Example 9 of image bearing member except that the layer thickness of the charge blocking layer was changed to 1.8 μm.

Manufacturing Example 23 of Image Bearing Member

Example 23 of image bearing member was manufactured in the same manner as in Manufacturing Example 9 of image bearing member except that the layer thickness of the charge blocking layer was changed to 2.3 μm.

Manufacturing Example 24 of Image Bearing Member

Example 24 of image bearing member was manufactured in the same manner as in Manufacturing Example 9 of image bearing member except that the composition of the charge blocking layer liquid of application was changed to the following:

| Charge blocking layer liquid of application | |
|---|---|
| Alcohol soluble nylon (AMILANE CM8000, manufactured by Toray Industries, Inc.) | 4 parts |
| Methanol | 70 parts |
| n-butanol | 30 parts |

Manufacturing Example 25 of Image Bearing Member

Example 25 of image bearing member was manufactured in the same manner as in Manufacturing Example 9 of image bearing member except that the composition of the charge blocking layer liquid of application was changed to the following:

| Charge blocking layer liquid of application | |
|---|---|
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 400 parts |

Manufacturing Example 26 of Image Bearing Member

Example 26 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 168 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 2/1. The ratio by weight of the alkyd resin to the melamine resin was 6/4.

Manufacturing Example 27 of Image Bearing Member

Example 27 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 252 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 3/1. The ratio by weight of the alkyd resin to the melamine resin was 6/4.

Manufacturing Example 28 of Image Bearing Member

Example 28 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 84 parts |
| Alkyd resin (BEKKOLIGHT ® M6401-50-S: solid, portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1/1. The ratio by weight of the alkyd resin to the melamine resin was 6/4.

Manufacturing Example 29 of Image Bearing Member

Example 29 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 42 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 0.5/1. The ratio by weight of the alkyd resin to the melamine resin was 6/4.

Manufacturing Example 30 of Image Bearing Member

Example 30 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 336 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 4/1. The ratio by weight of the alkyd resin to the melamine resin was 6/4.

Manufacturing Example 31 of Image Bearing Member

Example 31 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 126 parts |
| N-methoxy methylized nylon (fine resin FR-101, manufactured by Namariichi Co., Ltd.) | 27.5 parts |
| Tartaric acid (curing catalyst) | 1 part |
| 2-butanone | 100 parts |

The ratio by volume of the inorganic pigment to the binder resin in the composition mentioned above was 1.5/1.

Manufacturing Example 32 of Image Bearing Member

Example 32 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 126 parts |
| Alkyd resin (BEKKOLIGHT ® M6401-50-S: solid portion 50%, manufactured by Dainippon Ink and Chemicals, Incorporated.) | 22.4 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 4/6.

Manufacturing Example 33 of Image Bearing Member

Example 33 of image bearing member was manufactured in the same manner as in Manufacturing Example 9 of image bearing member except that the composition of the moir prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 126 parts |

-continued

| Moiré prevention layer liquid of application | |
|---|---|
| Alkyd resin (BEKKOLIGHT ® M6401-50-S: solid portion 50%, manufactured by Dainippon Ink and Chemicals, Incorporated.) | 28 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 5/5.

Manufacturing Example 34 of Image Bearing Member

Example 34 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 126 parts |
| Alkyd resin (BEKKOLIGHT ® M6401-50-S: solid portion 50%, manufactured by Dainippon Ink and Chemicals, Incorporated.) | 39.2 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 7/3.

Manufacturing Example 35 of Image Bearing Member

Example 35 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 126 parts |
| Alkyd resin (BEKKOLIGHT ® M6401-50-S: solid portion 50%, manufactured by Dainippon Ink and Chemicals, Incorporated.) | 44.8 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 8/2.

Manufacturing Example 36 of Image Bearing Member

Example 36 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 126 parts |
| Alkyd resin (BEKKOLIGHT ® M6401-50-S: solid portion 50%, manufactured by Dainippon Ink and Chemicals, Incorporated.) | 50.4 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 9/1.

Manufacturing Example 37 of Image Bearing Member

Example 37 of image bearing member was manufactured in the same manner as in Manufacturing Example 9 of image bearing member except that the composition of the moire prevention layer liquid of application was changed to the following:

| Moiré prevention layer liquid of application | |
|---|---|
| Zinc oxide (SAZEX4000, manufactured by Sakai Chemical Industry, Co. Ltd.: Average particle diameter: 0.25 μm) | 165 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 120 parts |

The ratio by volume of the inorganic pigment to the binder resin in the composition mentioned above was 1.5/1. The ratio by weight of the alkyd resin to the melamine resin was 6/4.

Manufacturing Example 38 of Image Bearing Member

Example 38 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 63 parts |
| Titanium oxide (PT-401M, manufactured by Ishihara Sangyo Kaisha, Ltd.: Average particle diameter: 0.07 μm) | 63 parts |

-continued

| Moiré prevention layer liquid of application | |
|---|---|
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 6/4.

The ratio of the average particle diameter of PT-401M to CR-EL was 0.28 and the mixing ratio of PT-401M to CR-EL was 0.5.

Manufacturing Example 39 of Image Bearing Member

Example 39 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 113.4 parts |
| Titanium oxide (PT-401M, manufactured by Ishihara Sangyo Kaisha, Ltd.: Average particle diameter: 0.07 μm) | 12.6 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 6/4.

The ratio of the average particle diameter of PT-401M to CR-EL was 0.28 and the mixing ratio of PT-401M to CR-EL was 1/9. Manufacturing Example 40 of image bearing member Example 40 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 12.6 parts |
| Titanium oxide (PT-401M, manufactured by Ishihara Sangyo Kaisha, Ltd.: Average particle diameter: 0.07 μm) | 113.4 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 6/4.

The ratio of the average particle diameter of PT-401M to CR-EL was 0.28 and the mixing ratio of PT-401M to CR-EL was 9/1.

Manufacturing Example 41 of Image Bearing Member

Example 41 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 63 parts |
| Titanium oxide (TTO-F1, manufactured by Ishihara Sangyo Kaisha, Ltd.: Average particle diameter: 0.04 μm) | 63 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 6/4.

The ratio of the average particle diameter of TTO-F1 to CR-EL was 0.28 and the mixing ratio of TTO-F1 to CR-EL was 1/1.

Manufacturing Example 42 of Image Bearing Member

Example 42 of image bearing member was manufactured in the same manner as in Manufacturing Example 9 of image bearing member except that the composition of the moire prevention layer liquid of application was changed to the following:

| Moiré prevention layer liquid of application | |
|---|---|
| Titanium oxide (CR-EL, manufactured by Ishihara Sangyo Kaisha, Ltd.: Average particle diameter: 0.25 μm) | 63 parts |
| Titanium oxide (A-100, manufactured by Ishihara Sangyo Kaisha, Ltd.: Average particle diameter: 0.15 μm) | 63 parts |
| Alkyd resin (BEKKOLIGHT ® M6401-50-S: solid portion 50%, manufactured by Dainippon Ink and Chemicals, Incorporated.) | 33.6 parts |
| Melamine resin (SUPER BECKAMINE L-121-60 (solid portion 60%, manufactured by Dainippon Ink and Chemicals, Incorporated.) | |
| 2-butanone | 100 parts |

The ratio by volume of the inorganic pigment to the binder resin in the composition mentioned above was 1.5/1. The ratio by weight of the alkyd resin to the melamine resin was 6/4.

The ratio of the average particle diameter of A-100 to CR-EL was 0.6 and the mixing ratio of TTO-F1 to CR-EL was 1/1.

Manufacturing Example 43 of Image Bearing Member

Example 43 of image bearing member was manufactured in the same manner as in Manufacturing Example 9 of image bearing member except that the composition of the charge transport layer liquid of application was changed to the following:

| | |
|---|---|
| Charge transport polymer (weight average molecular weight: about 135,000) represented by the following structure | 10 parts |

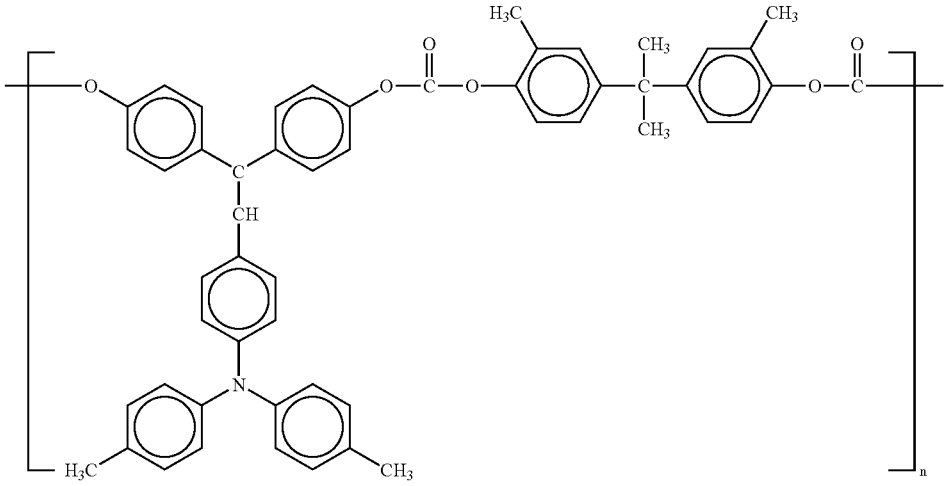

-continued

| | |
|---|---|
| Additive represented by the following structure | 0.5 parts |

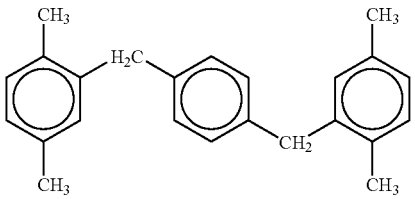

| | |
|---|---|
| Methylene chloride | 100 parts |

Manufacturing Example 44 of Image Bearing Member

Example 44 of image bearing member was manufactured in the same manner as in Manufacturing Example 9 of image bearing member except that the layer thickness of the charge transport layer was changed to be 23 μm, and the protective layer liquid of application having the following composition was applied and dried on the charge transport layer to form a protective layer having a thickness of 5 μm.

| Protective layer liquid of application | |
|---|---|
| Polycarbonate (TS2050, manufactured by Teijin Chemicals Ltd., viscosity average molecular weight: 50,000) | 10 parts |
| Charge transport material represented by the following chemical formula | 7 parts |

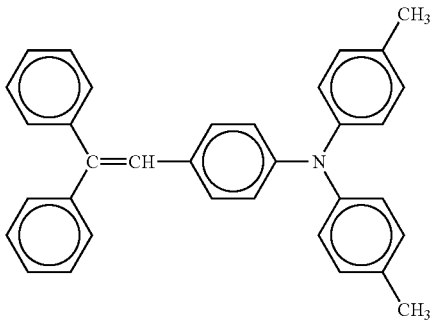

| | |
|---|---|
| Aluminum particulate (Specific electric resistance: $2.5 \times 10^{12}$ Ωcm, average primary particle diameter: 0.4 μm) | 4 parts |
| Cyclohexanone | 500 parts |
| Tetrahydrofuran | 150 parts |

Manufacturing Example 45 of Image Bearing Member

Example 45 of image bearing member was manufactured in the same manner as in Manufacturing Example 44 of image bearing member except that alumina particulates in the protective layer liquid of application was changed to the following.

Titanium oxide particulates (Specific electric resistance: $1.5\times10^{12}$ Ω·cm, average primary particle diameter: 0.5 μm)

Manufacturing Example 46 of Image Bearing Member

Example 46 of image bearing member was manufactured in the same manner as in Manufacturing Example 9 of image bearing member except that alumina particulates in the protective layer liquid of application was changed to the following.

| | |
|---|---|
| Tin oxide - antimony oxide powder (Specific electric resistance: $1.0 \times 10^{6}$ Ωcm, average primary particle diameter: 0.4 μm) | 4 parts |

Manufacturing Example 47 of Image Bearing Member

Example 47 of image bearing member was manufactured in the same manner as in Manufacturing Example 44 of image bearing member except that the protective layer liquid of application was changed to the following.

| Protective layer liquid of application | |
|---|---|
| Charge transport polymer (weight average molecular weight: about 135,000) represented by the following structure | 10 parts |

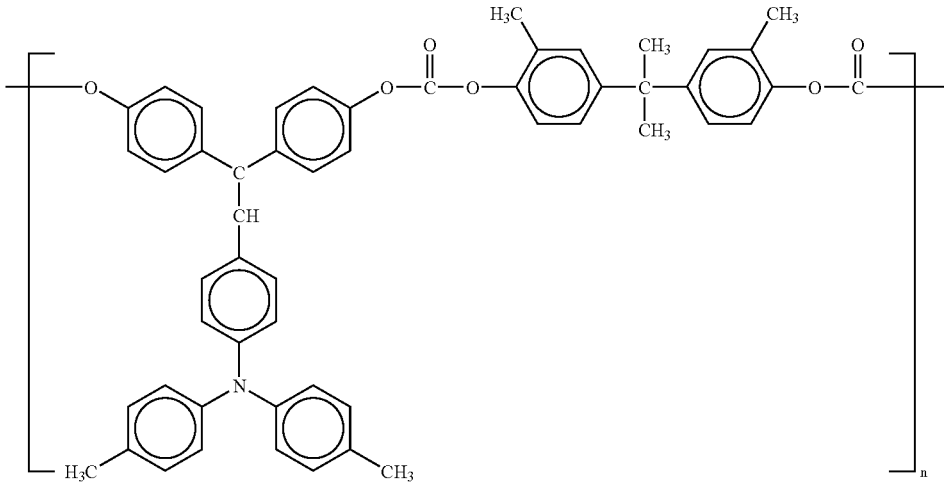

| | |
|---|---|
| Aluminum particulate (Specific electric resistance: $2.5 \times 10^{12}$ Ωcm, average primary particle diameter: 0.4 μm) | 4 parts |
| Cyclohexanone | 500 parts |
| Tetrahydrofuran | 150 parts |

Manufacturing Example 48 of Image Bearing Member

Example 48 of image bearing member was manufactured in the same manner as in Manufacturing Example 44 of image bearing member except that the protective layer liquid of application was changed to the following.

| Protective layer liquid of application | |
|---|---|
| Methyl trimethoxy silane | 100 parts |
| 3% acetic acid | 20 parts |
| Charge transport material represented by the following chemical formula | 35 parts |

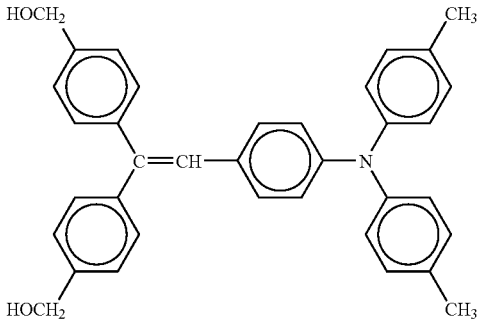

| | |
|---|---|
| Anti-oxidization agent (SANOL LS2626, manufactured by Sankyo Co., Ltd. | 1 part |
| Curing agent (Dibutyl tin acetate) | 1 part |
| 2-propanpl | 200 parts |

Manufacturing Example 49 of Image Bearing Member

Example 49 of image bearing member was manufactured in the same manner as in Manufacturing Example 44 of image bearing member except that the protective layer liquid of application was changed to the following.

| Protective layer liquid of application | |
|---|---|
| Methyl trimethoxysilane | 100 parts |
| 3% acetic acid | 20 parts |
| Charge transport material represented by the following chemical structure | 35 parts |

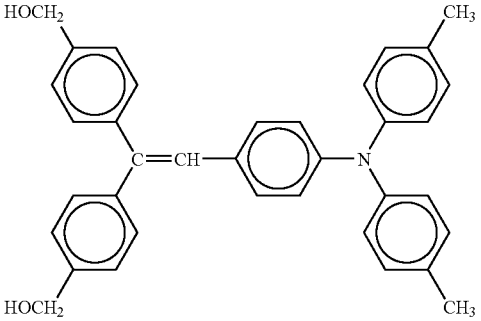

| | |
|---|---|
| α-aluminum particle (SUMICORUNDUM AA-3, manufactured by Sumitomo Chemical Co., Ltd. | 15 parts |
| Anti-oxidization agent (SANOL LS2626, manufactured by Sankyo Co., Ltd. | 1 part |
| Polycarbonic acid compound (BYK P104, manufactured by BYK-Chemie U.S. Inc.) | 0.4 parts |
| Curing agent (dibutyl tin acetate | 1 part |
| 2-propanol | 200 parts |

Manufacturing Example 50 of Image Bearing Member

Example 50 of image bearing member was manufactured in the same manner as in Manufacturing Example 44 of image bearing member except that the protective layer liquid of application was changed to the following.

The protective layer was cured and formed by naturally drying a spray-coated film for 20 minutes and irradiating the film with a metal halide lamp of 160 W/cm, irradiation intensity of 500 mW/cm$^2$ and irradiation time of 60 sec.

| Protective layer liquid of application | |
|---|---|
| Radical polymeric monomer having at least 3 functional groups without having a charge transport structure [Trimethyl propane triacrylate (KAYARAD TMPTA, manufactured by Nippon Kayaku Co., Ltd., molecular weight of 296, 3 functional groups, molecular weight/the number of functional groups = 99)] | 10 parts |
| Radical polymeric compound having a functional group with a charge transport structure represented by the following chemical structure | 10 parts |

Example Chemical Compound No. 54

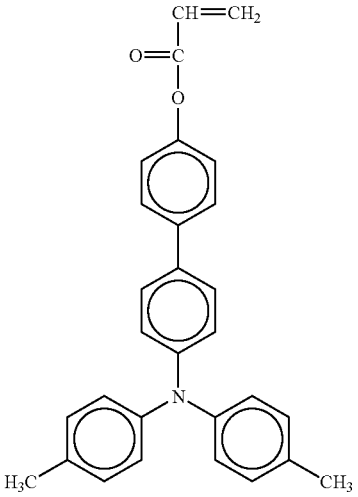

-continued

| Protective layer liquid of application | |
|---|---|
| Optical polymerization initiator [1-hydroxy-cyclohexyl-phenyl-ketone (IRGACURE 184, manufactured by Chiba Specialty Chemicals)] | 1 part |
| Tetrahydrofuran | 100 parts |

Manufacturing Example 51 of Image Bearing Member

Example 51 of image bearing member was manufactured in the same manner as in Manufacturing Example 50 of image bearing member except that the charge transport layer liquid of application was changed to the following.

| | |
|---|---|
| Charge transport polymer (weight average molecular weight: about 135,000) represented by the following structure | 10 parts |

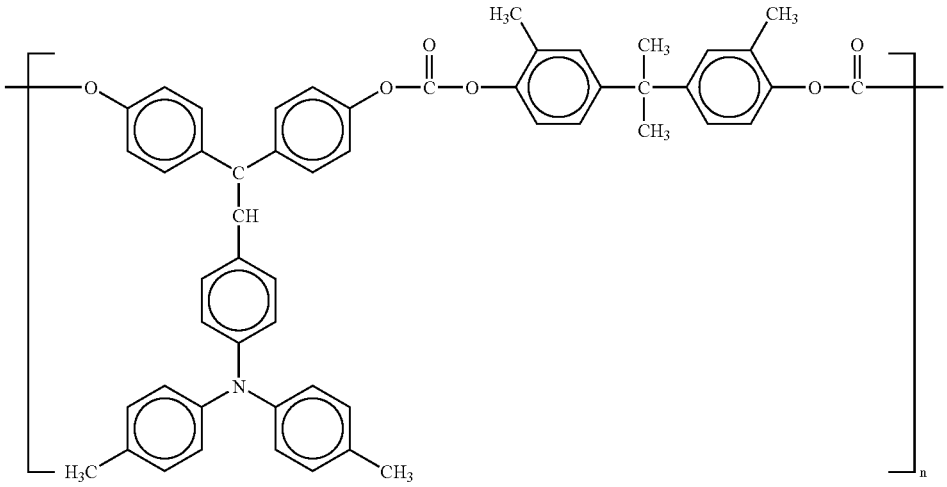

| | |
|---|---|
| Methylene chloride | 100 parts |

Manufacturing Example 52 of Image Bearing Member

Example 52 of image bearing member was manufactured in the same manner as in Manufacturing Example 50 of image bearing member except that the radical polymeric monomer having at least 3 functional groups without having a charge transport structure contained in the protective layer liquid of application was changed to the following radical polymeric monomer.

Radical polymeric monomer having at least 3 functional groups without having a charge transport structure [pentaerythritol tetraacrylate (SR-295, manufactured by Sartomer Company, Inc., molecular weight of 352, 4 functional groups, molecular weight/the number of functional groups=88)

Manufacturing Example 53 of Image Bearing Member

Example 53 of image bearing member was manufactured in the same manner as in Manufacturing Example 50 of image bearing member except that the radical polymeric monomer having at least 3 functional groups without having a charge transport structure contained in the protective layer liquid of application was changed to 10 parts of the following radical polymeric monomer having 2 functional groups without having a charge transport structure.

| | |
|---|---|
| Radical polymeric monomer having 2 functional groups without having a charge transport structure (1,6-hexane diol diacrylate, manufactured by Wako Pure Chemical Industries, Ltd., molecular weight of 226, 2 functional groups, molecular weight/the number of functional groups = 113) | 10 parts |

Manufacturing Example 54 of Image Bearing Member

Example 54 of image bearing member was manufactured in the same manner as in Manufacturing Example 50 of image bearing member except that the radical polymeric monomer having at least 3 functional groups without having a charge transport structure contained in the protective layer liquid of application was changed to the following radical polymeric monomer and the optical polymerization initiator was changed to 1 part of the following compound.

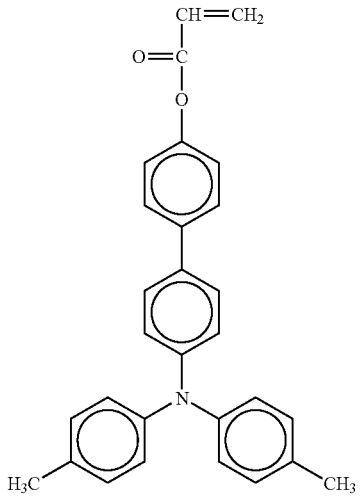

| | |
|---|---|
| Radical polymeric monomer having at least 3 functional groups without having a charge transport structure [caprolactone modified dipenta erythritol hexa acrylate, (KAYARAD DACA-120, manufactured by Nippon Kayaku Co., Ltd., molecular weight of 1947, 6 functional groups, molecular weight/the number of functional groups = 325)] | 10 parts |

Manufacturing Example 55 of Image Bearing Member

Example 55 of image bearing member was manufactured in the same manner as in Manufacturing Example 50 of image bearing member except that the radical polymeric compound having a functional group with a charge transport structure was changed to 10 parts of the radical polymeric compound having 2 functional groups with a charge transport structure represented by the following chemical structure.

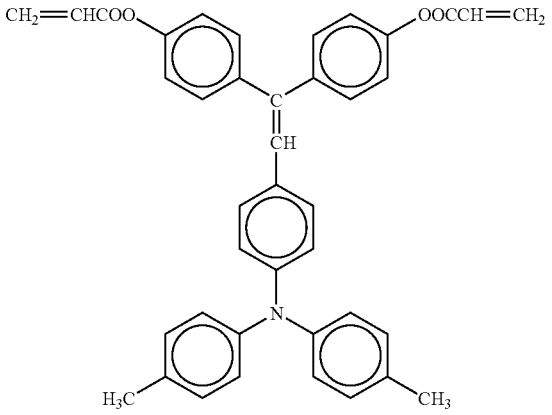

Manufacturing Example 56 of Image Bearing Member

Example 56 of image bearing member was manufactured in the same manner as in Manufacturing Example 50 of image bearing member except that the composition of the protective layer liquid of application was changed to the following:

| | |
|---|---|
| Radical polymeric monomer having at least 3 functional groups without having a charge transport structure [Trimethyl propane triacrylate (KAYARAD TMPTA, manufactured by Nippon Kayaku Co., Ltd., molecular weight of 296, 3 functional groups, molecular weight/the number of functional groups = 99)] | 6 parts |
| Radical polymeric compound having a functional group with a charge transport structure represented by the following chemical structure Example chemical compound No. 54 | 14 parts |

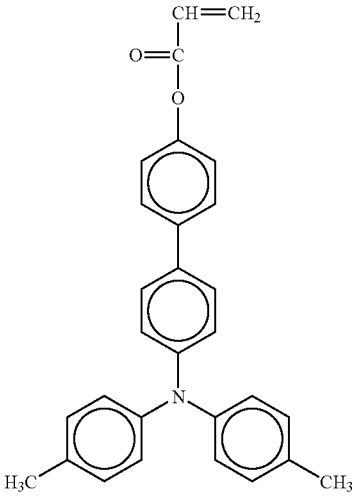

| | |
|---|---|
| Optical polymerization initiator [1-hydroxy-cyclohexyl-phenyl-ketone (IRGACURE 184, manufactured by Chiba Specialty Chemicals)] | 1 part |
| Tetrahydrofuran | 100 parts |

Manufacturing Example 57 of Image Bearing Member

Example 57 of image bearing member was manufactured in the same manner as in Manufacturing Example 50 of image bearing member except that the composition of the protective layer liquid of application was changed to the following:

| | |
|---|---|
| Radical polymeric monomer having at least 3 functional groups without having a charge transport structure [Trimethyl propane triacrylate (KAYARAD TMPTA, manufactured by Nippon Kayaku Co., Ltd., molecular weight of 296, 3 functional groups, molecular weight/the number of functional groups = 99)] | 14 parts |
| Radical polymeric compound having a functional group with a charge transport structure represented by the following chemical structure Example Chemical Compound No. 54 | 6 parts |

-continued

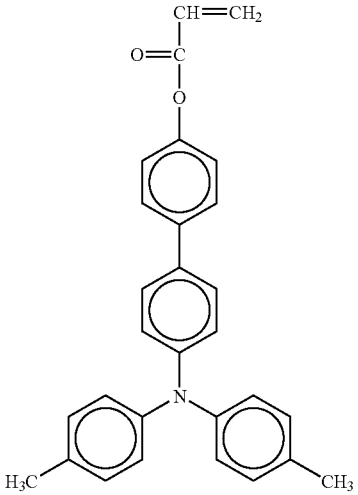

| | |
|---|---|
| Optical polymerization initiator [1-hydroxy-cyclohexyl-phenyl-ketone (IRGACURE 184, manufactured by Chiba Specialty Chemicals)] | 1 part |
| Tetrahydrofuran | 100 parts |

Manufacturing Example 58 of Image Bearing Member

Example 58 of image bearing member was manufactured in the same manner as in Manufacturing Example 50 of image bearing member except that the composition of the protective layer liquid of application was changed to the following:

| | |
|---|---|
| Radical polymeric monomer having at least 3 functional groups without having a charge transport structure [Trimethyl propane triacrylate (KAYARAD TMPTA, manufactured by Nippon Kayaku Co., Ltd., molecular weight of 296, 3 functional groups, molecular weight/the number of functional groups = 99)] | 2 parts |
| Radical polymeric compound having a functional group with a charge transport structure represented by the following chemical structure Example Chemical Compound No. 54 | 18 parts |

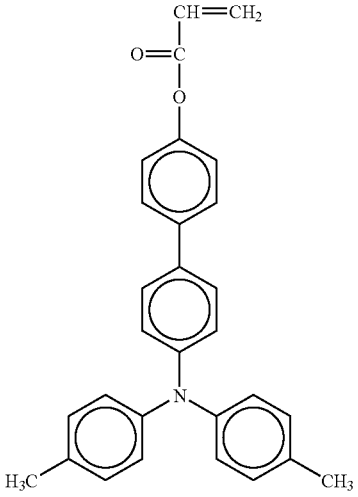

-continued

| | |
|---|---|
| Optical polymerization initiator [1-hydroxy-cyclohexyl-phenyl-ketone (IRGACURE 184, manufactured by Chiba Specialty Chemicals)] | 1 part |
| Tetrahydrofuran | 100 parts |

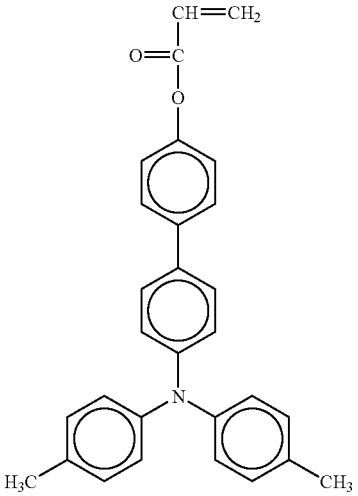

Manufacturing Example 59 of Image Bearing Member

Example 59 of image bearing member was manufactured in the same manner as in Manufacturing Example 50 of image bearing member except that the composition of the protective layer liquid of application was changed to the following:

| | |
|---|---|
| Radical polymeric monomer having at least 3 functional groups without having a charge transport structure [Trimethyl propane triacrylate (KAYARAD TMPTA, manufactured by Nippon Kayaku Co., Ltd., molecular weight of 296, 3 functional groups, molecular weight/the number of functional groups = 99)] | 18 parts |
| Radical polymeric compound having a functional group with a charge transport structure represented by the following chemical structure Example chemical compound No. 54 | 2 parts |

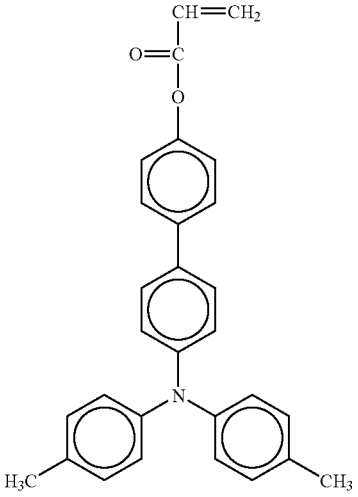

-continued

| | |
|---|---|
| Optical polymerization initiator [1-hydroxy-cyclohexyl-phenyl-ketone (IRGACURE 184, manufactured by Chiba Specialty Chemicals)] | 1 part |
| Tetrahydrofuran | 100 parts |

Cracking and peeling of the layer of Examples 50 to 59 of image bearing members as manufactured above were determined by observing the appearance thereof with naked eyes. Next, as the dissolution test for an organic solvent, a drop of tetrahydrofuran (hereinafter referred to as THF) and dichloromethane was dropped to Examples 50 to 59 of image bearing members to observe the surface state after natural dry. The results are shown in Table 6.

TABLE 6

| Image bearing member | Surface state | Dissolution test THF | Dichloromethane |
|---|---|---|---|
| 50 | Good | Insoluble | Insoluble |
| 51 | Good | Insoluble | Insoluble |
| 52 | Good | Insoluble | Insoluble |
| 53 | Good | Slightly soluble | Slightly soluble |
| 54 | Good | Insoluble | Insoluble |
| 55 | Cracking | Insoluble | Insoluble |
| 56 | Good | Insoluble | Insoluble |
| 57 | Good | Insoluble | Insoluble |
| 58 | Good | Slightly soluble | Slightly soluble |
| 59 | Good | Insoluble | Insoluble |

Manufacturing Example 60 of Image Bearing Member

Example 60 of image bearing member was manufactured in the same manner as in Manufacturing Example 1 of image bearing member except that the electroconductive substrate was changed to aluminum cylinder (JIS1050) having a diameter of 40 mm.

Manufacturing Example 61 of Image Bearing Member

Example 61 of image bearing member was manufactured in the same manner as in Manufacturing Example 4 of image bearing member except that the electroconductive substrate was changed to aluminum cylinder (JIS1050) having a diameter of 40 mm.

Manufacturing Example 62 of Image Bearing Member

Example 62 of image bearing member was manufactured in the same manner as in Manufacturing Example 6 of image bearing member except that the electroconductive substrate was changed to aluminum cylinder (JIS1050) having a diameter of 40 mm.

Manufacturing Example 63 of Image Bearing Member

Example 63 of image bearing member was manufactured in the same manner as in Manufacturing Example 9 of image bearing member except that the electroconductive substrate was changed to aluminum cylinder (JIS1050) having a diameter of 40 mm.

Manufacturing Example 64 of image bearing member

Example 64 of image bearing member was manufactured in the same manner as in Manufacturing Example 11 of image bearing member except that the electroconductive substrate was changed to aluminum cylinder (JIS1050) having a diameter of 40 mm.

Manufacturing Example 65 of Image Bearing Member

Example 65 of image bearing member was manufactured in the same manner as in Manufacturing Example 12 of image bearing member except that the electroconductive substrate was changed to aluminum cylinder (JIS1050) having a diameter of 40 mm.

Manufacturing Example 66 of Image Bearing Member

Example 66 of image bearing member was manufactured in the same manner as in Manufacturing Example 16 of image bearing member except that the electroconductive substrate was changed to aluminum cylinder (JIS1050) having a diameter of 40 mm.

Manufacturing Example 67 of Image Bearing Member

Example 67 of image bearing member was manufactured in the same manner as in Manufacturing Example 17 of image bearing member except that the electroconductive substrate was changed to aluminum cylinder (JIS1050) having a diameter of 40 mm.

Manufacturing Example 68 of Image Bearing Member

Example 68 of image bearing member was manufactured in the same manner as in Manufacturing Example 18 of image bearing member except that the electroconductive substrate was changed to aluminum cylinder (JIS1050) having a diameter of 40 mm.

Manufacturing Example 69 of Image Bearing Member

Example 69 of image bearing member was manufactured in the same manner as in Manufacturing Example 38 of image bearing member except that the electroconductive substrate was changed to aluminum cylinder (JIS1050) having a diameter of 40 mm.

Manufacturing Example 70 of Image Bearing Member

Example 70 of image bearing member was manufactured in the same manner as in Manufacturing Example 44 of image bearing member except that the electroconductive substrate was changed to aluminum cylinder (JIS1050) having a diameter of 40 mm.

Manufacturing Example 71 of Image Bearing Member

Example 71 of image bearing member was manufactured in the same manner as in Manufacturing Example 50 of image bearing member except that the electroconductive substrate was changed to aluminum cylinder (JIS1050) having a diameter of 40 mm.

Examples 1 to 58 and Comparative Examples 1 to 26

Examples 1 to 42 of image bearing members as manufactured in Manufacturing Examples 1 to 42 of image bearing members were attached to a process cartridge for an image forming apparatus as illustrated in FIG. 7 and the process cartridge was attached to an image forming apparatus having an image bearing member having linear velocity of 320 mm/sec as illustrated in FIG. 5. Continuous printing of 300,000 prints was performed at 22° C. and 55% RH. The charging device taking a scorotron system was used and the charging was performed under the following conditions.

Test pattern irradiation having a writing ratio of 6% was performed using a multi-beam irradiation head having a polygon mirror with a definition of 600 dpi where 4 end face emission semiconductor laser elements having 780 nm were arranged in the secondary scanning direction as the image irradiation light source. A two component developer containing toner and carrier was used for reversal development by which the toner was attracted to the irradiated portion of the image bearing member. A transfer belt, by which a toner image was directly transferred to a transfer medium, was used as a transfer device.

Charging Condition 1

Discharge voltage: −6.0 kV

Grid voltage: −920 V (the surface voltage of unirradiated portion of the image bearing member was −900 V)

Charging Condition 2

Discharge voltage: −5.8 kV

Grid voltage: −780 V (the surface voltage of unirradiated portion of the image bearing member was −750 V)

The intensity of the electric field during the 300,000 printing was 32.1 to 38.0 (V/μm) for Comparative Examples 1 to 13 and Examples 1 to 29 under the charging condition 1 and 26.8 to 29.5 (V/μm) for Comparative Examples 14 to 26 and Examples 30 to 58 under the charging condition 2.

The obtained images were evaluated with regard to the following after 300,000 printing. The image bearing member was charged to have an intensity of the electric field represented by the following relationship (A) and (B) of 32.1 (V/μm) and 26.8 (V/μm), respectively.

1) Image bearing member in which a photosensitive layer was disposed on the surface of the image bearing member:

The intensity of the electric field(V/μm)=the absolute value of the surface voltage(V)of unirradiated portion of the image bearing member at developing portion/the layer thickness of the photosensitive layer(μm) (A)

2) Image bearing member in which a protective layer is provided on a photosensitive layer:

The intensity of the electric field(V/μm)=the absolute value of the surface voltage(V)of unirradiated portion of the image bearing member at developing portion/the layer thickness of(the photosensitive layer+the protective layer)(μm) (B)

(i) Evaluation on Background Fouling

A white solid image was output and the number and the size of black spots observed on the background portion were evaluated. The evaluation was performed based on 4 ranking of E (excellent), G (good), F (fair) and P (poor).

(ii) Evaluation on a Horizontal Image with Two Laser Beam Writing

Figure 22:
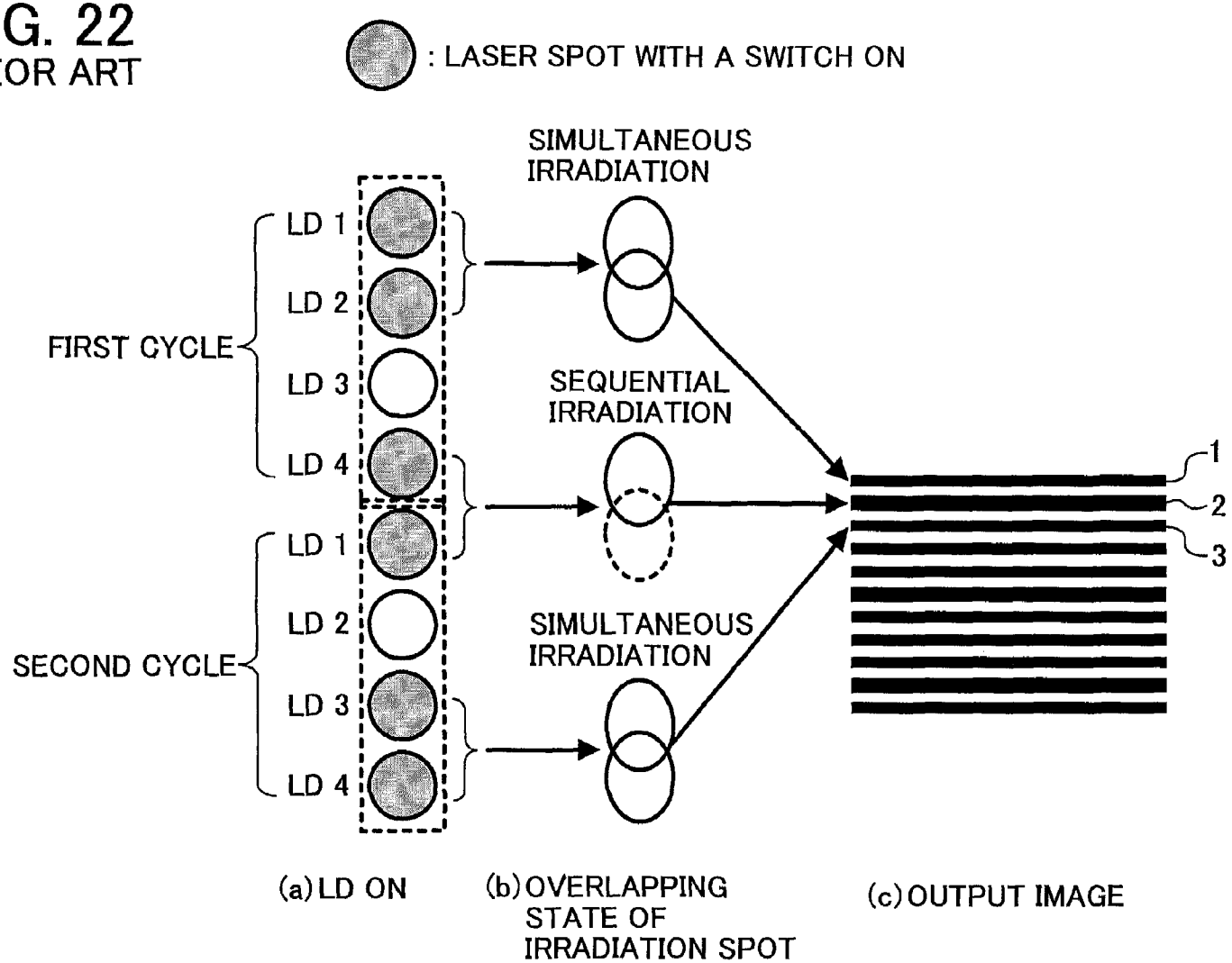
FIG. 22 PRIOR ART
FIG. 22 is a diagram illustrating multi-beam irradiation.

The 4 LD elements were lighted as illustrated in FIG. 22 to form a latent horizontal line image. The latent horizontal line image was output at a ratio of 3 simultaneous irradiation line images and 1 sequential irradiation line image over the recording medium. The image was observed with naked eyes and evaluated according to the following ranking system.

E (excellent): uniform with no difference seen between the simultaneous irradiation image and the sequence image irradiation.

G (good): uniform with extremely slightly non-uniform portions.

F (fair): slightly non-uniform portions were seen.

P (poor): poorly uniform with distinctive differences between the simultaneous irradiation image and the sequence image irradiation.

(iii) Others

As other evaluation items, the density of a black solid image was evaluated. In addition, half tone images were initially (1st to 100th) output during image formation and evaluated for the occurrence of moiré.

The results are shown in Table 7. The results of the items of (iii) are shown only when a problem occurred. The results of the occurrence of moiré are the evaluation on the initial images.

TABLE 7

| | Image bearing member | Dye | Intensity of electric field (V/μm) | Image evaluation after 300,000 prints | | |
|---|---|---|---|---|---|---|
| | | | | Background fouling | Horizontal line image | Others |
| CE 1 | 1 | 1 | 32.1 | F, P | F | |
| CE 2 | 2 | 2 | 32.1 | P | F | |
| CE 3 | 3 | 3 | 32.1 | P | F | |
| CE 4 | 4 | 4 | 32.1 | P | F | |
| CE 5 | 5 | 5 | 32.1 | P | F | |
| CE 6 | 6 | 9 | 32.1 | P | F | |
| CE 7 | 7 | 7 | 32.1 | P | F | |
| CE 8 | 8 | 8 | 32.1 | P | F | |
| E 1 | 9 | 9 | 32.1 | E, G | E | |
| E 2 | 10 | 10 | 32.1 | E, G | E | |
| E 3 | 11 | 11 | 32.1 | G | E | |
| E 4 | 12 | 1 | 32.1 | E, G | E | |
| E 5 | 13 | 1 | 32.1 | G | E | |
| CE 9 | 14 | 1 | 32.1 | P | F | |
| CE 10 | 15 | 1 | 32.1 | P | F | |
| CE 11 | 16 | 9 | 32.1 | P | G | Image density reduced. Occurrence of dielectric breakdown |
| CE 12 | 17 | 9 | 32.1 | G | P | Occurrence of moire |
| CE 13 | 18 | 9 | 32.1 | G | P | Image density reduced |
| E 6 | 19 | 9 | 32.1 | G, F | E | |
| E 7 | 20 | 9 | 32.1 | G | E | |
| E 8 | 21 | 9 | 32.1 | G | E | |
| E 9 | 22 | 9 | 32.1 | E | E | |

TABLE 7-continued

| | Image bearing member | Dye | Intensity of electric field (V/μm) | Image evaluation after 300,000 prints | | |
|---|---|---|---|---|---|---|
| | | | | Background fouling | Horizontal line image | Others |
| E 10 | 23 | 9 | 32.1 | E | E | Image density slightly reduced (practically no problem) |
| E 11 | 24 | 9 | 32.1 | E, G | E | Image density slightly reduced (practically no problem) |
| E 12 | 25 | 9 | 32.1 | G | E | Image density slightly reduced (practically no problem) |
| E 13 | 26 | 9 | 32.1 | E, G | E | |
| E 14 | 27 | 9 | 32.1 | E, G | E | |
| E 15 | 28 | 9 | 32.1 | E, G | E | |
| E 16 | 29 | 9 | 32.1 | E | E | Occurrence of moiré slightly (practically no problem) |
| E 17 | 30 | 9 | 32.1 | G, F | E | |
| E 18 | 31 | 9 | 32.1 | G, F | E | |
| E 19 | 32 | 9 | 32.1 | E, G | E | Image density slightly reduced (practically no problem) |
| E 20 | 33 | 9 | 32.1 | E, G | E | |
| E 21 | 34 | 9 | 32.1 | E, G | E | |
| E 22 | 35 | 9 | 32.1 | E, G | E | |
| E 23 | 36 | 9 | 32.1 | G, F | E | |
| E 24 | 37 | 9 | 32.1 | G, F | E | |
| E 25 | 38 | 9 | 32.1 | E | E | |
| E 26 | 39 | 9 | 32.1 | E | E | |
| E 27 | 40 | 9 | 32.1 | E | E | Occurrence of moiré slightly (practically no problem) |
| E 28 | 41 | 9 | 32.1 | E | E | Occurrence of moiré slightly (practically no problem) |
| E 29 | 42 | 9 | 32.1 | E | E | |
| CE 14 | 1 | 1 | 26.8 | F, P | F, P | |
| CE 15 | 2 | 2 | 26.8 | P | F, P | |
| CE 16 | 3 | 3 | 26.8 | P | F, P | |
| CE 17 | 4 | 4 | 26.8 | P | F, P | |
| CE 18 | 5 | 5 | 26.8 | P | F, P | |

TABLE 7-continued

| | Image bearing member | Dye | Intensity of electric field (V/μm) | Image evaluation after 300,000 prints: Background fouling | Horizontal line image | Others |
|---|---|---|---|---|---|---|
| CE 19 | 6 | 9 | 26.8 | P | F, P | |
| CE 20 | 7 | 7 | 26.8 | P | F, P | |
| CE 21 | 8 | 8 | 26.8 | P | F, P | |
| E 30 | 9 | 9 | 26.8 | E, G | E, G | |
| E 31 | 10 | 10 | 26.8 | E, G | G | |
| E 32 | 11 | 11 | 26.8 | G | G | |
| E 33 | 12 | 1 | 26.8 | E, G | G | |
| E 34 | 13 | 1 | 26.8 | G | G | |
| CE 22 | 14 | 1 | 26.8 | P | F, P | |
| CE 23 | 15 | 1 | 26.8 | P | F, P | |
| CE 24 | 16 | 9 | 26.8 | P | E, G | Image density reduced. Occurrence of dielectric breakdown |
| CE 25 | 17 | 9 | 26.8 | G | P | Image density reduced |
| CE 26 | 18 | 9 | 26.8 | G | P | |
| E 35 | 19 | 9 | 26.8 | G, F | E, G | |
| E 36 | 20 | 9 | 26.8 | G | E, G | |
| E 37 | 21 | 9 | 26.8 | G | E, G | |
| E 38 | 22 | 9 | 26.8 | E | E, G | |
| E 39 | 23 | 9 | 26.8 | E | E, G | Image density slightly reduced (practically no problem) |
| E 40 | 24 | 9 | 26.8 | E, G | E, G | Image density slightly reduced (practically no problem) |
| E 41 | 25 | 9 | 26.8 | G | E, G | Image density slightly reduced (practically no problem) |
| E 42 | 26 | 9 | 26.8 | E, G | E, G | |
| E 43 | 27 | 9 | 26.8 | E, G | E, G | |
| E 44 | 28 | 9 | 26.8 | E, G | E, G | |
| E 45 | 29 | 9 | 26.8 | E | E, G | |
| E 46 | 30 | 9 | 26.8 | G, F | E, G | |
| E 47 | 31 | 9 | 26.8 | G, F | E, G | |
| E 48 | 32 | 9 | 26.8 | E, G | E, G | Occurrence of moiré slightly (practically no problem) |
| E 49 | 33 | 9 | 26.8 | E, G | E, G | |

TABLE 7-continued

| | Image bearing member | Dye | Intensity of electric field (V/μm) | Image evaluation after 300,000 prints: Background fouling | Horizontal line image | Others |
|---|---|---|---|---|---|---|
| E 50 | 34 | 9 | 26.8 | E, G | E, G | |
| E 51 | 35 | 9 | 26.8 | E, G | E, G | |
| E 52 | 36 | 9 | 26.8 | G, F | E, G | |
| E 53 | 37 | 9 | 26.8 | G, F | E, G | |
| E 54 | 38 | 9 | 26.8 | E | E, G | |
| E 55 | 39 | 9 | 26.8 | E | E, G | |
| E 56 | 40 | 9 | 26.8 | E | E, G | Occurrence of moiré slightly (practically no problem) |
| E 57 | 41 | 9 | 26.8 | E | E, G | Occurrence of moiré slightly (practically no problem) |
| E 58 | 42 | 9 | 26.8 | E | E, G | |

CE represents Comparative Example and E represents Example.
E: Excellent
G: Good
F: Fair
P: Poor The 300,000 images obtained in each Example of the present application are relatively good in comparison with those obtained in each Comparative Example.

Examples 59 to 66

The image forming apparatus used in Example 1 was remodeled to form dot images of 1,200 dpi.

Image bearing member 9 manufactured in Image bearing member Example 9 was used in the remodeled image forming apparatus. The background fouling and the change in the horizontal line image formation were observed in the same way as in Example 1 under a different charging condition and with the intensity of the electric field applied to the image bearing member changed as described in Table 8.

TABLE 8

| Example | Image bearing member | Intensity of electric field (V/μm) | Image evaluation: Background fouling | Horizontal line image |
|---|---|---|---|---|
| 59 | 9 | 20 | E | F |
| 60 | 9 | 25 | E | G, F |
| 61 | 9 | 30 | E | E, G |
| 62 | 9 | 35 | E | E |
| 63 | 9 | 40 | E, G | E |
| 64 | 9 | 50 | E, G | E |
| 65 | 9 | 60 | G | E |
| 66 | 9 | 70 | G, F | E |

E: Excellent
G: Good
F: Fair
P: Poor

Example 67

The chart used in the continuous printing test of Example 1 was changed to a chart having an image ratio of 1% and continuous printing of 300,000 prints was performed. The image forming apparatus was remodeled such that a surface electrometer could be set by which the surface voltages of the image bearing member at the developed portion and immediately after transfer could be measured.

The voltages of the image bearing member irradiation portion at the developed portion were measured before and after the continuous printing test.

To measure the surface voltage of the irradiated portion, optical writing was performed for the entire surface of the image bearing member.

In the continuous printing test for Example 67, the voltage of non-written portion of the image bearing member after transfer was adjusted to be −150 V by controlling the transfer bias. The voltage of the image bearing member after transfer was measured without performing optical writing. The results are shown in Table 9.

Example 68

Example 68 was performed in the same manner as in Example 67 except that the voltage of non-written portion of the image bearing member after transfer was adjusted to be −80 V. The results are shown in Table 9.

Example 69

Example 69 was performed in the same manner as in Example 67 except that the voltage of non-written portion of the image bearing member after transfer was adjusted to be 0 V. The results are shown in Table 9.

Example 70

Example 70 was performed in the same manner as in Example 67 except that the voltage of non-written portion of the image bearing member after transfer was adjusted to be +70 V. The results are shown in Table 9.

Example 71

Example 71 was performed in the same manner as in Example 67 except that the voltage of non-written portion of the image bearing member after transfer was adjusted to be +150 V. The results are shown in Table 9.

Example 72

Example 72 was performed in the same manner as in Example 67 except that the discharging device was changed from a discharging lamp to an electroconductive brush (connected to earth). The results are shown in Table 9.

TABLE 9

| Example | Image bearing member | Surface voltage after transfer (V) | Voltage at non-irradiated portion at developed portion: Before test (V) | Voltage at non-irradiated portion at developed portion: After test (V) | Image after 300,000 prints |
|---|---|---|---|---|---|
| 67 | 9 | −150 | −140 | −180 | Image density slightly reduced |
| 68 | 9 | 180 | −140 | −165 | Good |
| 69 | 9 | 0 | −140 | −150 | Good |
| 70 | 9 | +70 | −140 | −150 | Good |
| 71 | 9 | +150 | −140 | −150 | Slight background fouling |
| 72 | 9 | −150 | −140 | −150 | Good |

Examples 73 to 90

Image bearing members 9 and 43 to 59 as manufactured in Examples 9 and 43 to 59 of image bearing member of Manufacturing Examples 9 and 43 to 59 of image bearing member were attached to a process cartridge for an image forming apparatus as illustrated in FIG. 7 and the process cartridge was attached to an image forming apparatus having an image bearing member linear velocity of 320 mm/sec) as illustrated in FIG. 5. Continuous printing of 500,000 prints was performed at 22° C. and 55% RH. The charging device taking a scorotron system was used and the charging was performed under the following conditions.

Test pattern irradiation having a writing ratio of 6% was performed using a multi-beam irradiation head having a polygon mirror with a definition of 600 dpi where 4 end face emission semiconductor laser elements having 780 nm were arranged in the secondary scanning direction as the image irradiation light source. A two component developer containing toner and carrier was used for reversal development by which the toner was attracted to the irradiated portion of the image bearing member. A transfer belt, by which a toner image was directly transferred to a transfer medium, was used as a transfer device Charging Condition 1

Discharge voltage: −6.0 kV

Grid voltage: −920 V (the surface voltage of unirradiated portion of the image bearing member was −900 V).

The intensity of the electric field during the 500,000 printing was 32.1 to 40.9 (V/μm) for Example 73, 32.1 to 38.0 (V/μm) for Example 74 and 32.1 to 36.1 for Examples 75 to 90.

The obtained images were evaluated with regard to the following after 500,000 printing. The image bearing member was charged to have an intensity of the electric field represented by the following relationship (A) and (B) of 32.1 (V/μm).

3) Image bearing member in which a photosensitive layer was disposed on the surface of the image bearing member:

The intensity of the electric field(V/μm)=the absolute value of the surface voltage(V)of unirradiated portion of the image bearing member at developing portion/the layer thickness of the photosensitive layer(μm) (A)

4) Image bearing member in which a protective layer is provided on a photosensitive layer:

The intensity of the electric field(V/μm)=the absolute value of the surface voltage(V)of unirradiated portion of the image bearing member at developing portion/the layer thickness of(the photosensitive layer+the protective layer)(μm) (B)

(i) Evaluation on Background Fouling

A white solid image was output and the number and the size of black spots observed on the background portion were evaluated. The evaluation was performed based on 4 ranking of E (excellent), G (good), F (fair) and P (poor).

(ii) Evaluation on a Horizontal Image with Two Laser Beam Writing

The 4 LD elements were lighted as illustrated in FIG. 22 to form a latent horizontal line image. The latent horizontal line image was output at a ratio of 3 simultaneous irradiation line images and 1 sequential irradiation line image over the recording medium. The image was observed with naked eyes and evaluated according to the following ranking system.

E (excellent): uniform with no difference seen between the simultaneous irradiation image and the sequence image irradiation.

G (good): uniform with extremely slightly non-uniform portions.

F (fair): slightly non-uniform portions were seen.

P (poor): poorly uniform with distinctive differences between the simultaneous irradiation image and the sequence image irradiation.

(iii) Others

As other evaluation items, the density of a black solid image was evaluated. In addition, half tone images were initially (1st to 100th) output during image formation and evaluated for the occurrence of moiré.

The results are shown in Table 10. The results of the items of (iii) are shown only when a problem occurred. The results of the occurrence of moiré are the evaluation on the initial images.

TABLE 10

| Example | Image bearing member | Intensity of electric field (V/μm) | Image evaluation after 500,000 prints: Background fouling | Horizontal line image | Others | Amount of abrasion (μm) |
|---|---|---|---|---|---|---|
| 73 | 9 | 32.1 | G | E | Slight black stream observed (practically no problem) | 6.0 |
| 74 | 43 | 32.1 | E, G | E | | 4.3 |
| 75 | 44 | 32.1 | E | E | | 2.5 |
| 76 | 45 | 32.1 | E, G | E | | 2.5 |
| 77 | 46 | 32.1 | G | E | | 2.6 |
| 78 | 47 | 32.1 | E | E | | 1.9 |
| 79 | 48 | 32.1 | E | E | | 3.1 |
| 80 | 49 | 32.1 | E, G | E | | 1.8 |
| 81 | 50 | 32.1 | E | E | | 1.7 |
| 82 | 51 | 32.1 | E | E | | 1.5 |
| 83 | 52 | 32.1 | E | E | | 1.5 |
| 84 | 53 | 32.1 | G | E | | 3.0 |
| 85 | 54 | 32.1 | E, G | E | | 2.3 |
| 86 | 55 | 32.1 | E | E | Image density slightly reduced (practically no problem) | 1.5 |
| 87 | 56 | 32.1 | E | E | | 1.8 |
| 88 | 57 | 32.1 | E | E | | 1.6 |

TABLE 10-continued

| Example | Image bearing member | Intensity of electric field (V/μm) | Image evaluation after 500,000 prints: Background fouling | Horizontal line image | Others | Amount of abrasion (μm) |
|---|---|---|---|---|---|---|
| 89 | 58 | 32.1 | E, G | E | | 2.1 |
| 90 | 59 | 32.1 | E | E | Image density slightly reduced (practically no problem) | 1.5 |

Good images were obtained in each Example during the 500,000 prints.

Examples 91 to 106

After the continuous printing of 500,000 prints performed by the image bearing members 44 to 59 (Examples 75 to 90) in which a protective layer was manufactured as described above, a further 500 images were output at a high temperature (30° C.) and a high humid environment (90% RH) for image evaluation. The evaluation conditions were according to those for Examples 75 to 90. The results are shown in FIG. 11.

The image after the 500 prints was evaluated as follows.

(i) Evaluation on Background Fouling

A white solid image was output and the number and the size of black spots observed on the background portion were evaluated. The evaluation was performed based on 4 ranking of E (excellent), G (good), F (fair) and P (poor).

(ii) Evaluation on Image Density

A solid black square image of 4 cm×4 cm was output. The average density of 9 points in the solid portion was measured by Macbeth densitometer and evaluated as follows:

E (excellent): average density was not less than 1.4 and uniform.

G (good): average density was not less than 1.2 and less than 1.4.

F (fair): average density was not less than 1.0 and less than 1.2

P (Poor): average density was less than 1.0 or not less 1.0 but non-uniform.

(iii) Evaluation on a Horizontal Image with Two Laser Beam Writing

The 4 LD elements were lighted as illustrated in FIG. 22 to form a latent horizontal line image. The latent horizontal line image was output at a ratio of 3 simultaneous irradiation line images and 1 sequential irradiation line image over the recording medium. The image was observed with naked eyes and evaluated according to the following ranking system.

E (excellent): uniform with no difference seen between the simultaneous irradiation image and the sequence image irradiation.

G (good): uniform with extremely slightly non-uniform portions.

F (fair): slightly non-uniform portions were seen.

P (poor): poorly uniform with distinctive differences between the simultaneous irradiation image and the sequence image irradiation.

TABLE 11

| Example | Image bearing member | Image evaluation (under a high temperature and humidity environment) Background fouling | Image density | Horizontal line image |
|---|---|---|---|---|
| 91 | 44 | E | G | E |
| 92 | 45 | E, G | G | E |
| 93 | 46 | G | G | E |
| 94 | 47 | E | G | E |
| 95 | 48 | E | G | E |
| 96 | 49 | E, G | G | E |
| 97 | 50 | E | E | E |
| 98 | 51 | E | E | E |
| 99 | 52 | E | E | E |
| 100 | 53 | G | G | E |
| 101 | 54 | E, G | G | E |
| 102 | 55 | E | G | E |
| 103 | 56 | E | E | E |
| 104 | 57 | E | E | E |
| 105 | 58 | E, G | E | E |
| 106 | 59 | E | G | E |

Examples 107 to 118 and Comparative Examples 27 to 38

The image bearing members manufactured in Manufacturing Examples 60 to 71 of image bearing member were attached to a process cartridge for an image forming apparatus as illustrated in FIG. 7 and the process cartridge was attached to an image forming apparatus having an image bearing member linear velocity of 320 mm/sec as illustrated in FIG. 6. Continuous printing of 150,000 prints was performed at 22° C. and 55% RH. With regard to the 4 image forming elements, the charging device taking a scorotron system was used and the charging was performed under the following conditions.

Test pattern irradiation was performed with a writing ratio of 6% using a multi-beam irradiation head having a polygon mirror with a definition of 600 dpi where 4 end face emission semiconductor laser elements having 780 nm were arranged in the secondary scanning direction as the image irradiation light source. A two component developer containing toner and carrier was used for reversal development by which the toner was attracted to the irradiated portion of the image bearing member. A transfer belt, by which a toner image was directly transferred to a transfer medium, was used as a transfer device.

Charging Condition 1

Discharge voltage: −6.0 kV

Grid voltage: −920 V (the surface voltage of unirradiated portion of the image bearing member was −900 V)

Charging Condition 2

Discharge voltage: −5.8 kV

Grid voltage: −780 V (the surface voltage of unirradiated portion of the image bearing member was −750 V)

The intensity of the electric field during the 150,000 printing was 32 to 45 (V/μm) for Examples 107 to 110 and Comparative Examples 27 to 32, 32 to 37 (V/μm) for Examples 111 and 112, 32 to 38 (V/μm) for Examples 113 to 116 and Comparative Examples 33 to 38, and 26 to 31 (V/μm) for Examples 117 and 118.

The obtained images were evaluated with regard to the following after 150,000 printing. The image bearing member was charged to have an intensity of the electric field represented by the following relationship (A) and (B) of 32 (V/μm) and 26 (V/μm), respectively.

5) Image bearing member in which a photosensitive layer was disposed on the surface of the image bearing member:

The intensity of the electric field(V/μm)=the absolute value of the surface voltage(V)of unirradiated portion of the image bearing member at developing portion/the layer thickness of the photosensitive layer(μm) (A)

6) Image bearing member in which a protective layer is provided on a photosensitive layer:

The intensity of the electric field(V/μm)=the absolute value of the surface voltage(V)of unirradiated portion of the image bearing member at developing portion/the layer thickness of(the photosensitive layer+the protective layer)(μm) (B)

(i) Evaluation on Background Fouling

A white solid image was output and the number and the size of black spots observed on the background portion were evaluated. The evaluation was performed based on 4 ranking of E (excellent), G (good), F (fair) and P (poor).

(ii) Evaluation on a Horizontal Image with Two Laser Beam Writing

The 4 LD elements were lighted as illustrated in FIG. 22 to form a latent horizontal line image. The latent horizontal line image was output in a single color of black, cyan and magenta at a ratio of 3 simultaneous irradiation line images and 1 sequential irradiation line image over the recording medium. The image was observed with naked eyes and evaluated according to the following ranking system.

E (excellent): uniform with no difference seen between the simultaneous irradiation image and the sequence image irradiation.

G (good): uniform with extremely slightly non-uniform portions.

F (fair): slightly non-uniform portions were seen.

P (poor): poorly uniform with distinctive differences between the simultaneous irradiation image and the sequence image irradiation.

(iii) Evaluation on Color Reproducibility

The same full color image was output before and after the 150,000 prints for evaluation on color reproducibility. The evaluation was performed based on 4 ranking of E (excellent), G (good), F (fair) and P (poor).

(iv) Others

As other evaluation items, the density of a black solid image was evaluated. In addition, half tone images were initially (1st to 100th) output during image formation and evaluated for the occurrence of moiré.

The results are shown in Table 12. The results of the items of (iv) are shown only when a problem occurred. The results of the occurrence of moiré are the evaluation on the initial images.

TABLE 12

| | member | | Intensity of electric field (V/μm) | Image evaluation after 150,000 prints | | | |
|---|---|---|---|---|---|---|---|
| | | | | Backgroud fouling | Horizontal line image | Color reproducibility | Others |
| CE 27 | 60 | 1 | 32 | F, P | F | G | |
| CE 28 | 61 | 4 | 32 | P | F | G, F | |
| CE 29 | 62 | 6 | 32 | P | F | G, F | |
| E 107 | 63 | 9 | 32 | E, G | F | E | |
| E 108 | 64 | 11 | 32 | G | E | E | |
| E 109 | 65 | 1 | 32 | E, G | E | E, G | |
| CE 30 | 66 | 9 | 32 | P | E, G | G, F | Image density reduced. Occurrence of dielectric breakdown |
| CE 31 | 67 | 9 | 32 | G | P | P | Occurrence of moire |
| CE 32 | 68 | 9 | 32 | G | P | P, F | Image density reduced |
| E 110 | 69 | 9 | 32 | E | E | E | |
| E 111 | 70 | 9 | 32 | E | E | E, G | |
| E 112 | 71 | 9 | 32 | E | E | E | |
| CE 33 | 60 | 1 | 26 | F, P | F, P | G | |
| CE 34 | 61 | 4 | 26 | P | F, P | F | |
| CE 35 | 62 | 6 | 26 | P | F, P | F | |
| E 113 | 63 | 9 | 26 | E, G | E, G | E | |
| E 114 | 64 | 11 | 26 | G | E, G | E | |
| E 115 | 65 | 1 | 26 | E, G | E, G | E, G | |
| CE 36 | 66 | 9 | 26 | F | E, G | G, F | Image density reduced. Occurrence of dielectric breakdown |
| CE 37 | 67 | 9 | 26 | G | F | F | Occurrence of moire |
| CE 38 | 68 | 9 | 26 | G | F | F | Image density reduced |
| E 116 | 69 | 9 | 26 | E | E, G | E | |
| E 117 | 70 | 9 | 26 | E | E, G | E, G | |
| E 118 | 71 | 9 | 26 | E | E, G | E | |

CE represents Comparative Example and E represents Example.
E: Excellent
G: Good
F: Fair
P: Poor The 150,000 images obtained in each Example were relatively good in comparison with those obtained in each Comparative Example.

Example 119

In Example 119, the continuous printing of 300,000 prints was performed in the same manner as in Example 1 except that the charging was performed under the following charging conditions and a multi-beam irradiation head having a polygon mirror with a definition of 1,200 dpi where 4×4 vertical cavity surface emitting laser elements having 780 nm were arranged in a two dimension as the image irradiation light source. The continuous printing was performed at 22° C. and 55% RH.

Charging Condition

Discharge voltage: −6.0 kV

Grid voltage: −920 V (the surface voltage of unirradiated portion of the image bearing member was −900 V)

The obtained images were evaluated with regard to the following after 300,000 printing. The image bearing member was charged to have an intensity of the electric field represented by the following relationship of 32.1 (V/μm).

The intensity of the electric field(V/μm)=the absolute value of the surface voltage(V)of unirradiated portion of the image bearing member at developing portion/the layer thickness of the photosensitive layer(μm)

(i) Evaluation on Background Fouling

A white solid image was output and the number and the size of black spots observed on the background portion were evaluated. The evaluation was performed based on 4 ranking of E (excellent), G (good), F (fair) and P (poor).

(ii) Evaluation on a Horizontal Image with Two Laser Beam Writing

Horizontal line images were output over a recording medium. The images were observed with naked eyes and evaluated according to the following ranking system.

E (excellent): uniform with no difference seen between the simultaneous irradiation image and the sequence image irradiation.

G (good): uniform with extremely slightly non-uniform portions.

F (fair): slightly non-uniform portions were seen.

P (poor): poorly uniform with distinctive differences between the simultaneous irradiation image and the sequence image irradiation.

(iii) Others

As other evaluation items, the density of a black solid image was evaluated. In addition, half tone images were initially (1st to 100th) output during image formation and evaluated for the occurrence of moiré.

The results are shown in Table 13. The results of the items of (iii) are shown only when a problem occurred. The results of the occurrence of moiré are the evaluation on the initial images.

Comparative Example 39

In Comparative Example 39, the continuous printing of 300,000 prints was performed in the same manner as in Example 119 except that Image bearing member 15 was used and the image was evaluated. The continuous printing was performed at 22° C. and 55% RH.

Comparative Example 40

In Comparative Example 40, the continuous printing of 300,000 prints was performed in the same manner as in Example 119 except that Image bearing member 16 was used and the image was evaluated. The continuous printing was performed at 22° C. and 55% RH.

Comparative Example 41

In Comparative Example 41, the continuous printing of 300,000 prints was performed in the same manner as in Example 119 except that Image bearing member 17 was used and the image was evaluated. The continuous printing was performed at 22° C. and 55% RH.

The results of Example 119 and Comparative Examples 39 to 41 are shown in Table 13.

The intensity of the electrical field of Example 119 and Comparative Examples 39 to 41 was 32.1 to 38.0 (V/μm) during the 300,000 printing.

TABLE 13

| | Image bearing member | Dye | Intensity of Electric field (V/μm) | Image evaluation after 300,000 prints | | |
|---|---|---|---|---|---|---|
| | | | | Background fouling | Horizontal line image | Others |
| E 119 | 9 | 9 | 32.1 | E, G | E, G | |
| CE 39 | 15 | 1 | 32.1 | P | F, P | |
| CE 40 | 16 | 9 | 32.1 | P | G, F | Image density reduced. Occurrence of dielectric breakdown |
| CE 41 | 17 | 9 | 32.1 | G | P | Occurrence of moire |

CE represents Comparative Example and E represents Example.
E: Excellent
G: Good
F: Fair
P: Poor Image formation during the 300,000 prints when a vertical cavity surface emitting laser arranged in a two dimension as a multi-beam irradiation device for the image forming apparatus of the present application was also good as when an edge face emission laser was used.

Finally, whether the lowest angle peak of 7.3° C. in Bragg angle characteristic to the titanyl phthalocyanine for use in the present application was the same as the lowest angle of 7.5 of a known material was checked.

Comparative Synthesis Example 9

The titanyl phthalocyanine of Comparative Synthesis Example 9 was obtained in the same manner as in Comparative Synthesis Example 1 except that the crystal conversion solvent was changed from methylene chloride to 2-butanone.

Figure 19:
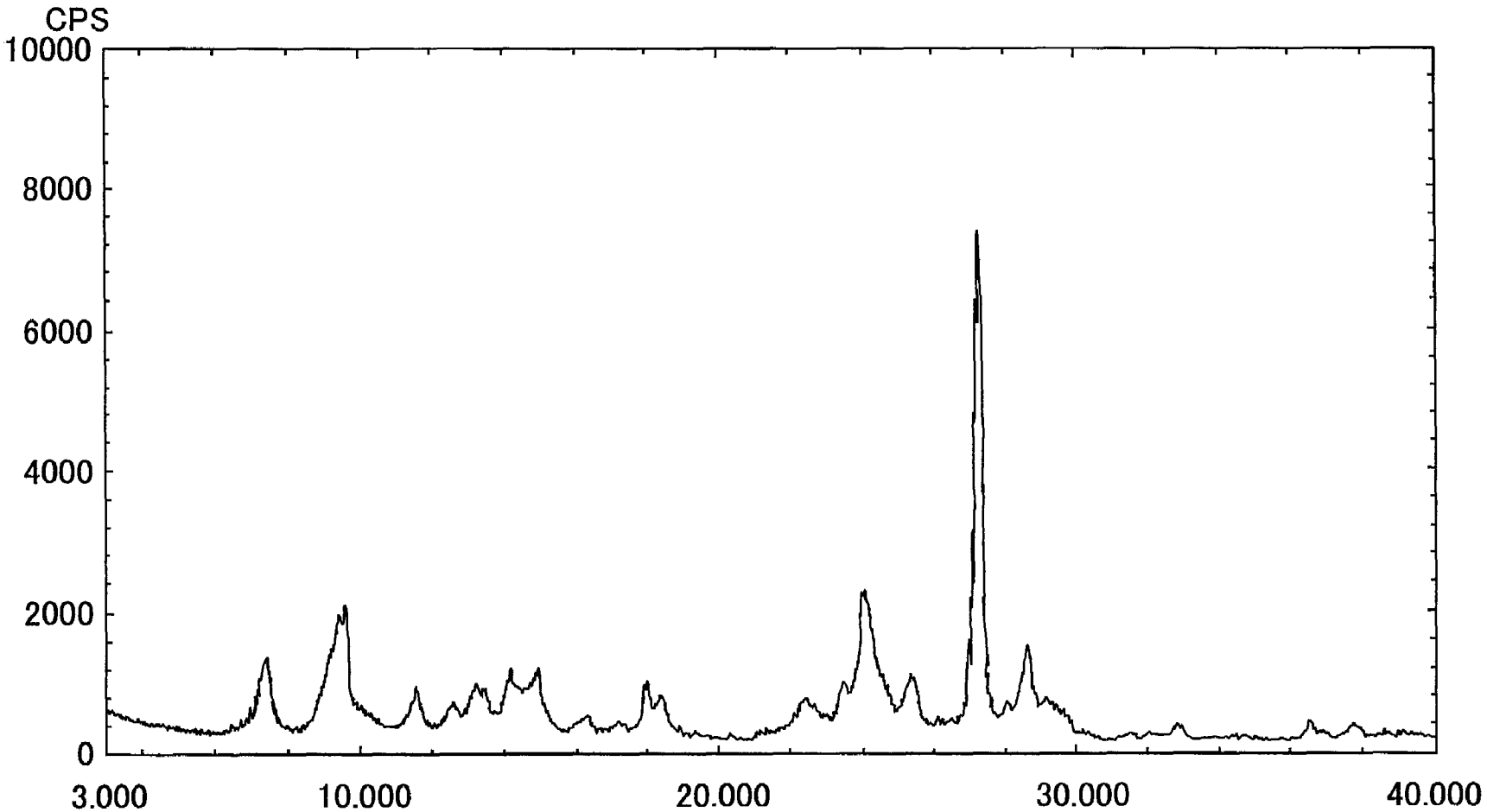
FIG. 19 is a diagram illustrating XD spectrum of the titanyl phthalocyanine synthesized in Comparative synthesis Example 9 described later.

AS in Comparative Synthesis Example 1, XD spectrum of the titanyl phthalocyanine obtained in Comparative Synthesis Example 9 was measured. The results are illustrated in FIG. 19. As seen in FIG. 19, it is found that the lowest peak angle in XD spectrum of the titanyl phthalocyanine manufactured in Comparative synthesis Example 9 was 7.5°, which is different from that, i.e., 7.3°, of the titanyl phthalocyanine manufactured in Comparative synthesis Example 1.

Measuring Example 1

Figure 20:
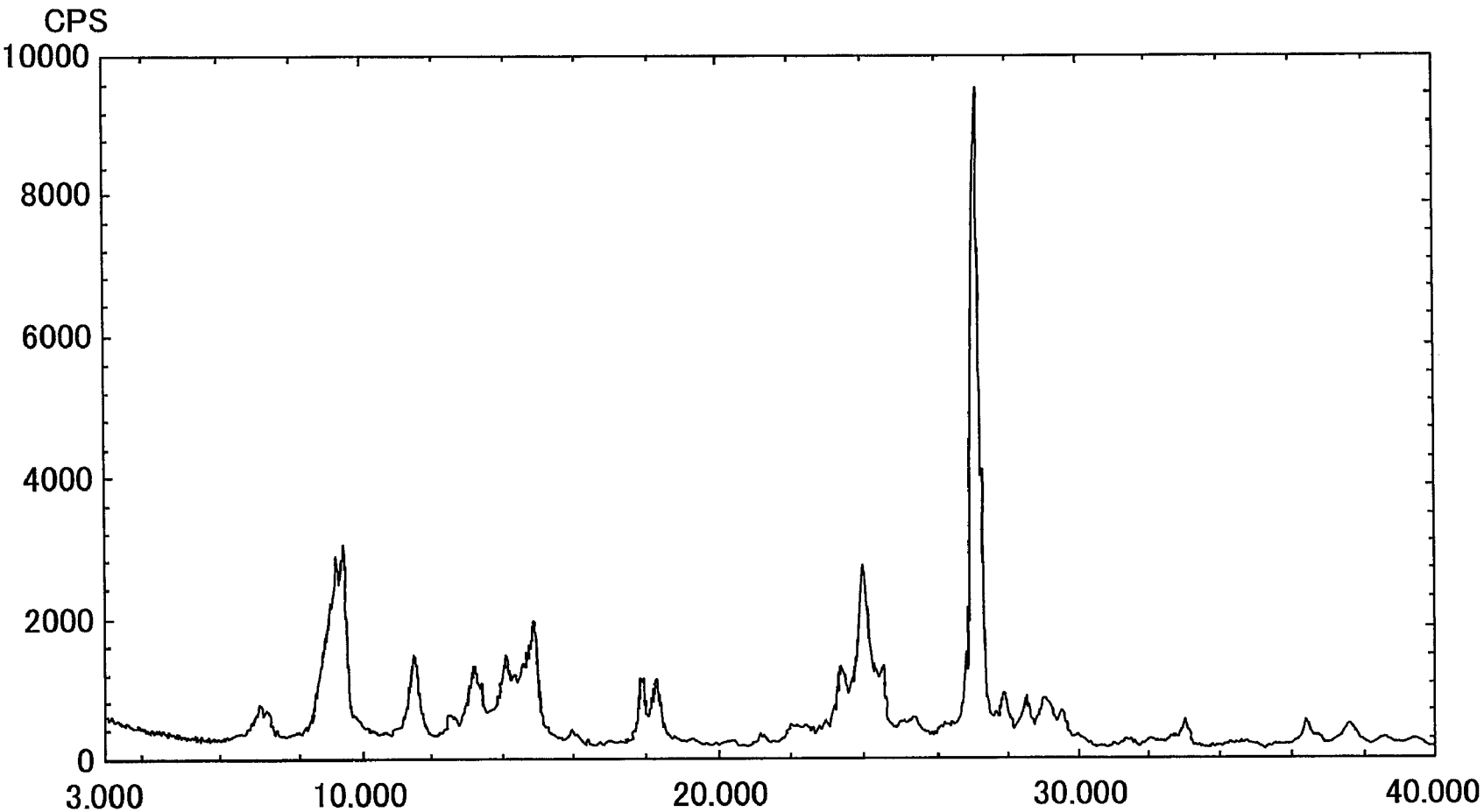
FIG. 20 is a diagram illustrating XD spectrum of the titanyl phthalocyanine for use in Measuring Example 1 described later.

A dye (having a maximum diffraction peak of 7.5°) manufactured in the same manner as described in JOP S61-239248 was added in an amount of 3% by weight to the dye obtained in Comparative synthesis Example 1 (having the lowest peak angle of 7.3°) and the mixture was mixed in a mortar. X ray diffraction spectrum of the mixture was measured as described above. FIG. 20 is a diagram illustrating X-ray diffraction spectrum of Measuring Example 1.

Measuring Example 2

Figure 21:
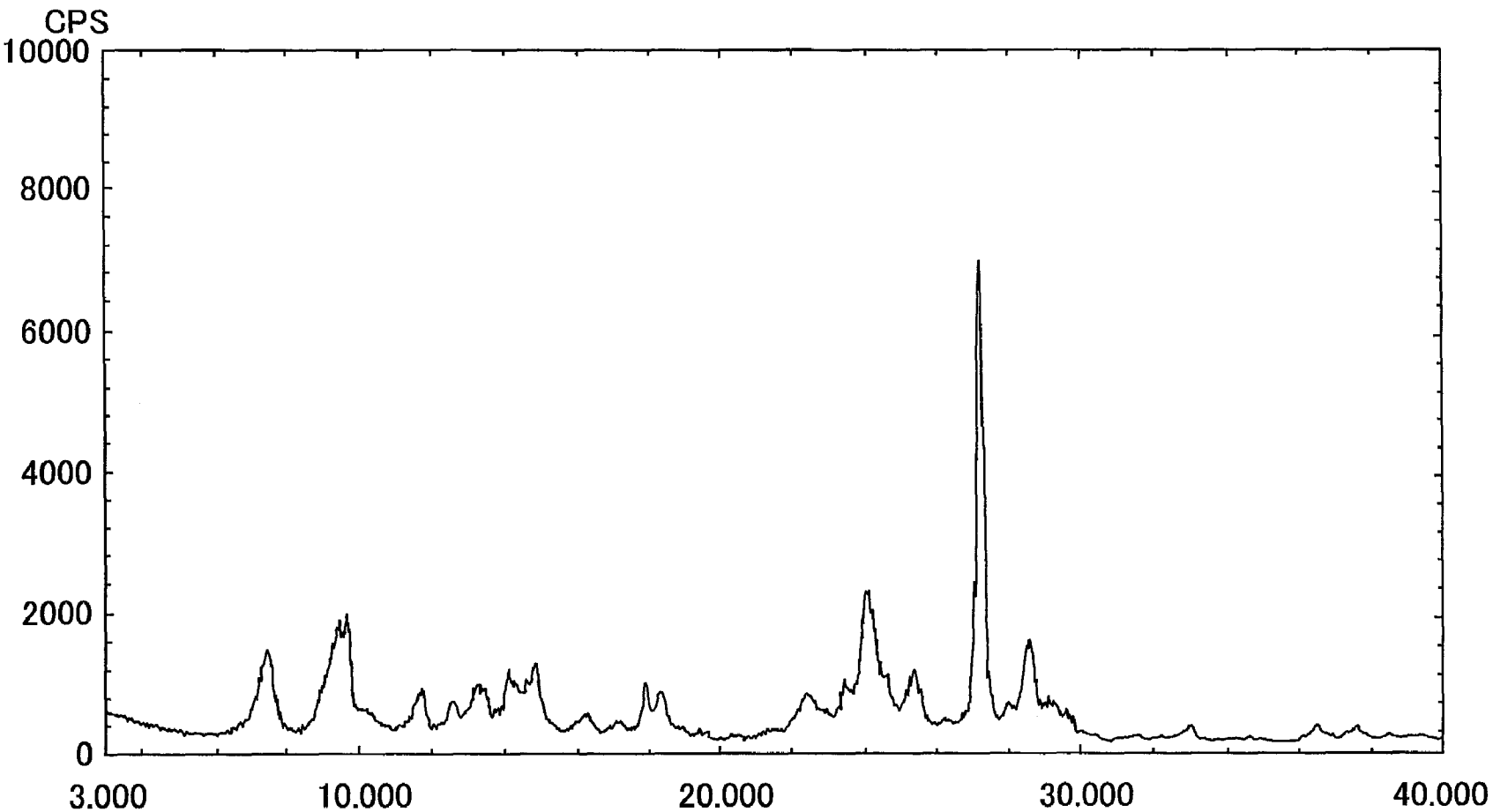
FIG. 21 is a diagram illustrating XD spectrum of the titanyl phthalocyanine for use in Measuring Example 2 described later.

A dye (having a maximum diffraction peak of 7.5°) manufactured in the same manner as described in JOP S61-239248 was added in an amount of 3% by weight to the dye obtained in Comparative Synthesis Example 9 (having the lowest peak angle of 7.3°) and the mixture was mixed in a mortar. X ray diffraction spectrum of the mixture was measured as described above. FIG. 21 is a diagram illustrating X-ray diffraction spectrum of Measuring Example 2.

In the spectrum of FIG. 20, there are observed two independent peaks at 7.3° and 7.5° on the low angle side. Therefore, the peaks of 7.3° and 7.5° are different. To the contrary, in the spectrum of FIG. 21, there is only one peak on the low angle side, which is 7.5°, which is obviously different from the spectrum of FIG. 20. That is, the lowest angle peak of 7.3° on the low angle side of the titanyl phthalocyanine crystal for use in the present application is different from the peak of 7.5° of the known titanyl phtalocyanine crystal.

This document claims priority and contains subject matter related to Japanese Patent Applications Nos. 2005-060335 and 2005-328554, filed on Mar. 4, 2005, and Nov. 14, 2005, respectively, the entire contents of which are) incorporated herein by reference.

Having now fully described embodiments of the present application, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. A method of forming an image, comprising:

charging an an image bearing member by means of a charging device configured to charge the image bearing member, wherein the image bearing member has an established surface charge having an electric field intensity of at least 32 V/μm and operates at a linear velocity of at least 300 mm/sec, the image bearing member comprising:

(i) an aluminum cylinder drum, (ii) a charge blocking layer overlying the aluminum cylinder drum, (iii) a moiré prevention layer overlying the charge blocking layer, and (iv) a photosensitive layer overlying the moiré prevention layer, consisting essentially of titanyl phthalocyanine having a primary particle diameter of not greater than 0.25 μm, and having a crystal form having a CuKα X ray diffraction spectrum having a wavelength of 1.542 Å such that a maximum diffraction peak is observed at a Bragg (2θ) angle of 27.2°±0.2°; main peaks at a Bragg (2θ) angle of 9.4°±0.2°, 9.6±0.2° and 24.0±0.2°, and a peak at a Bragg (2θ) angle of 7.3°±0.2°, as a lowest angle diffraction peak and having no peak between 9.4±0.2° and 7.3±0.2° and having no peak at 26.3°±0.2°;

irradiating said surface of the image bearing member with an irradiating device configured to irradiate a surface of the image bearing member with plural irradiation beams emitted from a power source to form a latent electrostatic image on the image bearing member;

developing the latent electrostatic image with a developing device configured to develop the latent electrostatic image on the image bearing member;

transferring the developed image by a transfer device configured to transfer the developed image onto a transfer medium; and cleaning the image bearing member with a cleaning device configured to clean the image bearing member, wherein, the established surface charge having an electric field intensity of at least 32.1 V/μm is defined as the ratio of the absolute value (V) of the surface voltage of a non-irradiated portion of the image bearing member at a developing position to the layer thickness of the photosensitive layer (μm).

2. The method of forming an image according to claim 1, wherein said electric field intensity is no more than about 60 V/μm.

3. The method of forming an image according to claim 2, wherein said electric field intensity is no more than about 50 V/μm.

4. The method of forming an image according to claim 1, wherein the photosensitive layer comprises a charge generation layer and a charge transport layer located overlying the charge generation layer.

5. The method of forming an image according to claim 1, further comprising a protective layer located overlying the photosensitive layer.

6. The method of forming an image according to claim 1, wherein the charge blocking layer comprises an insulating material having a layer thickness ranging from 0.1 to 2.0 μm.

7. The method of forming an image according to claim 6, wherein the insulating material is a polyamide.

8. The method of forming an image according to claim 7, wherein the polyamide is N-methoxymethyl nylon.

9. The method of forming an image according to claim 1, wherein the moiré prevention layer comprises an inorganic pigment and a binder resin and a volume ratio of the inorganic pigment to the binder resin ranges from 1/1 to 3/1.

10. The method of forming an image according to claim 9, wherein the binder resin is a thermosetting resin.

11. The method of forming an image according to claim 10, wherein the thermosetting resin is a mixture of an alkyd resin and a melamine resin.

12. The method of forming an image according to claim 11, wherein a mixing ratio by weight of the alkyd resin to the melamine resin ranges from 5/5 to 8/2.

13. The method of forming an image according to claim 9, wherein the inorganic pigment is a titanium oxide.

14. The method of forming an image according to claim 13, wherein the titanium oxide comprises a titanium oxide (T1) having an average particle diameter of D1, and another titanium oxide (T2) having an average particle diameter of D2, and the ratio of D2/D1 satisfies the following relationship:

$$0.2<(D2/D1)\leqq 0.5.$$

15. The method of forming an image according to claim 14, wherein the average particle diameter D2 of the titanium oxide (T2) is greater than 0.05 μm and less than 0.2 μm.

16. The method of forming an image according to claim 14, wherein a mixing ratio {T2/(T1+T2)} by weight of the two titanium oxides (T1 and T2) ranges from 0.2 to 0.8.

17. The method of forming an image according to claim 1, wherein the photosensitive layer is formed by applying a dispersion liquid of the titanyl phthalocyanine having the crystal form which is prepared by dispersing the titanyl phthalocyanine until the titanyl phthalocyanine has an average particle diameter of not greater than 0.25 μm with a deviation of not greater than 0.2 μm and filtering the resultant titanyl phthalocyanine with a filter having an effective pore diameter of not greater than 3 μm to obtain the titanyl phthalocyanine having an average primary particle diameter of not greater than 0.25 μm.

18. The method of forming an image according to claim 17, wherein the titanyll phthalocyanine in crystal form is synthesized of a material excluding a halogenated compound.

19. The method of forming an image according to claim 1, wherein the titanyl phthalocyanine having the crystal form is prepared by performing crystal-conversion of an amorphous form or low crystalline titanyl phthalocyanine with an organic solvent in the presence of water, the amorphous form or low crystalline titanyl phthalocyanine having an average particle diameter not greater than 0.1 μm and having a CuKα X ray diffraction spectrum having a wavelength of 1.542 Å such that a maximum diffraction peak is observed at a Bragg (2θ) angle of 7.0 to 7.5°±0.2° with a half value width of at least 1°, and filtering the titanyl phthalocyanine after the crystal-conversion before a primary average particle diameter of the titanyl phthalocyanine after the crystal-conversion is greater than 0.25 μm.

20. The method of forming an image according to claim 18, wherein the titanyl phthalocyanine is prepared by an acid paste method and is washed with a deionized water until the deionized water after washing has at least one of a pH ranging from 6 to 8 and a specific conductivity of not greater than 8 μS/cm.

21. The method of forming an image according to claim 19, wherein a ratio by weight of the organic solvent to the amorphous form or low crystalline titanyl phthalocyanine is not less than 30/1.

22. The method of forming an image according to claim 1, wherein the photosensitive layer comprises a polycarbonate having a triarylamine structure in at least one of a main chain or side chain thereof.

23. The method of forming an image according to claim 5, wherein the protective layer comprises an inorganic pigment or a metal oxide having a specific electric resistance of not less than $10^{10}$ Ω·cm.

24. The method of forming an image according to claim 5, wherein the protective layer comprises a charge transport polymer material.

25. The method of forming an image according to claim 5, wherein the protective layer comprises a binder resin having a cross-linking structure.

26. The method of forming an image according to claim 25, wherein the cross-linking structure in the binder resin has a charge transport portion.

27. The method of forming an image according to claim 25, wherein the protective layer is formed by curing a radical polymeric monomer having at least three functional groups without a charge transport structure and a radical polymeric compound with a charge transport structure having a functional group.

28. The method of forming an image according to claim 27, wherein the functional groups of the radical polymeric monomer are at least one of an acryloyloxy group and a methacryloyloxy group.

29. The method of forming an image according to claim 27, wherein a ratio (molecular weight/number of functional groups) of the molecular weight of the radical polymeric monomer to the number of functional groups thereof is not greater than 250.

30. The method of forming an image according to claim 27, wherein the functional group of the radical polymeric monomer is one of an acryloyloxy group or a methacryloyloxy group.

31. The method of forming an image according to claim 27, wherein the charge transport structure of the radical polymeric compound is a triarylamine structure.

32. The method of forming an image according to claim 27, wherein the charge transport structure of the radical polymeric compound is at least one compound represented by the following chemical formulae (1) and (2):

Chemical formula (1)

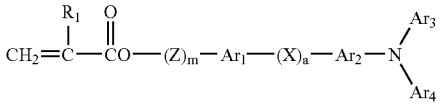

Chemical formula (2)

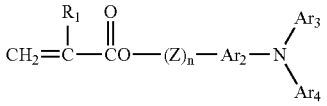

wherein, $R_1$ represents a hydrogen atom, a halogen atom, an alkyl group, an aralkyl group, an aryl group, a cyano group, a nitro group, an alkoxy group, —$COOR_7$, wherein $R_7$ represents a hydrogen atom, a halogen atom, an alkyl group, an aralkyl group or an aryl group, a halogenated carbonyl group or $CONR_8R_9$, wherein $R_5$ and $R_9$ independently represent a hydrogen atom, a halogen atom, an alkyl group, an aralkyl group or an aryl group, $Ar_1$ and $Ar_2$ independently represent an arylene group, $Ar_3$ and $Ar_4$ independently represent an aryl group, X represents an alkylene group, a cycloalkylene group, an alkylene ether group, oxygen atom, sulfur atom or a vinylene group, Z represents an alkylene group, an alkylene ether divalent group, and a represents 0 or 1, m and n represent an integer ranging from 0 to 3.

33. The method of forming an image according to claim 27, wherein the charge transport structure of the radical polymeric compound is at least one of the compounds represented by the following chemical formulae (3): Chemical formula (3)

Chemical formula (3)

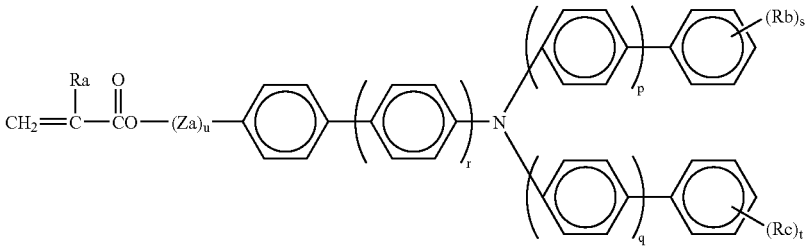

wherein u, r, p and q each represents 0 or 1, s and t each represent an integer ranging from 0 to 3, Ra represents a hydrogen atom or a methyl group, Rb and Rc each independently represents an alkyl group having from 1 to 6 carbon atoms, and Za represents a methylene group, an ethylene group, —$CH_2CH_2O$—, —$CHCH_3CH_2O$— or —$C_6H_5CH_2CH_2$—.

34. The method of forming an image according to claim 27, wherein a content ratio of the radical polymeric monomer ranges from 30 to 70 weight % based on the total weight of the protective layer.

35. The method of forming an image according to claim 27, wherein a content ratio of the radical polymeric compound ranges from 30 to 70 weight % based on the total weight of the protective layer.

36. The method of forming an image according to claim 27, wherein the radical polymeric monomer and the radical polymeric polymer compound are cured by irradiation of heat or optical energy.

37. The method of forming an image according to claim 1, wherein the power source comprises at least 3 vertical cavity surface emitting lasers.

38. The method of forming an image according to claim 37, wherein the vertical cavity surface emitting lasers are arranged in two dimensions.

* * * * *